US007229390B2

(12) United States Patent
Fujii et al.

(10) Patent No.: US 7,229,390 B2
(45) Date of Patent: Jun. 12, 2007

(54) TIGHTS-TYPE LEG SUPPORT GARMENT

(75) Inventors: Takako Fujii, Kyoto (JP); Makoto Oyama, Kyoto (JP)

(73) Assignee: Wacoal Corp., Kyoto (JP)

( * ) Notice: Subject to any disclaimer, the term of this patent is extended or adjusted under 35 U.S.C. 154(b) by 44 days.

(21) Appl. No.: 10/030,367

(22) PCT Filed: Apr. 18, 2001

(86) PCT No.: PCT/JP01/03303

§ 371 (c)(1),
(2), (4) Date: Jan. 2, 2002

(87) PCT Pub. No.: WO01/80675

PCT Pub. Date: Nov. 1, 2001

(65) Prior Publication Data

US 2003/0101506 A1 Jun. 5, 2003

(30) Foreign Application Priority Data

Apr. 20, 2000 (JP) ..... 2000-120095

(51) Int. Cl.
*A63B 21/00* (2006.01)

(52) U.S. Cl. ..... 482/124; 482/121; 2/2.18

(58) Field of Classification Search ..... 2/409, 2/69, 227, 22, 2.18, 2.16, 228; 482/124, 482/121, 105, 77; 450/99–100; 66/171
See application file for complete search history.

(56) References Cited

U.S. PATENT DOCUMENTS 5,201,074 A 4/1993 Dicker
5,367,708 A * 11/1994 Fujimoto (Continued)

FOREIGN PATENT DOCUMENTS

EP 0519135 12/1992

(Continued)

OTHER PUBLICATIONS

International Search Report for PCT/JP01/03303 (present application).

(Continued)

*Primary Examiner*—Jerome Donnelly
(74) *Attorney, Agent, or Firm*—Darby & Darby

(57) ABSTRACT

A leg support garment of a tights type that has stretchability and is applied in close contact with the human body so as to support the legs is provided with a stretchable part having a relatively great straining force. The stretchable part having a relatively great straining force includes a stretchable portion (A) having a relatively great straining force that substantially covers the ligamentum collateralle on a medial side of the knee joint of the human body, and on a superior side of the knee joint, extends through a length of not less than ¼ of that of the thigh, along at least one selected from the musculus group consisting of the musculus sartorius, the musculus semitendinosus, the musculus semimembranosus, and the musculus gracilis. Thus, it is possible to provide a leg support garment that is capable of effectively protecting the knees and stably maintaining the knee joints without decreasing the degree of freedom of the movement of the knee joints, that provides a good feeling when worn, and that is useful for preventing and reducing gonalgia of the knees, and further, for preventing injuries to the ligamentum collateralle medialis caused by sports or the like.

29 Claims, 128 Drawing Sheets

U.S. PATENT DOCUMENTS

| | | | | |
|---|---|---|---|---|
| 5,737,773 | A | 4/1998 | Dicker et al. | |
| 5,745,917 | A | 5/1998 | Dicker et al. | |
| 5,829,058 | A * | 11/1998 | Dicker et al. | 2/69 |
| 5,867,827 | A * | 2/1999 | Wilkinson | |
| 6,186,970 | B1 | 2/2001 | Fujii et al. | 602/75 |

FOREIGN PATENT DOCUMENTS

| | | | |
|---|---|---|---|
| EP | 0642777 | A | 3/1995 |
| EP | 0 733 351 | A2 | 9/1996 |
| EP | 1016351 | | 7/2000 |
| JP | 04050302 | | 2/1992 |
| JP | 04057902 | | 2/1992 |
| JP | 4343868 | | 11/1992 |
| JP | 08081807 | | 3/1996 |
| JP | 08325813 | | 12/1996 |
| JP | 9-149959 | A | 6/1997 |
| JP | 09241906 | | 9/1997 |
| JP | 10110306 | | 4/1998 |
| JP | 10-280209 | | 10/1998 |
| JP | 11012814 | | 1/1999 |
| JP | 11-61516 | A1 | 3/1999 |

OTHER PUBLICATIONS

International Search Report for PCT/JP97/03372 (for EP1016351A1, claiming priority from JP 10-280209).

Patent Abstracts of Japan, vol. 0162, No. 57, Jun. 11, 1992, Publication No. JP 4-57904.

Patent Abstracts of Japan, vol. 1998, No. 9, Jul. 31, 1998, Publication No. JP 10-110306.

Patent Abstracts of Japan, vol. 1998, No. 1, Jan. 30, 1998, Publication No. JP 9-241906.

Platzer, W.; "Taschenatlas der Anatomie"; Band 1: Bewegungsapparat; Georg Thieme Verlag Stuttgard, 1991.

* cited by examiner

TIGHTS-TYPE LEG SUPPORT GARMENT

CROSS-REFERENCE TO RELATED APPLICATIONS

This application is a U.S. National Stage Application under 35 U.S.C. §371 of PCT International Application No. PCT/JP01/03303, filed Apr. 18, 2001, which claims priority to Japanese Patent Application No. 2001-120095, filed Apr. 20, 2000. Each of these applications is incorporated herein by reference in its entirety.

TECHNICAL FIELD

The present invention relates to a tights-type leg support garment, and particularly relates to a stretchable leg support garment in which stretchable portions having relatively great straining forces are provided at specific positions.

BACKGROUND ART

Among parts of the human body, the knees tend to have orthopedic troubles most often, due to declines with age of muscles and ligaments that support the knees, injuries to the knees in sports, etc.

Recently, care of injuries to the knees and protection of the knees have been carried out by applying a taping treatment or a corset to a part of the human body that requires the same, occasionally.

However, the taping treatment is difficult to carry out for oneself, and it is necessary to ask the others, specifically the specialists, to conduct the same since the taping treatment requires skills that are not available from inexperienced persons. Therefore, it involves inconvenience in application and removal. Besides, long-period application of the same should be avoided, since it could cause skin disorders. Furthermore, the taping treatment fixes the knee joint, thereby decreasing the degree of freedom of the movement of the knee joint. On the other hand, in the case where a corset is employed, the degree of freedom of the movement of the knee joint likewise decreases significantly, since a corset does not provide sufficient freedom to the patella.

Recently, various garments that support specific muscles have been proposed (JP 4(1922)-343868 A, JP 4(1992)-57902 A, JP 4(1992)-50302 A, JP 8(1996)-81807 A, JP 9(1997)-241906 A, JP 10(1998)-280209 A, etc.).

Such garments having muscle-supporting functions are generally provided with stretchable portions having relatively great straining forces at positions over or beside muscles to be supported.

However, these garments having muscle-supporting functions are designed not particularly from the viewpoint of the protection of the knees.

As to the human body, even taking a standing position causes the knees to warp. More specifically, a force causing the legs to bend convexly with the medial side of each knee joint being a vertex is applied to the legs, thereby applying more tension to the ligamentum collateralle of each knee joint on the medial side thereof (the ligamentum collateralle on the medial side is hereinafter referred to as ligamentum collateralle medialis). The ligamentum collateralle medialis is covered with tendons on inferior sides of the musculus sartorius, the musculus semitendinosus, the musculus semimembraneous, and the musculus gracilis, thereby being protected. However, if these muscles fatigue or become weaken with age, it is impossible to resist against the foregoing force with only the ligaments, and hence, the knees are made unstable.

Meanwhile, few studies have been made on garments for supporting the ligamentum collateralle medialis of the knee joint of the human body. Statistics, however, show that there are considerably many cases of disorders to the ligamentum collateralle medialis of the knee joint, among the disorders of the knee joint. Therefore, it has been found that, with a view to providing sufficient support to the knees while securing the freedom of the movement of the knees, studies should be focused on the ligamentum collateralle medialis.

The ligamentum collateralle medialis is located at a position slightly posterior to the medial side of each knee joint, extending between the vicinity of an inferior end of the os femoris and the vicinity of a superior end of the tibia. On the lateral side of the knee joint, opposite to the ligamentum collateralle medialis, the ligamentum collateralle lateralis is located, extending between the vicinity of the inferior end of the os femoris and the vicinity of a superior a end of the fibra. It should be noted, however, that cases of disorders of the ligamentum collateralle lateralis are significantly less than cases of disorders of the ligamentum collateralle medialis; namely, cases of disorder of the ligamentum collateralle medialis are many. This is because that the ligamentum collateralle medialis has a small tensile strength as compared with that of the ligamentum collateralle lateralis, and hence, exhibits a small degree of extension before fracture. In other words, the ligamentum collateralle medialis is inferior to the ligamentum collateralle lateralis in strength and elasticity.

As described above, the ligamentum collateralle medialis is covered with tendons on inferior sides of the musculus sartorius, the musculus semitendinosus, the musculus semimembraneous, and the musculus gracilis, and is located at a position slightly posterior to the medial side of the knee joint. Therefore, there has been no muscle support garment that is focused on and actually intended to provide the support of the ligamentum collateralle medialis.

The inventors of the present invention made studies centering on the support of the ligamentum collateralle medialis and aimed to providing a leg support garment that is capable of effectively protecting the knees and stably maintaining the knee joints without decreasing the degree of freedom of the movement of the knee joints, that provides a good feeling when worn, and that is useful for preventing and reducing gonalgia caused by the instability of the knees, and further, for preventing injuries to the ligamentum collateralle medialis caused by sports or the like.

SUMMARY OF THE INVENTION

With the foregoing in mind, the present invention is to provide a leg support garment as described below. It should be noted that the following description includes auxiliary headings in brackets < > at the top of respective sections of descriptions corresponding to claims, but these are provided merely for conveniences, in referring to the contents of the present invention, and do not limit the present invention at all.

<Tights-type Leg Support Garment in General>

(1) A leg support garment of a tights type that has stretchability and is applied in close contact of the human body so as to support the legs, the leg support garment comprising a stretchable part having a relatively great straining force, wherein the stretchable part having a relatively great straining force includes a stretchable portion (A) having a relatively great straining force that:

substantially covers the ligamentum collateralle on a medial side of the knee joint of the human body; and on a superior side of the knee joint, extends through a length of not less than ¼ of that of the thigh, along at least one selected from the musculus group consisting of the musculus sartorius, the musculus semitendinosus, the musculus semimembranosus, and the musculus gracilis.

In the leg support garment of a tights type of the present invention, the stretchable portion (A) having a relatively great straining force supports the ligamentum collateralle medialis, and further, on the superior side of the knee joint, supports at least one selected from the musculus group consisting of the musculus sartorius, the musculus semitendinosus, the musculus semimembranosus, and the musculus gracilis that are located over the ligamentum collateralle medialis and extend upward. Therefore, a power of pulling up the stretchable portion having a relatively great straining force that supports the ligamentum collateralle medialis is produced by the portion extending upward in the stretchable portion (A) having a relatively great straining force, thereby increasing the power of supporting the ligamentum collateralle medialis. Further, at least one of the musculus sartorius, the musculus semitendinosus, the musculus semimembranosus, and the musculus gracilis that support the knee joint in cooperation with the ligamentum collateralle medialis is also supported by the stretchable portion having a relatively great straining force. Therefore, the combined actions of these make it possible to provide a leg support garment that is capable of protecting the knees and stably maintaining the knee joints without decreasing the degree of freedom of the movement of the knee joints, that provides a good feeling when worn, and that is useful for preventing and reducing gonalgia caused by the instability of the knees, and further, for preventing injuries to the ligamentum collateralle medialis caused by sports or the like.

(2.) A leg support garment of a tights type that has stretchability and is applied in close contact with the surface of the human body so as to support the legs, the leg support garment comprising a stretchable part having a relatively great straining force, wherein the stretchable part having a relatively great straining force includes a stretchable portion (A) having a relatively great straining force that:

substantially covers the ligamentum collateralle on a medial side of the knee joint of the human body; and on a superior side of the knee joint, extends through a length of not less than ½ of that of the thigh, along at least one selected from the musculus group consisting of the musculus sartorius, the musculus semitendinosus, the musculus semimembranosus, and the musculus gracilis.

In the leg support garment of a tights type of the present invention, a length of a portion covering the thigh is set to be not less than ½ of the length of the thigh. Therefore, the power of pulling the stretchable portion having a relatively great straining force that supports the ligamentum collateralle medialis, described in the above item (1), is exerted more intensely where the portion extends upward to the superior part of the thigh. Consequently, this provides a leg support garment in which the power of supporting the ligamentum collateralle medialis is improved, which is preferable.

<Tights-type Leg Support Garment Having a Length from Waistline to Superior Side of Ankle>

(3) The leg support garment according to the above item (1) or (2), being a garment of a tights type that has a length capable of covering at least a range from a waistline to a superior side of the ankle.

According to the foregoing preferable embodiment of the present invention, the leg support garment has a length capable of covering at least a range from a waistline to a superior side of the ankle. Therefore, the power of pulling the stretchable portion having a relatively great straining force that supports the ligamentum collateralle medialis, described in the above item (1), is exerted further more intensely where the portion extends upward to the superior part of the thigh. Consequently, this provides a leg support garment in which the power of supporting the ligamentum collateralle medialis is improved, which is preferable. Besides, since it is a tights-type garment, it is easy to wear, and suitable as sports wear.

(4) The leg support garment according to the above item (3), wherein:

the portion expressed as the stretchable portion (A) having a relatively great straining force is a stretchable portion (A1) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of the musculus gastrocnemius and/or the musculus soleus on the medial side; and on a superior side of the knee joint, extends from a medial side to a lateral side of the thigh via an anterior side thereof approximately along the musculus sartorius to a vicinity of the trochanter major, passing a superior part of the musculus rectus femoris.

According to the foregoing preferred embodiment of the present invention, the stretchable portion having a relatively great straining force covers a portion of an inferior region of the patella so as to support the patella as if pulling up the same from the inferior side, thereby improving the stability of the knee joint. The portion further supports the musculus sartorius and extends from the medial side to the lateral side of the thigh obliquely and spirally toward the vicinity of the trochanter major, thereby increasing the power for pulling the stretchable portion having a relatively great straining force that supports the ligamentum collateralle medialis. This makes it possible to provide a leg support garment having an increased power for supporting the ligamentum collateralle medialis, and hence, this is preferable. Furthermore, this provides the support to the musculus sartorius that complements the function of the ligamentum collateralle medialis as well, which is also preferable.

(5) The leg support garment according to the above item (4), wherein the portion expressed as the stretchable portion (A1) having a relatively great straining force further includes a stretchable portion (A1-1) having a relatively great straining force that extends from a vicinity of the trochanter major to a vicinity of the waist along the tractus iliotibialis.

According to the foregoing preferred embodiment of the present invention, the stretchable portion (A1-1) having a relatively great straining force is further provided, which extends from the vicinity of the trochanter at major to the waist along the tractus iliotibialis. Therefore, the function of the item (4) is enhanced further, as well as the function of intensely pressing the trochanter major is enhanced also, thereby improving the connection between the caput ossis femoris and the acetabulum. This is preferable since further providing a function of enhancing the stability of the hip joint.

(6) The leg support garment according to the above item (4) or (5), wherein the portion expressed as the stretchable portion (A1) having a relatively great straining force further covers at least a part of a superior region of the patella by extending thereto approximately from a vicinity of the periphery of the patella on the medial side of the patella.

According to the foregoing preferred embodiment of the present invention, the stretchable portion (A1) having a relatively great straining force also covers at least a part of the superior region of the patella. Therefore, the knee joint is supported therefrom as well as from the inferior region of the patella, thereby allowing more stability of the knee joint to be achieved, which is preferable.

(7) The leg support garment according to any one of the above items (4) to (6), wherein the portion expressed as the stretchable portion (A1) having a relatively great straining force further includes a stretchable portion (A1-2) having a relatively great straining force that extends obliquely upward from a side of the musculus gastrocnemius on the medial side through a vicinity of the periphery of the patella on the inferior side of the patella to a lateral side of the patella.

According to the foregoing preferred embodiment of the present invention, the periphery of the patella is covered from a side of the musculus gastrocnemius on the medial side, i.e., from the inferior medial side, and a power of pulling up the same in an obliquely upward direction is exerted thereto. Therefore, this provides more stability of the knee joint, and hence, the present embodiment is preferable.

(8) The leg support garment according to any one of the above items (4) to (7), wherein the stretchable part having a relatively great straining force further includes a stretchable portion (B) having a relatively great straining force that:

extends from a vicinity of the trochanter major downward approximately along the tractus iliotibialis to a lateral side of the patella;

covers at least a part of the inferior region of the patella extending from the lateral side thereof, and passes a side of the musculus gastrocnemius and/or the musculus soleus on the lateral side According to the foregoing preferred embodiment of the present invention, the stretchable portion (B) having a relatively great straining force is further provided. Therefore, the knee and leg are supported from the both sides at the femoral region and the lower leg region, and further, the musculus gastrocnemius and/or the musculus soleus are supported from their sides without hindering their actions. Furthermore, the function of pressing the trochanter major is enhanced further, thereby improving the connection between the caput ossis femoris and the acetabulum. Therefore, this reinforces a function of enhancing the stability of the hip joint (9) The leg support garment according to the above item (3), wherein the portion expressed as the stretchable portion (A) having a relatively great straining force is a stretchable portion (A2) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of the musculus gastrocnemius and/or the musculus soleus on the medial side; and on a superior side of the knee joint, extends approximately along at least one selected from the musculus group consisting of the musculus semitendinosus, the musculus semimembranosus, and the musculus gracilis, and reaches a vicinity below the crotch or of the sulcus gluteus.

According to the foregoing preferred embodiment of the present invention, the stretchable portion having a relatively great straining force covers at least a part of the inferior region of the patella, thereby supporting the patella as if pulling up the patella from the inferior side thereof. As a result, the stability of the knee joint is improved. Furthermore, at least one of the musculus semitendinosus, the musculus semimembranosus, and the musculus gracilis that are located on the medial side of the thigh, thereby increasing the power of pulling the stretchable portion having a relatively great straining force that supports the ligamentum collateralle medialis. Consequently, a leg support garment with an increased power for supporting the ligamentum collateralle medialis is provided, which is preferable. Furthermore, at least one of the musculus semitendinosus, the musculus semimembranosus, and the musculus gracilis that complement the function of the ligamentum collateralle medialis is supported, which is also preferable.

(10) The leg support garment according to the above item (9), wherein the portion expressed as the stretchable portion (A2) having a relatively great straining force is a stretchable portion (A2-1) having a relatively great straining force that further covers at least a part of a superior region of the patella by extending thereto approximately from a vicinity of the periphery of the patella on the medial side of the patella.

According to the foregoing preferred embodiment of the present invention, the stretchable portion (A2) having a relatively great straining force also covers at least a part of the superior region of the patella. Therefore, the knee joint is supported therefrom as well as from the inferior region of the patella, thereby allowing more stability of the knee joint to be achieved, which is preferable.

(11) The leg support garment according to the above item (3), wherein the portion expressed as the stretchable portion (A) having a relatively great straining force is a stretchable portion (A3) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of the musculus gastrocnemius and/or the musculus soleus on the medial side; and on a superior side of the knee joint, extends from a medial side to a lateral side of the thigh via a posterior side thereof approximately along the musculus semitendinosus and/or the musculus semimembranosus to a vicinity of the trochanter major, passing over the musculus biceps femoris obliquely.

According to the foregoing preferred embodiment of the present invention, the stretchable portion having a relatively great straining force is provided, which extends from the side of the musculus gastrocnemius and/or the musculus soleus on the medial side upwards, then passes the thigh obliquely in a spiral form from the medial side to the lateral side thereof via the posterior side thereof, and reaches the vicinity of the trochanter major. Therefore, it is possible to support the patella as if pulling up the same from the inferior side thereof, thereby improving the stability of the knee joint. Furthermore, it is also possible to increase the power of pulling the stretchable portion having a relatively great straining force that supports the ligamentum collateralle medialis. Consequently, a leg support garment with an increased power for supporting the ligamentum collateralle medialis is provided, which is preferable. Furthermore, the musculus semitendinosus and/or the musculus semimembranosus that complements the function of the ligamentum collateralle medialis is supported, which is preferable.

(12) The leg support garment according to the above item (11), wherein the portion expressed as the stretchable portion (A3) having a relatively great straining force is a stretchable portion (A3-1) having a relatively great straining force that further covers at least a part of a superior region of the patella by extending thereto approximately from a vicinity of the periphery of the patella on the medial side of the patella.

According to the foregoing preferred embodiment of the present invention, the stretchable portion (A3) having a relatively great straining force also covers at least a part of the superior region of the patella. Therefore, the knee joint is supported therefrom as well as from the inferior region of the patella, thereby allowing more stability of the knee joint to be achieved, which is preferable.

(13) The leg support garment according to any one of the above items (9) to (12), wherein the stretchable part having a relatively great straining force further includes a stretchable portion (B) having a relatively great straining force that:

extends from a side part of the waist approximately along the tractus iliotibialis via a vicinity of the trochanter major, then, approximately along the tractus iliotibialis to a lateral side of the patella;

covers at least a part of an inferior region of the patella, or at least a part of inferior and superior regions of the patella; and passes a side of the musculus gastrocnemius and/or the musculus soleus on a lateral side of the same.

According to the foregoing preferred embodiment of the present invention, the stretchable portion (B) having a relatively great straining force is further provided. Therefore, the knee and leg are supported from the both sides at the femoral region and the lower leg region, and further, the musculus gastrocnemius and/or the musculus soleus are supported from their sides without hindering their actions. Furthermore, the function of pressing the trochanter major is enhanced further, thereby improving the connection between the caput ossis femoris and the acetabulum. Therefore, this reinforces a function of enhancing the stability of the hip joint.

(14) The leg support garment according to any one of the above items (4) to (8), wherein the portion expressed as the stretchable portion (A) having a relatively great straining force is the stretchable portion (A1) having a relatively great straining force, and further includes, on a superior side of a knee-joint-part of the stretchable portion (A1) having a relatively great straining force, a stretchable portion (A2') having a relatively great straining force that extends approximately along at least one selected from the musculus group consisting of the musculus semitendinosus, the musculus semimembranosus, and the musculus gracilis to a vicinity of the crotch or a vicinity of the sulcus gluteus.

According to the foregoing preferred embodiment of the present invention, the stretchable portion having a relatively great straining force is present in a spiral form, extending obliquely from the medial side to the lateral side of the thigh, and then, to the trochanter major. In addition, the stretchable portion (A2') having a relatively great straining force that branches therefrom on the superior side of the knee joint is present also, extending through the thigh approximately along at least one selected from the musculus group consisting of the musculus semitendinosus, the musculus semimembranosus, and the musculus gracilis to the vicinity of the crotch or the vicinity of the sulcus gluteus. The actions of these in combination further increase the power of pulling the stretchable portion having a relatively great straining force that supports the ligamentum collateralle medialis. Consequently, a leg support garment with an increased power for supporting the ligamentum collateralle medialis is provided, which is preferable. Furthermore, along with the musculus sartorius that complements the function of the ligamentum collateralle medialis, at least one selected from the musculus group consisting of the musculus semitendinosus, the musculus semimembranosus, and the musculus gracilis is also supported, which is preferable. Furthermore, the stretchable portion having a relatively great straining force that is provided from the vicinity of the trochanter major to the vicinity of the waist along the tractus iliotibialis provides a function of pressing the trochanter major, thereby improving the connection between the caput ossis femoris and the acetabulum. Therefore, this further provides a function of enhancing the stability of the hip joint, which is preferable.

(15) The leg support garment according to the above item (3), wherein:

the portion expressed as the stretchable portion (A) having a relatively great straining force is a stretchable portion (A2') having a relatively great straining force that:

substantially covers the ligamentum collateralle on the medial side of the knee joint of the human body;

extends approximately along a vicinity of a periphery of the patella on a medial side thereof, surrounds the patella through at least approximately ½ or more of the periphery of the patella so as to cover at least a part of inferior and superior regions of the patella, and reaches a side of the musculus gastrocnemius and/or the musculus soleus on the medial side; and on a superior side of the knee joint, extends approximately along at least one selected from the musculus group consisting of the musculus semitendinosus, the musculus semimembranosus, and the musculus gracilis, and reaches a vicinity below the crotch and a vicinity of the sulcus gluteus; and, the stretchable part having a relatively great straining force further includes a stretchable portion (B') having a relatively great straining force that:

extends from a side part of the waist approximately along the tractus iliotibialis via a vicinity of the trochanter major, then, approximately along the tractus iliotibialis to a lateral side of the patella;

surrounds the patella through approximately ½ or more of the periphery of the patella so as to cover at least a part of inferior and superior regions of the patella; and passes a side of the musculus gastrocnemius and/or the musculus soleus on the lateral side.

According to the foregoing preferred embodiment of the present invention, the stretchable portions having relatively great straining forces supports the knee and leg from both sides in the femoral region and the lower leg region, without hindering the action of the musculus vastus lateralis and the musculus vastus medialis on the anterior side of the thigh. Further, the foregoing embodiment allows the knee joint to be supported as if wrapped from the surrounding, thereby providing more support to the knee joint. Besides, the function of pressing the trochanter major is reinforced, thereby further improving the connection between the caput ossis femoris and the acetabulum. Therefore, the function of enhancing the stability of the hip joint is reinforced, which is preferable.

(16) The leg support garment according to the above item (15), wherein:

the stretchable portion (A2') having a relatively great straining force includes two portions projecting toward the lateral side and covering a part of the inferior region and a part of the superior region of the patella, respectively;

the stretchable portion (B') having a relatively great straining force includes two portions projecting toward the medial side and covering a part of the inferior region and a part of the superior region of the patella, respectively;

said two projecting portions of the stretchable portion (A2') having a relatively great straining force are arranged at positions opposite to said two projecting portions of the stretchable portion (B') having a relatively great straining force, respectively, the positions being slightly shifted to the inferior side from positions of said two portions of the stretchable portion (B') having a relatively great straining force, respectively;

and when viewed from the front, the portion of the stretchable portion (A2') having a relatively great straining force that covers the inferior region of the patella has a relatively greater area.

According to the preferred embodiment of the present invention, the function described in the above item (15) is achieved. Meanwhile, in the lower leg region, on the medial side, the muscles are fewer and the tibia is in contact with the surface of the body, whereas on the lateral side of the lower leg region, the musculus gastrocnemius is on the lateral side of the fibula. Therefore, the foregoing embodiment provides the support of the knee joint as if pulling the medial side thereof having fewer muscles more intensely from the inferior side, thereby reinforcing the support of the ligamentum collateralle medialis, which is preferable.

(17) The leg support garment according to any one of the items (2) to (16), wherein the stretchable part having a relatively great straining force further includes:

a stretchable portion (C) having a relatively great straining force that, on the posterior side of the human body, covers a region extending from a certain position in a range from the vertebrae lumbales to the os sacrum, through an approximately middle part of the musculus gluteus maximus at right and left, approximately in a direction along muscular fibers of the musculus gluteus maximus via the top of the bulge of the hip or the vicinity of the same to at least the vicinity of trochanter major; and a stretchable portion (D) having a relatively great straining force that, on the anterior side of the human body, covers a region extending from a position on the musculus rectus abdominis in the hypogastric region, obliquely downward approximately in a direction along muscular fibers of the musculus obliquus internus abdominis at right and left to the vicinity of the trochanter major.

According to the foregoing preferred embodiment of the present invention, the stretchable portion (C) having a relatively great straining force is provided, which provides the firm support of the musculus gluteus maximus in the muscular fiber direction thereof. Thus, it can play a large role in supporting the rotating motion of the hips, preventing a decrease in the rotating angle of the hips, and stabilizing the pelvis in anterior-posterior direction. For an elderly person, it is effective in preventing failing down. Furthermore, it can play a large role in extending the hip joint in anterior-posterior direction when running, jumping, and climbing up a slope. Besides, the stretchable portion (D) having a relatively great straining force is provided, which supports a part of the musculus rectus abdominis and the musculus obliquus internus abdominis, thereby providing functions of reducing lumbar lordosis, maintaining good posture, making youthful figure, and preventing generation of pains such as lumbar pains.

<Tights-type Leg Support Garment Having a Length from Waistline to Inferior Side of Knee>

(18) The leg support garment according to the above item (1) or (2), being a garment of a tights type that has a length capable of covering at least a range from a waistline to an inferior side of the knee.

According to the foregoing preferred embodiment of the present invention, the leg support garment has a length capable of covering at least a range from the waistline to the inferior side of the knee. Therefore, the power of pulling the stretchable portion having a relatively great straining force that supports the ligamentum collateralle medialis, described in the above item (1), is exerted more intensely where the portion extends upward to the superior part of the thigh. Consequently, this provides a leg support garment in which the power of supporting the ligamentum collateralle medialis is improved, which is preferable. Moreover, since it is a tights-type garment, it is easy to wear, and suitable as sports wear. Particularly, it is suitably worn in high temperature areas or in the hot season. Meanwhile, "having a length capable of covering at least a range to the inferior side of the knee" described above means that the garment reaches at least the inferior end of the patella or a position below the same, and preferably, the garment has a hem line at a position at least 3 cm to 5 cm below the inferior end of the patella.

(19) The leg support garment according to the above item (18), wherein:

the portion expressed as the stretchable portion (A) having a relatively great straining force is a stretchable portion ($A^2$1) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of a superior part of the musculus gastrocnemius on the medial side; and on a superior side of the knee joint, extends from a medial side to a lateral side of the thigh via an anterior side thereof approximately along the musculus sartorius to a vicinity of the trochanter major, passing a superior part of the musculus rectus femoris.

According to the foregoing preferred embodiment of the present invention, the stretchable portion having a relatively great straining force covers a portion of an inferior region of the patella so as to support the patella as if pulling up the same from the inferior side, thereby improving the stability of the knee joint. The portion further supports the musculus sartorius and extends from the medial side to the lateral side of the thigh obliquely and spirally toward the vicinity of the trochanter major, thereby increasing the power for pulling the stretchable portion having a relatively great straining force that supports the ligamentum collateralle medialis. This makes it possible to provide a leg support garment having an increased power for supporting the ligamentum collateralle medialis, and hence, this is preferable. Furthermore, this provides the support to the musculus sartorius that complements the function of the ligamentum collateralle medialis as well, which is also preferable.

(20) The leg support garment according to the above item (19), wherein the portion expressed as the stretchable portion ($A^2$1) having a relatively great straining force further includes a stretchable portion ($A^2$1-1) having a relatively great straining force that extends from a vicinity of the trochanter major to a vicinity of the waist along the tractus iliotibialis.

According to the foregoing preferred embodiment of the present invention, the stretchable portion ($A^2$1-1) having a relatively great straining force is further provided, which extends from the vicinity of the trochanter major to the waist along the tractus iliotibialis. Therefore, the function of the item (19) is enhanced further, as well as the function of intensely pressing the trochanter major is enhanced also, thereby improving the connection between the caput ossis femoris and the acetabulum. This is preferable since further providing a function of enhancing the stability of the hip joint.

(21) The leg support garment according to the above item (19) or (20), wherein the portion expressed as the stretchable portion ($A^2$1) having a relatively great straining force further covers at least a part of a superior region of the patella by extending thereto approximately from a vicinity of the periphery of the patella on the medial side of the patella.

According to the foregoing preferred embodiment of the present invention, the stretchable portion ($A^2$1) having a relatively great straining force also covers at least a part of the superior region of the patella. Therefore, the knee joint is supported therefrom as well as from the inferior region of the patella, thereby allowing more stability of the knee joint to be achieved, which is preferable.

(22) The leg support garment according to any one of the above items (19) to (20), wherein the stretchable part having a relatively great straining force further includes a stretchable portion ($B^2$) having a relatively great straining force that:

extends from a vicinity of the trochanter major downward approximately along the tractus iliotibialis to a lateral side of the patella;

covers at least a part of the inferior region of the patella extending from the lateral side thereof, and reaches a side of a superior part of the musculus gastrocnemius on the lateral side.

According to the foregoing preferred embodiment of the present invention, the stretchable portion ($B^2$) having a relatively great straining force is further provided. Therefore, the knee is supported from the both sides, whereby the support of the knee is reinforced. Furthermore, the function of pressing the trochanter major is enhanced further, thereby improving the connection between the caput ossis femoris and the acetabulum. Therefore, this reinforces a function of enhancing the stability of the hip joint.

(23) The leg support garment according to the above item (18), wherein the portion expressed as the stretchable portion (A) having a relatively great straining force is a stretchable portion ($A^2$2) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of a superior part of the musculus gastrocnemius on the medial side; and on a superior side of the knee joint, extends approximately along at least one selected from the musculus group consisting of the musculus semitendinosus, the musculus semimembranosus, and the musculus gracilis, and reaches a vicinity below the crotch or of the sulcus gluteus.

According to the foregoing preferred embodiment of the present invention, the stretchable portion having a relatively great straining force covers at least a part of the inferior region of the patella, thereby supporting the patella as if pulling up the patella from the inferior side thereof. As a result, the stability of the knee joint is improved. Furthermore, at least one of the musculus semitendinosus, the musculus semimembranosus, and the musculus gracilis that are located on the medial side of the thigh, thereby increasing the power of pulling the stretchable portion having a relatively great straining force that supports the ligamentum collateralle medialis. Consequently, a leg support garment with an increased power for supporting the ligamentum collateralle medialis is provided, which is preferable. Furthermore, at least one of the musculus semitendinosus, the musculus semimembranosus, and the musculus gracilis that complement the function of the ligamentum collateralle medialis is supported, which is preferable.

(24) The leg support garment according to the above item (23), wherein the portion expressed as the stretchable portion ($A^2$2) having a relatively great straining force is a stretchable portion ($A^2$2-1) having a relatively great straining force that further covers at least a part of a superior region of the patella by extending thereto approximately from a vicinity of the periphery of the patella on the medial side of the patella.

According to the foregoing preferred embodiment of the present invention, the stretchable portion ($A^2$2) having a relatively great straining force also covers at least a part of the superior region of the patella. Therefore, the knee joint is supported therefrom as well as from the inferior region of the patella, thereby allowing more stability of the knee joint to be achieved, which is preferable.

(25) The leg support garment according to the above item (18), wherein the portion expressed as the stretchable portion (A) having a relatively great straining force is a stretchable portion ($A^2$3) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of a superior part of the musculus gastrocnemius on the medial side; and on a superior side of the knee joint, extends from a medial side to a lateral side of the thigh via a posterior side thereof approximately along the musculus semitendinosus and/or the musculus semimembranosus to a vicinity of the trochanter major, passing over the musculus biceps femoris obliquely.

According to the foregoing preferred embodiment of the present invention, the stretchable portion having a relatively great straining force is present, extending from the medial side to the lateral side of the thigh via the posterior side thereof obliquely and spirally toward the vicinity of the trochanter major, thereby supporting the patella as if pulling up the same from the inferior side, and improving the stability of the knee joint. Furthermore, the power of pulling the stretchable portion having a relatively great straining force that supports the ligamentum collateralle medialis is increased. This makes it possible to provide a leg support garment having an increased power for supporting the ligamentum collateralle medialis, and hence, this is preferable. Furthermore, this provides the support to the musculus semitendinosus and/or the musculus semimembranosus that complements the function of the ligamentum collateralle medialis as well, which is also preferable.

(26) The leg support garment according to the above item (25), wherein the portion expressed as the stretchable portion ($A^2$3) having a relatively great straining force is a stretchable portion ($A^2$3-1) having a relatively great straining force that further covers at least a part of a superior region of the patella by extending thereto approximately from a vicinity of the periphery of the patella on the medial side of the patella.

According to the foregoing preferred embodiment of the present invention, the stretchable portion ($A^3$3) having a relatively great straining force also covers at least a part of the superior region of the patella. Therefore, the knee joint is supported therefrom as well as from the inferior region of the patella, thereby allowing more stability of the knee, which is preferable.

(27) The leg support garment according to any one of the above items (23) to (26), wherein the stretchable part having a relatively great straining force further includes a stretchable portion ($B^2$) having a relatively great straining force that:

extends from a side part of the waist approximately along the tractus iliotibialis via a vicinity of the trochanter major, then, approximately along the tractus iliotibialis to a lateral side of the patella;

covers at least a part of an inferior region of the patella, or at least a part of inferior and superior regions of the patella; and reaches a side of a superior part of the musculus gastrocnemius on the lateral side.

According to the foregoing preferred embodiment of the present invention, the stretchable portions ($B^2$) having relatively great straining forces are further provided. Therefore, the knee is supported from both of the sides, whereby the support of the knee is reinforced. Besides, the function of pressing the trochanter major is reinforced, thereby further improving the connection between the caput ossis femoris and the acetabulum. Therefore, the function of enhancing the stability of the hip joint is reinforced.

(28) The leg support garment according to any one of the above items (19) to (22), wherein the portion expressed as the stretchable portion (A) having a relatively great straining force is the stretchable portion ($A^2$1) having a relatively great straining force, and further includes, on a superior side of a knee-joint-part of the stretchable portion ($A^2$1) having a relatively great straining force, a stretchable portion ($A^2$2') having a relatively great straining force that extends approximately along at least one selected from the musculus group consisting of the musculus semitendinosus, the musculus semimembranosus, and the musculus gracilis to a vicinity of the crotch or a vicinity of the sulcus gluteus.

According to the foregoing preferred embodiment of the present invention, the stretchable portions having relatively great straining forces are present in a spiral form, extending obliquely from the medial side to the lateral side of the thigh, then, to the trochanter major. In addition, the stretchable portion ($A^2$2') having a relatively great straining force that branches therefrom on the superior side of the knee joint is present, extending through the thigh approximately along at least one selected from the musculus group consisting of the musculus semitendinosus, the musculus semimembranosus, and the musculus gracilis to the vicinity of the crotch or the sulcus gluteus. The actions of these in combination increases the power of pulling the stretchable portion having a relatively. great straining force that supports the ligamentum collateralle medialis. Consequently, a leg support garment with an increased power for supporting the ligamentum collateralle medialis is provided, which is preferable. Furthermore, along with the musculus sartorius that complements the function of the ligamentum collateralle medialis, at least one selected from the musculus group consisting of the musculus semitendinosus, the musculus semimembranosus, and the musculus gracilis is also supported, which is preferable. Furthermore, the stretchable portion having a relatively great straining force that is provided from the vicinity of the trochanter major to the vicinity of the waist along the tractus iliotibialis provides a function of pressing the trochanter major, thereby improving the connection between the caput ossis femoris and the acetabulum. Therefore, this further provides a function of enhancing the stability of the hip joint, which is preferable.

(29) The leg support garment according to the above item (18), wherein:

the portion expressed as the stretchable portion (A) having a relatively great straining force is a stretchable portion ($A^2$2') having a relatively great straining force that:

substantially covers the ligamentum collateralle on the medial side of the knee joint of the human body;

extends approximately along a vicinity of a periphery of the patella on a medial side thereof, surrounds the patella through at least approximately ½ or more of the periphery of the patella so as to cover at least a part of inferior and superior regions of the patella, and reaches a side of a superior part of the musculus gastrocnemius on the medial side; and on a superior side of the knee joint, extends approximately along at least one selected from the musculus group consisting of the musculus semitendinosus, the musculus semimembranosus, and the musculus gracilis, and reaches a vicinity below the crotch and a vicinity of the sulcus gluteus;

and, the stretchable part having a relatively great straining force further includes a stretchable portion ($B^{2'}$) having a relatively great straining force that:

extends from a side part of the waist approximately along the tractus iliotibialis via a vicinity of the trochanter major, then, approximately along the tractus iliotibialis to a lateral side of the patella;

surrounds the patella through approximately ½ or more of the periphery of the patella so as to cover at least a part of inferior and superior regions of the patella; and reaches a side of a superior part of the musculus gastrocnemius on the lateral side.

According to the foregoing preferred embodiment of the present invention, the stretchable portions having relatively great straining forces support the knee and leg from both sides in the femoral region and the lower leg region, without hindering the action of the musculus vastus lateralis and the musculus vastus medialis on the anterior side of the thigh. Further, the knee joint is supported as if wrapped from the surrounding, whereby further support of the knee joint is provided. Besides, the function of pressing the trochanter major is reinforced, thereby further improving the connection between the caput ossis femoris and the acetabulum. Therefore, the function of enhancing the stability of the hip joint is reinforced, which is preferable.

(30) The leg support garment according to the item (29), wherein:

the stretchable portion ($A^2$2') having a relatively great straining force includes two portions projecting toward the lateral side and covering a part of the inferior region and a part of the superior region of the patella, respectively;

the stretchable portion ($B^{2'}$) having a relatively great straining force includes two portions projecting toward the medial side and covering a part of the inferior region and a part of the superior region of the patella, respectively;

said two projecting portions of the stretchable portion ($A^2$2') having a relatively great straining force are arranged at positions opposite to said two projecting portions of the stretchable portion ($B^{2'}$) having a relatively great straining force, respectively, the positions being slightly shifted to the inferior side from positions of said two portions of the stretchable portion ($B^{2'}$) having a relatively great straining force, respectively;

and a vertex of the portion of the stretchable portion ($A^2$2') having a relatively great straining force that covers the inferior region of the patella is positioned at center of the patella, or slightly on a lateral side from the center.

According to the preferred embodiment of the present invention, the function described in the above item (29) is achieved. Meanwhile, in the lower leg region, on the medial side, the muscles are fewer and the tibia is in contact with the surface of the body, whereas on the lateral side of the lower leg region, the musculus gastrocnemius is on the lateral side of the fibula. Therefore, the foregoing embodiment provides the support of the knee joint as if pulling the medial side thereof having fewer muscles more intensely from the inferior side, thereby reinforcing the support of the ligamentum collateralle medialis, which is preferable.

(31) The leg support garment according to any one of the above items (18) to (30), wherein the stretchable part having a relatively great straining force further includes:

a stretchable portion (C) having a relatively great straining force that, on the posterior side of the human body, covers a region extending from a certain position in a range from the vertebrae lumbales to the os sacrum, through an approximately middle part of the musculus gluteus maximus at right and left, approximately in a direction along muscular fibers of the musculus gluteus maximus via the top of the bulge of the hip or the vicinity of the same to at least the vicinity of trochanter major; and a stretchable portion (D) having a relatively great straining force that, on the anterior side of the human body, covers a region extending from a position on the musculus rectus abdominis in the hypogastric region, obliquely downward approximately in a direction along muscular fibers of the musculus obliquus internus abdominis at right and left to the vicinity of the trochanter major.

According to the foregoing preferred embodiment of the present invention, the stretchable portion (C) having a relatively great straining force is provided, which provides the firm support of the musculus gluteus maximus in the muscular fiber direction thereof. Thus, it can play a large role in supporting the rotating motion of the hips, preventing a decrease in the rotating angle of the hips, and stabilizing the pelvis in anterior-posterior direction. For an elderly person, it is effective in preventing falling down. Furthermore, it can play a large role in extending the hip joint in anterior-posterior direction when running, jumping, and climbing up a slope. Besides, the stretchable portion (D) having, a relatively great straining force is provided, which supports a part of the musculus rectus abdominis and the musculus obliquus internus abdominis, thereby providing functions of reducing lumbar lordosis, maintaining good posture, making youthful figure, and preventing generation of pains such as lumbar pains.

The above, and other objects, features and advantages of the present invention will become apparent from the following description read in conjunction with the accompanying drawings, in which like reference numerals designate the same elements.

BRIEF DESCRIPTION OF DRAWINGS

FIG. 120 is a cross-sectional conceptual process view illustrating the cut-boss knitting technique in the circular knitting FIG. 121 is a cross-sectional conceptual process view illustrating the cut-boss knitting technique in the circular knitting.

FIG. 122 is a cross-sectional conceptual view of a circular-knitting fabric obtained by the cut-boss knitting technique.

FIG. 123 is a view illustrating, in its right half and left half, a skeleton system and a muscle system of a leg part of the human body viewed from the anterior side, respectively.

FIG. 124 is a view illustrating, in its left half and right half, a skeleton system and a muscle system of a leg part of the human body viewed from the posterior side, respectively.

FIG. 125 is a view illustrating a muscle system, partially a skeleton system, of the right-side leg of the human body viewed from the lateral side.

FIG. 126 is a view illustrating a muscle system, partially a skeleton system, of the right-side leg of the human body viewed from the medial side.

FIG. 127 is a partial rear view of the skeleton and ligaments in the vicinity of the knee joint viewed from the posterior side.

FIG. 128 is a partial side view of the skeleton and ligaments in the vicinity of the knee joint viewed from the medial side.

DETAILED DESCRIPTION OF THE INVENTION

Figure 1:
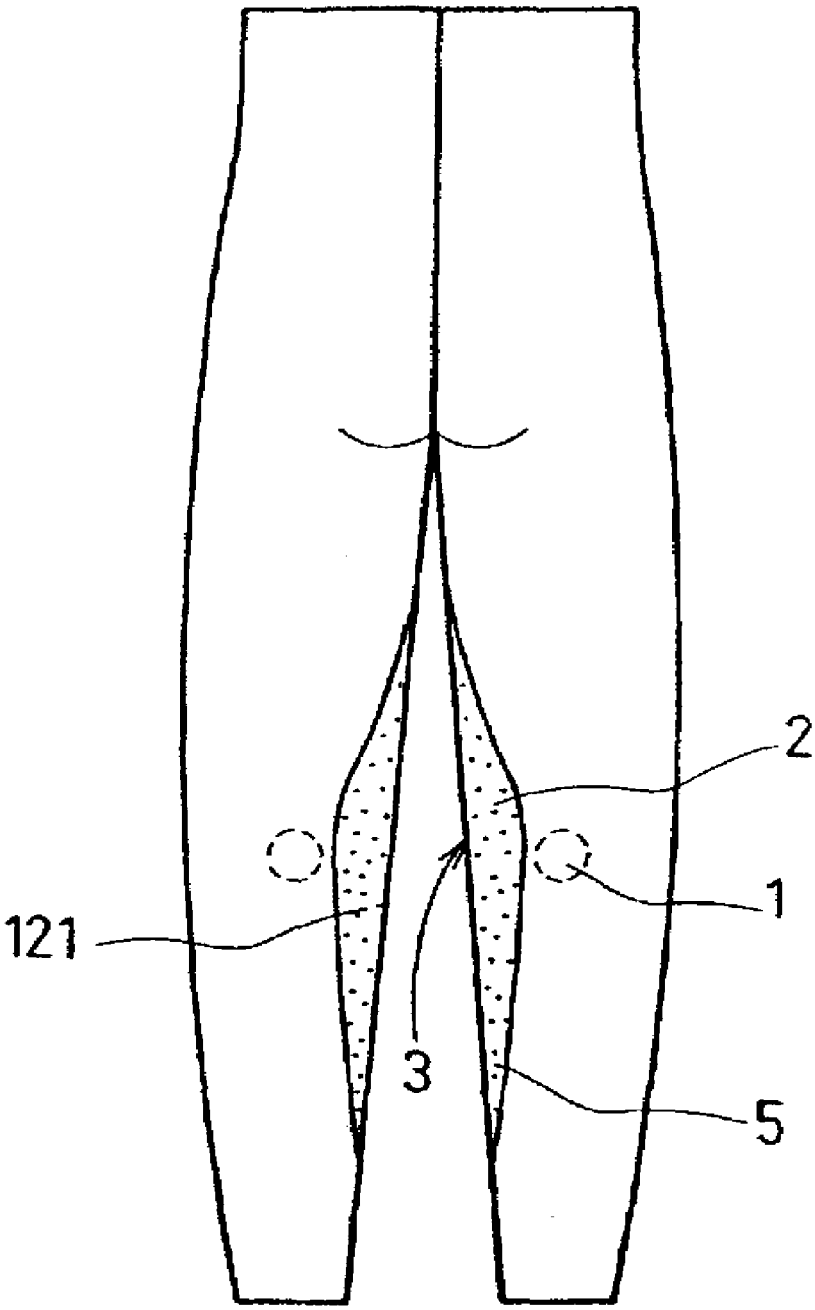
FIG. 1 is a rear view illustrating an embodiment of a tights-type leg support garment of the present invention having a length from a waistline to a superior side of the ankle (long tights type).

The following description will depict specific embodiments of the present invention, while referring to the drawings. In the description of the present invention, a position in a leg support garment of the present invention where a stretchable portion having a relatively great straining force is provided is occasionally explained using names of parts of the human body, and names of muscles and bones. For easier understanding, first of all, the following description will explain positions of bones and muscles of the human body used in descriptions of the positions where stretchable portions having great straining forces are placed and the like.

Figure 123:
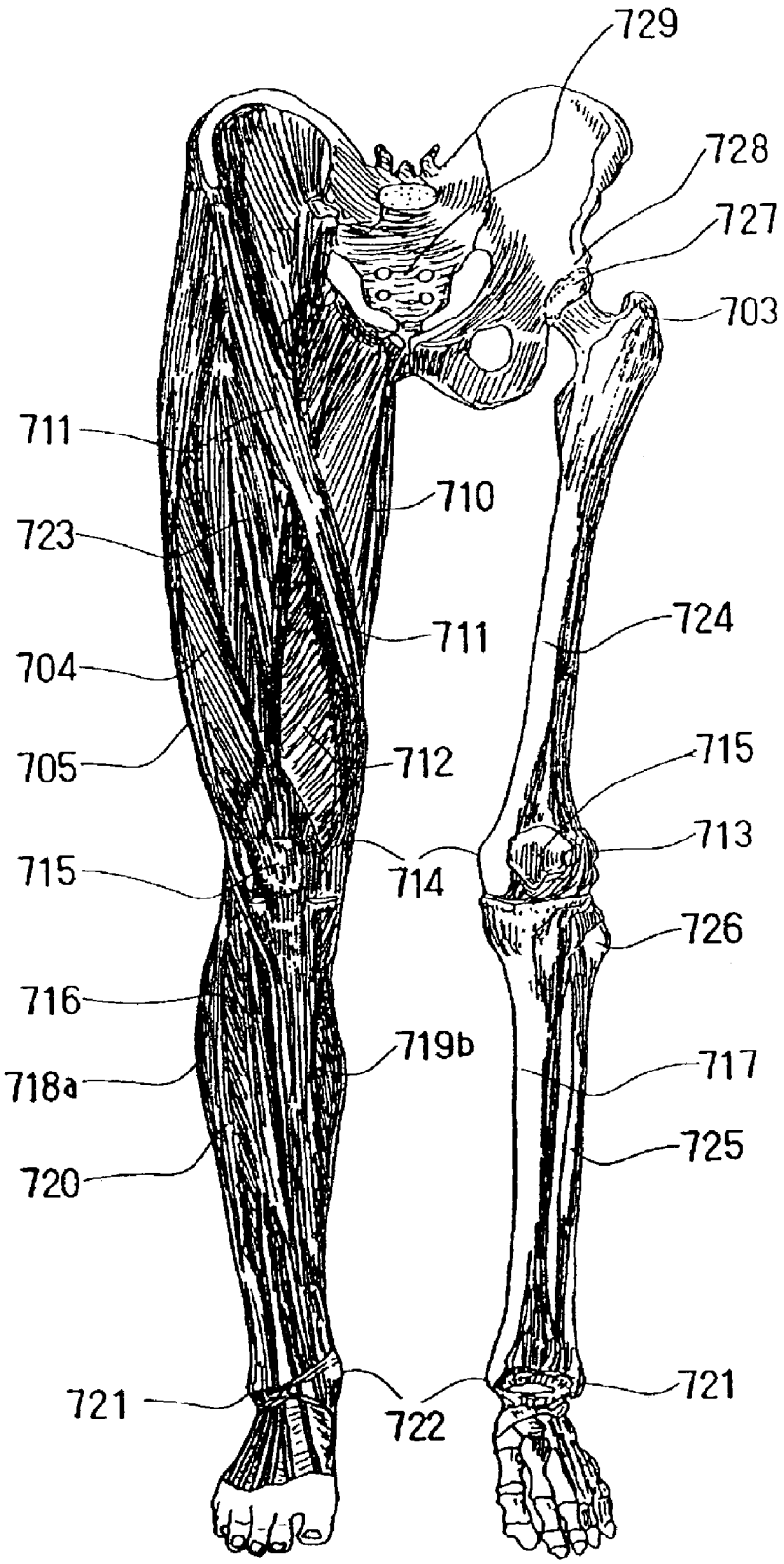
Figure 124:
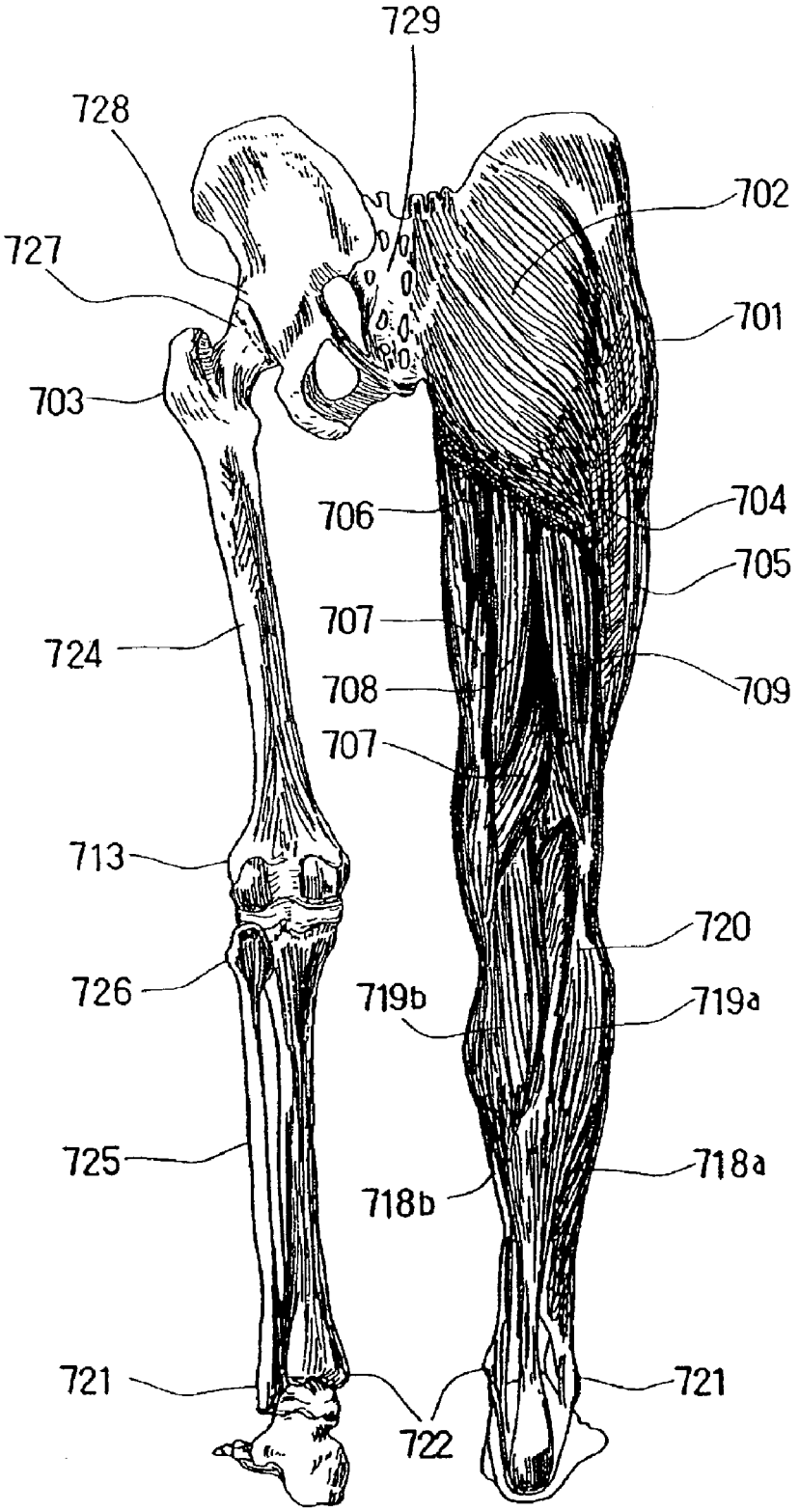
Figure 125:
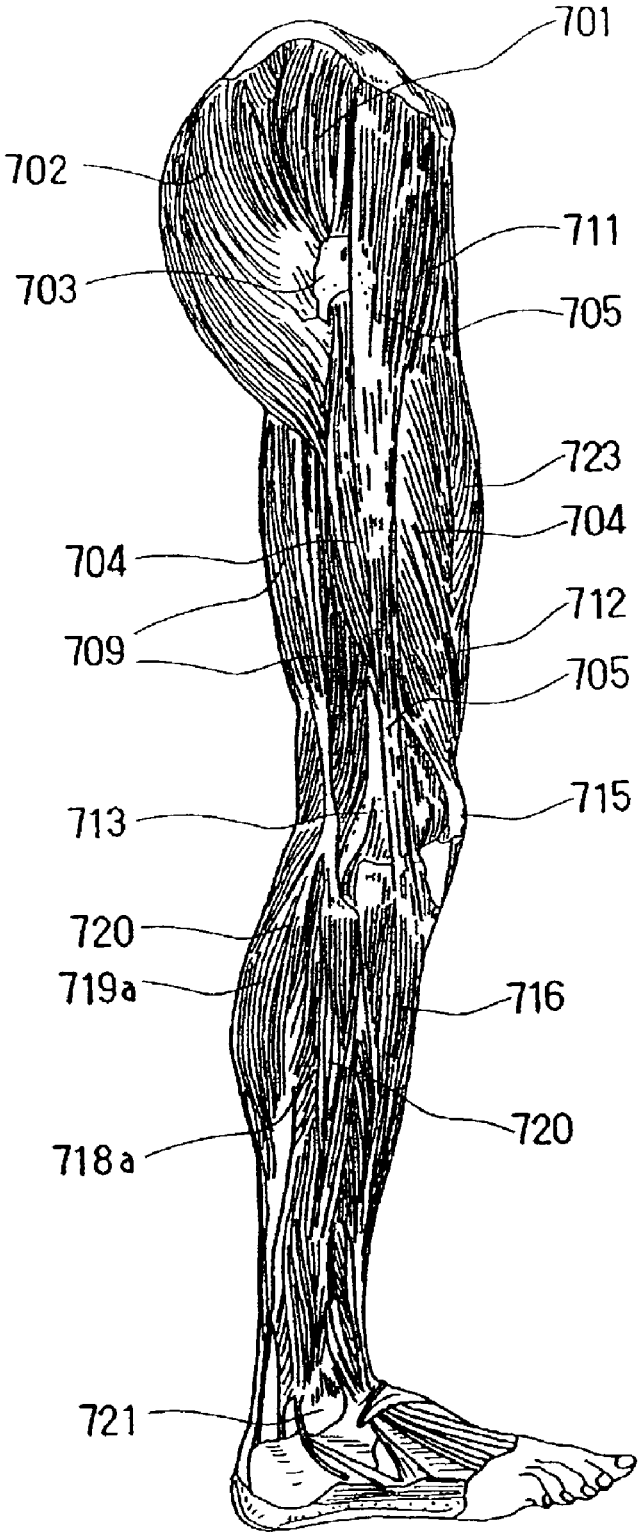
Figure 126:
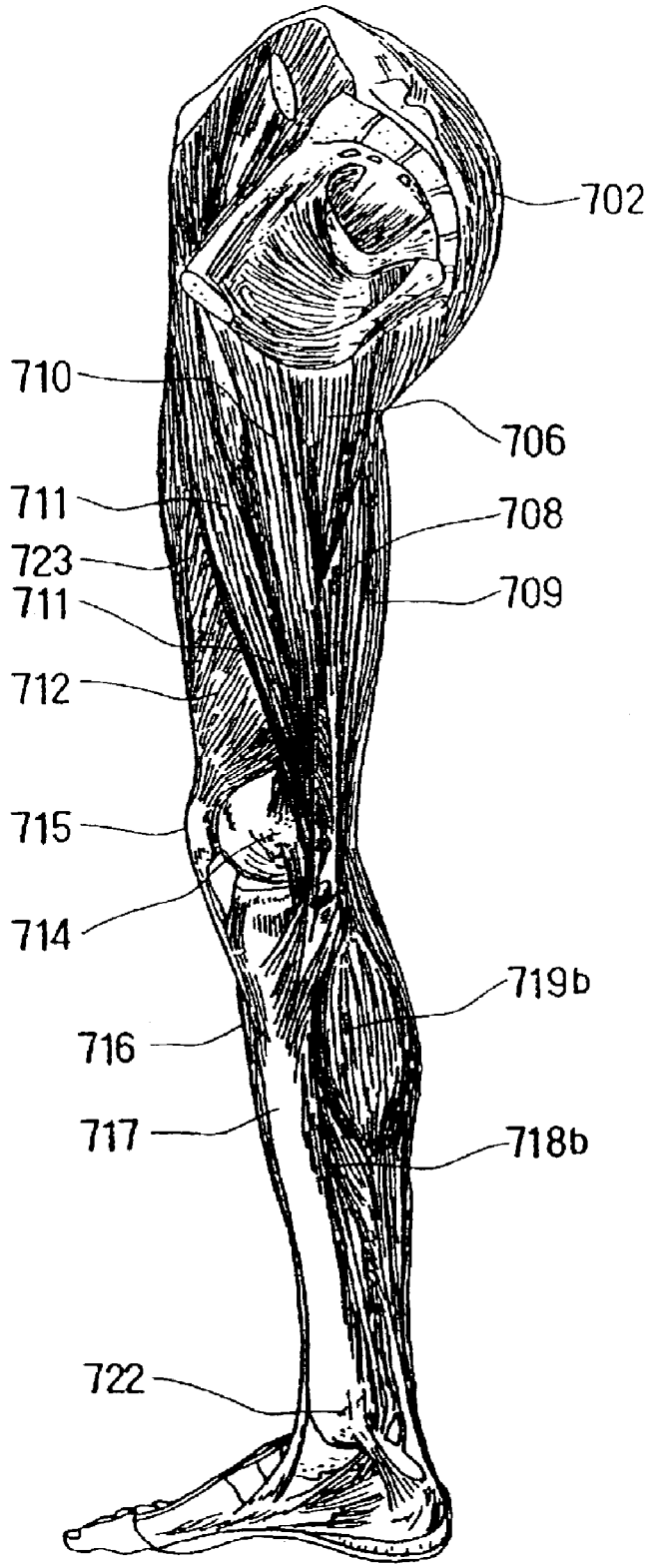

In FIG. 123, a right half thereof is a view illustrating a skeleton system of a leg part of the human body viewed from the anterior side, and a left half thereof is a view illustrating a muscle system of a leg part of the human body viewed from the anterior side. In FIG. 124, a left half thereof is a view illustrating a skeleton system of a leg part of the human body viewed from the posterior side, and a right half thereof is a view illustrating a muscle system of a leg part of the human body viewed from the posterior side, respectively FIG. 125 is a view illustrating a muscle system, partially a skeleton system, of the right-side leg of the human body viewed from the lateral side. FIG. 126 is a view illustrating a muscle system, partially a skeleton system, of the right-side leg of the human body viewed from the medial side. It should be noted that descriptions of muscles and bones that are unnecessary for describing the present invention are omitted in FIGS. 123 to 126.

In FIGS. 123 to 126, 701 denotes the musculus gluteus medius; 702 denotes the musculus gluteus maximus; 703 denotes the trochanter major; 704 denotes the musculus vastus lateralis; 705 denotes the tractus iliotibialis; 706 denotes the musculus adductor magnus; 707 denotes the musculus semimembranosus; 708 denotes the musculus semitendinosus; 709 denotes the musculus bicipitis femoris; 710 denotes the musculus gracilis; 711 denotes the musculus sartorius; 712 denotes the musculus vastus medialis; 713 denotes the condylus lateralis of the os femoris; 714 denotes the condylus medialis of the os femoris; 715 denotes the patella part (the patella); 716 denotes the musculus tibialis anterior; 717 denotes the tibia; 718 denotes the musculus soleus (718*a* denotes the musculus soleus on the lateral side, and 718*b* denotes the musculus soleus on the medial side); 719 denotes the musculus gastrocnemius (719*a* denotes the musculus gastrocnemius on the lateral side, and 719*b* denotes the musculus gastrocnemius on the medial side); 720 denotes the musculus peroneus longus; 721 denotes the lateral malleolus (the malleolus lateralis); 722 denotes the medial malleolus (the malleolus medialis); 723 denotes the musculus rectus femoris; 724 denotes the os femoris; 725 denotes the fibula; 726 denotes the caput fibulae; 727 denotes the caput ossis femoris; 728 denotes the acetabulum; and 729 denotes the os sacrum. It should be noted that the vertebrae lumbales include the first through fifth lumber vertebras, though not shown, which are located on the superior side of the os sacrum 729. Though not shown, the musculus rectus abdominis is located at the center of the abdomen region, vertically from a superior part of the abdomen region on the inferior side of the thorax to the hypogastric region. Though not shown, the musculus obliquus externus abdominis is located at each of the right and left sides of the musculus rectus abdominis, and its muscular fibers are directed in an obliquely upward direction toward each side. Further, though not shown, the musculus obliquus internus abdominis is located substantially on the dorsal side of the musculus rectus abdominis and each musculus obliquus externus abdominis, and its muscular fibers are directed approximately in an obliquely downward direction toward each of the right and left sides from the center front line.

Figure 127:
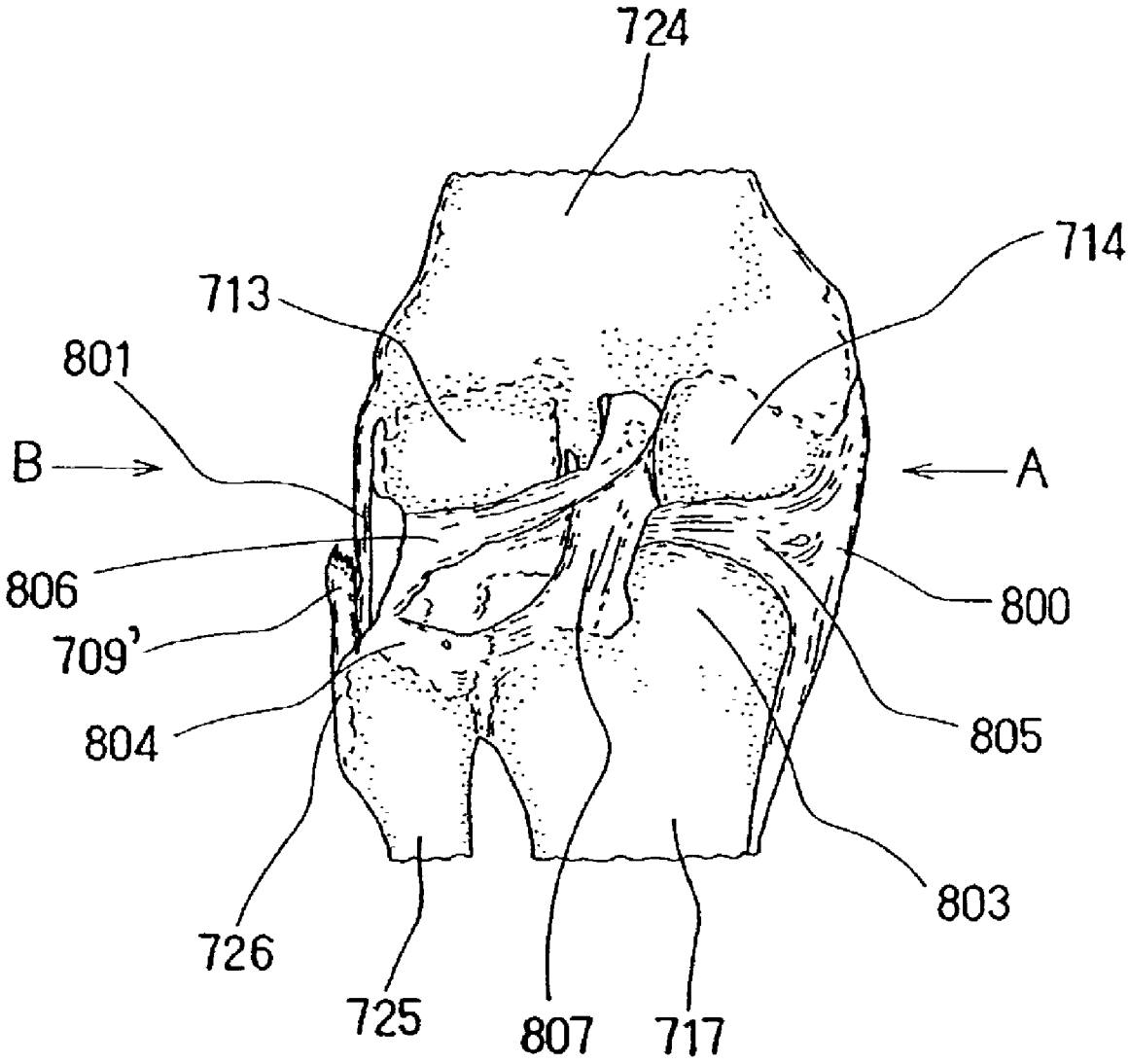
Figure 128:
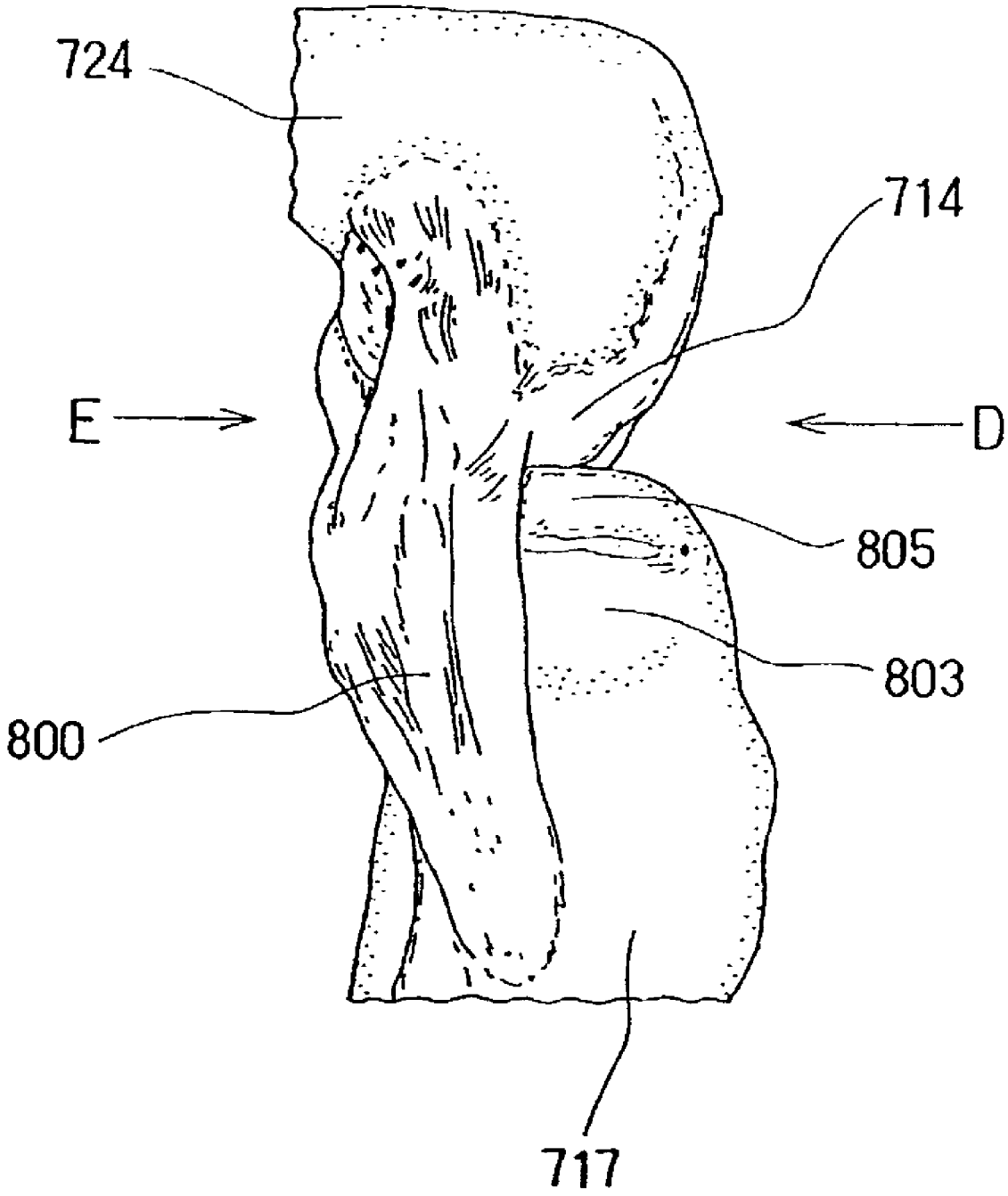

For descriptions of the ligamentum collateralle medialis and the like, a part of the skeleton and the ligaments in the vicinity of the knee joint is shown in FIGS. 127 and 128.

FIG. 127 is a rear view of the knee joint viewed from the dorsal side, and an arrow A indicates the medial side of the body while an arrow B indicates the lateral side of the body. FIG. 128 is a side view of the knee joint viewed from the medial side (the arrow A side), and an arrow D indicates the anterior side of the body while an arrow E indicates the posterior side of the body. FIG. 128 illustrates a state in which the knee is bent. 800 denotes the ligamentum collateralle medialis. 801 denotes the ligamentum collateralle lateralis. 803 denotes the condylus medialis of the tibia. 804 denotes the condylus lateralis of the fibula. 805 denotes the meniscus medialis. 806 denotes the meniscus lateralis. 807 denotes the ligamentum cruciatus posterior. 709' denotes a part of the tendon of the musculus biceps femoris, and the muscle on the superior side of the same is not shown.

As explicit from these drawings, the ligamentum collateralle medialis is located at a position slightly posterior to the medial side of the knee joint, extending between the vicnity of the inferior end of the os femoris and the vicinity of the superior end of the tibia.

It should be noted that the positions, shapes, and sizes of the bones and muscles vary slightly with the individual body, and the foregoing muscle and skeleton charts illustrate a mere typical example.

The directions of the muscular fibers are lengthwise directions of thin lines drawn in the muscles shown in the drawings, and these directions of the muscular fibers are directions in which the muscles contract. It should be noted that that the positions, shapes, and sizes of the bones and muscles vary slightly with the individual body, and the foregoing muscle and skeleton charts illustrate a mere typical example.

Since, as described above, the positions, shapes, and sizes of the bones and muscles vary slightly with the individual body and the body itself varies in size, there is no harm even if the positions on a garment of stretchable portions having relatively great straining forces and those having relatively small straining forces are shifted slightly from the predetermined specified positions, respectively, as long as they are in ranges such that the objects of the present invention can be achieved.

The following description will explain specific embodiments of a leg support garment of the present invention while referring to drawings, to make the present invention easily understood. However, the leg support garment of the present invention is not limited to those shown in the drawings.

Furthermore, in the following description, the positions of stretchable portions having relatively great straining forces and the like in the leg support garment of the present invention are described using names of muscles, ligaments, tendons, and bones. This intends to describe a position of a stretchable portion having a relatively great straining force or the like in a simpler manner, using names of muscles, ligaments, tendons, bones, etc. of the body, so as to indicate that the portion is to pass over, or in the vicinity of, a portion where the muscles, bones, and the like are located. In the garment other than the stretchable portions having relatively great straining forces, only specific small portions such as seam lines and others are made of portions having particularly small stretchability or no stretchability, and most portions of the garment are made of fabrics having stretchability and straining forces relatively smaller than those of the stretchable portions having relatively great straining forces. The matters described above apply to the other embodiments described below.

In the present invention, "the stretchable portion having a relatively great straining force substantially covers the ligamentum collateralle on the medial side of the knee joint" means that the portion may not necessarily cover the entirety of the ligamentum collateralle medialis, but may cover a majority of the same. More specifically, it means that, on the superior side of the knee joint, substantially the entirety of the ligamentum collateralle medialis is covered with the stretchable portion having a relatively great straining force, while on the inferior side of the knee joint, only a part of the ligamentum collateralle medialis to a position corresponding to an inferior end of the patella is covered with the stretchable portion having a relatively great straining force.

Furthermore, in the drawings illustrating the embodiments of the garment of the present invention, if FIGS. 1 to 4 are taken as an example, 1 schematically denotes a position where the patella is located; it does not indicate a size of the patella. It also is used to indicate a central position of the knee joint. It should be noted that in a rear view of the garment according to the embodiment of the present invention also, the marking of the position of the patella facilitates the understanding of the garment of the present invention in the descriptions with reference to the drawings. Therefore, the position of the patella is indicated with a circle of a broken line. In a cross-sectional view taken on an A–A' line and a side view also, the position of the patella is indicated with a half-circle.

Figure 2:
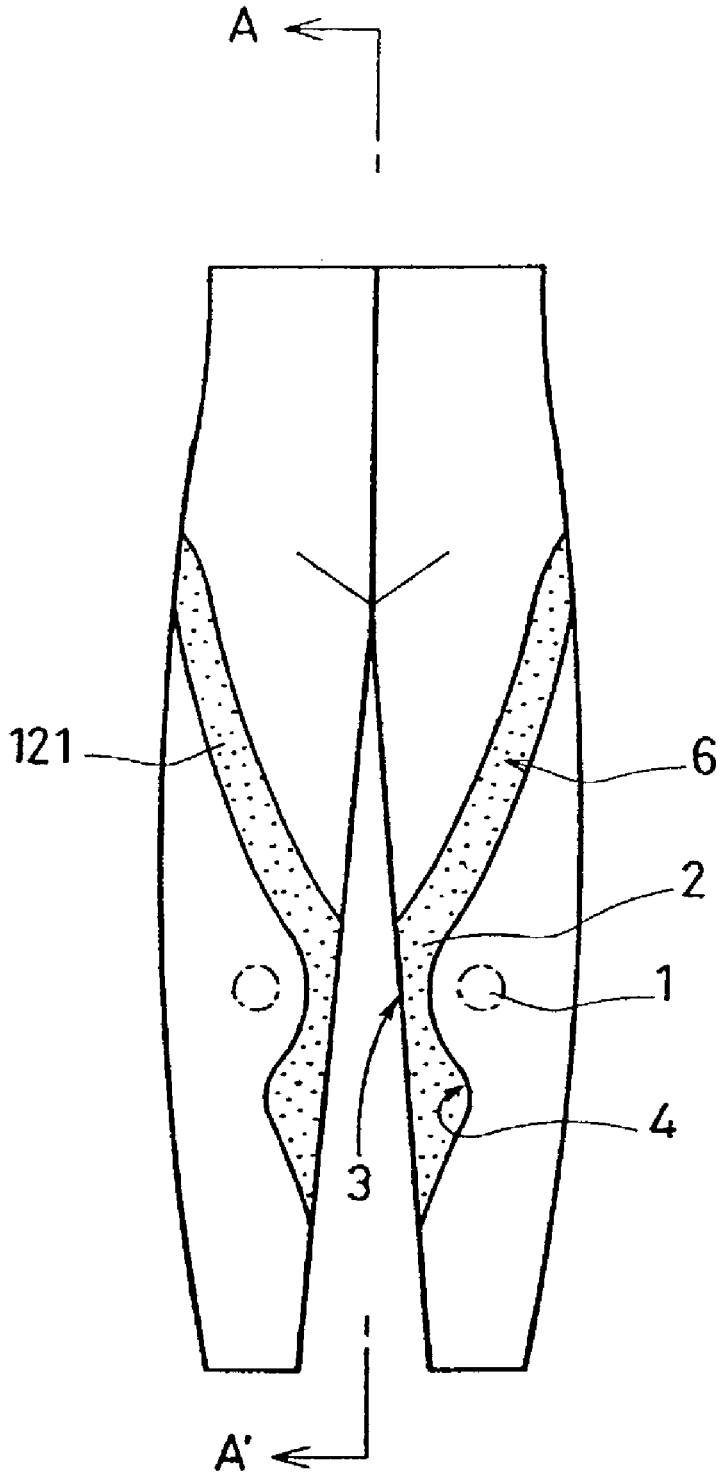
FIG. 2 is a front view of the leg support garment shown in FIG. 1.
Figure 3:
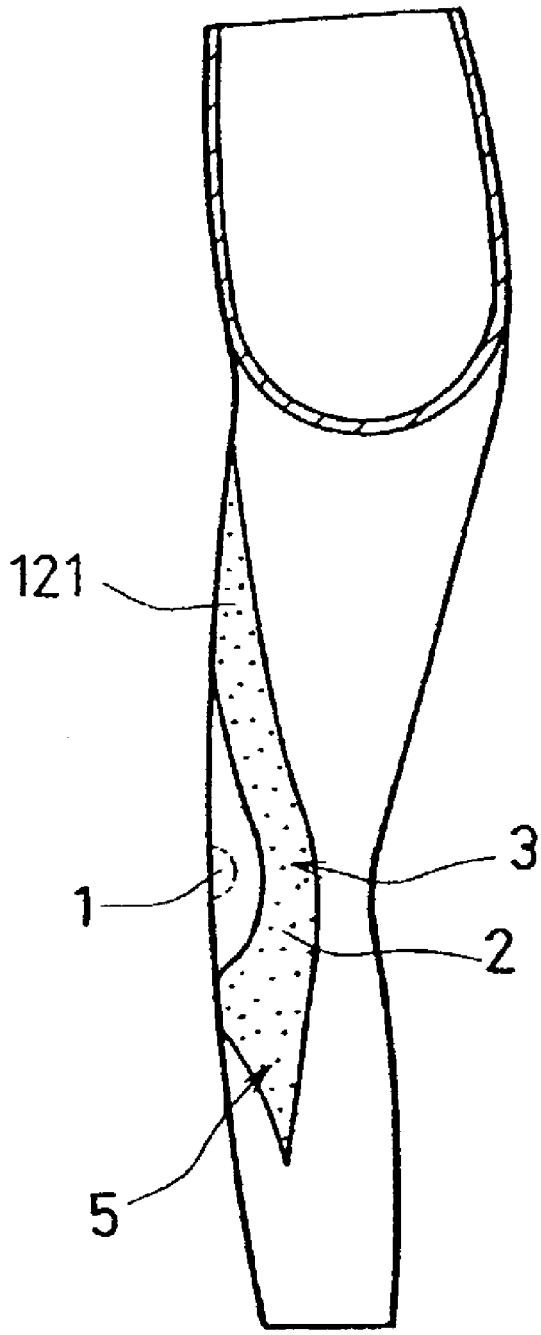
FIG. 3 is a cross-sectional view of the leg support garment taken along an A–A' line in FIG. 2.
Figure 4:
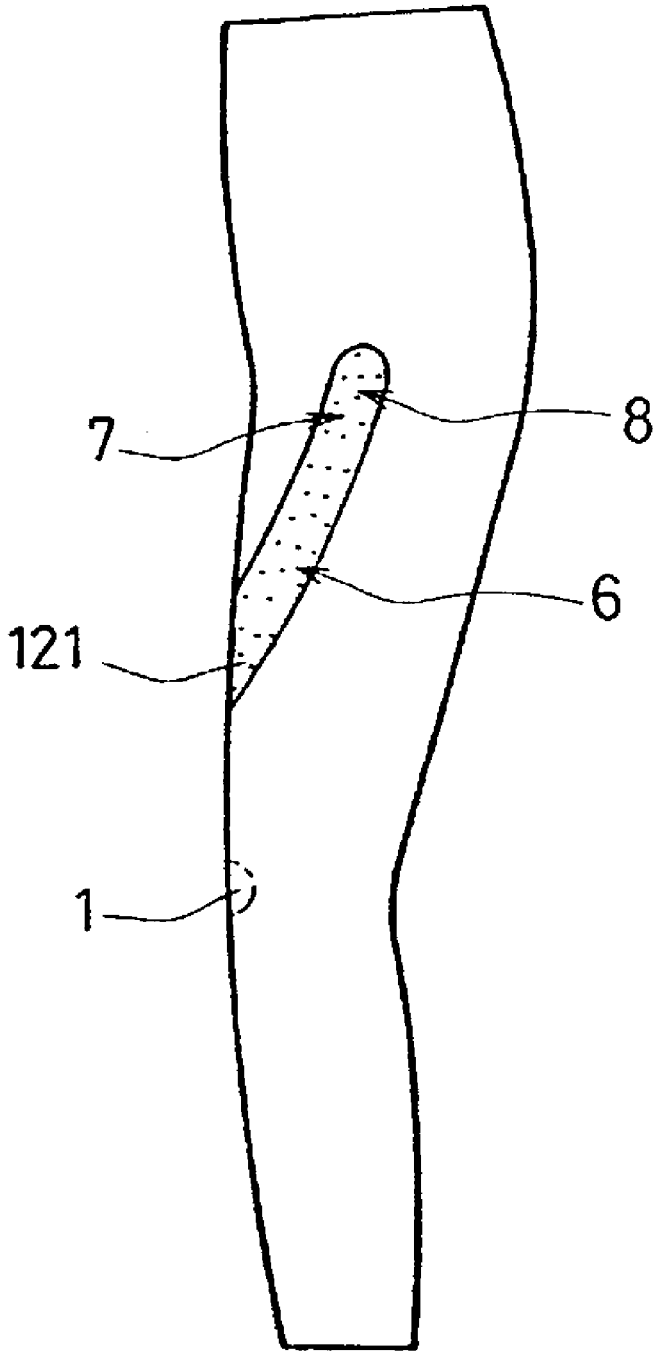
FIG. 4 is a right-side view of the leg support garment shown in FIG. 2.

FIG. 1 is a rear view of an embodiment of a tights-type leg support garment having a length capable of covering a range from a waistline to the superior side of the ankle according to the present invention (a long-type garment of this kind is hereinafter referred to as "long-tights-type garment" also). FIG. 2 is a front view of the same. FIG. 3 is a cross-sectional view of the same taken along an A–A' line in FIG. 2. FIG. 4 is a side view of the garment obtained when seen from the right side viewed in the front view (in this case, FIG. 2). Such a side view obtained when seen from the right side viewed in the front view is hereinafter referred to as the right-side view simply.

The long-tights-type leg support garment of the present invention shown in FIGS. 1 to 4 includes a stretchable part having a relatively great straining force, which includes a portion 2 expressed as the stretchable portion (A) having a relatively great straining force that is composed of a stretchable portion (A1) 121 having a relatively great straining force. The stretchable portion (A1) 121 having a relatively great straining force substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7/4) of the periphery of the patella 1 and to cover a part of an inferior region 4 of the patella 1, reaches a side 5 of the musculus gastrocnemius and the musculus soleus on the medial side, and on the superior side of the knee joint, extends from the medial side to the lateral side of the thigh via the anterior side thereof approximately along the musculus sartorius 6 toward the vicinity of the trochanter major 8, passing a superior part 7 of the musculus rectus femoris.

According to the foregoing preferred embodiment of the present invention, the stretchable portion 121 having a relatively great straining force covers a portion 4 of a part of an inferior region of the patella 1 so as to support the patella 1 as if pulling up the same from the inferior side, thereby improving the stability of the knee joint. The portion 121 further supports the musculus sartorius 6 and extends from the medial side to the lateral side of the thigh obliquely and spirally toward the vicinity of the trochanter major 8, thereby increasing the power for pulling the stretchable portion having a relatively great straining force that supports the ligamentum collateralle medialis 3. This makes it possible to provide a leg support garment having an increased power for supporting the ligamentum collateralle medialis 3, and hence, this is preferable. Furthermore, this provides the support to the musculus sartorius 6 that complements the function of the ligamentum collateralle medialis 3 as well, which is also preferable.

Figure 5:
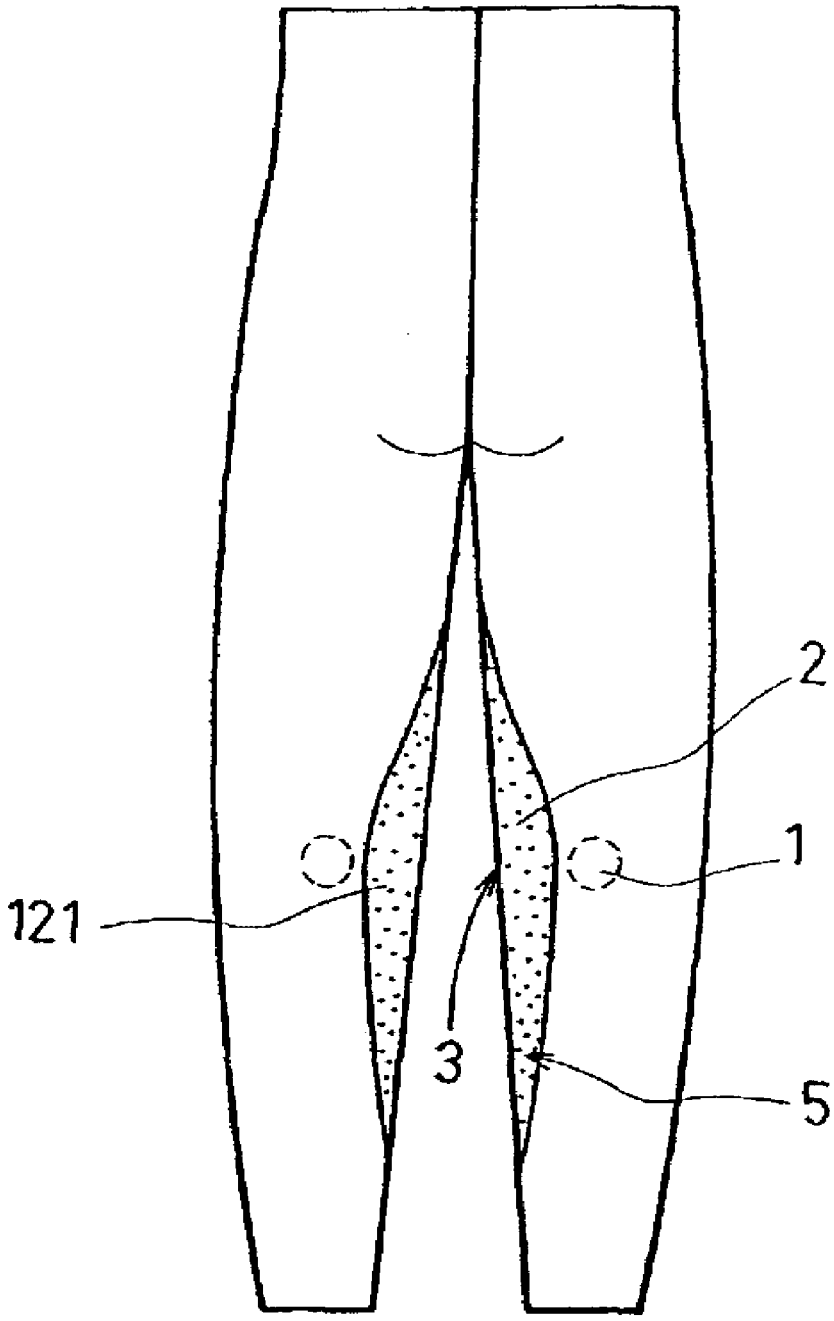
FIG. 5 is a rear view illustrating another embodiment of a long-tights-type leg support garment of the present invention.
Figure 6:
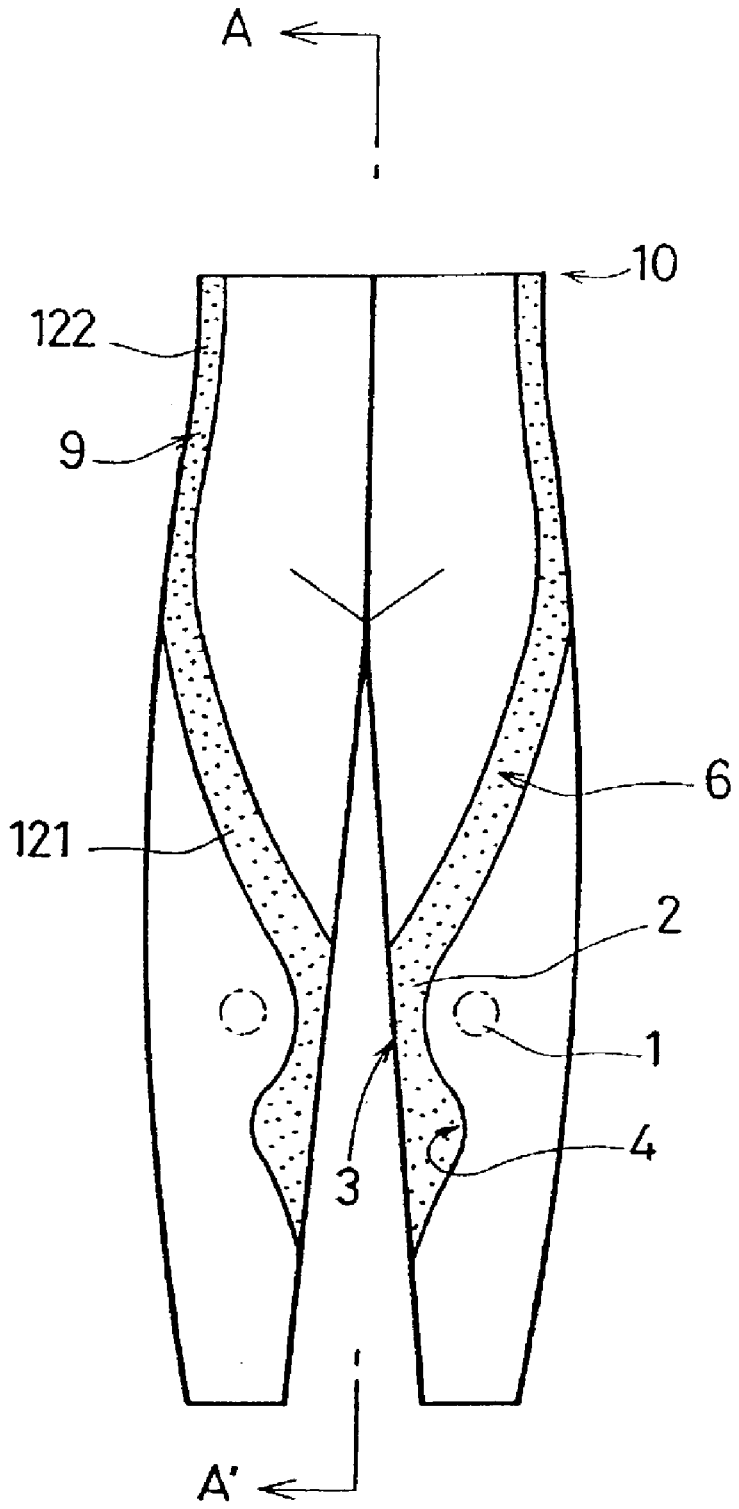
FIG. 6 is a front view of the leg support garment shown in FIG. 5
Figure 7:
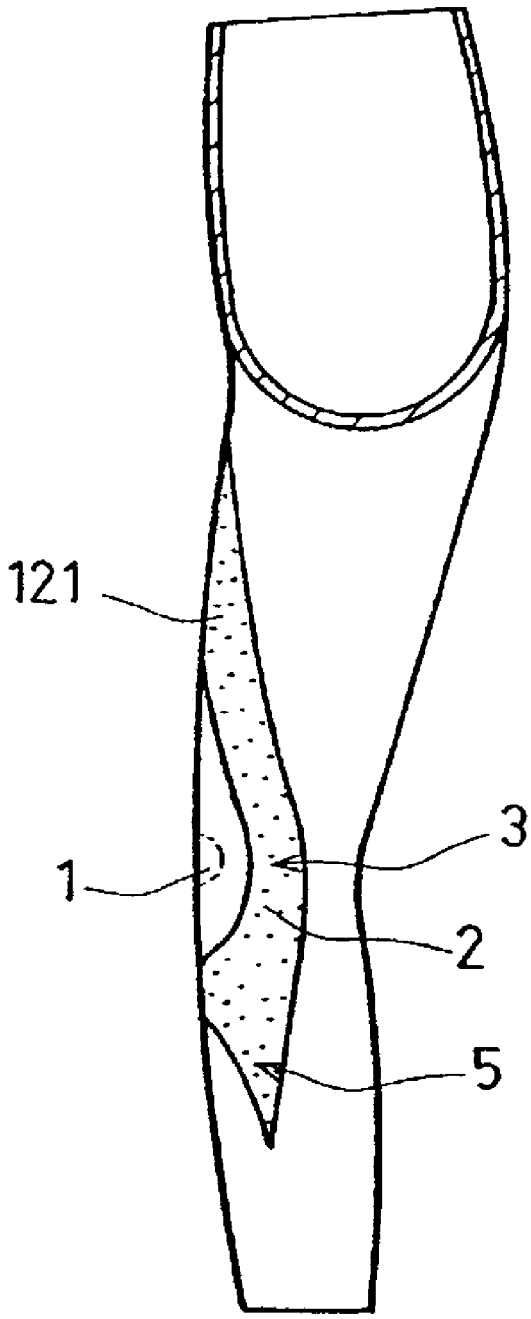
FIG. 7 is a cross-sectional view of the leg support garment taken along an A–A' line in FIG. 6.
Figure 8:
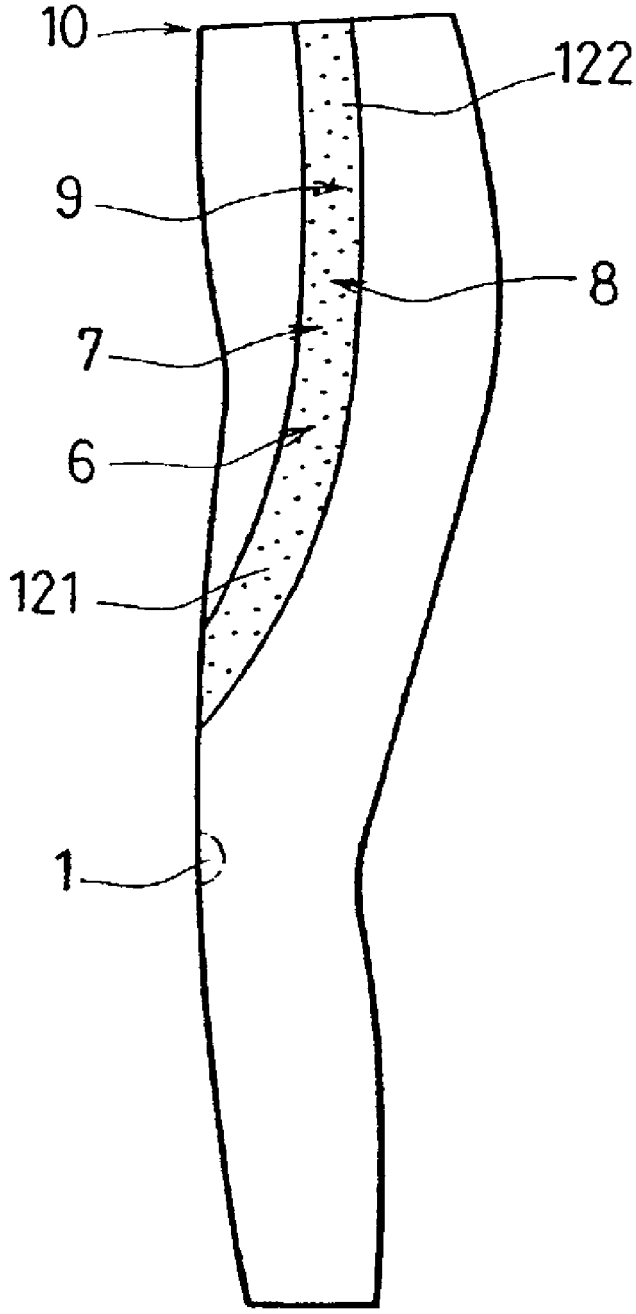
FIG. 8 is a right-side view of the leg support garment shown in FIG. 6.

FIGS. 5 to 8 are views illustrating another embodiment of a long-tights-type leg support garment of the present invention. FIG. 5 is a rear view of the same, FIG. 6 is a front view of the same, FIG. 7 is a cross-sectional view of the same taken along an A–A' line in FIG. 6, and FIG. 8 is a right-side view of the same.

The present embodiment differs from the embodiment shown in FIGS. 1 to 4 in the aspect that the portion 121 in the embodiment shown in FIGS. 1 to 4, which is expressed as the stretchable portion (A1) having a relatively great straining force, further includes a stretchable portion (A1-1) 122 having a relatively great straining force that extends from the vicinity of the trochanter major 8 to the vicinity of the waist 10 along the tractus iliotibialis 9. Therefore, the same portions as those in the embodiment shown in FIGS. 1 to 4 are designated with the same reference numerals unless otherwise specified, and descriptions of the same are omitted. In the descriptions below as well, as to the embodiments shown in the drawings, the same portions as those in the other embodiments previously shown in the drawings are designated with the same reference numerals, and descriptions of the same are omitted.

Since the foregoing preferred embodiment of the present invention further includes the stretchable portion (A1-1) 122 having a relatively great straining force, which extends from the vicinity of the trochanter major 8 to the waist 10 along the tractus iliotibialis 9, the same function as that explained with reference to FIGS. 1 to 4 is enhanced further, as well as the function of intensely pressing the trochanter major 8 is enhanced also, thereby improving the connection between the caput ossis femoris and the acetabulum. This is preferable since further providing a function of enhancing the stability of the hip joint.

Figure 9:
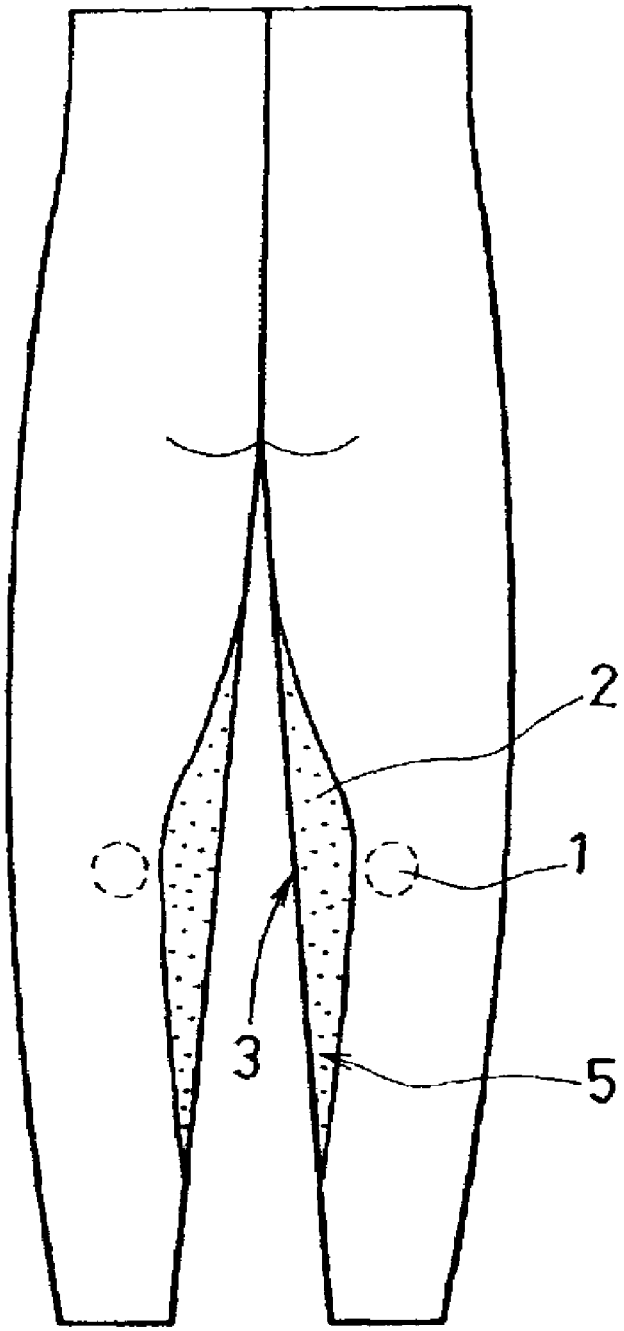
FIG. 9 is a rear view illustrating still another embodiment of a long-tights-type leg support garment of the present invention.
Figure 10:
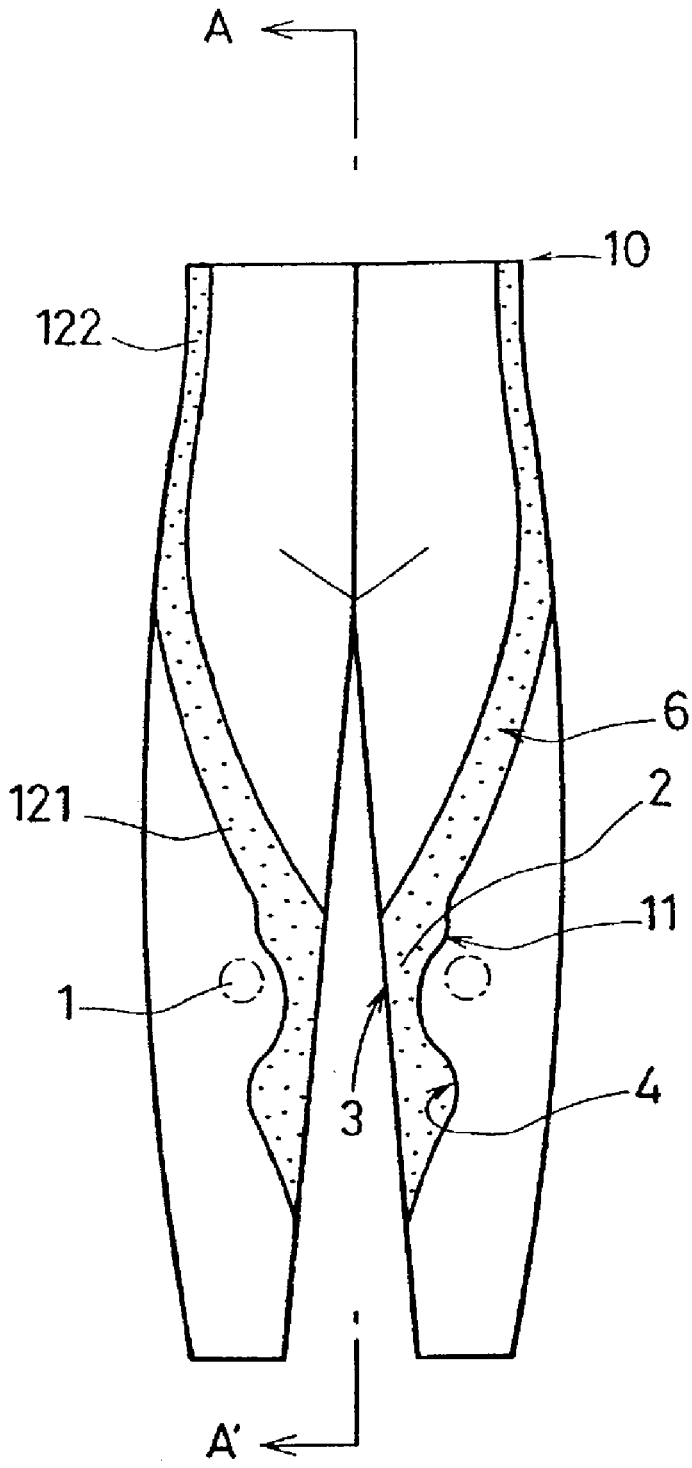
FIG. 10 is a front view of the leg support garment shown in FIG. 9
Figure 11:
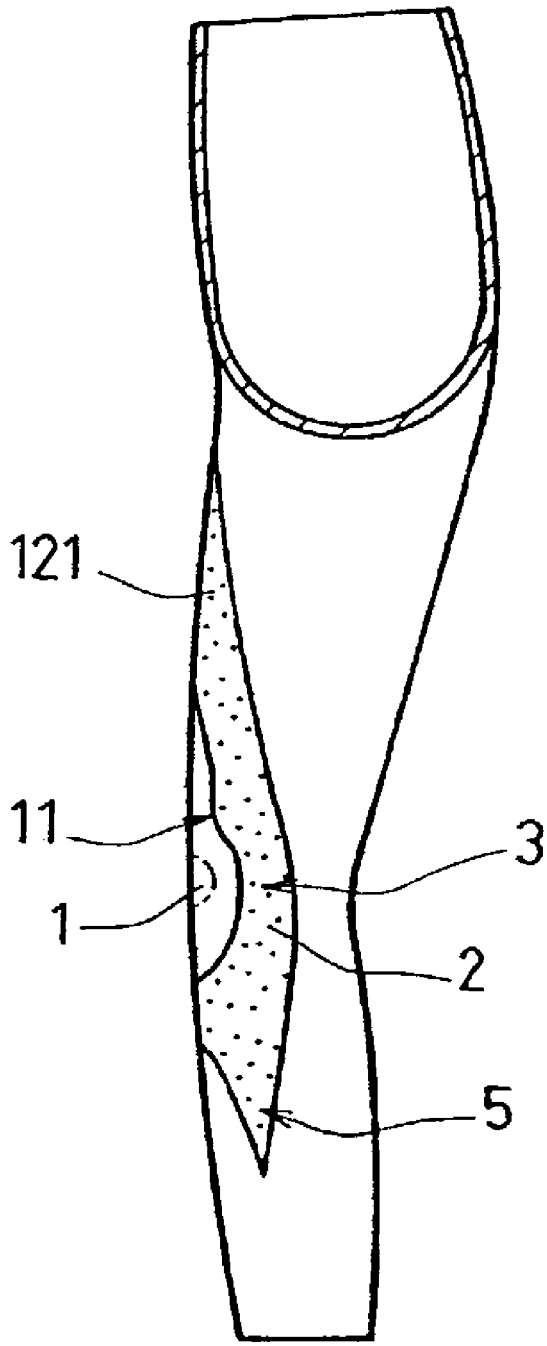
FIG. 11 is a cross-sectional view of the leg support garment taken along an A–A' line in FIG. 10.
Figure 12:
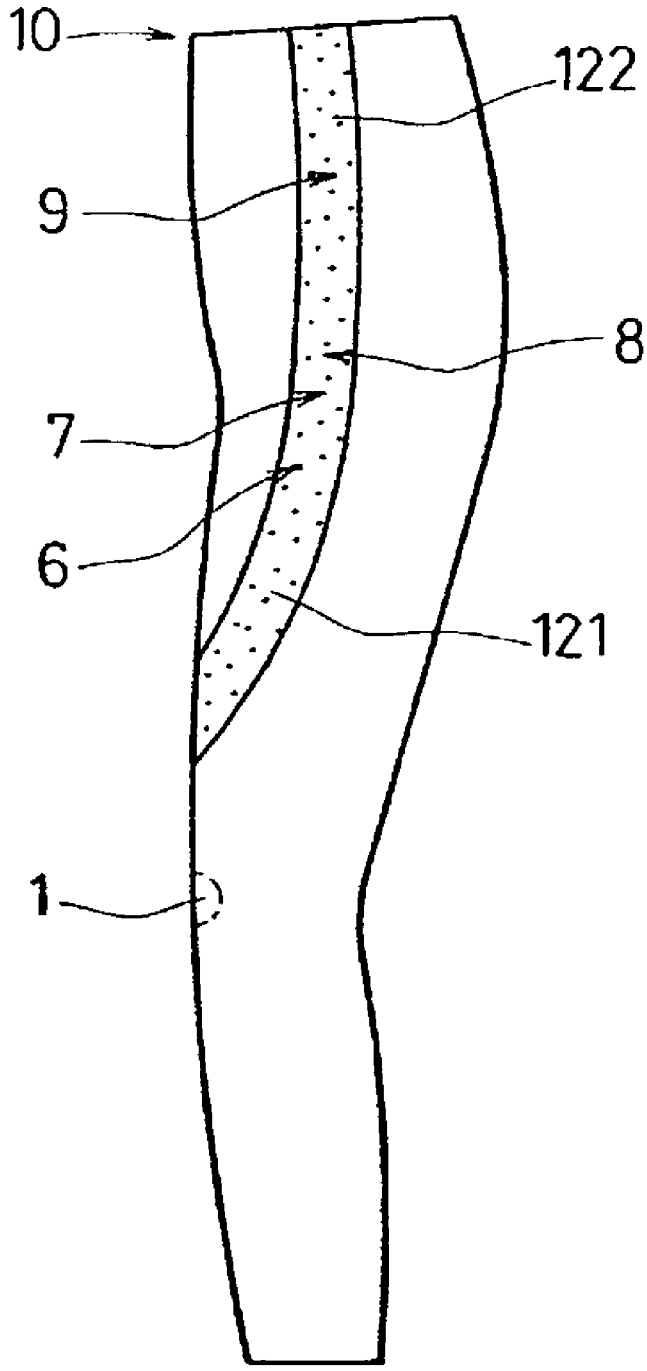
FIG. 12 is a right-side view of the leg support garment shown in FIG. 10.

Next, FIGS. 9 to 12 are views illustrating still another embodiment of a long-tights-type leg support garment of the present invention. FIG. 9 is a rear view of the same, FIG. 10 is a front view of the same, FIG. 11 is a cross-sectional view of the same taken along an A–A' line in FIG. 10, and FIG. 12 is a right-side view of the same.

The garment of the present embodiment is a garment as a modification of the embodiment shown in FIGS. 5 to 8; namely, the portion expressed as the stretchable portion (A1) 121 having a relatively great straining force further covers at least a part of a superior region 11 of the patella 1 by extending thereto approximately from a peripheral region of the patella 1 on the medial side of the patella 1.

With the foregoing preferred embodiment of the present invention, the same function as that explained with reference to FIGS. 5 to 8 is exhibited. Besides, since the stretchable portion (A1) 121 having a relatively great straining force also covers at least a part of the superior region 11 of the patella 1, the knee joint is supported therefrom as well as from the inferior region 4 of the patella 1. Therefore, it allows more stability of the knee joint to be achieved, which is preferable.

Figure 13:
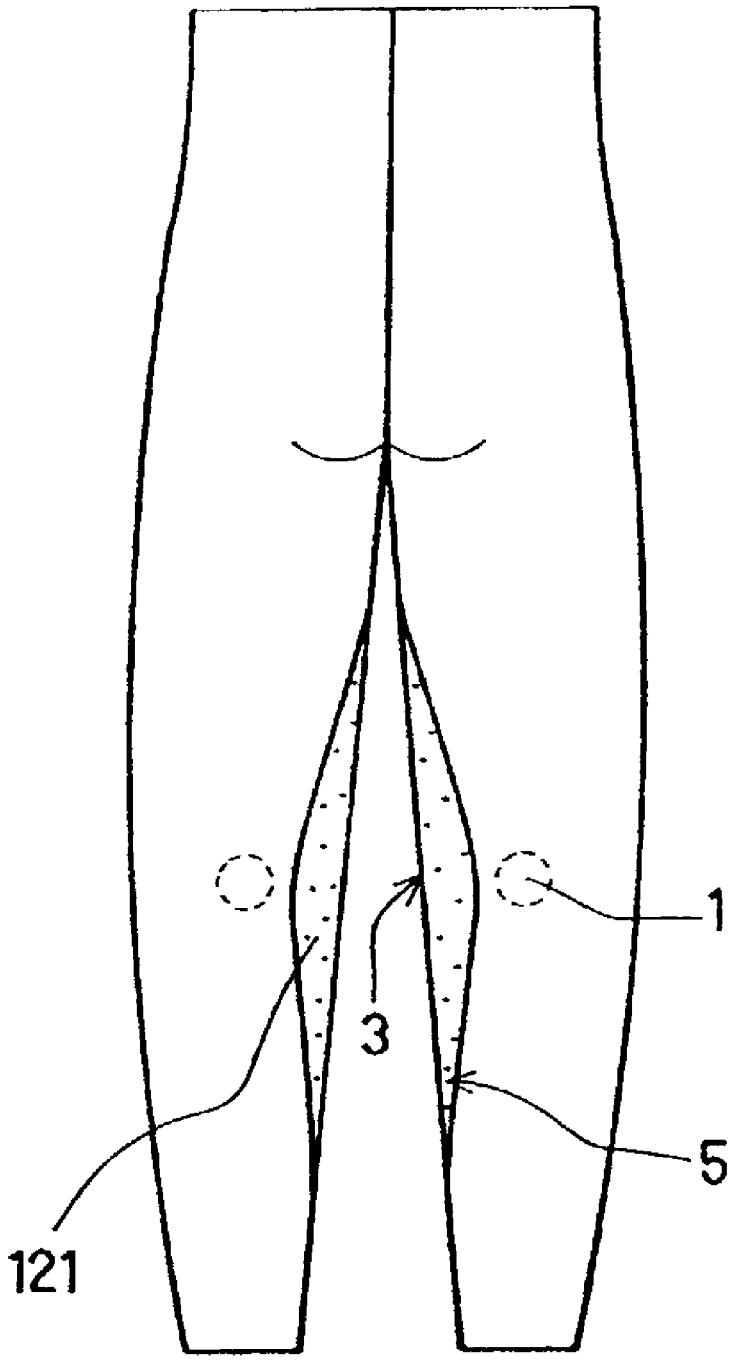
FIG. 13 is a rear view illustrating still another embodiment of a long-tights-type leg support garment of the present invention.
Figure 14:
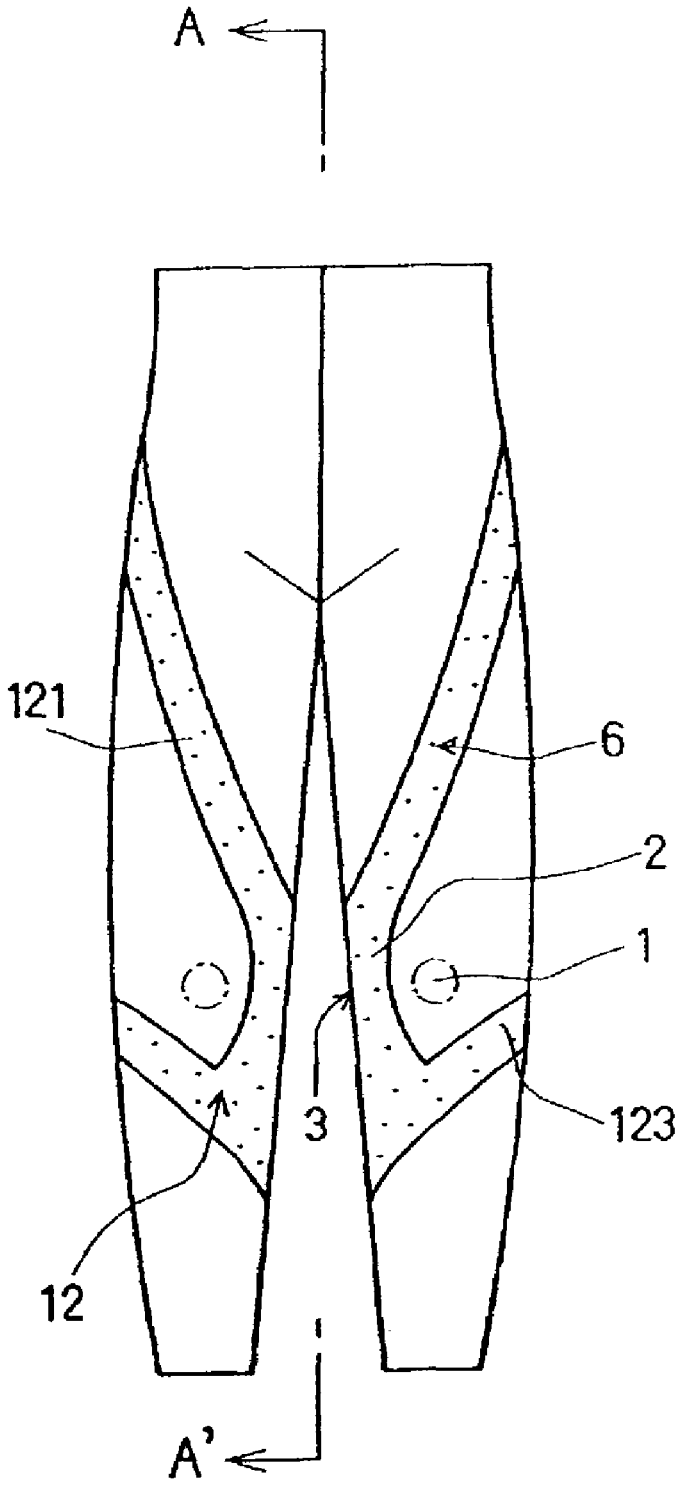
FIG. 14 is a front view of the leg support garment shown in FIG. 13
Figure 15:
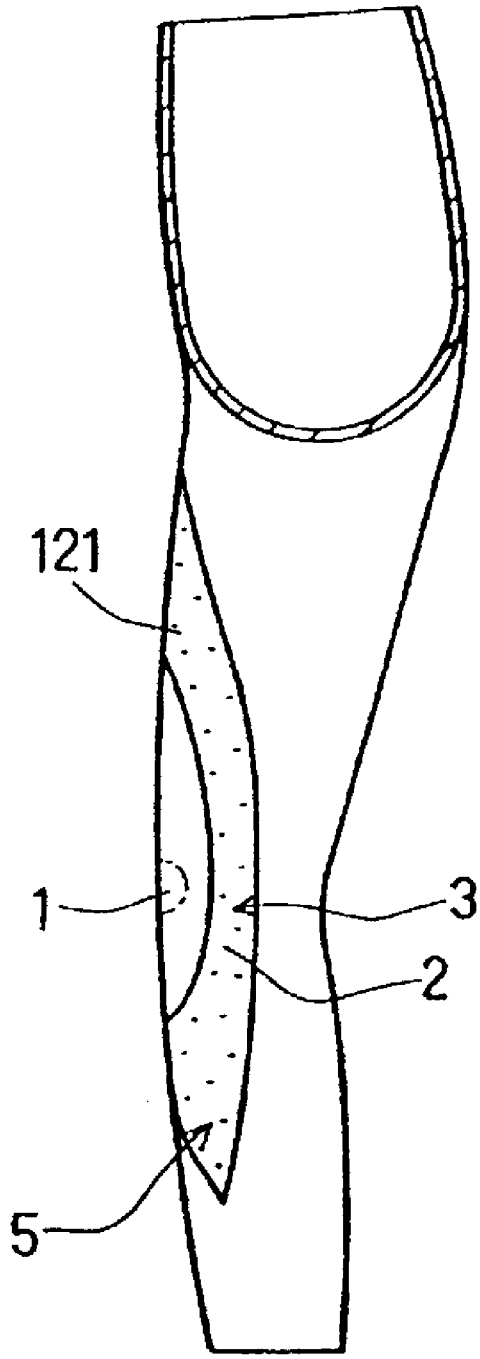
FIG. 15 is a cross-sectional view of the leg support garment taken along an A–A' line in FIG. 14.
Figure 16:
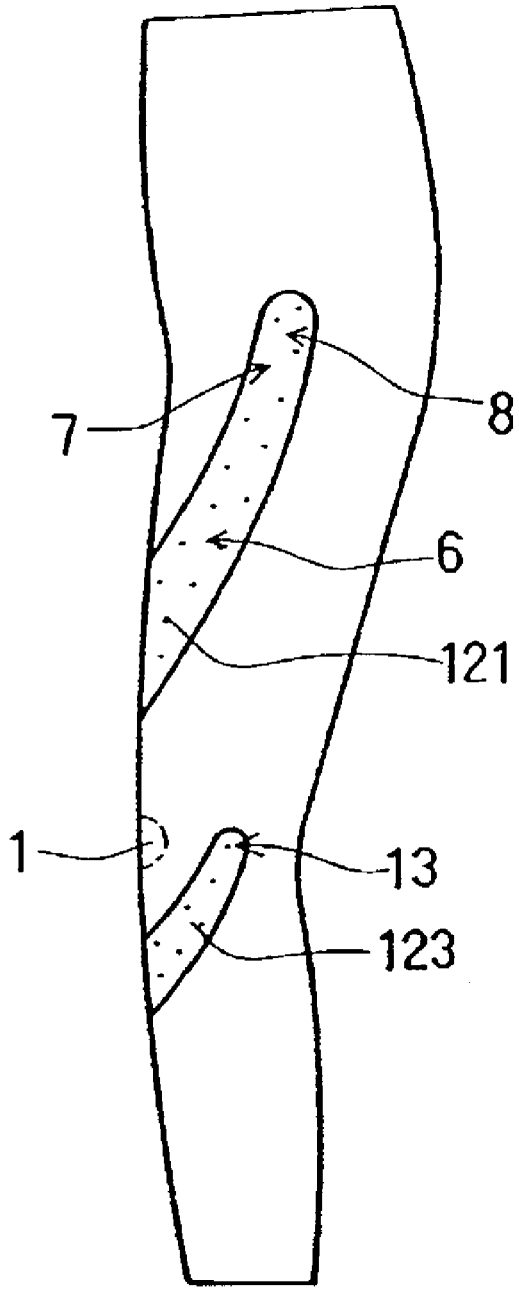
FIG. 16 is a right-side view of the leg support garment shown in FIG. 14.

Next, FIGS. 13 to 16 are views illustrating still another embodiment of a long-tights-type leg support garment of the present invention. FIG. 13 is a rear view of the same, FIG. 14 is a front view of the same, FIG. 15 is a cross-sectional view of the same taken along an A–A' line in FIG. 14, and FIG. 16 is a right-side view of the same.

The garment of the present embodiment is a garment as a modification of the embodiment shown in FIGS. 1 to 4; namely, the portion expressed as the stretchable portion (A1) 121 having a relatively great straining force further includes a stretchable portion (A1-2) 123 having a relatively great straining force. The stretchable portion (A1-2) 123 having a relatively great straining force extends obliquely upward from a side of the musculus gastrocnemius on the medial side through the vicinity of a periphery 12 of the patella on the inferior side of the patella to the lateral side 13 of the patella 1.

With the foregoing preferred embodiment of the present invention, the same function as that explained with reference to FIGS. 1 to 4 is exhibited. Besides, the periphery of the patella 1 is covered from a side of the musculus gastrocnemius on the medial side, i.e., from the inferior medial side, and a power of pulling up the same in an obliquely upward direction is exerted thereto. Therefore, this provides more stability of the knee joint, and hence, the present embodiment is preferable.

Figure 17:
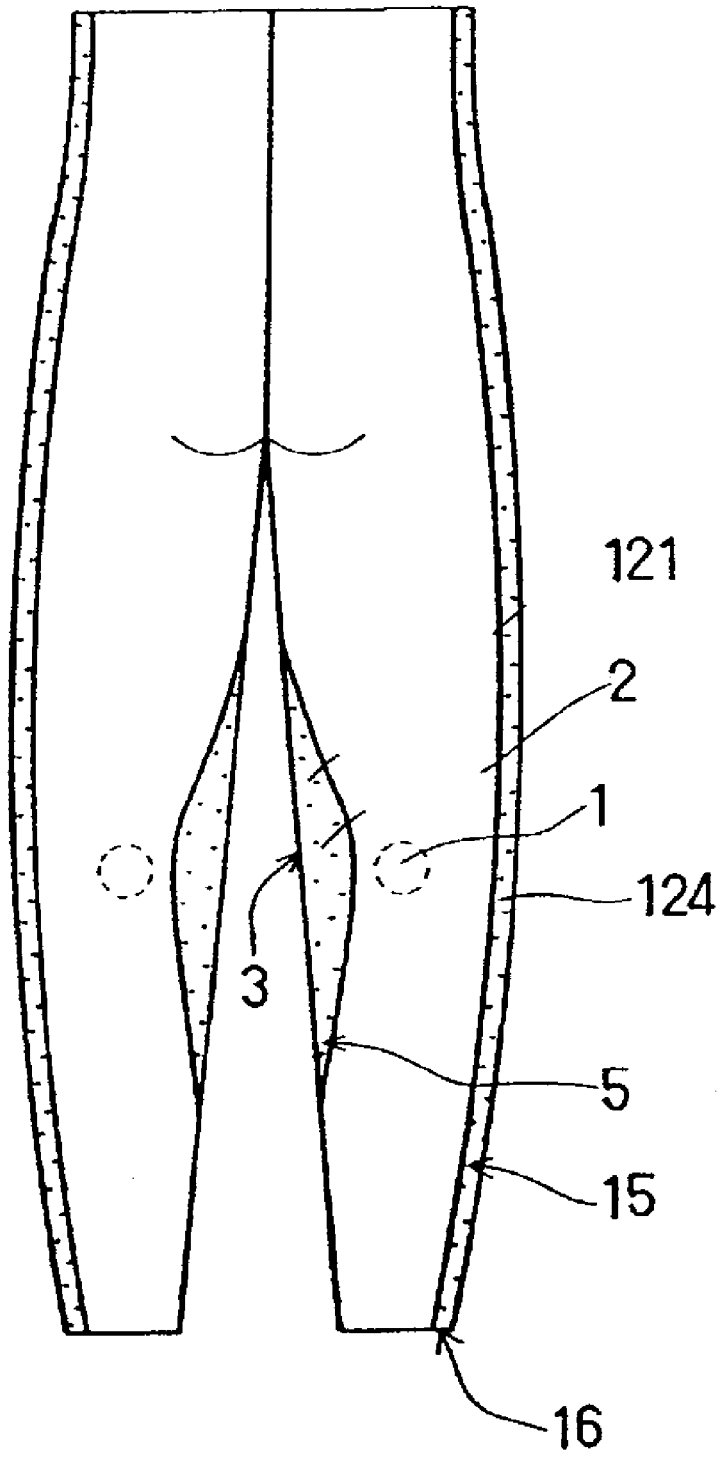
FIG. 17 is a rear view illustrating still another embodiment of a long-tights-type leg support garment of the present invention.
Figure 18:
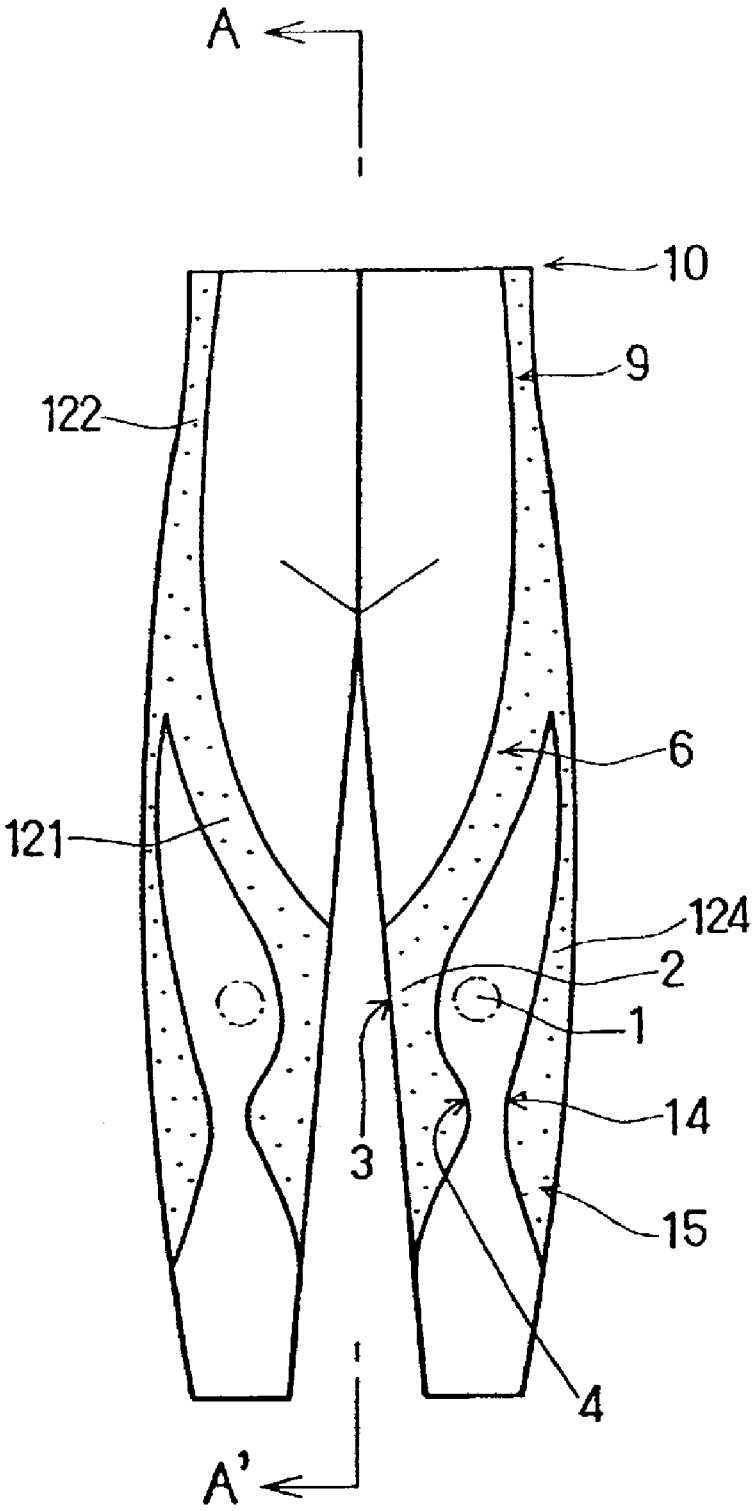
FIG. 18 is a front view of the leg support garment shown in FIG. 17
Figure 19:
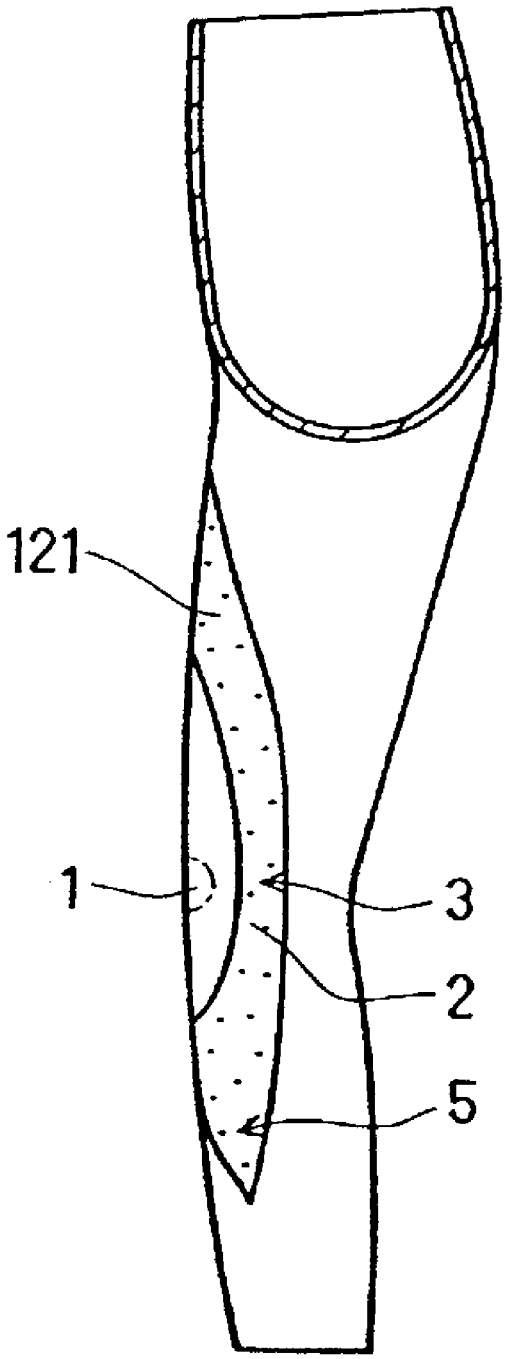
FIG. 19 is a cross-sectional view of the leg support garment taken along an A–A' line in FIG. 18.
Figure 20:
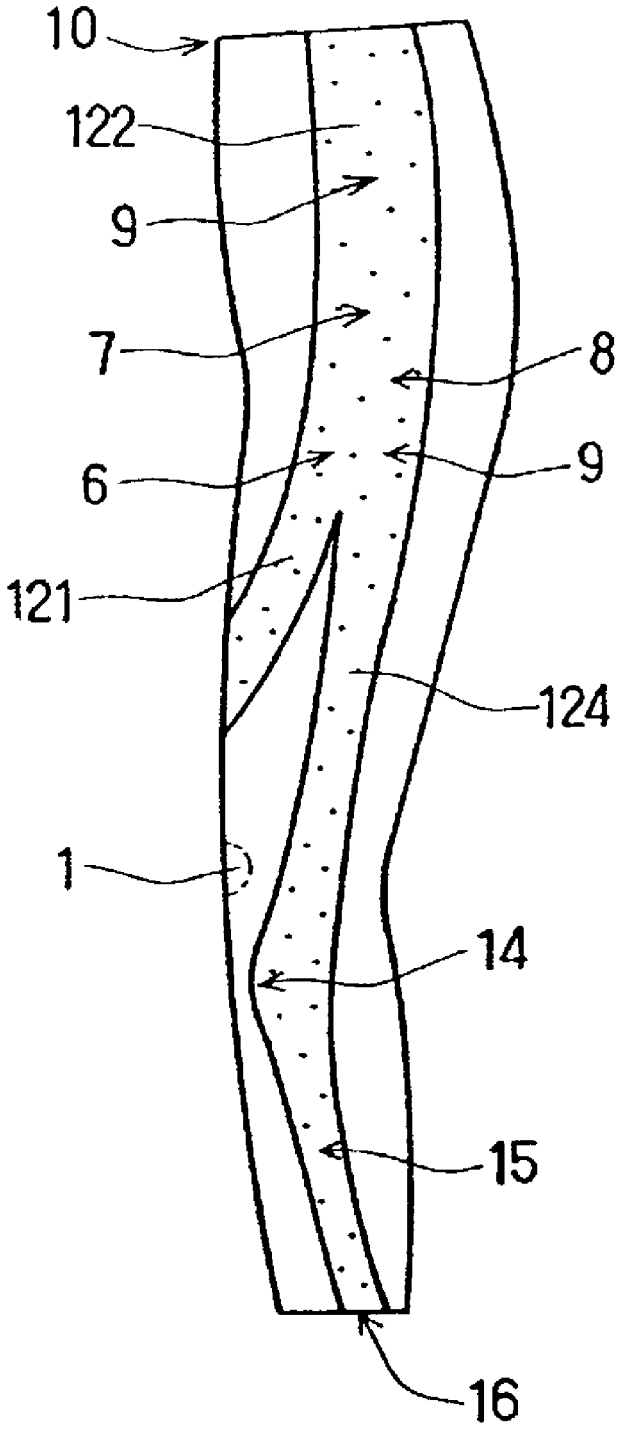
FIG. 20 is a right-side view of the leg support garment shown in FIG. 18.

Next, FIGS. 17 to 20 are views illustrating still another embodiment of a long-tights-type leg support garment of the present invention. FIG. 17 is a rear view of the same, FIG. 18 is a front view of the same, FIG. 19 is a cross-sectional view of the same taken along an A–A' line in FIG. 18, and FIG. 20 is a right-side view of the same.

The garment of the present embodiment is a garment as a modification of the embodiment shown in FIGS. 5 to 8; namely, to the garment shown in FIGS. 5 to 8, a stretchable portion (B) having a relatively great straining force as described below is added. Namely, the garment further includes a stretchable portion (B) 124 having a relatively great straining force. The stretchable 143 (B) 124 having a relatively great straining force extends from a vicinity of the trochanter major 8 downward approximately along the tractus iliotibialis 9 to the lateral side of the patella 1, covers a part of an inferior region 14 of the patella extending from the lateral side thereof, and passes a side 15 of the musculus gastrocnemius and the musculus soleus on the lateral side, thereby reaching the superior side 16 of the malleolus lateralis. The upper stretchable portion (A1-1) 122 having a relatively greater straining force has a slightly greater width as compared with that shown in FIGS. 5 to 8, at a position where the stretchable portion (B) 124 having a relatively great straining force and the stretchable portion (A1) 121 having a relatively great straining force are united therewith.

With the foregoing preferred embodiment of the present invention, the same function as that explained with reference to FIGS. 5 to 8 is exhibited. Besides, since the stretchable portion (B) 124 having a relatively great straining force is further provided, the knee and leg are supported from the both sides at the femoral region and the lower leg region, and further, the musculus gastrocnemius and the musculus soleus are supported from their sides without hindering their actions. Furthermore, the function of pressing the trochanter major 8 is enhanced further, thereby improving the connection between the caput ossis femoris and the acetabulum. Therefore, this reinforces a function of enhancing the stability of the hip joint.

Figure 21:
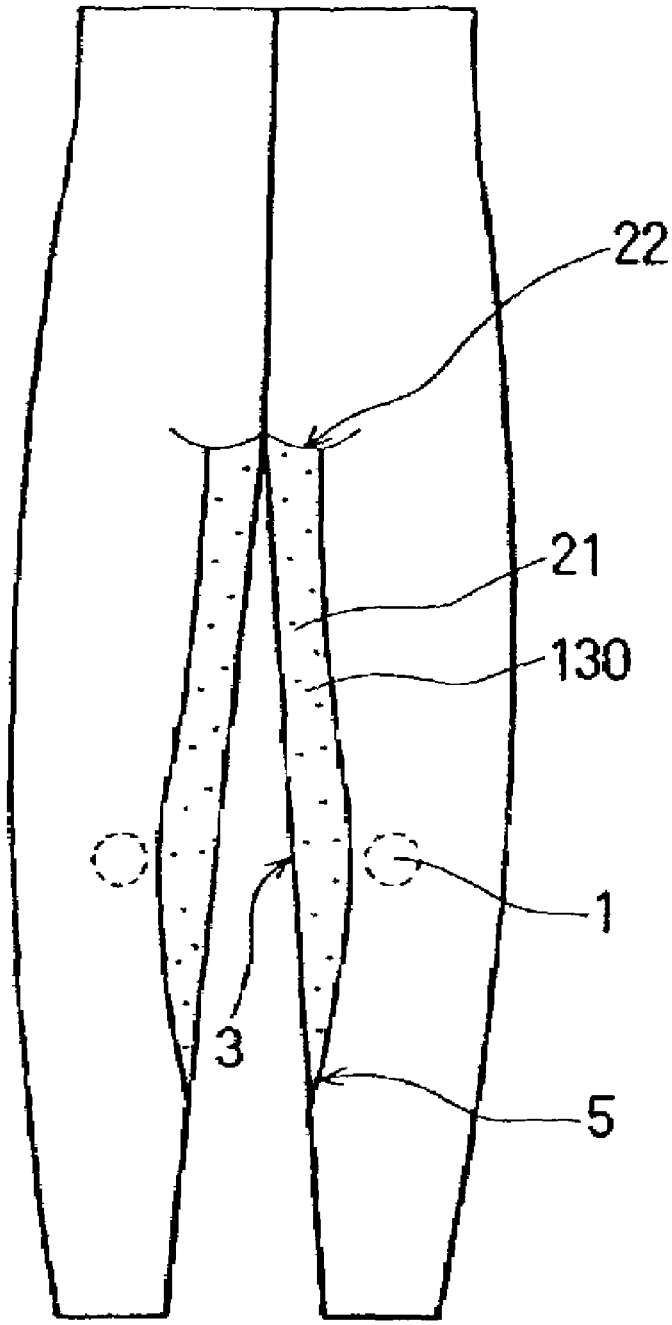
FIG. 21 is a rear view illustrating still another embodiment of a long-tights-type leg support garment of the present invention.
Figure 22:
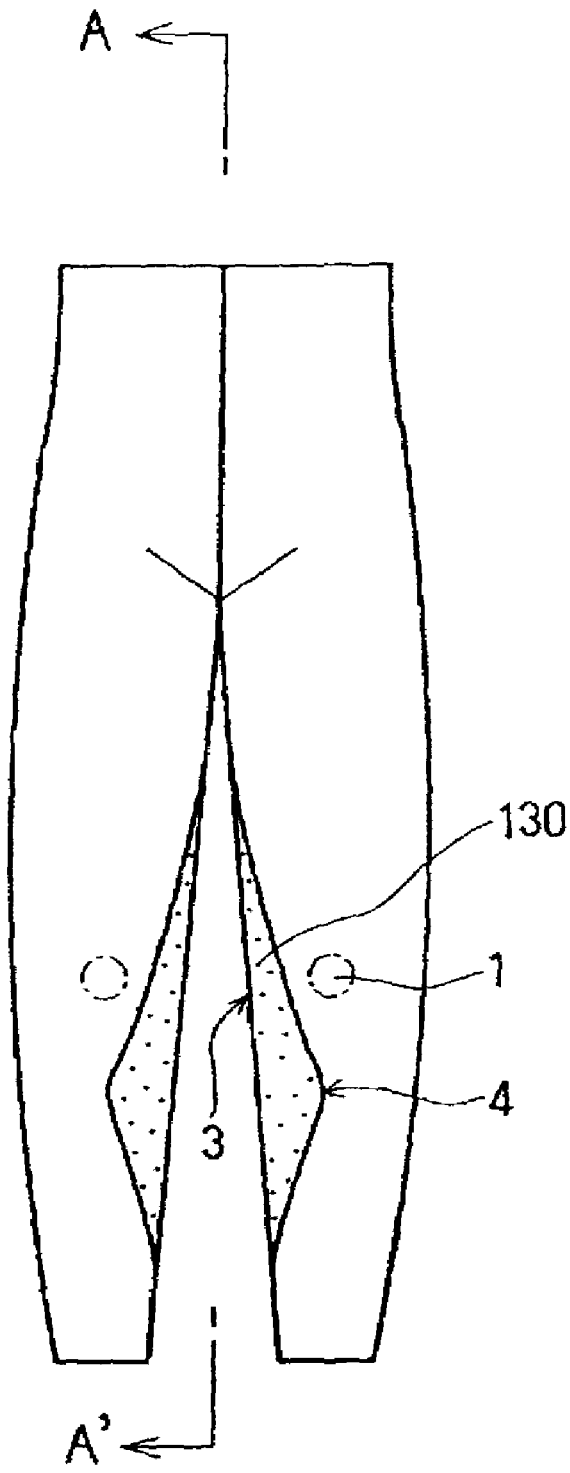
FIG. 22 is a front view of the leg support garment shown in FIG. 21
Figure 23:
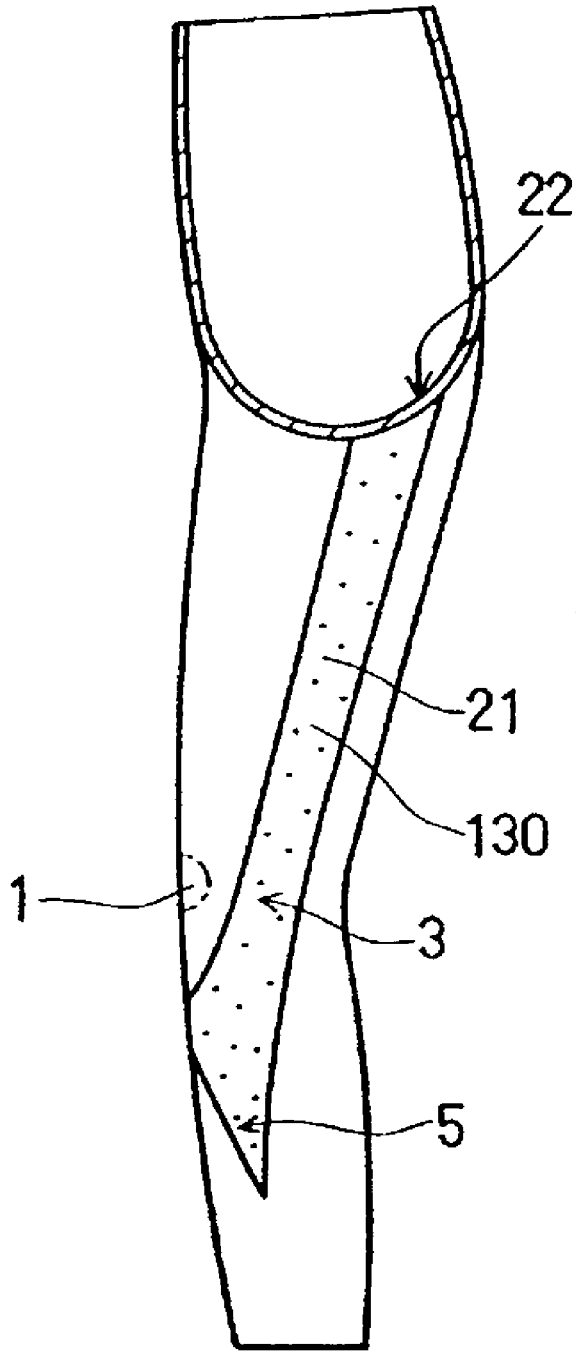
FIG. 23 is a cross-sectional view of the leg support garment taken along an A–A' line in FIG. 22.
Figure 24:
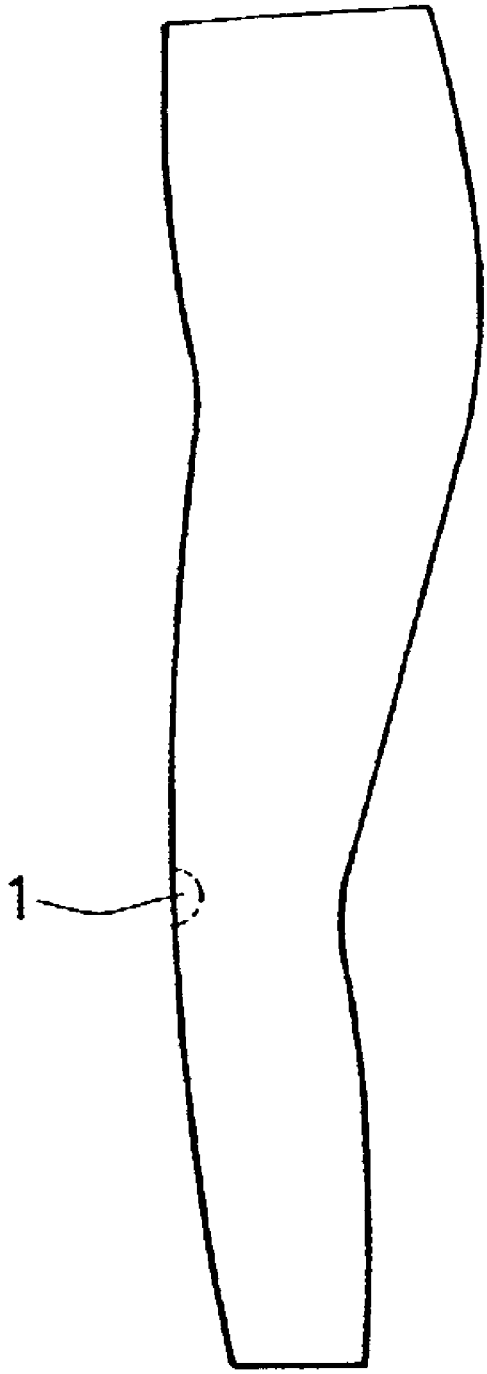
FIG. 24 is a right-side view of the leg support garment shown in FIG. 22.

Next, FIGS. 21 to 24 are views illustrating still another embodiment of a long-tights-type leg support garment of the present invention. FIG. 21 is a rear view of the same, FIG. 22 is a front view of the same, FIG. 23 is a cross-sectional view of the same taken along an A–A' line in FIG. 22, and FIG. 24 is a right-side view of the same The garment of the present embodiment is a leg support garment in which the portion expressed as the stretchable portion (A) having a relatively great straining force is composed of a stretchable portion (A2) 130 having a relatively great straining force. The stretchable portion (A2) 130 having a relatively great straining force substantially covers the ligamentum collateralle 3 on the medial side of the knee joint of the human body, and extends approximately along a vicinity of a periphery of the patella 1 on the medial side thereof so as to surround the patella 1 through not less than approximately ¼ of the periphery of the patella 1 and to cover a part of an inferior region 4 of the patella 1. Then, it reaches a side 5 of the musculus gastrocnemius and the musculus soleus on the medial side. Furthermore, on the superior side of the knee joint, the stretchable portion (A2) having a relatively great straining force extends through the thigh approximately along the musculus semitendinosus 21 to the vicinity of the sulcus gluteus 22.

The foregoing preferred embodiment allows the stretchable portion 130 having a relatively great straining force to cover a part of the inferior region 4 of the patella 1, thereby support the patella 1 as if pulling up the patella 1 from the inferior side thereof. As a result, the stability of the knee joint is improved. Furthermore, the embodiment allows the portion 130 to support the musculus semitendinosus 21 that is located on the medial side of the thigh, thereby increasing the power of pulling the stretchable portion having a relatively great straining force that supports the ligamentum collateralle medialis 3. Consequently, a leg support garment with an increased power for supporting w the ligamentum collateralle medialis 3 is provided, which is preferable. Furthermore, the musculus semitendinosus that complements the function of the ligamentum collateralle medialis is supported, which is also preferable.

Figure 25:
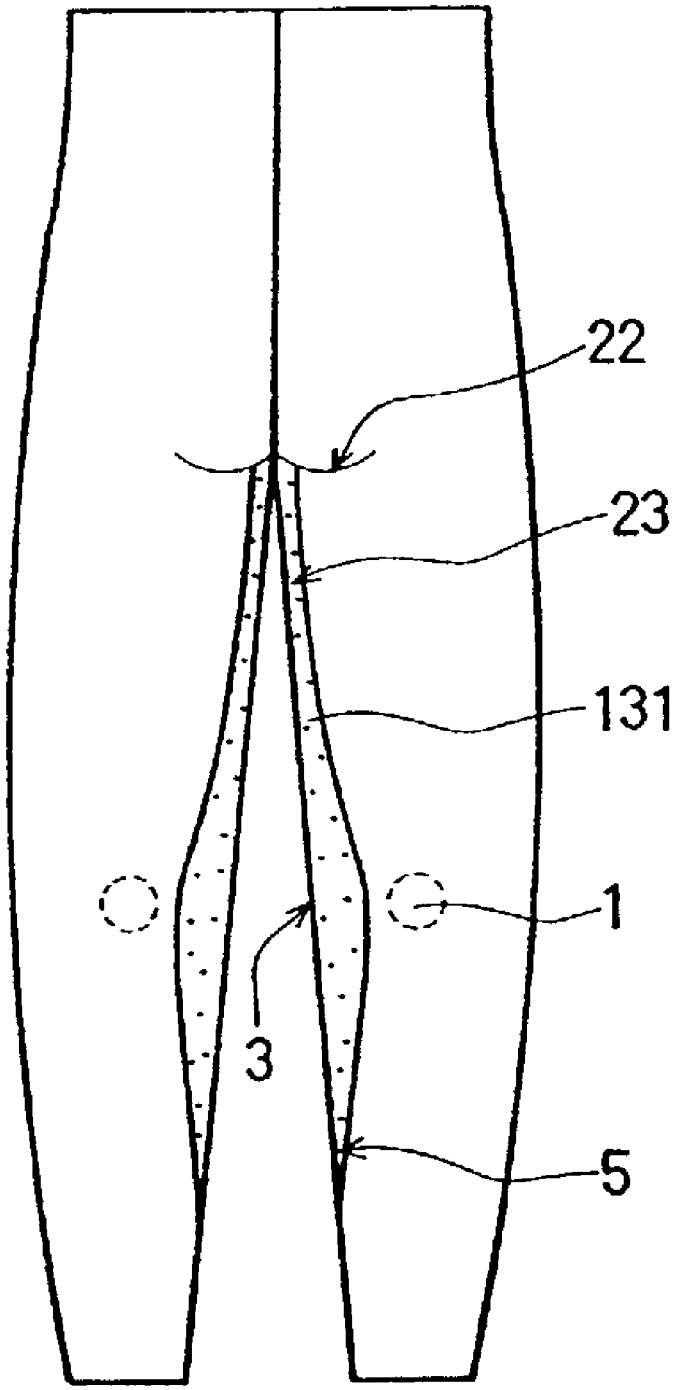
FIG. 25 is a rear view illustrating still another embodiment of a long-tights-type leg support garment of the present invention.
Figure 26:
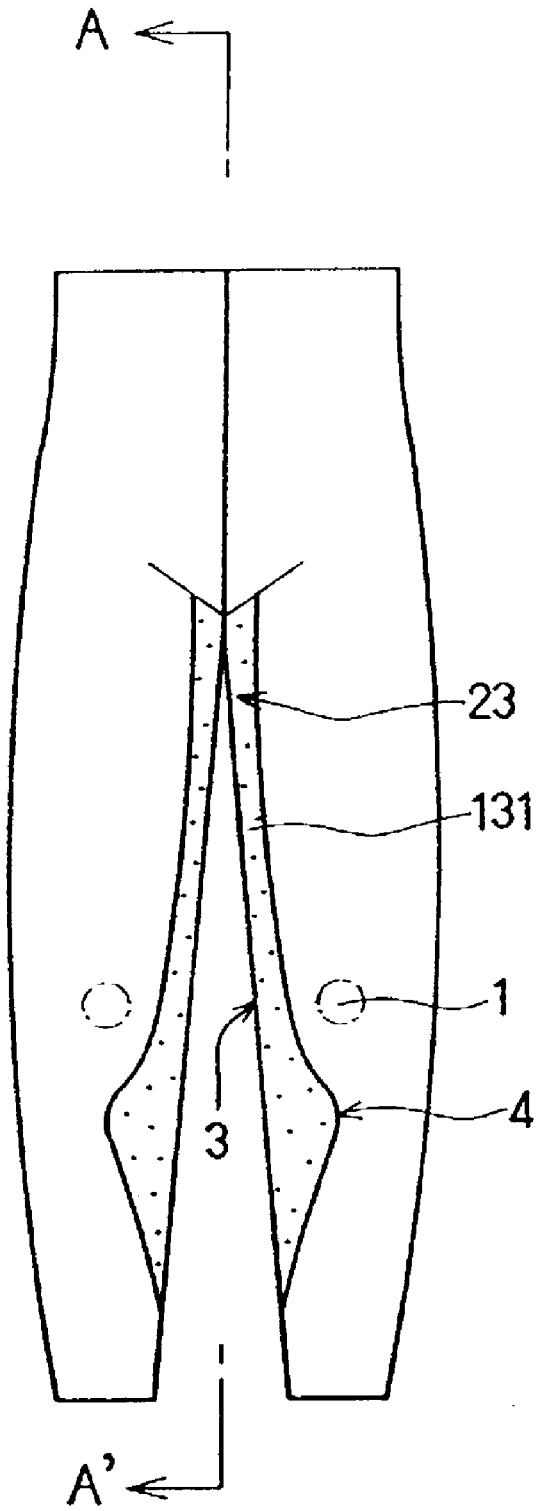
FIG. 26 is a front view of the leg support garment shown in FIG. 25
Figure 27:
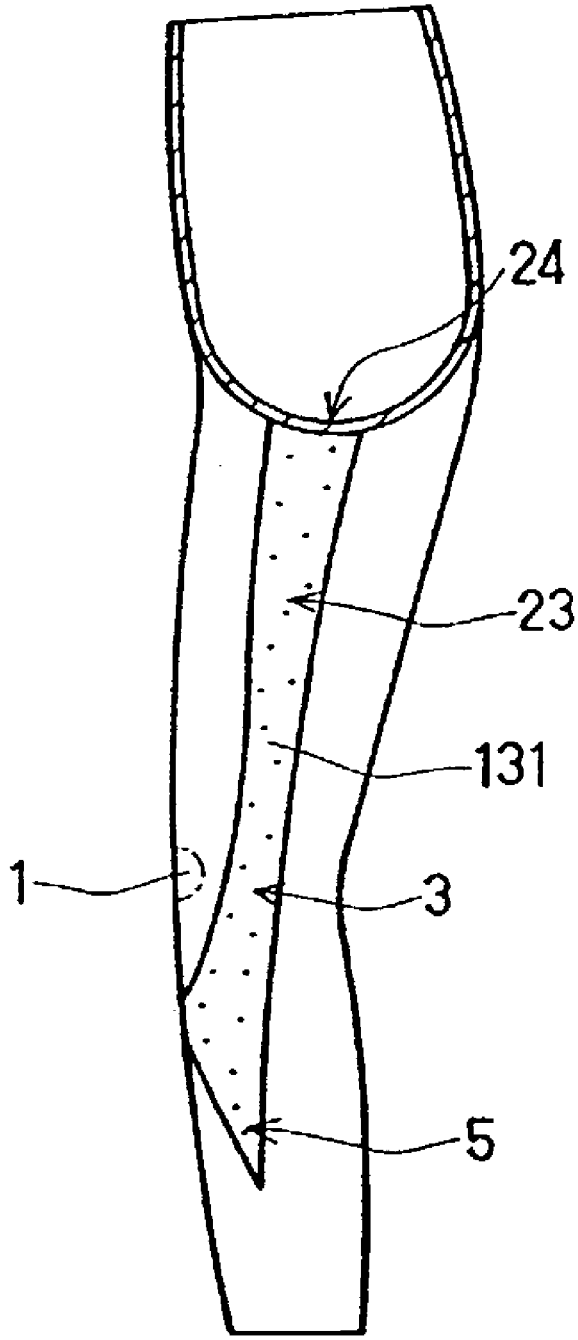
FIG. 27 is a cross-sectional view of the leg support garment taken along an A–A' line in FIG. 26.
Figure 28:
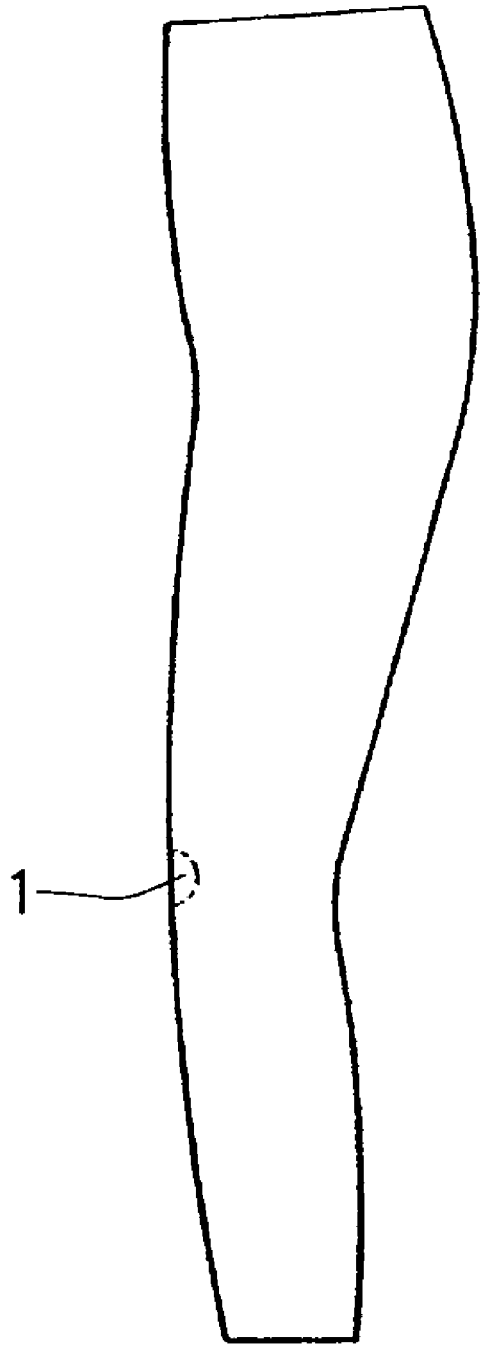
FIG. 28 is a right-side view of the leg support garment shown in FIG. 26.

Next, FIGS. 25 to 28 are views illustrating still another embodiment of a long-tights-type leg support garment of the present invention. FIG. 25 is a rear view of the same, FIG. 26 is a front view of the same, FIG. 27 is a cross-sectional view of the same taken along an A–A' line in FIG. 26, and FIG. 28 is a right-side view of the same.

The garment of the present embodiment is a leg support garment in which the portion expressed as the stretchable portion (A) having a relatively great straining force is composed of a stretchable portion (A2) 131 having a relatively great straining force. The stretchable portion (A2) 131 having a relatively great straining force substantially covers the ligamentum collateralle 3 on the medial side of the knee joint of the human body, and extends approximately along a vicinity of a periphery of the patella 1 on the medial side thereof so as to surround the patella 1 through not less than approximately ¼ of the periphery of the patella 1 and to cover a part of an inferior region 4 of the patella 1. Then, it reaches a side 5 of the musculus gastrocnemius and the musculus soleus on the medial side. Furthermore, on the superior side of the knee joint, the portion (A2) 131 passes through the thigh approximately along the musculus gracilis 23, and reaches the vicinity of the crotch 24.

The foregoing preferred embodiment allows the stretchable portion 131 having a relatively great straining force to cover a part of the inferior region 4 of the patella 1, thereby support the patella 1 as if pulling up the patella 1 from the inferior side thereof. As a result, the stability of the knee joint is improved. Furthermore, the embodiment allows the portion 131 to support the musculus gracilis 23 that is located on the medial side of the thigh, thereby increasing the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, the musculus gracilis that complements the function of the ligamentum collateralle medialis is supported, which is preferable.

Figure 29:
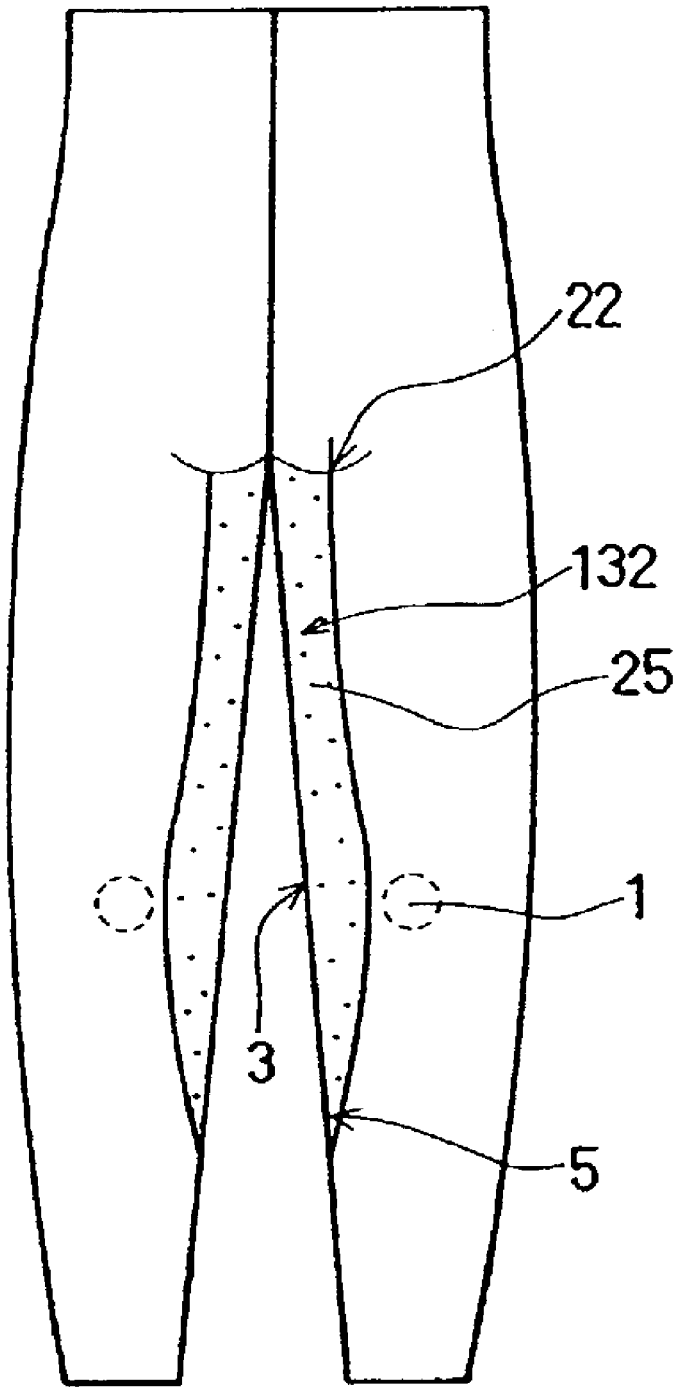
FIG. 29 is a rear view illustrating still another embodiment of a long-tights-type leg support garment of the present invention.
Figure 30:
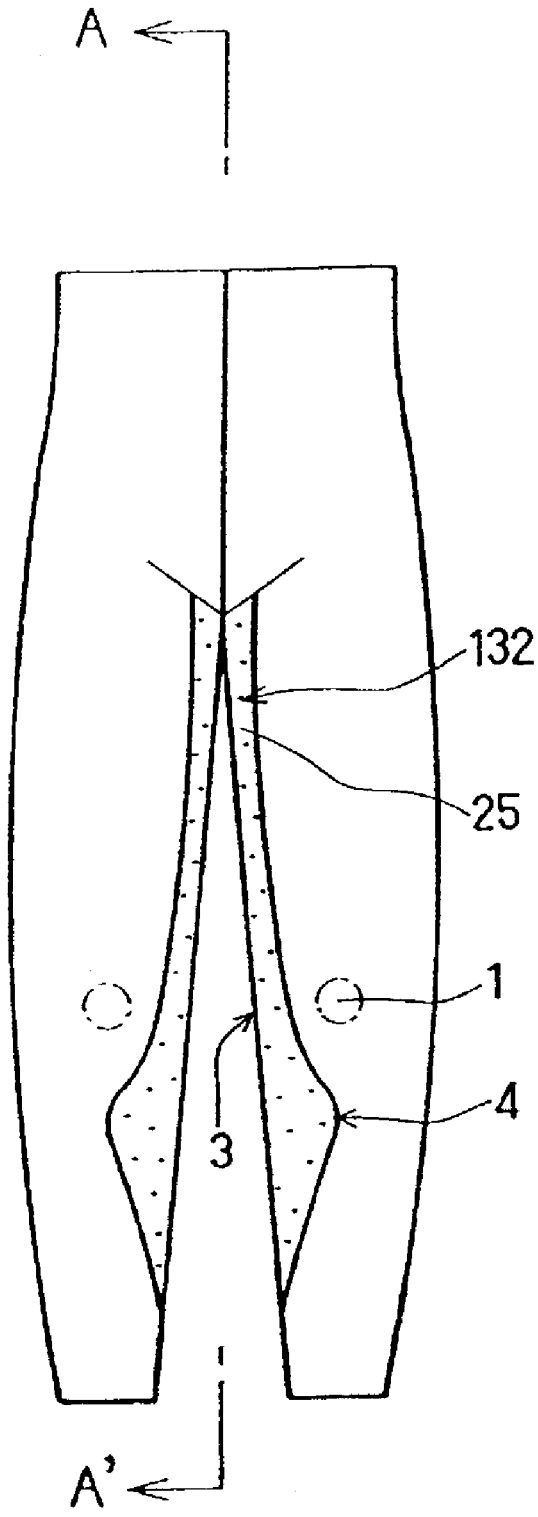
FIG. 30 is a front view of the leg support garment shown in FIG. 29
Figure 31:
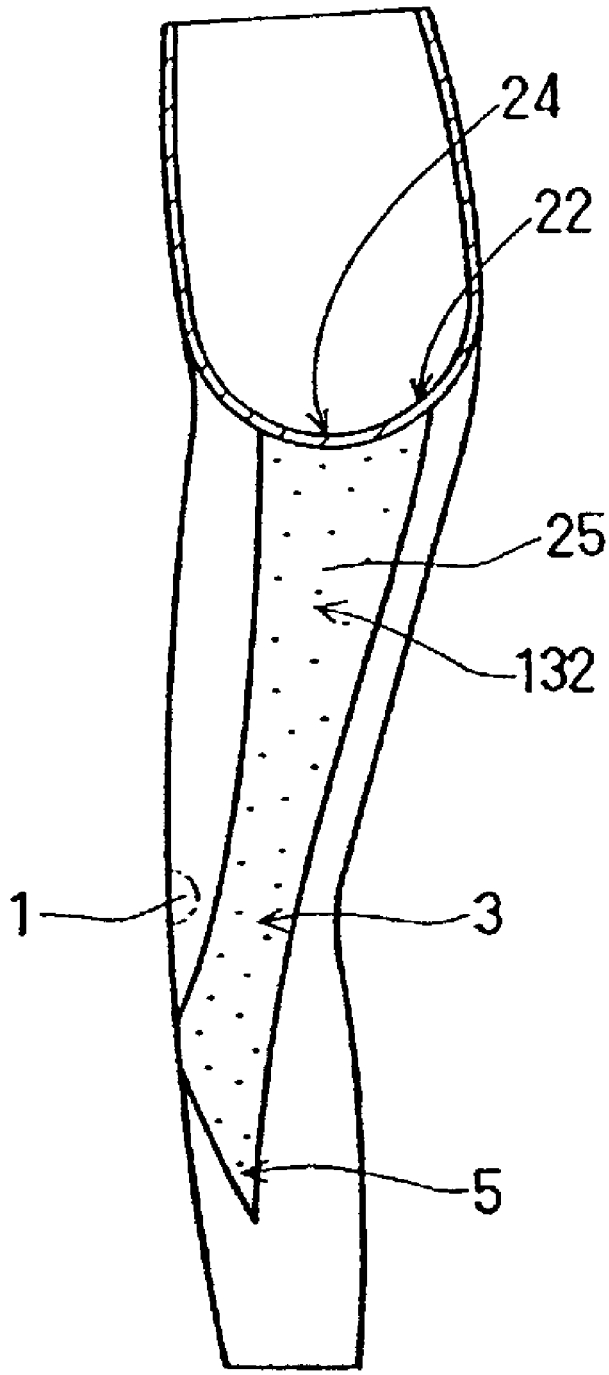
FIG. 31 is a cross-sectional view of the leg support garment taken along an A–A' line in FIG. 30.
Figure 32:
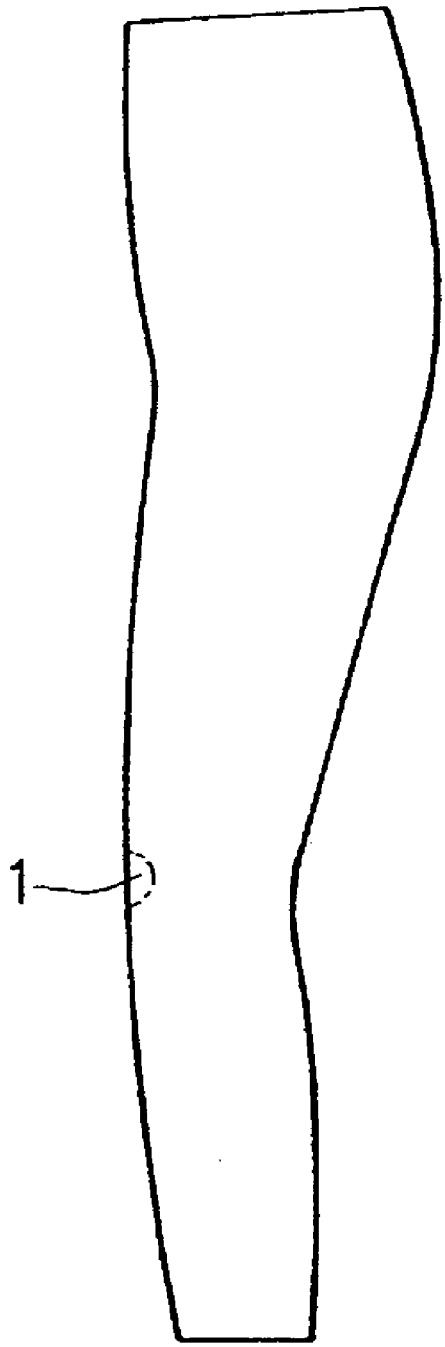
FIG. 32 is a right-side view of the leg support garment shown in FIG. 30.

Next, FIGS. 29 to 32 are views illustrating still another embodiment of a long-tights-type leg support garment of the present invention. FIG. 29 is a rear view of the same, FIG. 30 is a front view of the same, FIG. 31 is a cross-sectional view of the same taken along an A–A' line in FIG. 30, and FIG. 32 is a right-side view of the same.

The garment of the present embodiment is a leg support garment in which the portion expressed as the stretchable portion (A) having a relatively great straining force is composed of the stretchable portion (A2) 132 having a relatively great straining force. The stretchable portion (A2) 132 substantially covers the ligamentum collateralle 3 on the medial side of the knee joint of the human body, and extends approximately along the vicinity of a periphery of the patella 1 on the medial side thereof so as to surround the patella 1 through not less than approximately ¼ of the periphery of the patella 1 and to cover a part of an inferior region 4 of the patella 1. Then, it reaches a side 5 of the musculus gastrocnemius and the musculus soleus on the medial side. Further, on the superior side of the knee joint, the portion (A2) 132 passes through the thigh approximately along both 25 of the musculus semitendinosus and the musculus gracilis, and reaches the vicinity of the crotch 24 and the vicinity of the sulcus glutenus 22.

The foregoing preferred embodiment allows the stretchable portion 132 having a relatively great straining force to cover a part of the inferior region 4 of the patella 1, thereby support the patella 1 as if pulling up the patella 1 from the inferior side thereof. As a result, the stability of the knee joint is improved. Furthermore, the embodiment allows the portion 132 to support both 25 of the musculus semitendinosus and the musculus gracilis that are located on the medial side of the thigh, thereby increasing the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, both of the musculus semitendinosus and the musculus gracilis that complement the function of the ligamentum collateralle medialis are supported, which is also preferable.

Figure 33:
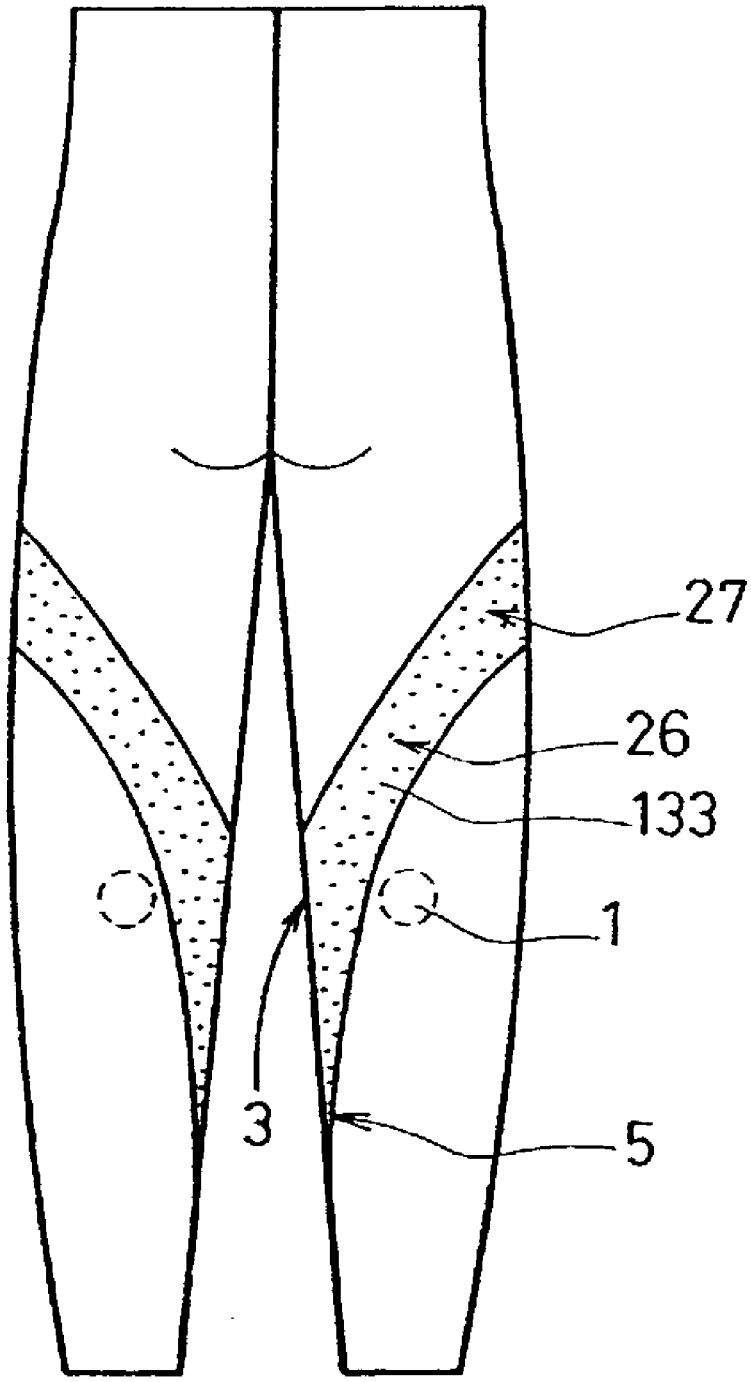
FIG. 33 is a rear view illustrating still another embodiment of a long-tights-type leg support garment of the present invention.
Figure 34:
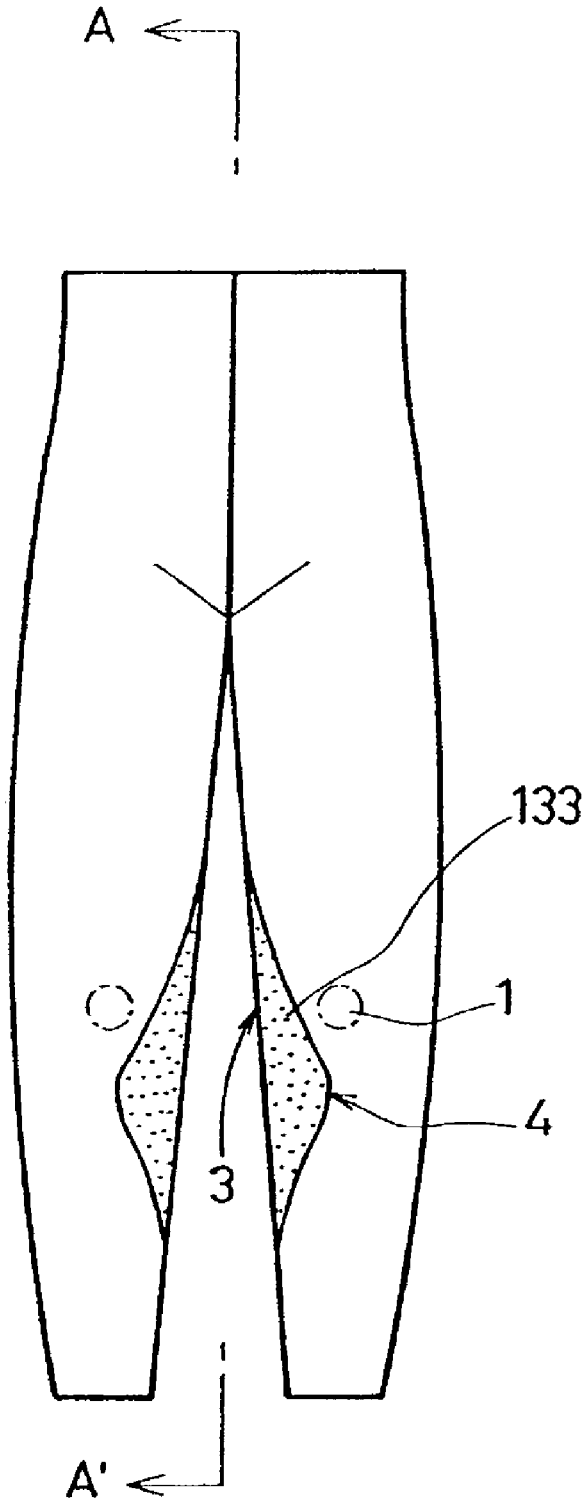
FIG. 34 is a front view of the leg support garment shown in FIG. 33
Figure 35:
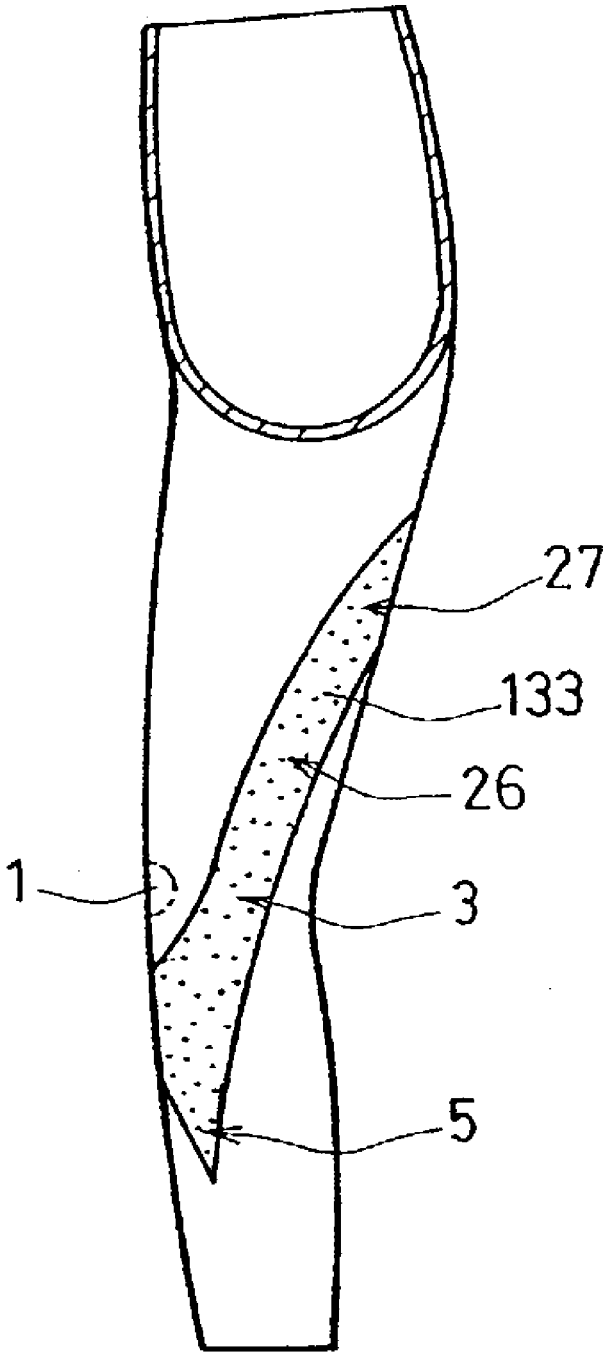
FIG. 35 is a cross-sectional view of the leg support garment taken along an A–A' line in FIG. 34.
Figure 36:
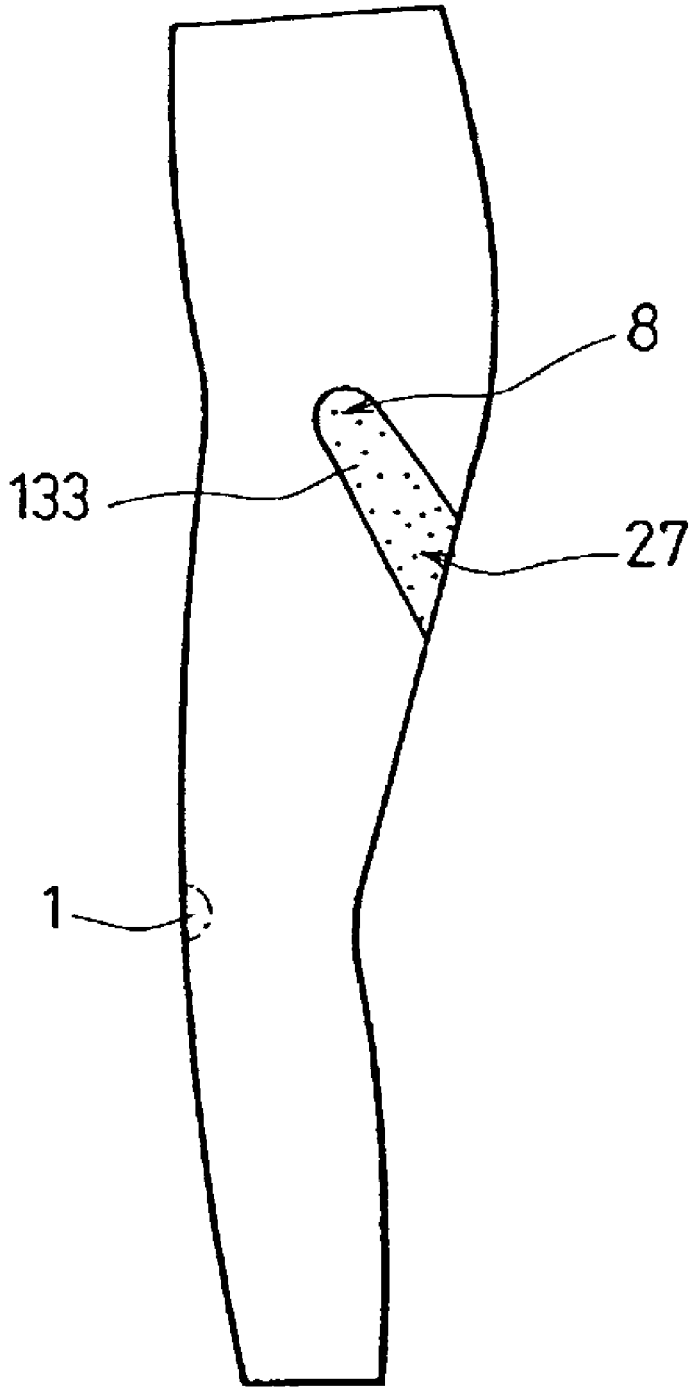
FIG. 36 is a right-side view of the leg support garment shown in FIG. 34.

Next, FIGS. 33 to 36 are views illustrating still another embodiment of a long-tights-type leg support garment of the present invention. FIG. 33 is a rear view of the same, FIG. 34 is a front view of the same, FIG. 35 is a cross-sectional view of the same taken along an A–A' line in FIG. 34, and FIG. 36 is a right-side view of the same.

The garment of the present embodiment is a leg support garment in which the portion expressed as the stretchable portion (A) having a relatively great straining force is composed of a stretchable portion (A3) 133 having a relatively great straining force. The stretchable portion (A3) 133 having a relatively great straining force substantially covers the ligamentum collateralle 3 on the medial side of the knee joint of the human body, and extends approximately along a vicinity of a periphery of the patella 1 on the medial side thereof so as to surround the patella through not less than approximately ¼0 of the periphery of the patella 1 and to cover a part of an inferior region 4 of the patella 1. Then, it reaches a side 5 of the musculus gastrocnemius and the musculus soleus on the medial side. Further, on the superior side of the knee joint, the portion (A3) 133 extends upward from the medial side to the lateral side of the thigh via the posterior side thereof approximately along the musculus semitendinosus and the musculus semimembranosus 26 to a vicinity of the trochanter major 8, passing over the musculus biceps femoris 27 obliquely.

According to the foregoing preferred embodiment, the stretchable portion (A3) 133 having a relatively great straining force is provided, which extends from the side 5 of the musculus gastrocnemius and the musculus soleus on the medial side upwards, then passes the thigh obliquely in a spiral form from the medial side to the lateral side thereof via the posterior side thereof, and reaches the vicinity of the trochanter major 8. Therefore, it is possible to support the patella 1 as if pulling up the same from the inferior side thereof, thereby improving the stability of the knee joint. Furthermore, it is also possible to increase the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, both of the musculus semitendinosus and the musculus semimembranosus that complement the function of the ligamentum collateralle medialis are supported, which is preferable.

Figure 37:
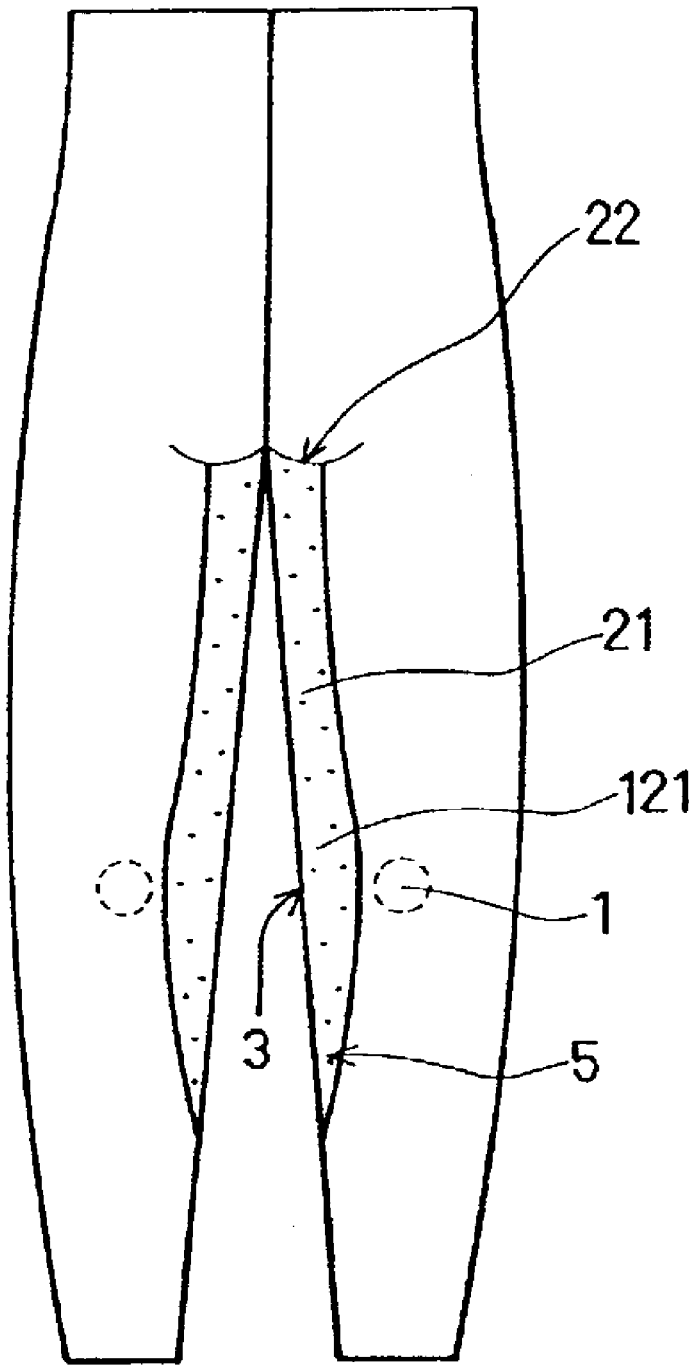
FIG. 37 is a rear view illustrating still another embodiment of a long-tights-type leg support garment of the present invention.
Figure 38:
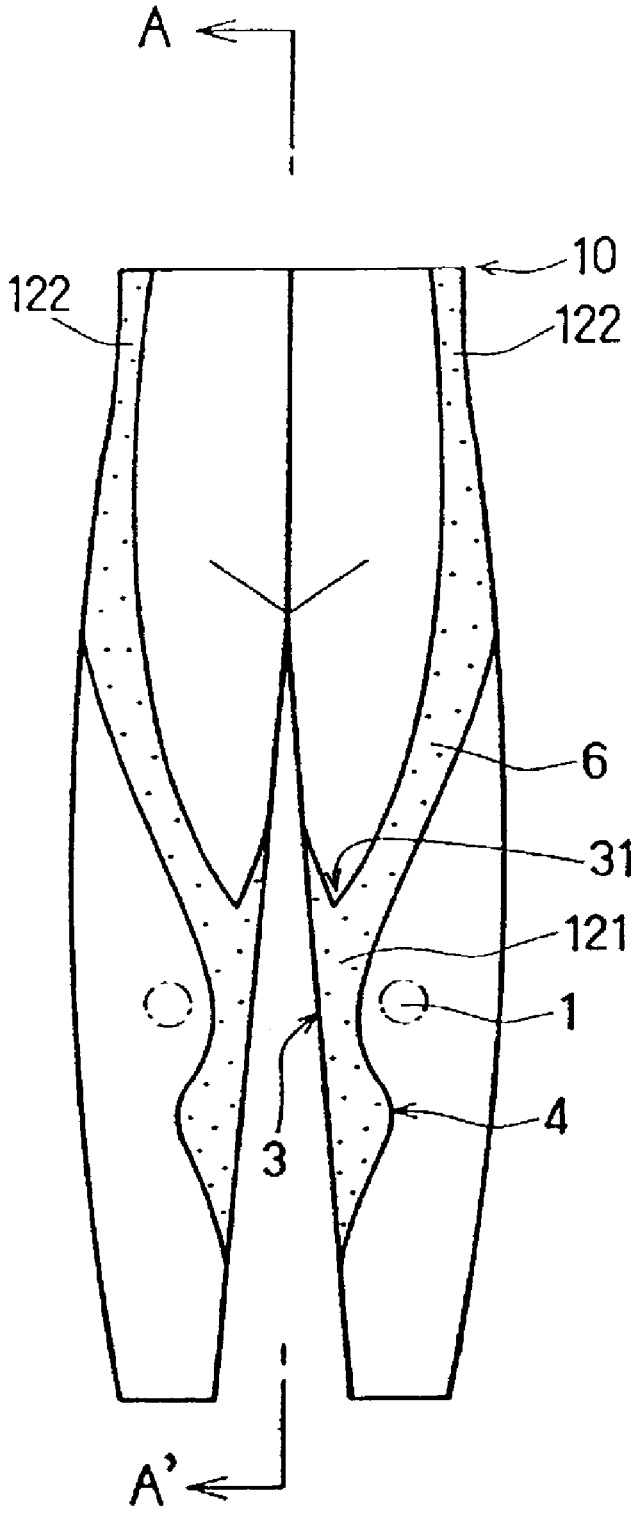
FIG. 38 is a front view of the leg support garment shown in FIG. 37
Figure 39:
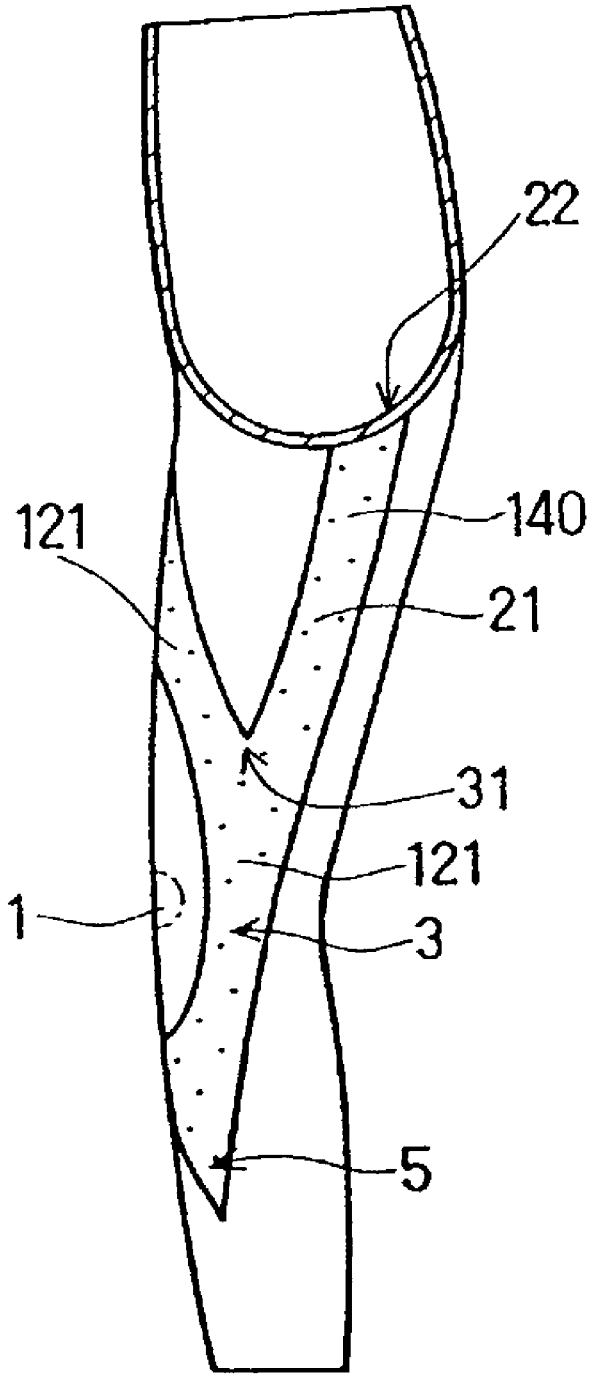
FIG. 39 is a cross-sectional view of the leg support garment taken along an A–A' line in FIG. 38.
Figure 40:
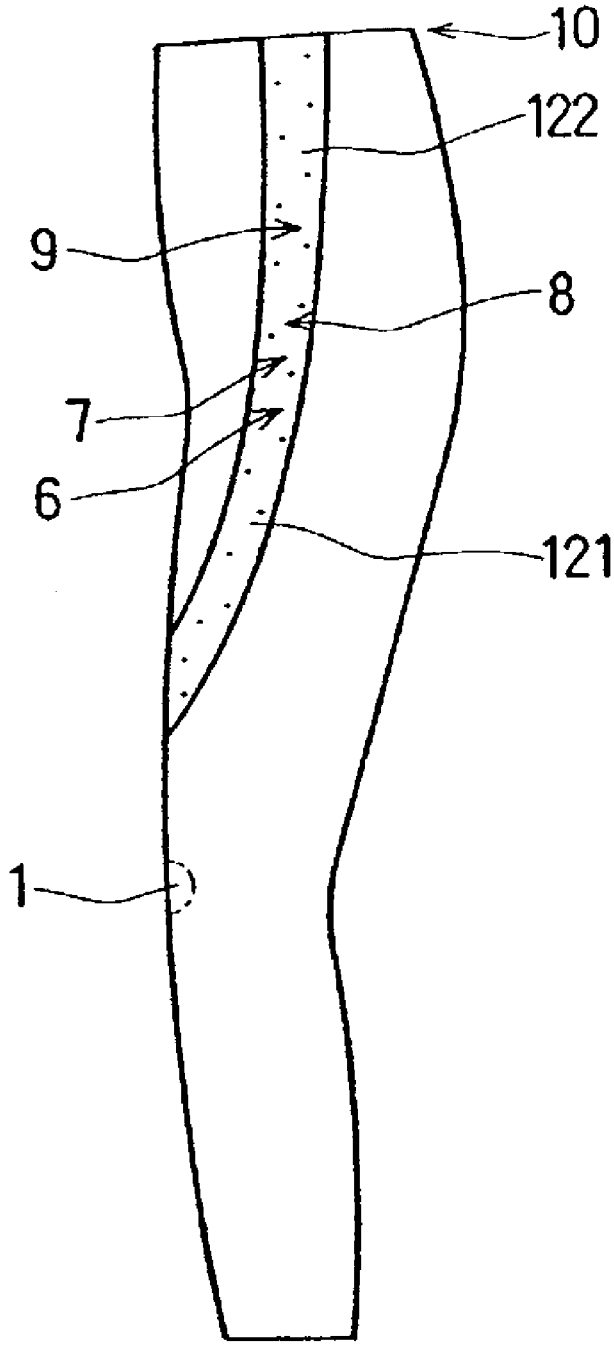
FIG. 40 is a right-side view of the leg support garment shown in FIG. 38.

Next, FIGS. 37 to 40 are views illustrating still another embodiment of a long-tights-type leg support garment of the present invention. FIG. 37 is a rear view of the same, FIG. 38 is a front view of the same, FIG. 39 is a cross-sectional view of the same taken along an A–A' line in FIG. 38, and FIG. 40 is a right-side view of the same.

The garment of the present embodiment has characteristics of both the garment shown in FIGS. 5 to 8 and that of FIGS. 21 to 24. More specifically, the portion expressed as the stretchable portion (A) having a relatively great straining force includes a stretchable portion (A) 121 having a relatively great straining force and a stretchable portion (A1-1) 122 having a relatively great straining force, as well as a stretchable portion (A2') 140 having a relatively great straining force. The stretchable portion (A) 121 having a relatively great straining force substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7¼) of the periphery of the patella 1 and to cover a part of an inferior region 4 of the patella 1, reaches a side 5 of the musculus gastrocnemius and the musculus soleus on the medial side, and on the superior side of the knee joint, extends from the medial side to the lateral side of the thigh via the anterior side thereof approximately along the musculus sartorius 6 to a superior region 7 of the musculus rectus femoris and the vicinity of the trochanter major 8 [(A1) 122]. The stretchable portion (A1-1) 122 having a relatively great straining force extends from the vicinity of the trochanter major 8 along the tractus iliotibialis 9 to the vicinity of the waist 10. On the superior side of the knee-joint-part of the stretchable portion (A) 121 having a relatively great straining force, the stretchable portion (A2') 140 having a relatively great straining force is also arranged extending from a divergence point 31 through the thigh approximately along the musculus semitendinosus 21 to the vicinity of the sulcus gluteus 22.

According to the foregoing preferred embodiment of the present invention, the stretchable portions (A1) 121 and (A1-1) 122 having relatively great straining forces are present in a spiral form, extending obliquely from the medial side to the lateral side of the thigh, then, over the trochanter major 8 to the vicinity of the waist 10. In addition, the stretchable portion (A2') 140 having a relatively great straining force that branches therefrom on the superior side of the knee joint is present also, extending through the thigh approximately along the musculus semitendinosus 21 to the vicinity of the sulcus gluteus 22. The actions of these in combination further increase the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, not only the musculus sartorius 6 but also the musculus semitendinosus 21 that complement the function of the ligamentum collateralle medialis 3 are supported, which is preferable. Furthermore, the stretchable portion (A1-1) 122 having a relatively great straining force that is provided from the vicinity of the trochanter major 8 to the vicinity of the waist 10 along the tractus iliotibialis 9 provides a function of pressing the trochanter major, thereby improving the connection between the caput ossis femoris and the acetabulum. Therefore, this further provides a function of enhancing the stability of the hip joint, which is preferable.

Figure 41:
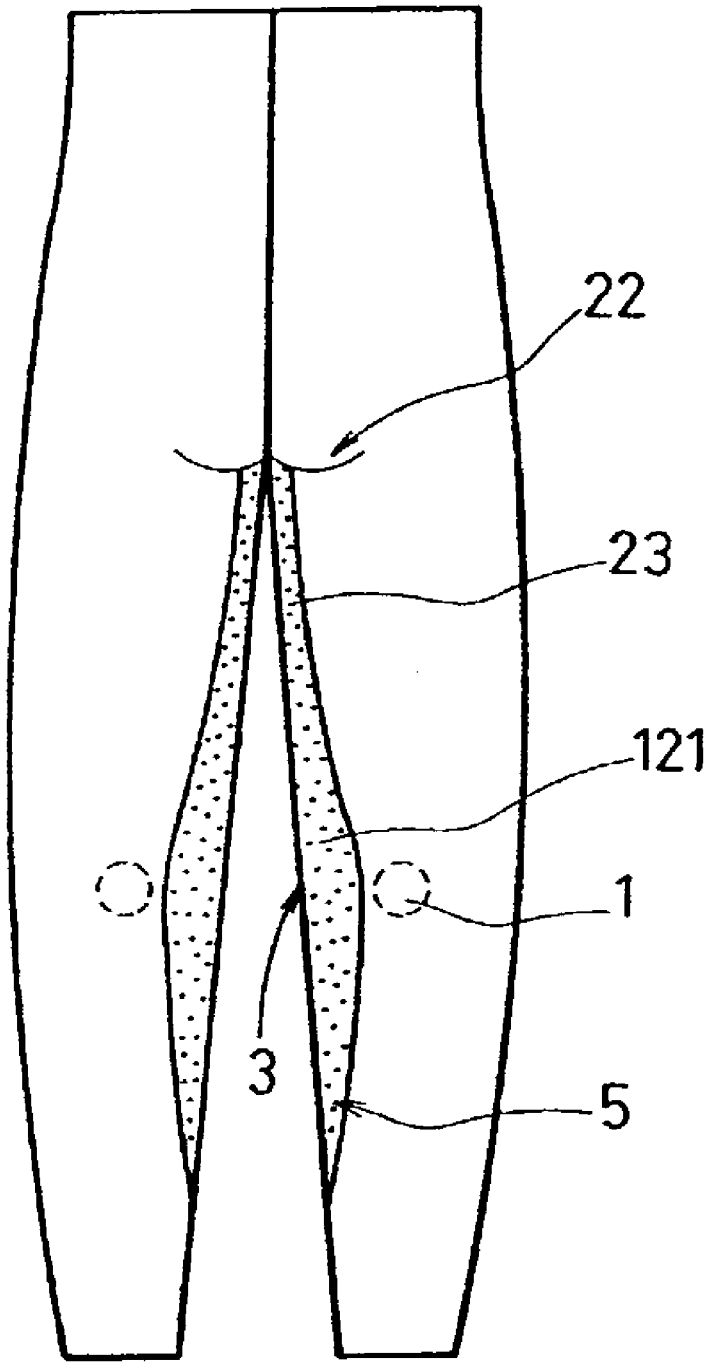
FIG. 41 is a rear view illustrating still another embodiment, of a long-tights-type leg support garment of the present invention.
Figure 42:
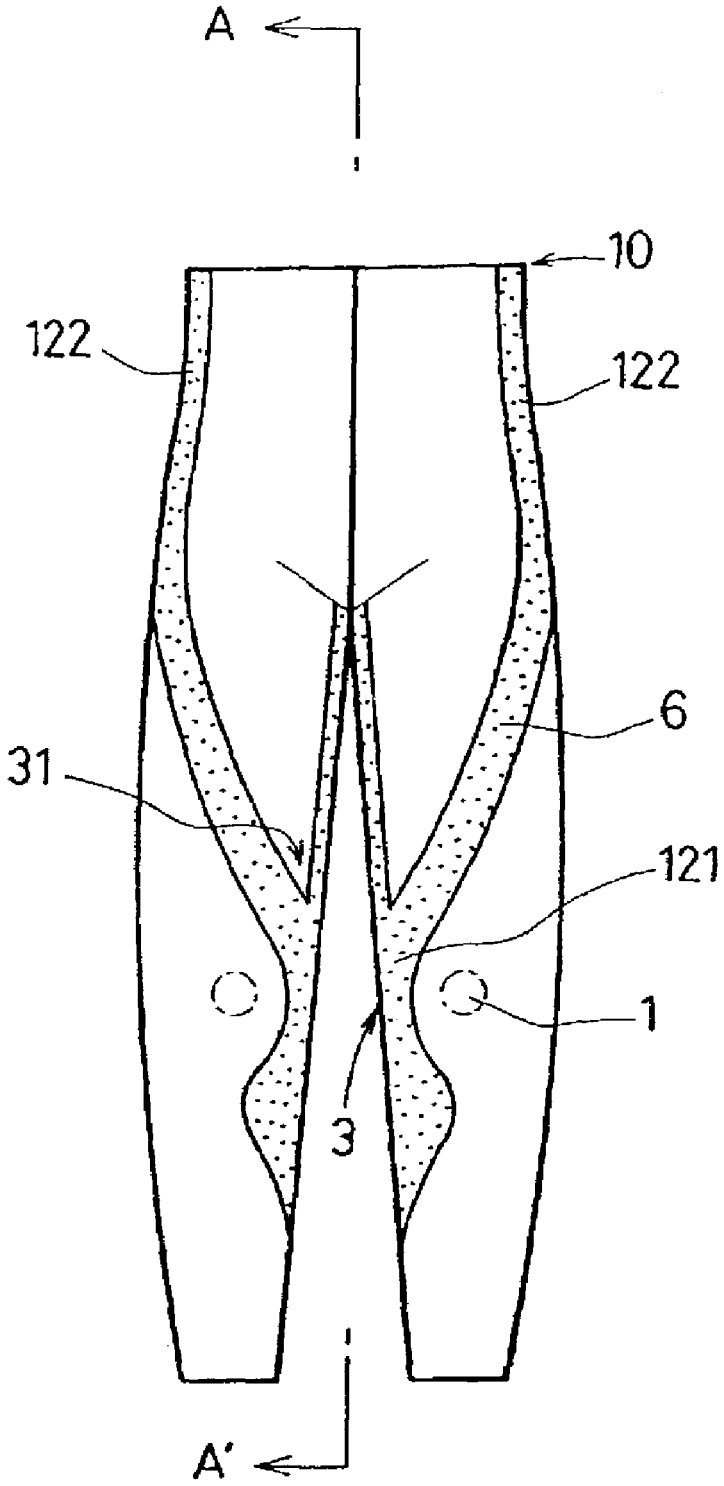
FIG. 42 is a front view of the leg support garment shown in FIG. 41
Figure 43:
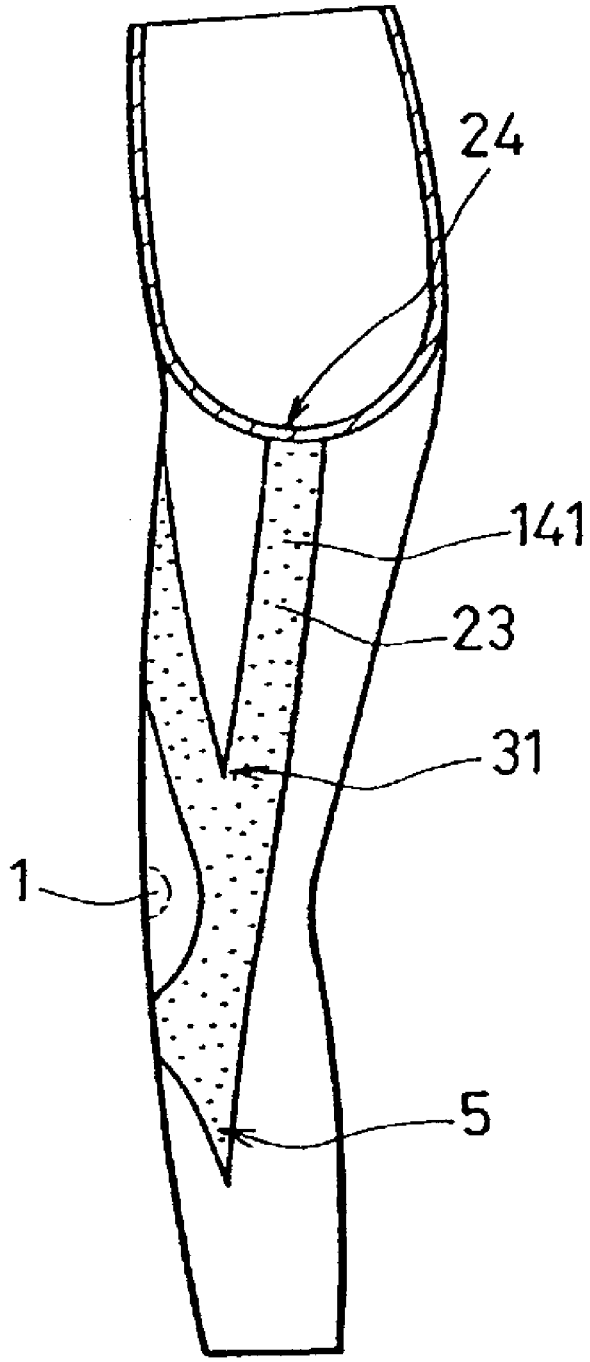
FIG. 43 is a cross-sectional view of the leg support garment taken along an A–A' line in FIG. 42.
Figure 44:
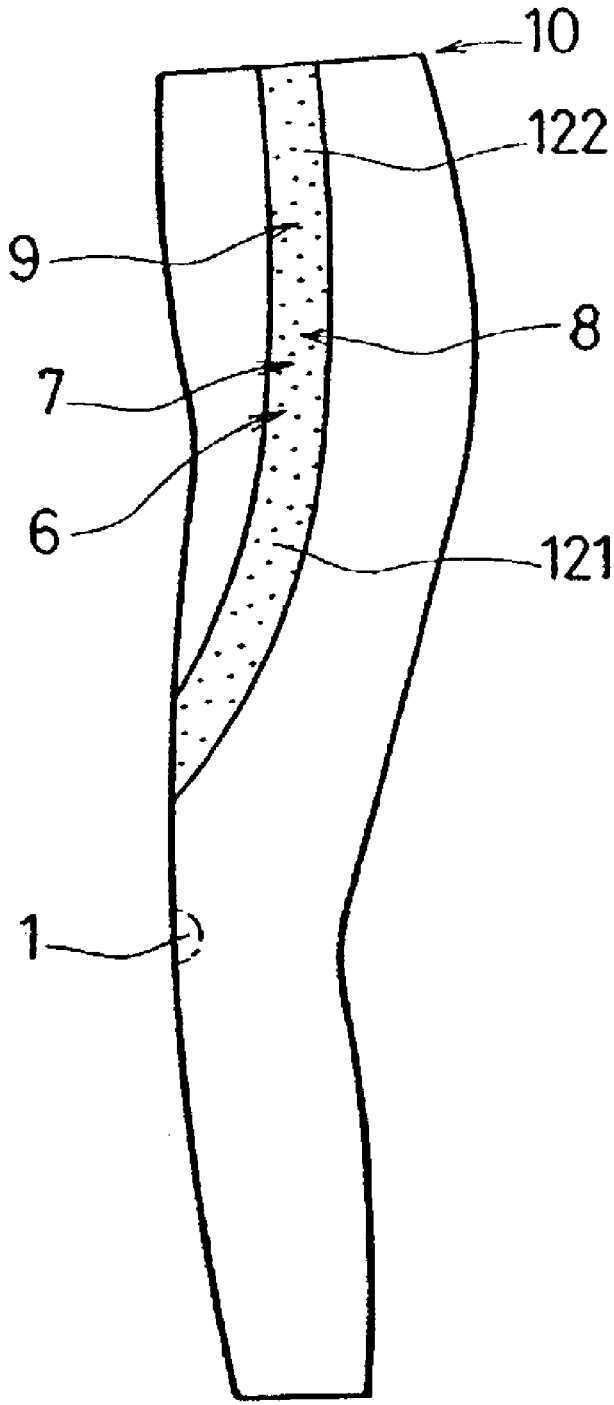
FIG. 44 is a right-side view of the leg support garment shown in FIG. 42.

Next, FIGS. 41 to 44 are views illustrating still another embodiment of a long-tights-type leg support garment of the present invention. FIG. 41 is a rear view of the same, FIG. 42 is a front view of the same, FIG. 43 is a cross-sectional view of the same taken along an A–A' line in FIG. 42, and FIG. 44 is a right-side view of the same.

The garment of the present embodiment has characteristics of both the garment shown in FIGS. 5 to 8 and that of FIGS. 25 to 28. More specifically, a portion expressed as the stretchable portion (A) having a relatively great straining force includes a stretchable portion (A) 121 having a relatively great straining force and a stretchable portion (A1-1) 122 having a relatively great straining force, as well as a stretchable portion (A2') 141 having a relatively great straining force. The stretchable portion (A) 121 having a relatively great straining force substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7/4) of the periphery of the patella 1 and to cover a part of an inferior region 4 of the patella 1, reaches a side 5 of the musculus gastrocnemius and the musculus soleus on the medial side, and on the superior side of the knee joint, extends from the medial side to the lateral side of the thigh via the anterior side thereof approximately along the musculus sartorius 6 to a superior region 7 of the musculus rectus femoris and the vicinity of the trochanter major 8. The stretchable portion (A1-1) 122 having a relatively great straining force extends from the vicinity of the trochanter major 8 along the tractus iliotibialis 9 to the vicinity of the waist 10. On the superior side of the knee-joint-part of the stretchable portion (A) 121 having a relatively great straining force, the stretchable portion (A2') 141 having a relatively great straining force is also arranged extending from a divergence point 31 through the thigh approximately along the musculus gracilis 23 to the vicinity of the crotch 24.

According to the foregoing preferred embodiment of the present invention, the stretchable portions (A1) 121 and (A1-1) 122 having relatively great straining forces are present in a spiral form, extending obliquely from the medial side to the lateral side of the thigh, then, over the trochanter major 8 to the vicinity of the waist 10. In addition, the stretchable portion (A2') 141 having a relatively great straining force that branches therefrom on the superior side of the knee joint is present, extending through the thigh approximately along the musculus gracilis 23 to the vicinity of the crotch 24. The actions of these in combination increases the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, not only the musculus sartorius 6 but also the musculus gracilis 23 that complement the function of the ligamentum collateralle medialis 3 are also supported, which is preferable. Furthermore, the stretchable portion (A1-1) 122 having a relatively great straining force that is provided from the vicinity of the trochanter major 8 to the vicinity of the waist 10 along the tractus iliotibialis 9 provides a function of pressing the trochanter major, thereby improving the connection between the caput ossis femoris and the acetabulum. Therefore, this further provides a function of enhancing the stability of the hip joint, which is preferable.

Figure 45:
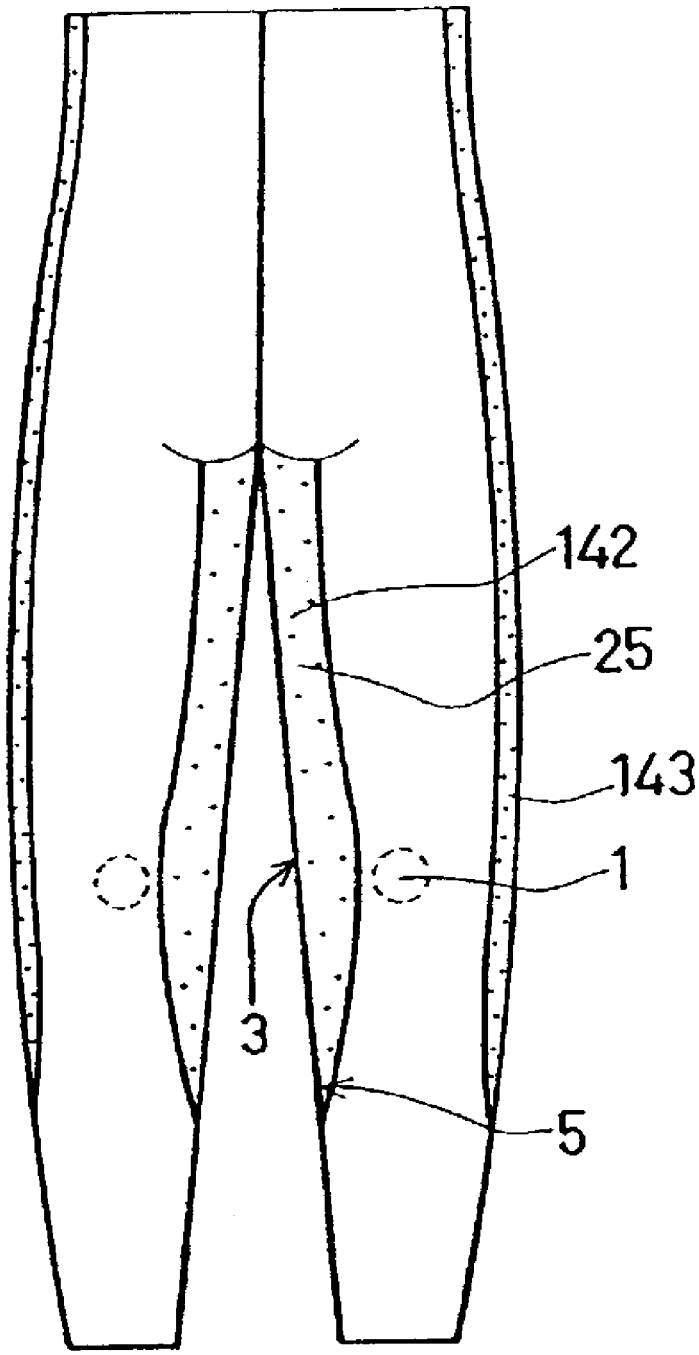
FIG. 45 is a rear view illustrating still another embodiment of a long-tights-type leg support garment of the present invention.
Figure 46:
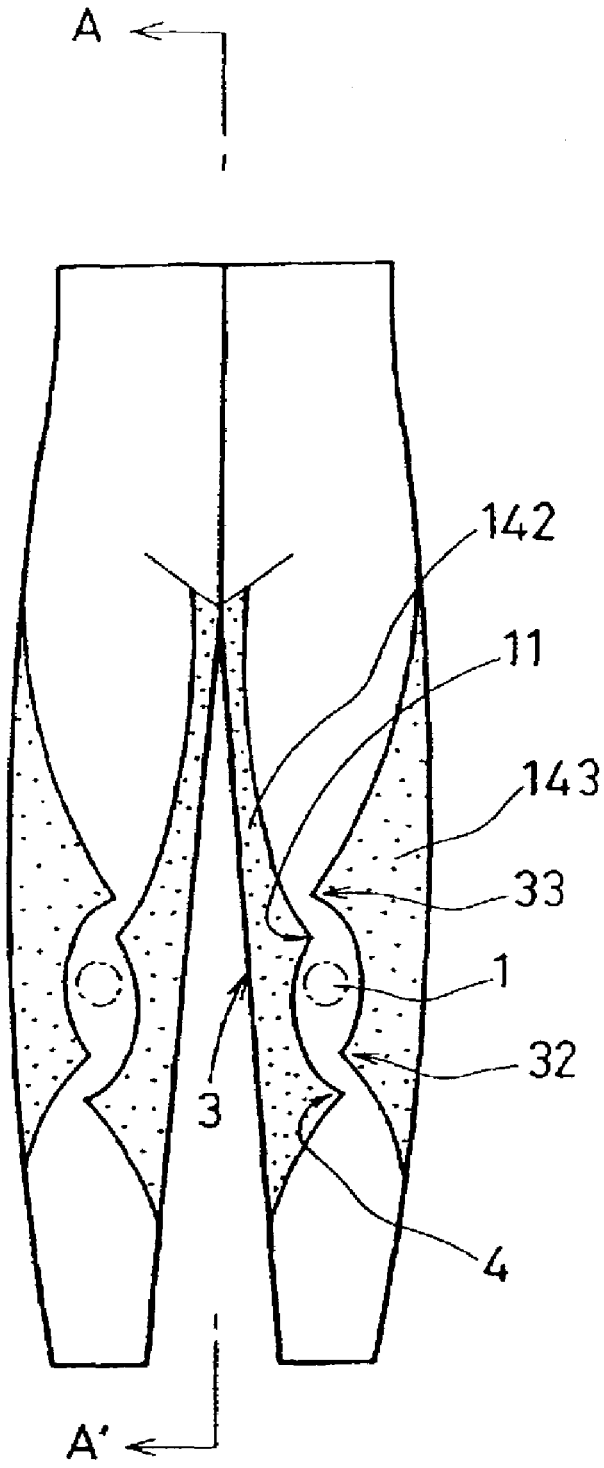
FIG. 46 is a front view of the leg support garment shown in FIG. 45
Figure 47:
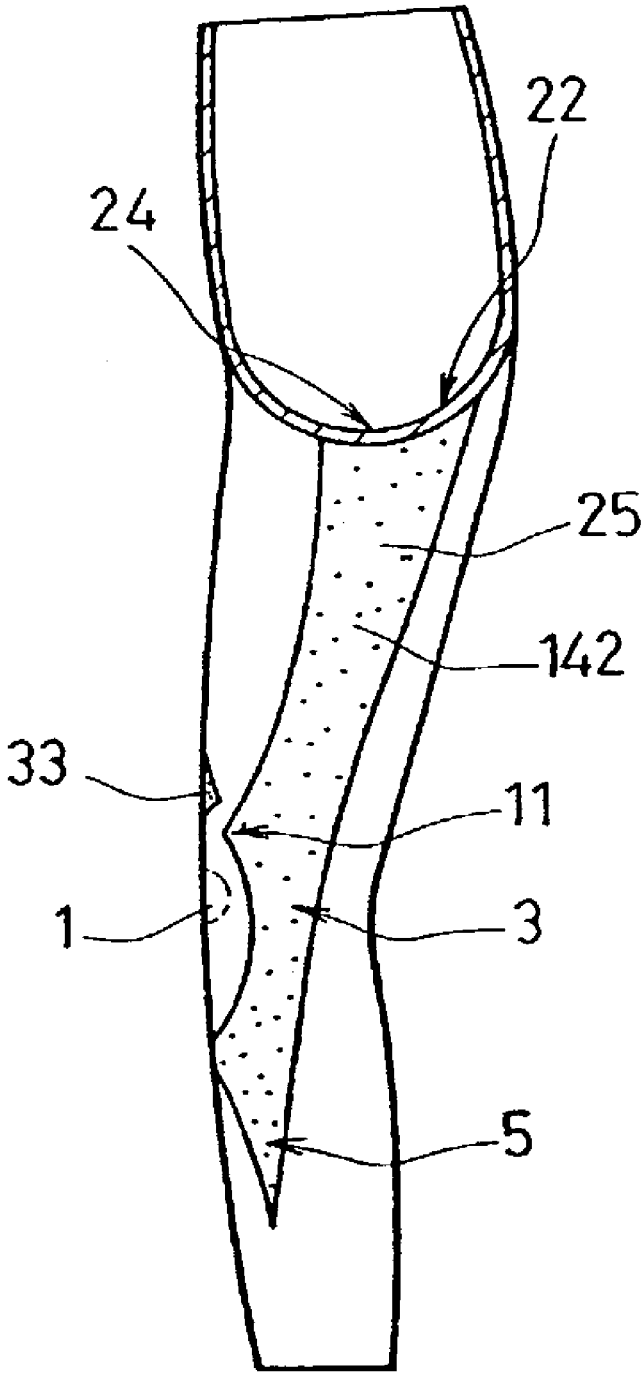
FIG. 47 is a cross-sectional view of the leg support garment taken along an A–A' line in FIG. 46.
Figure 48:
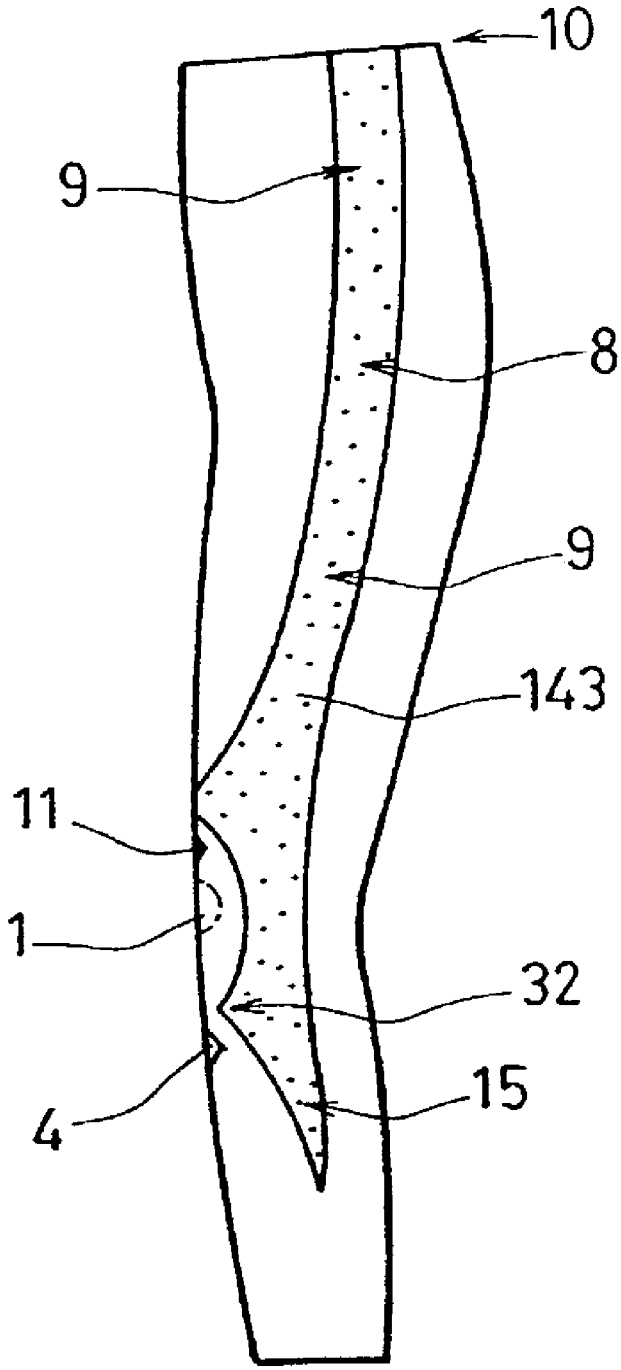
FIG. 48 is a right-side view of the leg support garment shown in FIG. 46.

Next, FIGS. 45 to 48 are views illustrating still another embodiment of a long-tights-type leg support garment of the present invention. FIG. 45 is a rear view of the same, FIG. 46 is a front view of the same, FIG. 47 is a cross-sectional view of the same taken along an A–A' line in FIG. 46, and FIG. 48 is a right-side view of the same.

The garment of the present embodiment is a leg support garment in which the portion expressed as the stretchable portion (A) having a relatively great straining force is a stretchable portion (A2-2) 142 having a relatively great straining force, and the stretchable part having a relatively great straining force further includes a stretchable portion (B') 143 having a relatively great straining force. The stretchable portion (A2-2) 142 having a relatively great straining force substantially covers the ligamentum collateralle 3 on the medial side of the knee joint of the human body, extends approximately along a vicinity of a periphery of the patella 1 on the medial side thereof so as to surround the patella 1 through at least more than approximately ½ of the periphery of the patella 1 and to cover a part of inferior and superior regions 4 and 11 of the patella, and reaches a side 5 of the musculus gastrocnemius and the musculus soleus on the medial side. Further, on the superior side of the knee joint, in the femoral region, the stretchable portion (A2-2) 142 having a relatively great straining force extends approximately along the musculus semitendinosus and the musculus gracilis, and reaches the vicinity below the crotch 24 and a vicinity of the sulcus gluteus 22. The stretchable portion (B') 143 having a relatively great straining force extends from a side part of the waist 10 approximately along the tractus iliotibialis 9 via a vicinity of the trochanter major 8, then, approximately along the tractus iliotibialis 9 to the lateral side of the patella 1, surrounds the patella 1 through approximately ½ or more of the periphery of the patella 1 so as to cover a part of an inferior region 32 and a superior region 33 of the patella 1, and passes a side 15 of the musculus gastrocnemius and the musculus soleus on the lateral side.

In the foregoing embodiment, two portions 4 and 11 of the stretchable portion (A2-2) 142 having relatively great straining forces project toward the medial side therefrom and cover a part of the inferior region 4 and a part of the superior region 11 of the patella 1, respectively. Besides, two portions 32 and 33 of the stretchable portion (B') 143 having relatively great straining forces project toward the lateral side therefrom and cover a part of the inferior region 32 and a part of the superior region 33 of the patella 1, respectively. Here, the two portions 4 and 11 of the stretchable (A2-2) 142 having a relatively great straining force are arranged opposite to the two portions 32 and 33 of the stretchable portion (B') 143 having a relatively great straining force, respectively, and at positions slightly shifted to the inferior side from positions of the portions 32 and 33 of the stretchable portion (B') 143 having a relatively great straining force, respectively. Furthermore, when viewed from the front the portion covering the inferior region 4 of the patella 1, of the stretchable portion (A2-2) 142 having a relatively great straining force, has a relatively greater area.

The foregoing preferred embodiment allows the stretchable portions having relatively great straining forces to support the knee and leg from both sides in the femoral region and the lower leg region, without hindering the action of the musculus vastus lateralis and the musculus vastus medialis on the anterior side of the thigh, and further, allows the knee joint to be supported as if wrapped from the surrounding, thereby providing further support of the knee joint. Besides, the function of pressing the trochanter major 8 is reinforced, thereby further improving the connection between the caput ossis femoris and the acetabulum. Therefore, the function of enhancing the stability of the hip joint is reinforced, which is preferable.

Furthermore, in the lower leg region, on the medial side, the muscles are fewer and the tibia is in contact with the surface of the body. On the other hand, on the lateral side of the lower leg region, the musculus gastrocnemius is on the lateral side of the fibula. Therefore, the foregoing embodiment provides the support of the knee joint as if pulling the medial side thereof having fewer muscles more intensely from the inferior side, thereby reinforcing the support of the ligamentum collateralle medialis, which is preferable.

As described above, in the foregoing embodiment, as to the two portions 4 and 11 of the stretchable portion (A2-2) 142 having a relatively great straining force that project to the lateral side and cover a part of the inferior region 4 and a part of the superior region 11 of the patella 1, respectively, and the two portions 32 and 33 of the stretchable portion (B') 143 having a relatively great straining force that project to the medial side and cover a part of the inferior region 32 and a part of the superior region 33 of the patella 1, respectively, the position of the projecting portion 4 is slightly inferior to the position of the projecting portion 32, and the position of the projecting portion 11 is slightly inferior to the position of the projecting portion 32. Therefore, this provides the support of the knee joint as if pulling the medial side thereof having fewer muscles more intensely from the inferior side, thereby reinforcing the support of the ligamentum collateralle medialis, which is preferable. However, the projecting portion 4 may be at a position as high as the position of the projecting portion 32, or the projecting portion 11 may be at a position as high as a position of the projecting portion 33. Besides, the two portions 4 and 11 projecting toward the lateral side may further extend over the central line of the anterior side of the leg toward the lateral side, while the portions 32 and 33 opposite thereto may further extend over the central line of the anterior side of the leg toward the medial side. Alternatively, the projecting portions 4 and 32 may be connected with each other, and likewise, the projecting portions 11 and 33 may be connected with each other. Furthermore, the projecting portion 4 may be located at a position shifted slightly to the superior side of the projecting portion 32, while the projecting portion 11 may be located at a position shifted slightly to the superior side of the projecting portion 33.

Figure 49:
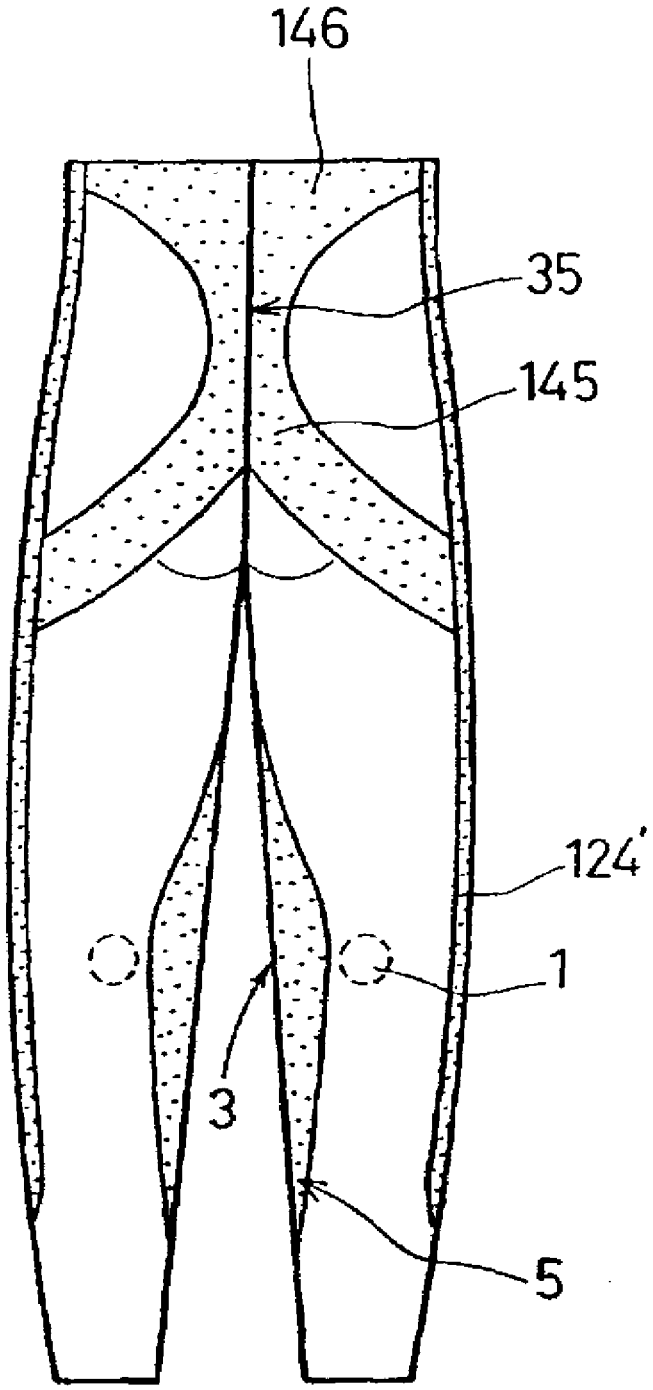
FIG. 49 is a rear view illustrating still another embodiment of a long-tights-type leg support garment of the present invention.
Figure 50:
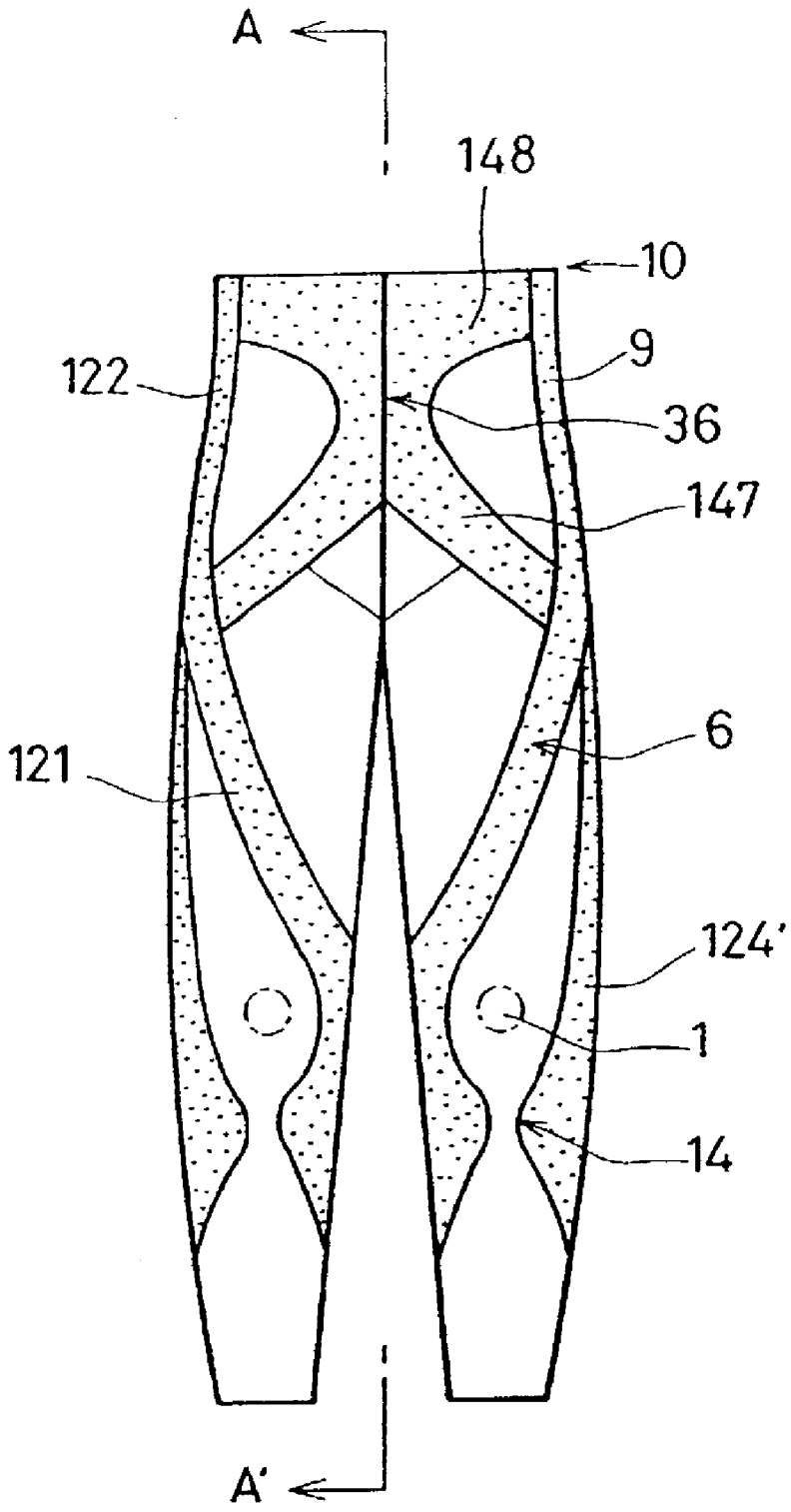
FIG. 50 is a front view of the leg support garment shown in FIG. 49
Figure 51:
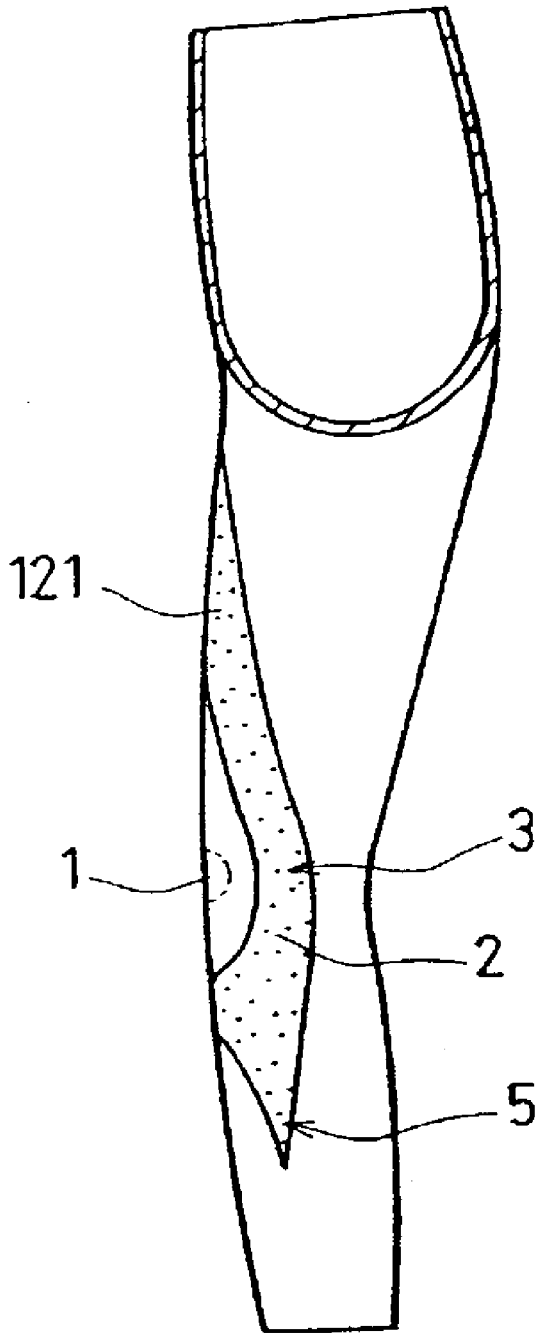
FIG. 51 is a cross-sectional view of the leg support garment taken along an A–A' line in FIG. 50.
Figure 52:
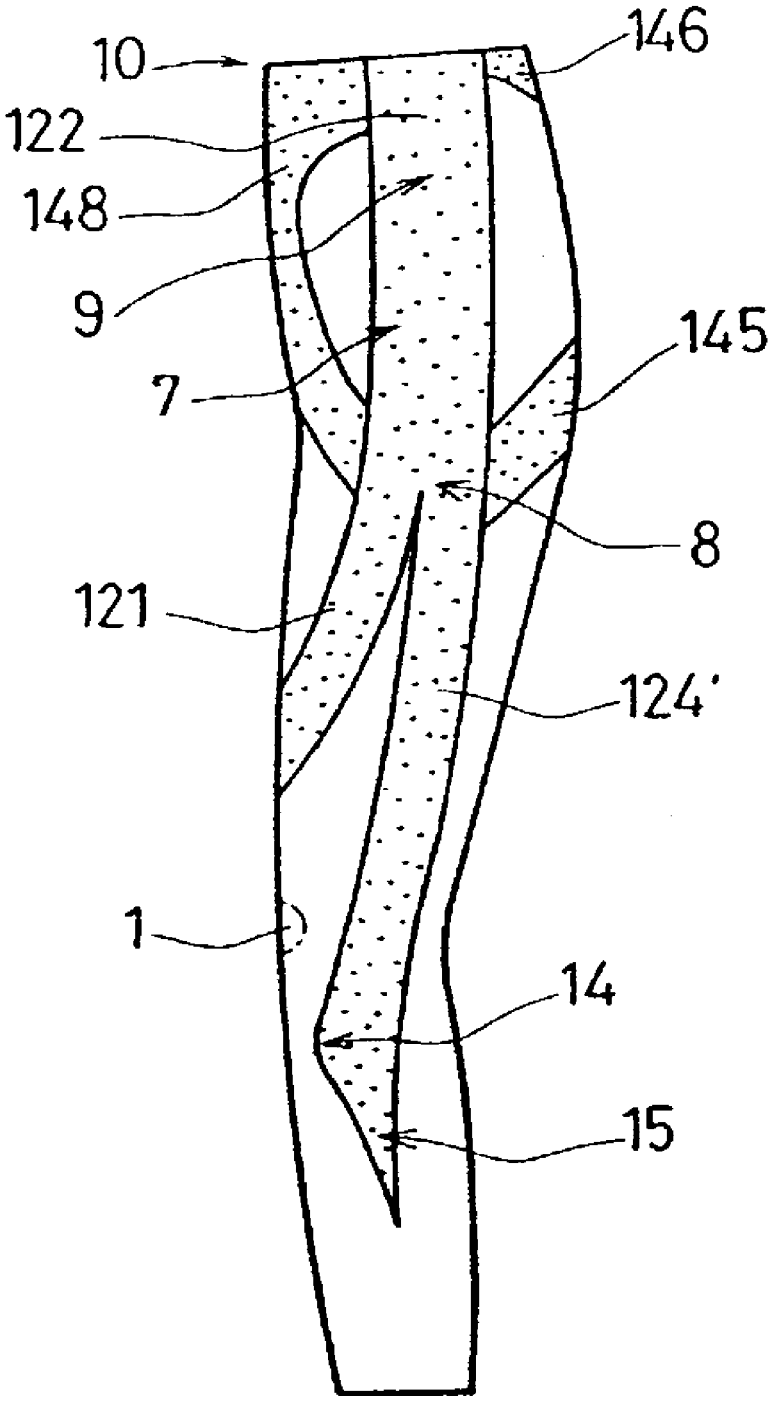
FIG. 52 is a right-side view of the leg support garment shown in FIG. 50.

Next, FIGS. 49 to 52 are views illustrating still another embodiment of a long-tights-type leg support garment of the present invention. FIG. 49 is a rear view of the same, FIG. 50 is a front view of the same, FIG. 51 is a cross-sectional view of the same taken along an A–A' line in FIG. 50, and FIG. 52 is a right-side view of the same.

The garment of the present embodiment is a garment as a modification of the embodiment shown in FIGS. 17 to 20; namely, to the garment shown in FIGS. 17 to 20, stretchable portions having relatively great straining forces obtained by modifying a stretchable portion (C) having a relatively great straining force and a stretchable portion (D) having a relatively great straining force, respectively, are added as described below. Therefore, the same portions as those in the embodiment shown in FIGS. 17 to 20 are designated with the same reference numerals, and descriptions of the same are omitted. However, the portions substantially the same as those shown in FIGS. 17 to 20 still have a slight difference. Namely, the stretchable portion (B) 124 having a relatively great straining force shown in FIGS. 17 to 20 reaches to the superior side 16 of the malleolus lateralis, while a stretchable portion (B) 124' having a relatively great straining force shown in FIGS. 49 to 52 reaches only the side 15 of the musculus gastrocnemius and the musculus soleus on the lateral side, and does not reach the superior side 16 of the malleolus lateralis.

The other aspects are substantially the same as those of the, embodiment of the garment shown in FIGS. 17 to 20, and stretchable portions having relatively great straining forces described below are further provided.

There are provided a stretchable portion (C) 145 having a relatively great straining force and a stretchable portion 146 having a relatively great straining force. The stretchable portion (C) 145 having a relatively great straining force includes right and left parts that are connected at a position 35 corresponding to the fourth lumbar vertebra to the os sacrum on the posterior side of the human body, and covers a region extending from the foregoing position 35, through an approximately middle part of the musculus gluteus maximus at right and left, approximately in a direction along muscular fibers of the musculus gluteus maximus via the top of the bulge of the hip or the vicinity of the same to at least the vicinity of trochanter major. The stretchable portion 146 having a relatively great straining force includes right and left parts that are connected approximately in the vicinity of the posterior central position of the waist, and covers a region extending from the vicinity of the posterior central position of the waist to at least the flank at right and left, in contact with a part of the musculus latissimus dorsi, the musculus gluteus medius, and the musculus obliquus externus abdominis. Therefore, the stretchable portion (C) 145 having a relatively great straining force provides the firm support of the musculus gluteus maximus in the muscular fiber direction thereof. Thus, it can play a large role in supporting the rotating motion of the hips, preventing a decrease in the rotating angle of the hips, and stabilizing the pelvis in anterior-posterior direction. For an elderly person, it is effective in preventing falling down. Furthermore, it can play a large role in extending the hip joint in anterior-posterior direction when running, jumping, and climbing up a slope. Moreover, the stretchable portion 146 having a relatively great straining force provides the firmer support of a region from the posterior central position of the waist to the musculus latissimus dorsi, the musculus gluteus medius, and the musculus obliquus externus abdominis at right and left. Consequently, a function for complementing the function of preventing backward inclination of the pelvis and keeping a stable position of the pelvis is displayed.

Furthermore, the garment of the present embodiment includes a stretchable portion (D) 147 having a relatively great straining force and a stretchable portion 148 having a relatively great straining force. The stretchable portion (D) 147 having a relatively great straining force includes right and left parts that are connected with each other on the musculus rectus abdominis 36 in the abdominal region, and covers a region extending from a position on the musculus rectus abdominis in the hypogastric region, obliquely downward approximately in a direction along muscular fibers of the musculus obliquus internus abdominis to the vicinity of the trochanter major 8 at right and left. The stretchable portion 148 having a relatively great straining force includes right and left parts that are connected with each other on the musculus rectus abdominis 36 in the hypogastric region, and covers a region extending from a position on the musculus rectus abdominis 36, obliquely upward approximately in a direction along muscular fibers of the musculus obliquus externus abdominis to at least the flank.

Therefore, the stretchable portion (D) 147 having a relatively great straining force supports a part of the musculus rectus abdominis and the musculus obliquus internus abdominis, thereby providing functions of reducing lumbar lordosis, maintaining good posture, making youthful figure, and preventing generation of pains such as lumbar pains. Furthermore, the stretchable portion 148 having a relatively great straining force supports a part of the musculus rectus abdominis and the musculus obliquus externus abdominis, thereby providing functions of reducing lumbar lordosis, maintaining good posture, making youthful figure, and preventing generation of pains such as lumbar pains.

It should be noted that such portions (C) 145, 146, (D) 147, and 148 are applicable to the stretchable part having a relatively great straining force in the other embodiments as required.

Figure 53:
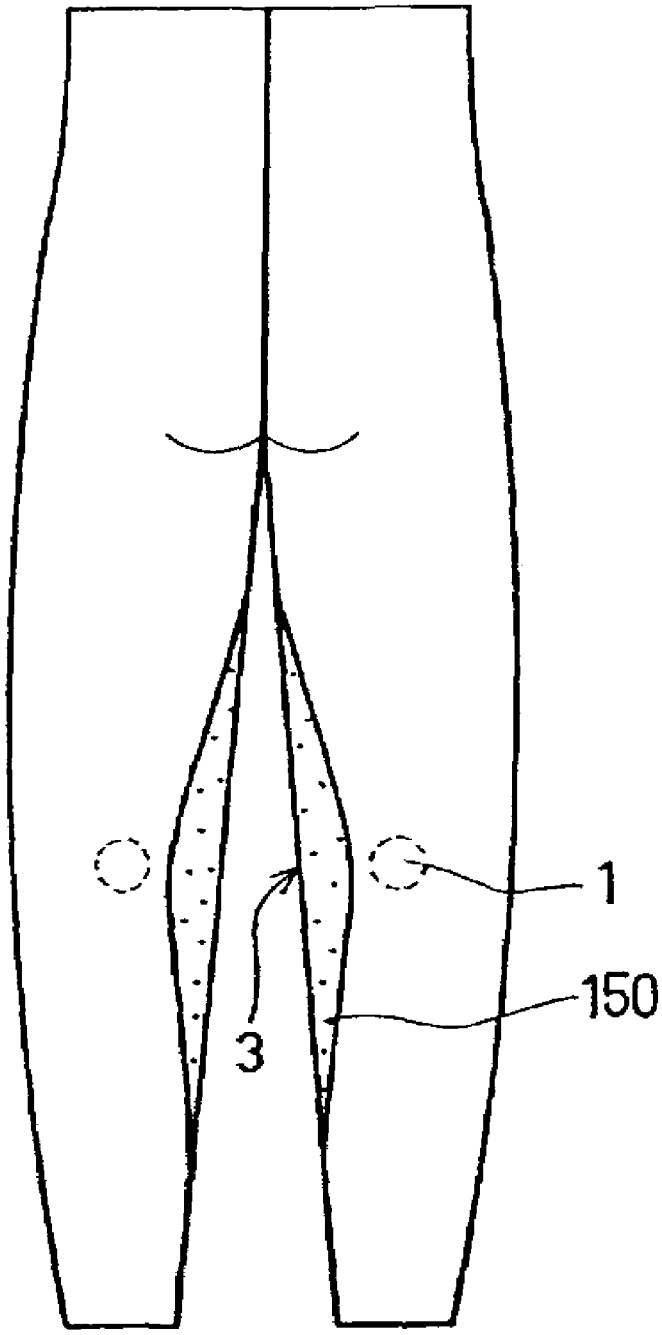
FIG. 53 is a rear view illustrating still another embodiment of a long-tights-type leg support garment of the present invention.
Figure 54:
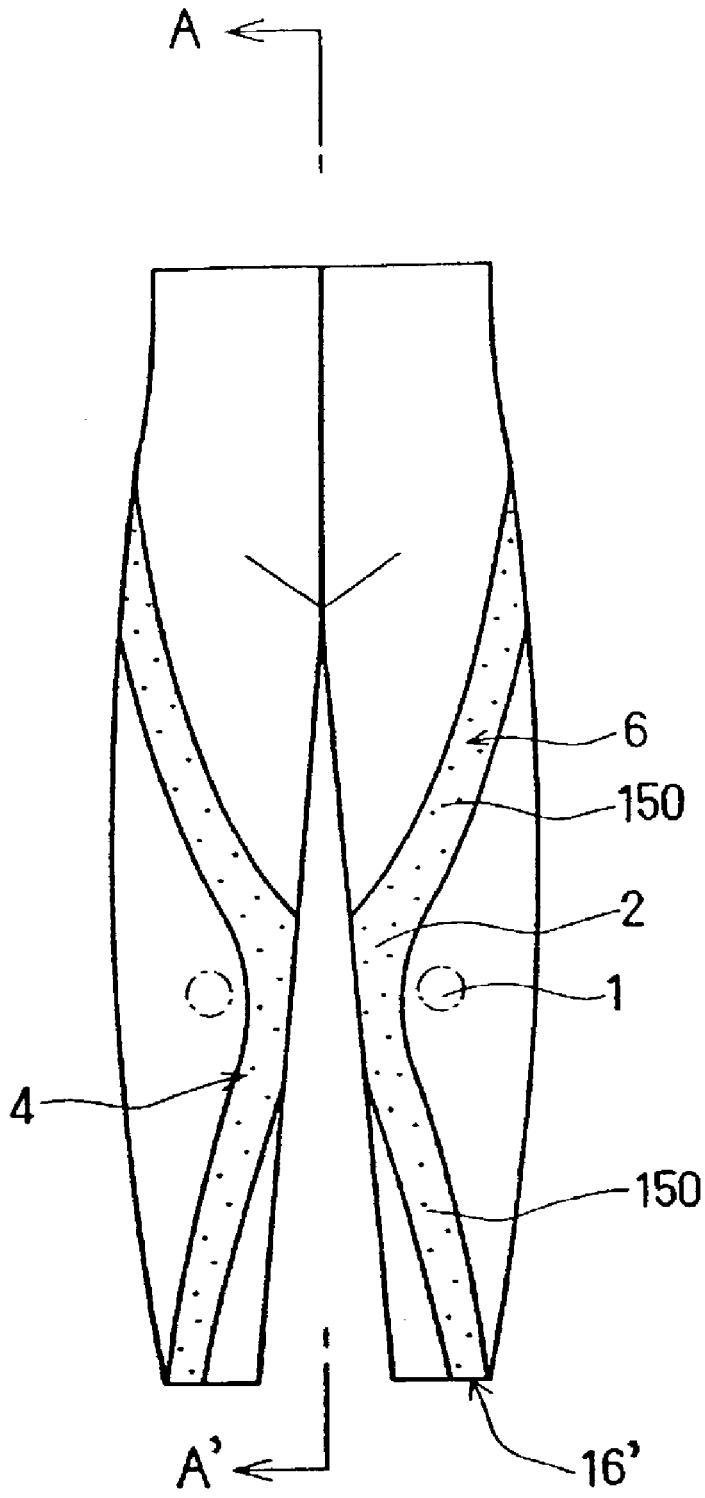
FIG. 54 is a front view of the leg support garment shown in FIG. 53
Figure 55:
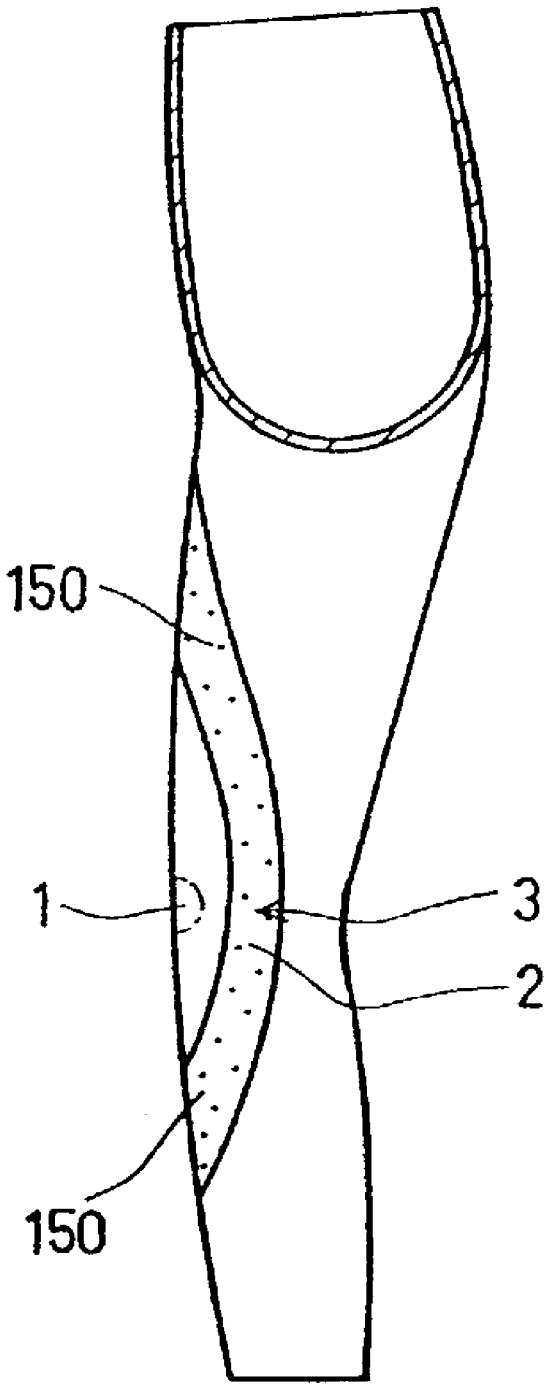
FIG. 55 is a cross-sectional view of the leg support garment taken along an A–A' line in FIG. 54.
Figure 56:
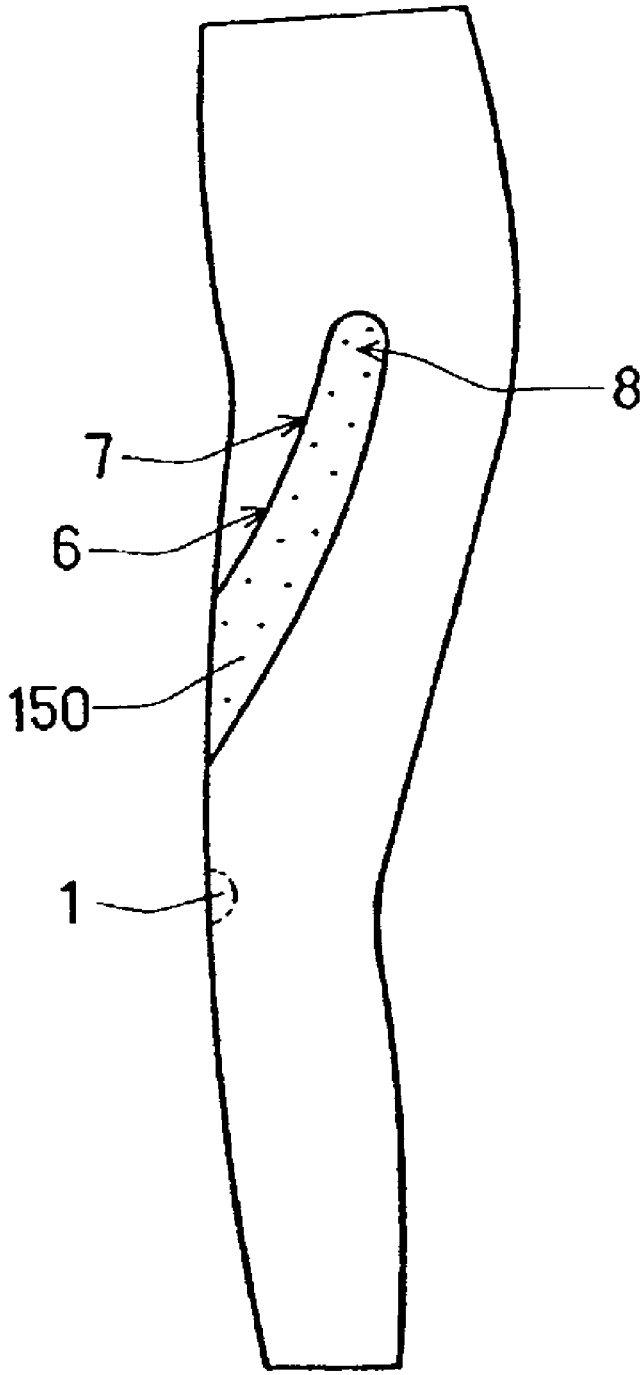
FIG. 56 is a right-side view of the leg support garment shown in FIG. 54.

Next, FIGS. 53 to 56 are views illustrating still another embodiment of a long-tights-type leg support garment of the present invention. FIG. 53 is a rear view of the same, FIG. 54 is a front view of the same, FIG. 55 is a cross-sectional view of the same taken along an A—A' line in FIG. 54, and FIG. 56 is a right-side view of the same.

In the garment of the present embodiment is substantially the same as the leg support garment shown in FIGS. 1 to 4 in the aspect of the stretchable portion having a relatively great straining force that extends upward from the ligamentum collateralle 3 on the medial side of the knee joint, but differs from the garment shown in FIGS. 1 to 4 in the aspect of the stretchable portion having a relatively great straining force that extends downward therefrom. More specifically, the portion 2 expressed as the stretchable portion (A) having a relatively great straining force that substantially covers the ligamentum collateralle 3 on the medial side of the knee joint of the human body, and extends approximately along a vicinity of a periphery of the patella 1 on the medial side thereof so as to surround the patella through not less than approximately ¼ (here, approximately 1.7/4) of the periphery of the patella 1 and to cover a part of an inferior region 4 of the patella 1. On the other hand, a stretchable portion 150 having a relatively great straining force that extends downward therefrom extends obliquely through the anterior side of the lower leg region to the lateral side in a direction toward the malleolus lateralis 16'. The stretchable portion 150 having a relatively great straining force, on the superior side of the knee joint, extends from the medial side to the lateral side of the thigh via the anterior side thereof approximately along the musculus sartorius 6 to a vicinity of the trochanter major 8, passing a superior part 7 of the musculus rectus femoris.

Therefore, the portion on the superior side of the knee joint displays the same function as that in the case of FIGS. 1 to 4, and the straining force is exerted to both of the superior and inferior parts of the ligamentum collateralle medialis 3 so as to pull up the same obliquely outward. Therefore, this provides the firmer support of the ligamentum collateralle medialis 3.

Figure 57:
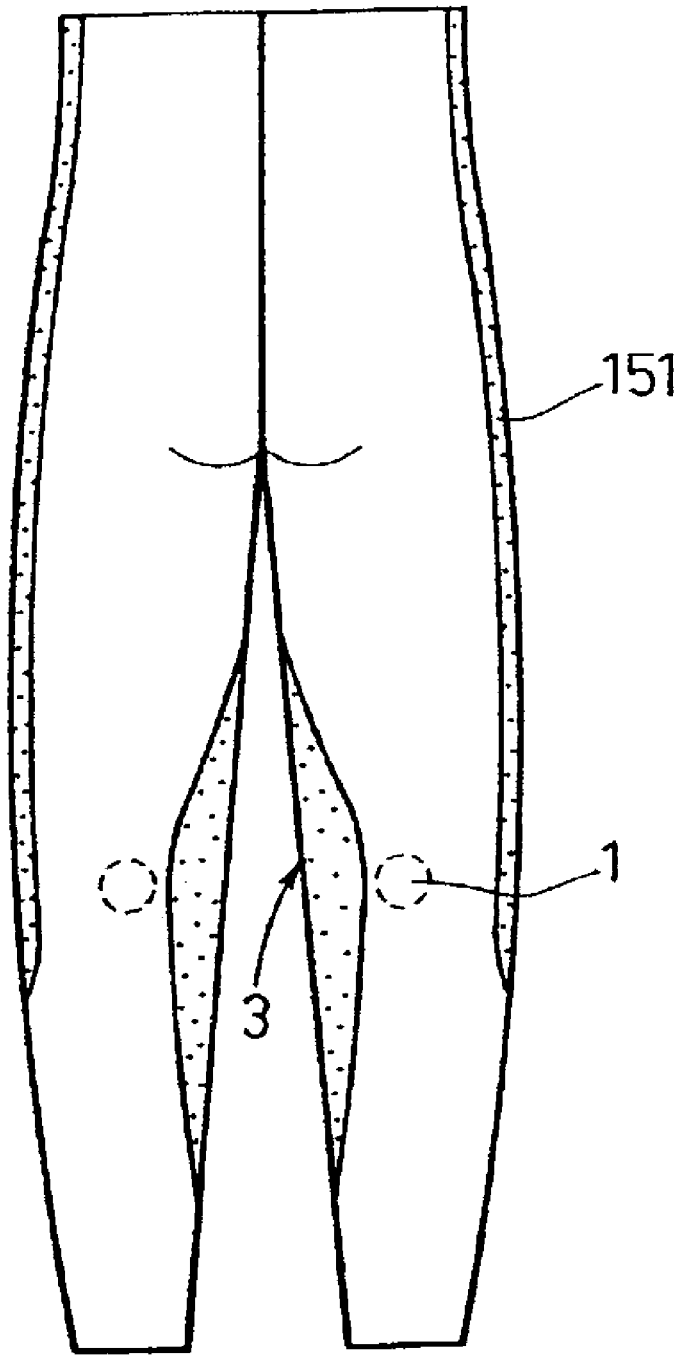
FIG. 57 is a rear view illustrating still another embodiment of a long-tights-type leg support garment of the present invention.
Figure 58:
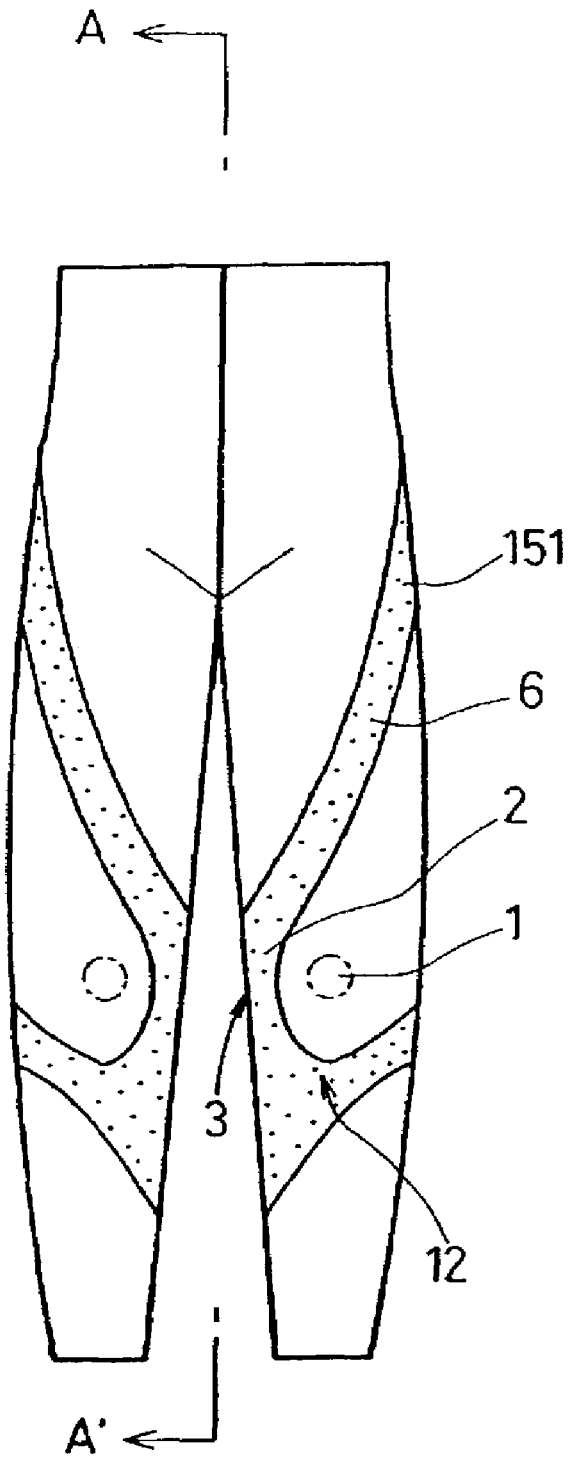
FIG. 58 is a front view of the leg support garment shown in FIG. 57
Figure 59:
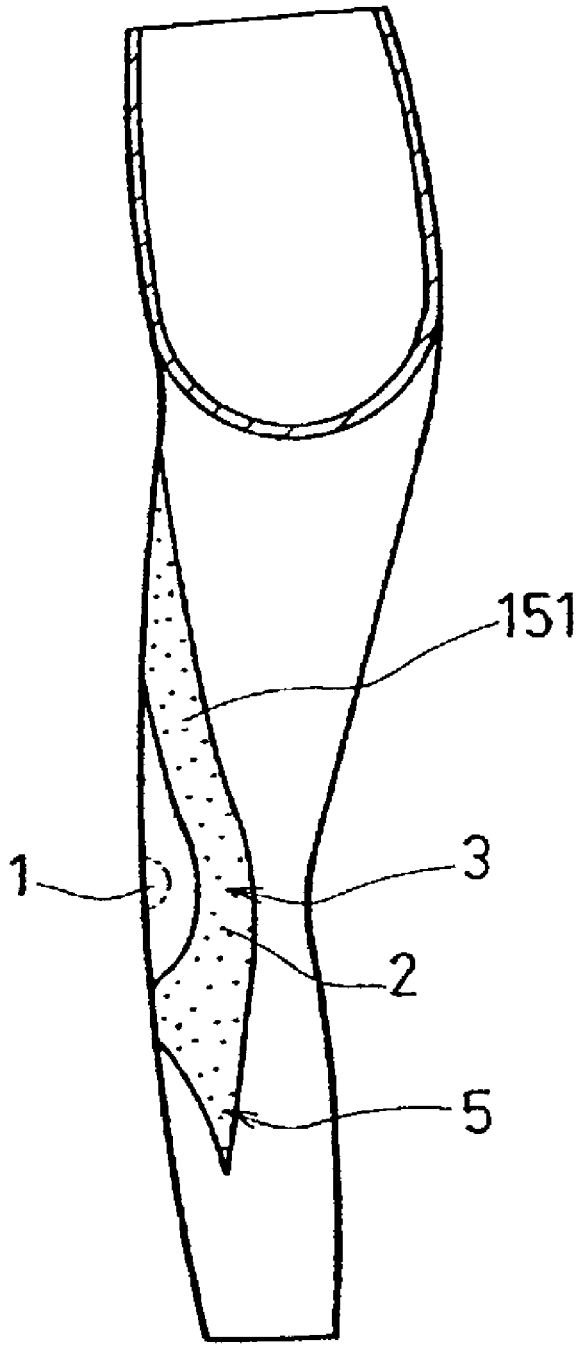
FIG. 59 is a cross-sectional view of the leg support garment taken along an A–A' line in FIG. 58.
Figure 60:
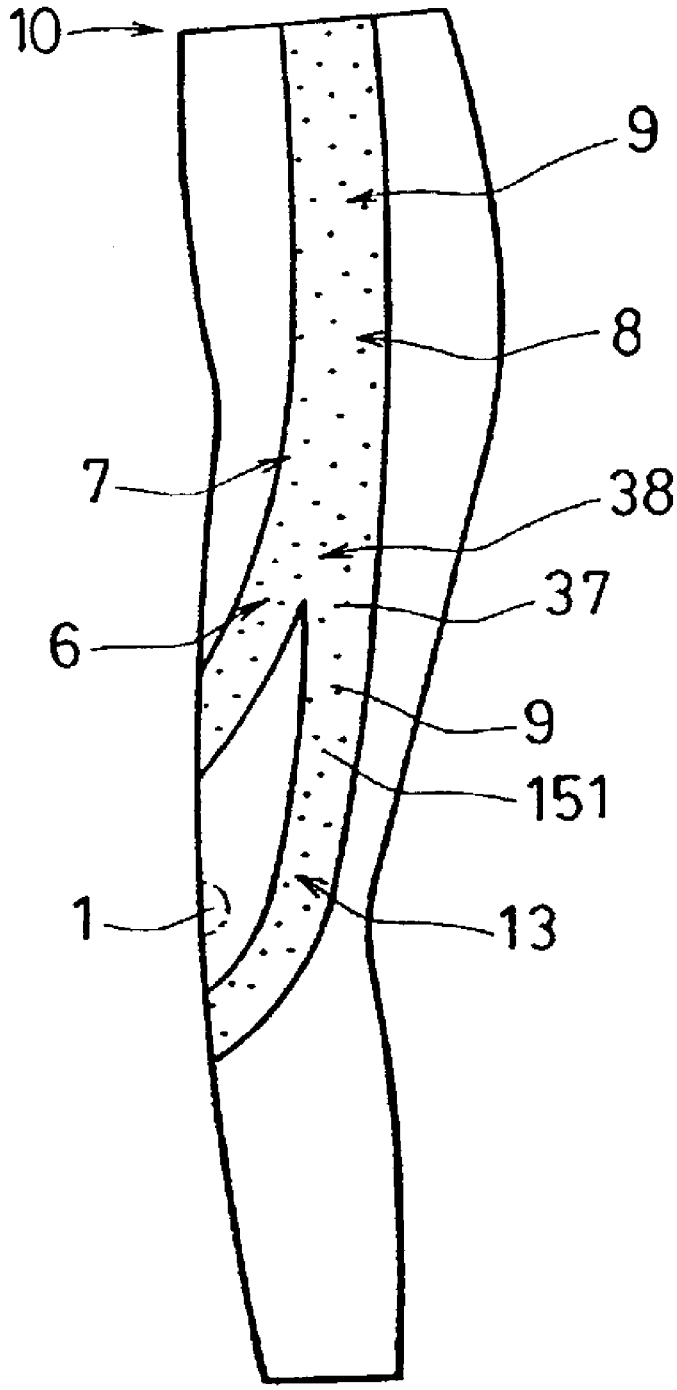
FIG. 60 is a right-side view of the leg support garment shown in FIG. 58.

Next, FIGS. 57 to 60 are views illustrating still another embodiment of a long-tights-type leg support garment of the present invention. FIG. 57 is a rear view of the same, FIG. 58 is a front view of the same, FIG. 59 is a cross-sectional view of the same taken along an A–A' line in FIG. 58, and FIG 60 is a right-side view of the same.

The garment of the present embodiment resembles the garment shown in FIGS. 13 to 16 in the aspect that a stretchable portion 151 having a relatively great straining force surrounds the inferior side of the patella 1. The former differs from the latter in the following aspect. Namely, the stretchable portion having a relatively great straining force extends obliquely upward from a side of the musculus gastrocnemius on the medial side through the vicinity 12 of the inferior side of the patella, further upward via the lateral side 13 of the patella 1 along the musculus vastus lateralis 37 and the tractus iliotibialis 9, and join in at a junction point 38 with a stretchable portion having a relatively great straining force that extends from the medial side to the lateral side of the thigh via the anterior side thereof approximately along the musculus sartorius 6 to a vicinity of the trochanter major 8, passing a superior part 7 of the musculus rectus femoris, and further, along the tractus iliotibialis 9 to the vicinity of the waist 10.

The foregoing embodiment allows the garment to display the same function as that of the garment shown in FIGS. 13 to 16, and to provide more stable support of the knee joint. Besides, as compared with the garment shown in FIGS. 13 to 16, the garment of the present embodiment further includes the stretchable portion having a relatively great straining force that extends from the vicinity of the trochanter major 8 along the tractus iliotibialis 9 to the vicinity of the waist 10. Therefore, the function of intensely pressing the trochanter major 8 is enhanced also, thereby improving the connection between the caput ossis femoris and the acetabulum. Therefore, this further provides a function of enhancing the stability of the hip joint. Thus, the present embodiment is preferable.

Figure 61:
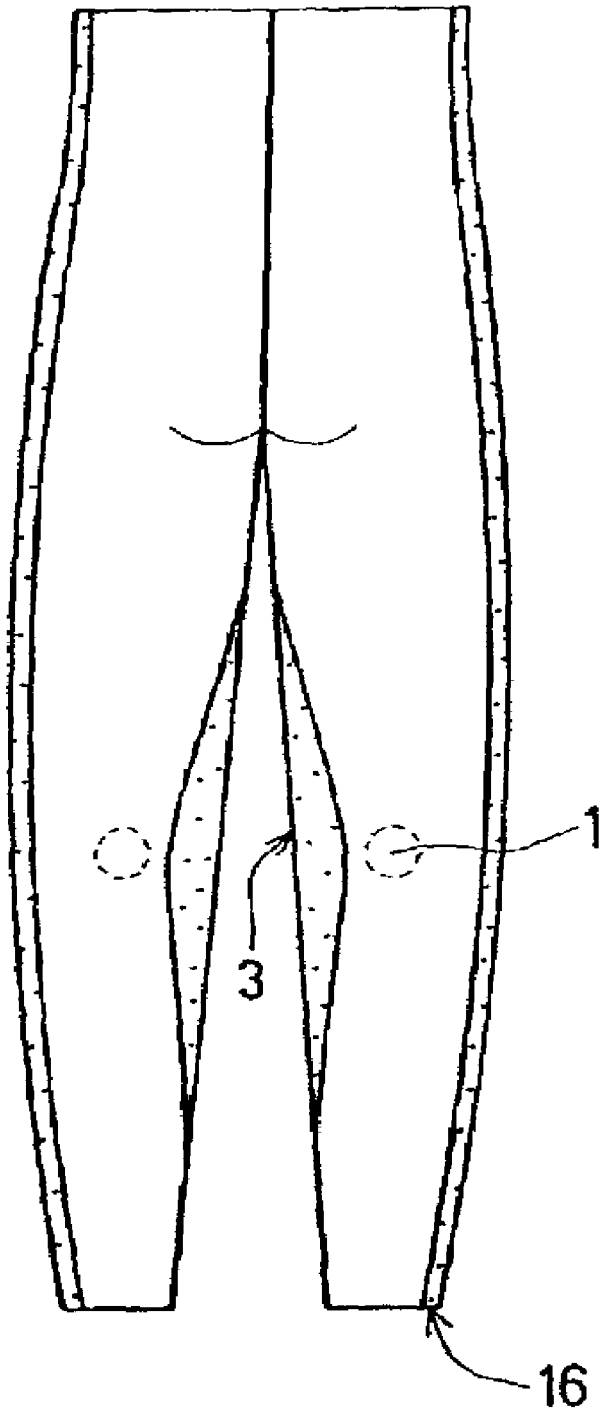
FIG. 61 is a rear view illustrating still another embodiment of a long-tights-type leg support garment of the present invention.
Figure 62:
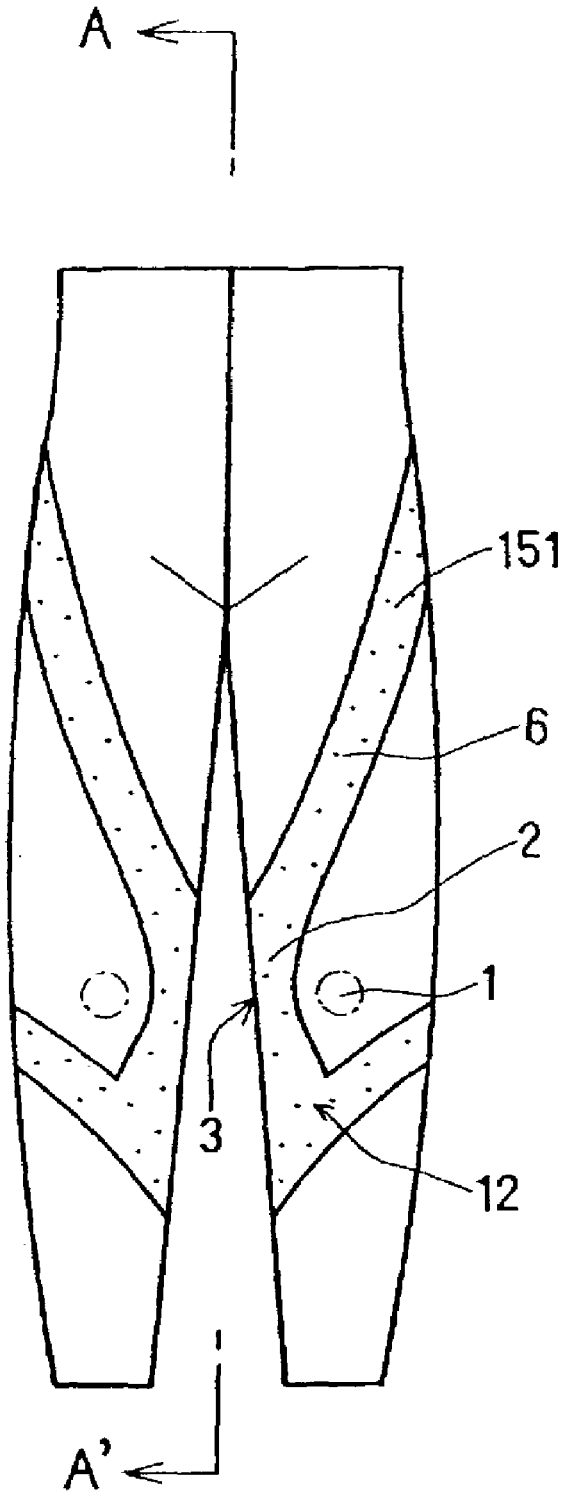
FIG. 62 is a front view of the leg support garment shown in FIG. 61
Figure 63:
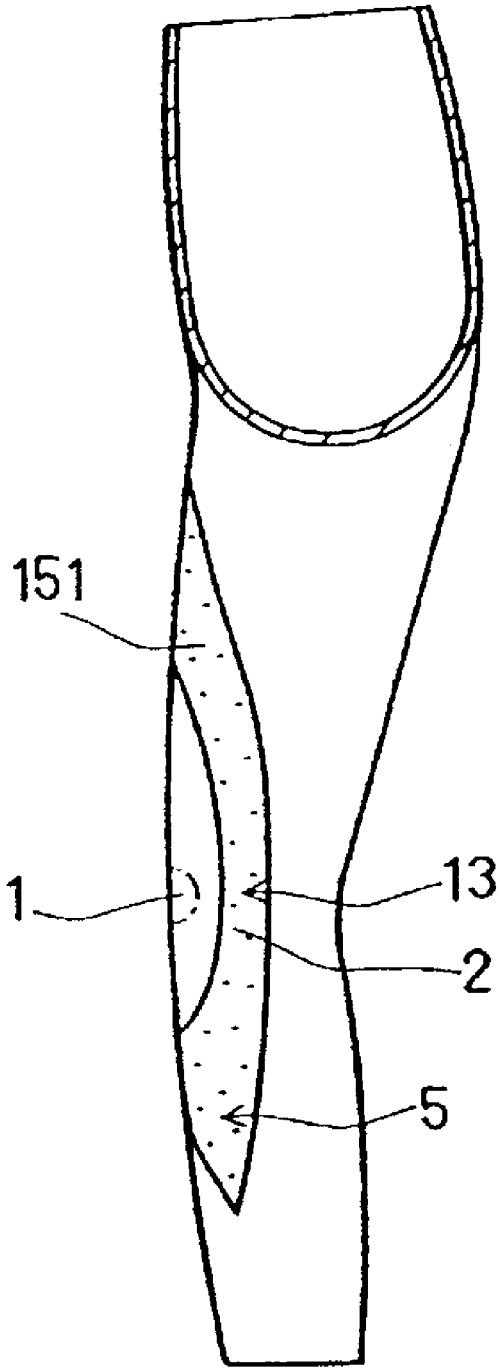
FIG. 63 is a cross-sectional view of the leg support garment taken along an A–A' line in FIG. 62.
Figure 64:
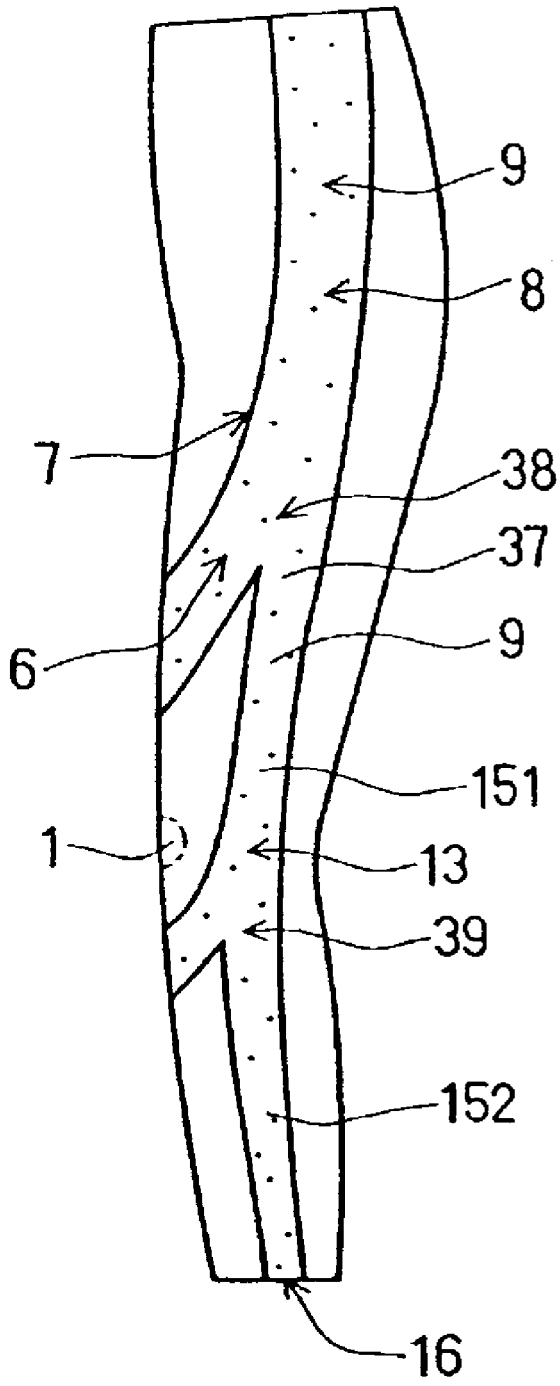
FIG. 64 is a right-side view of the leg support garment shown in FIG. 62.

Next, FIGS. 61 to 64 are views illustrating still another embodiment of a long-tights-type leg support garment of the present invention. FIG. 61 is a rear view of the same, FIG. 62 is a front view of the same, FIG. 63 is a cross-sectional view of the same taken along an A–A' line in FIG. 62, and FIG. 64 is a right-side view of the same.

The garment of the present embodiment is a modification of the embodiment shown in FIGS. 57 to 60; namely, the stretchable portion 151 having a relatively great straining force in the embodiment shown in FIGS. 57 to 60 further includes a stretchable portion 152 having a relatively great straining force that extends from a junction position 39 downward, passes a side of the musculus gastrocnemius and the musculus soleus on the lateral side, a then reaches the superior side 16 of the malleolus lateralis.

With the foregoing embodiment, the same function as that of the garment shown in FIGS. 57 to 60 is displayed, and further, the musculus gastrocnemius and the musculus soleus are supported from their sides without hindering their actions. Thus, the foregoing embodiment is preferable.

Figure 65:
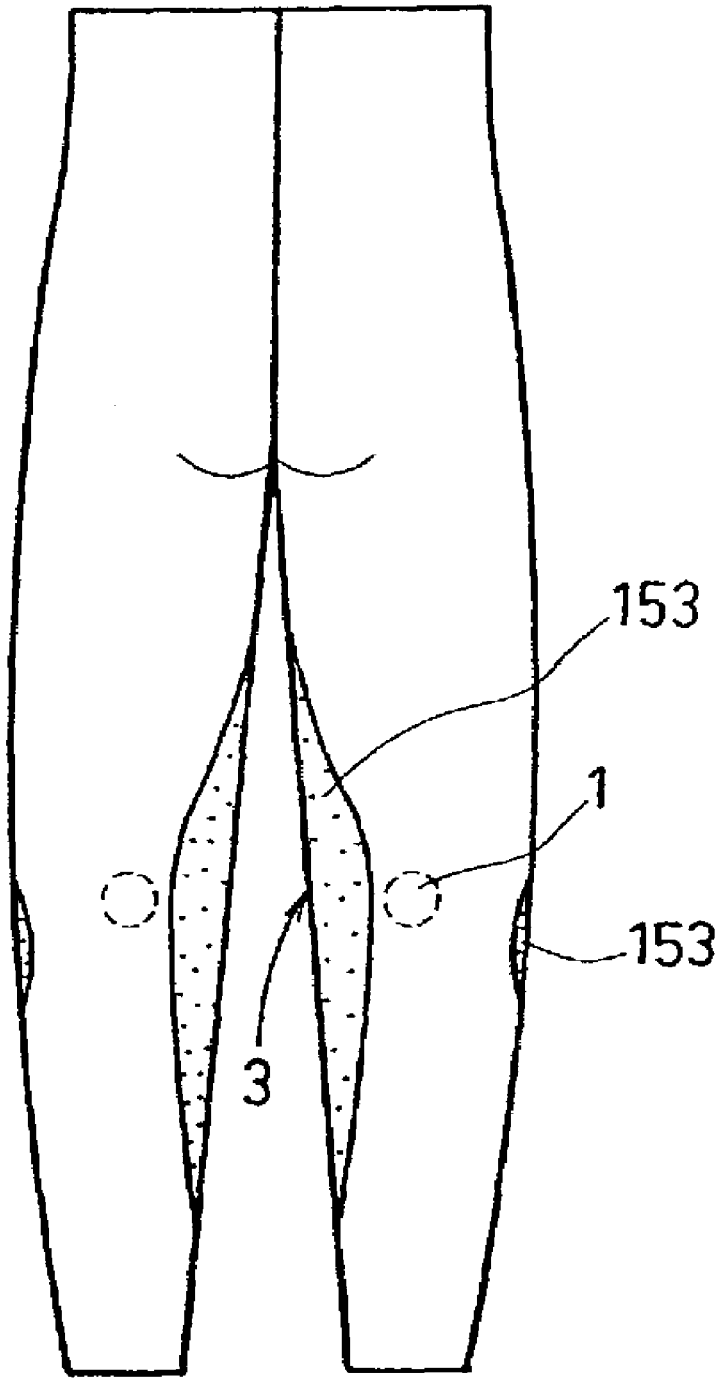
FIG. 65 is a rear view illustrating still another embodiment of a long-tights-type leg support garment of the present invention.
Figure 66:
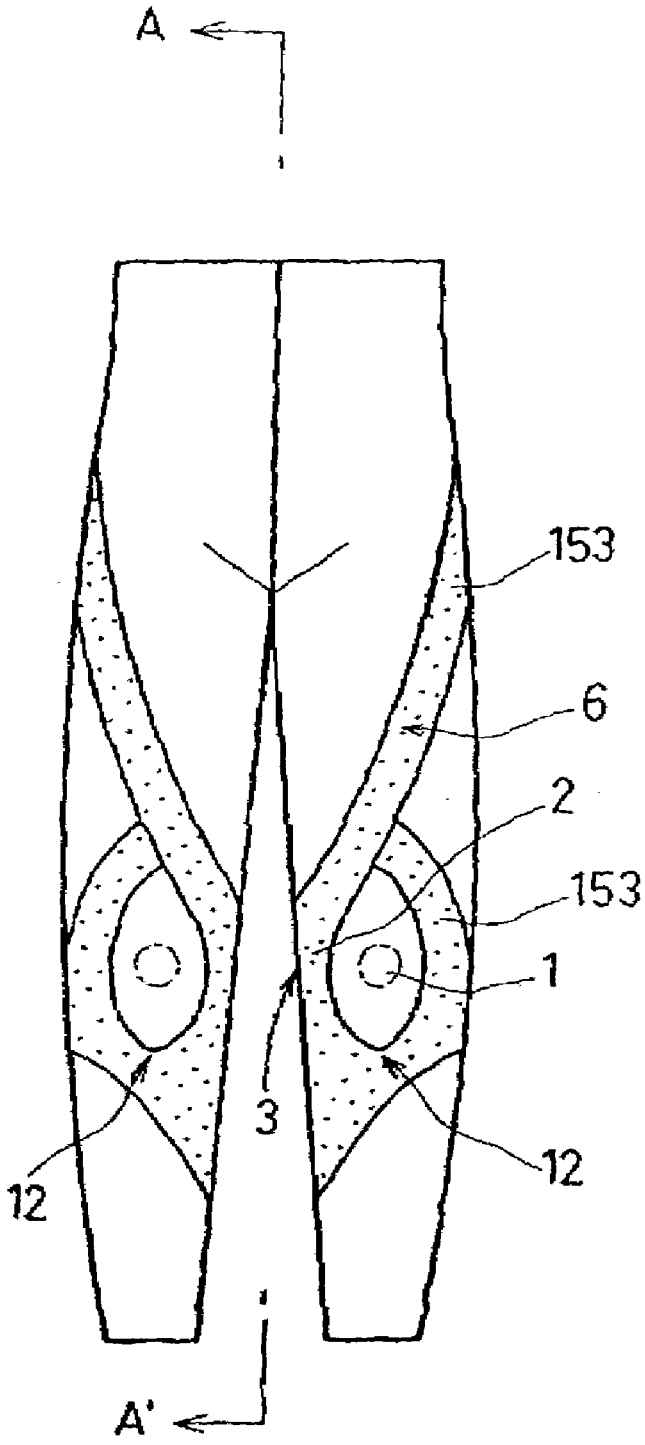
FIG. 66 is a front view of the leg support garment shown in FIG. 65
Figure 67:
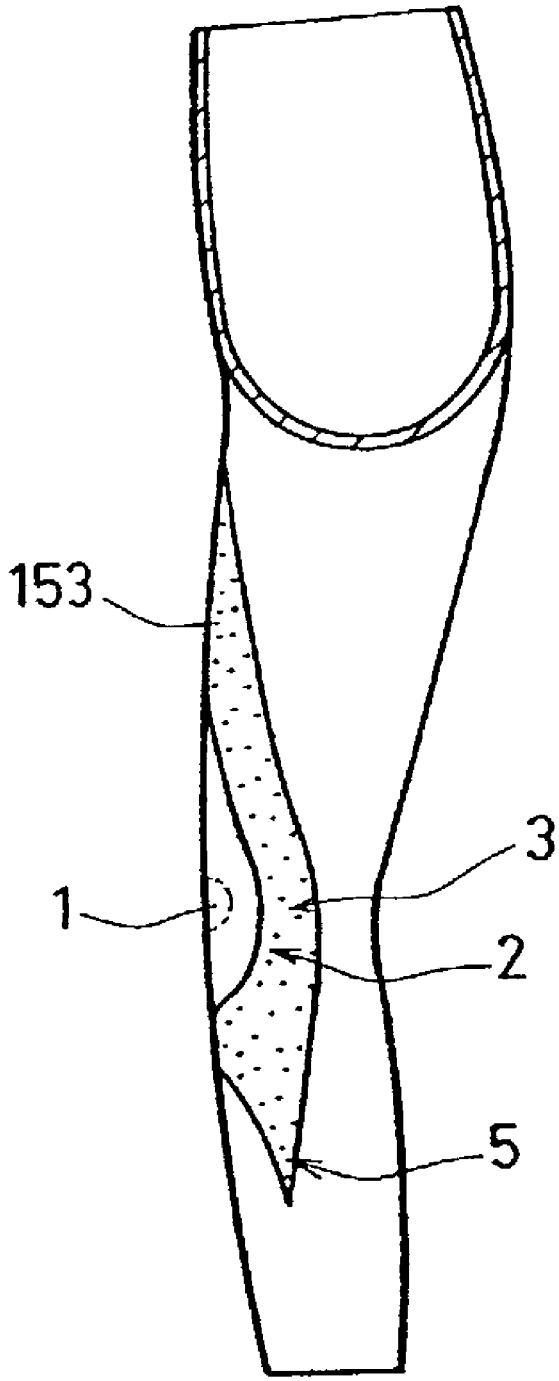
FIG. 67 is a cross-sectional view of the leg support garment taken along an A–A' line in FIG. 66.
Figure 68:
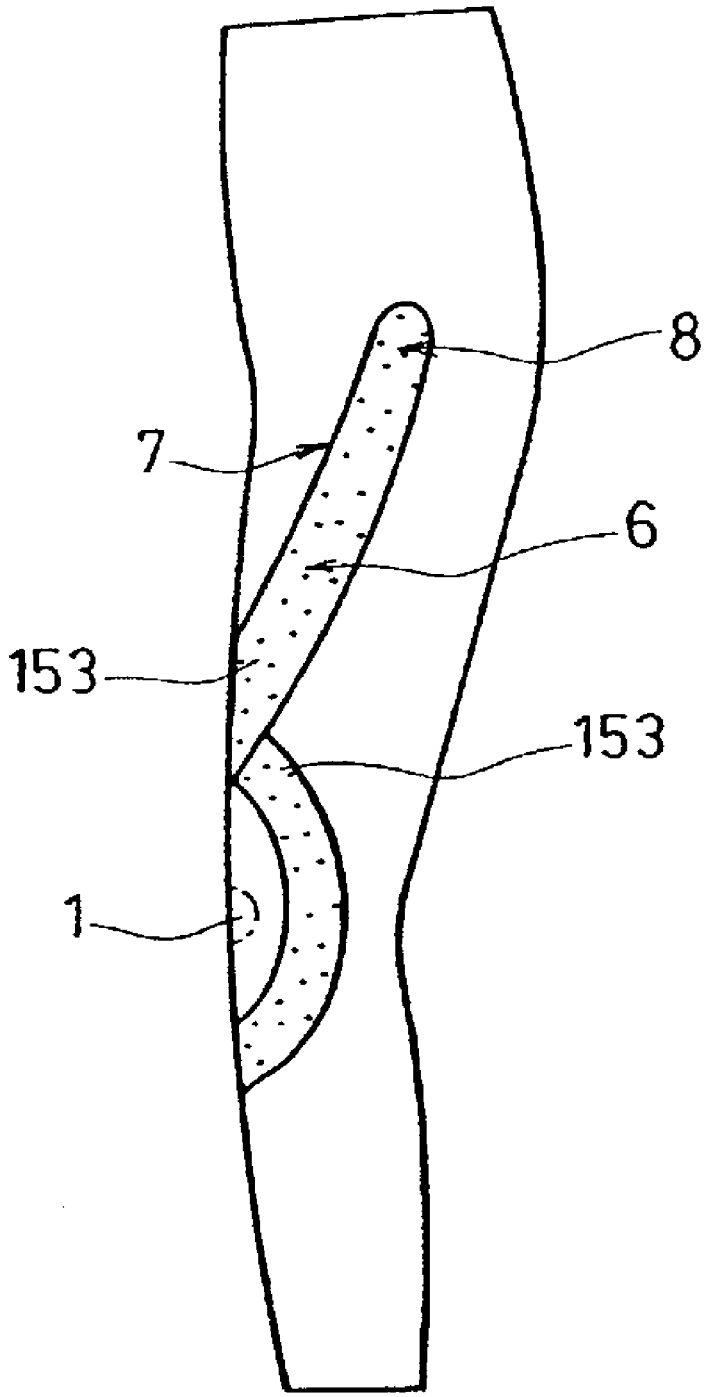
FIG. 68 is a right-side view of the leg support garment shown in FIG. 66.

Next, FIGS. 65 to 68 are views illustrating still another embodiment of a long-tights-type leg support garment of the present invention. FIG. 65 is a rear view of the same, FIG. 66 is a front view of the same, FIG. 67 is a cross-sectional view of the same taken along an A–A' line in FIG. 66, and FIG. 68 is a right-side view of the same.

The garment of the present embodiment is a modification of the embodiment shown in FIGS. 13 to 16. This is characterized in that a stretchable portion 153 having a relative great straining force completely surrounds the patella 1. This further enhances the stability of the knee. It should be noted that the other aspects other than the stretchable portion 153 having a relative great straining force are the same as those of the stretchable part having a relatively great straining force shown in FIGS. 13 to 16.

The foregoing embodiment allows the garment to display the same function as that of the garment shown in FIGS. 13 to 16, and further provides the more stable support of the knee joint.

Figure 69:
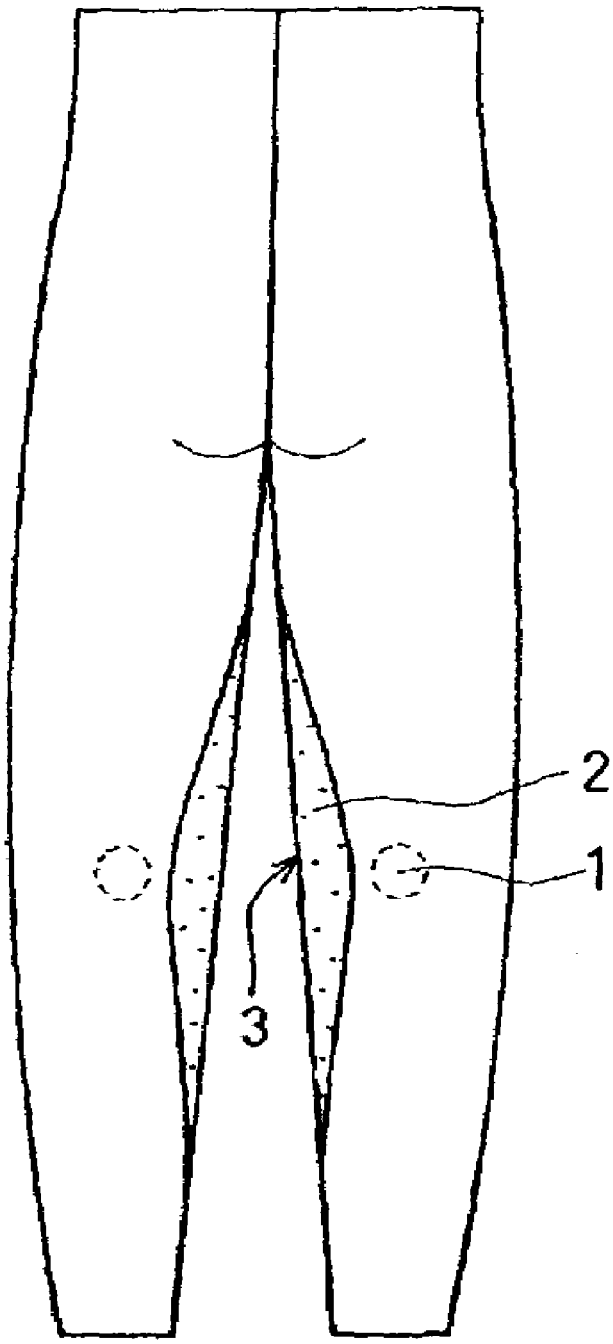
FIG. 69 is a rear view illustrating still another embodiment of a long-tights-type leg support garment of the present invention.
Figure 70:
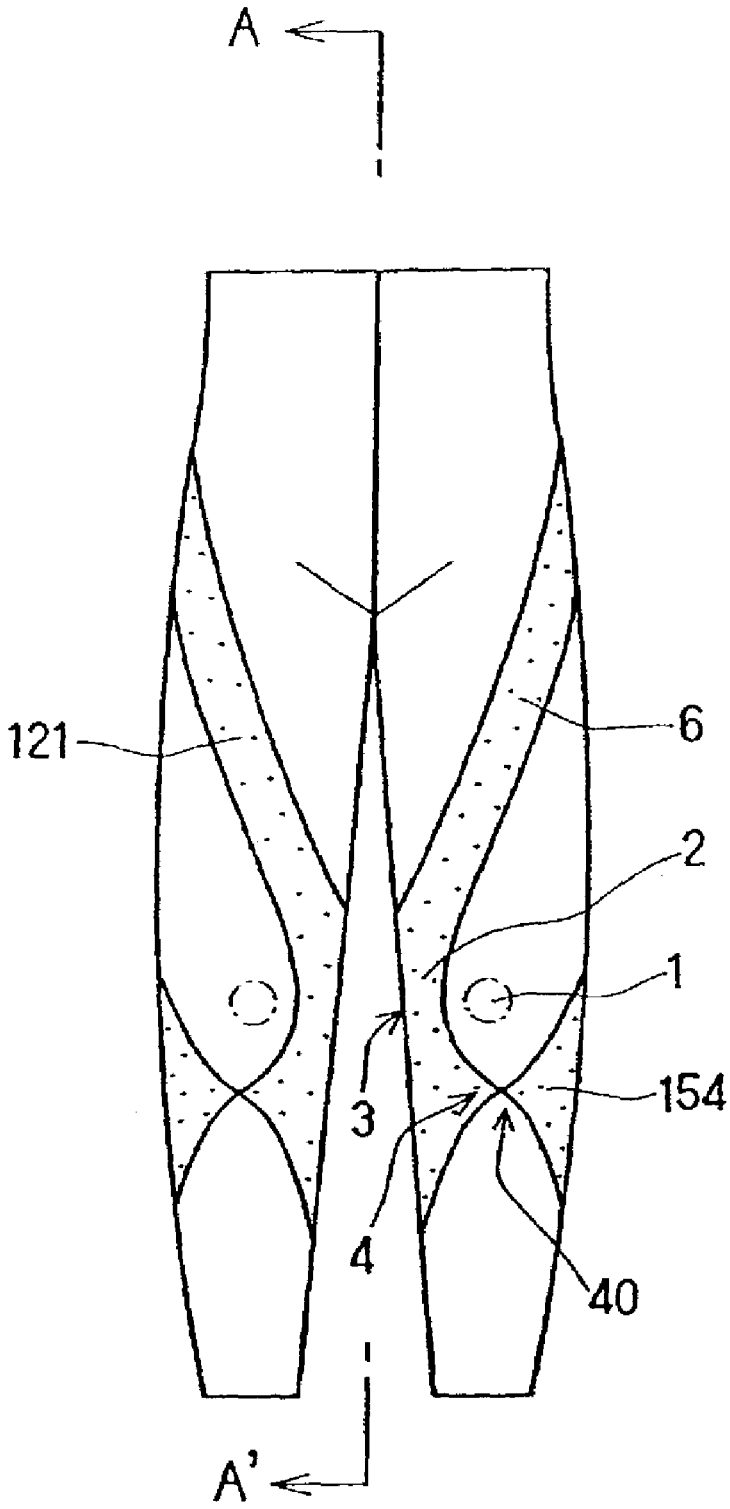
FIG. 70 is a front view of the leg support garment shown in FIG. 69
Figure 71:
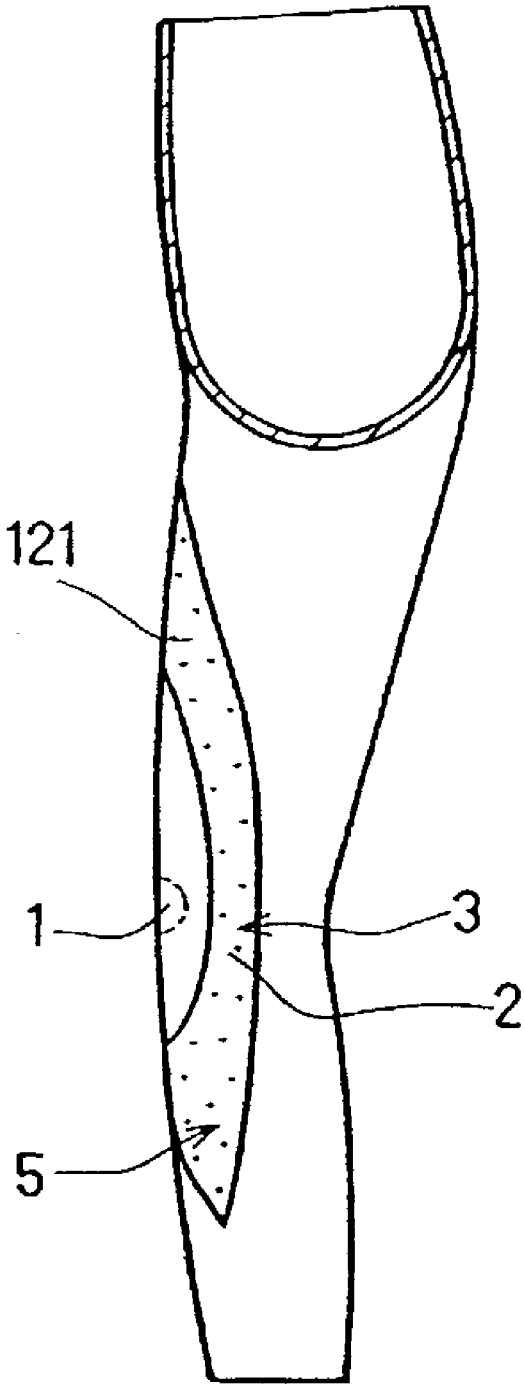
FIG. 71 is a cross-sectional view of the leg support garment taken along an A–A' line in FIG. 70.
Figure 72:
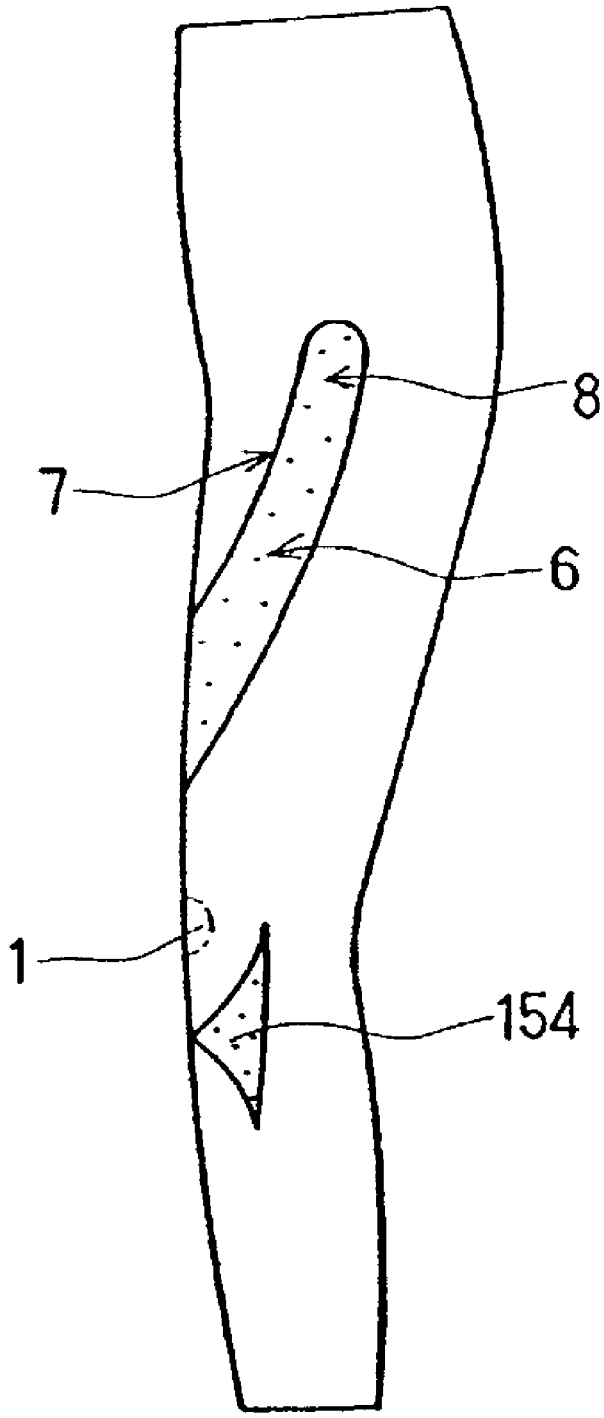
FIG. 72 is a right-side view of the leg support garment shown in FIG. 70.

Next, FIGS. 69 to 72 are views illustrating still another embodiment of a long-tights-type leg support garment of the present invention. FIG. 69 is a rear view of the same, FIG. 70 is a front view of the same, FIG. 71 is a cross-sectional view of the same taken along an A–A' line in FIG. 70, and FIG. 72 is a right-side view of the same.

The garment according to the present embodiment is a modification of the embodiment shown in FIGS. 1 to 4. The garment of the present embodiment has the following characteristic common to the leg support garment shown in FIGS. 1 to 4. The portion 2 expressed as the stretchable portion (A) having a relatively great straining force that is composed of a stretchable portion (A1) 12 having a relatively great straining force. The stretchable portion (A1) 121 having a relatively great straining force substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7¼) of the periphery of the patella 1 and to cover a part of an inferior region 4 of the patella 1, reaches a side 5 of the musculus gastrocnemius and the musculus soleus on the medial side, and on the superior side of the knee joint, extends from the medial side to the lateral side of the thigh via the anterior side thereof approximately along the musculus sartorius 6 toward the vicinity of the trochanter major 8, passing a superior part 7 of the musculus rectus femoris. In the present embodiment, however, a triangle-shaped stretchable portion 154 having a relatively great straining force is further provided on the lateral inferior side of the patella 1, and the vertex of the projecting portion 4 having a relatively great straining force covering the inferior region of the patella 1 of the stretchable portion 121 having a relatively great straining force is in contact with a vertex 40 of the stretchable portion 154 having a relatively great straining force at a position on the inferior side of the patella 1 so as to support the knee from the right, left, and inferior sides. Therefore, the same function as that of the leg support garment shown in FIGS. 1 to 4 is exhibited, while the function of supporting the knee from the inferior side is reinforced. It should be noted that the projecting portion 4 of the stretchable portion having a relatively great straining force that covers the inferior region 4 of the patella 1 and the stretchable portion 154 having a relatively great straining force may overlap each other, rather than only with the vertex of the former and the vertex 40 of the latter being in contact with each other.

Figure 73:
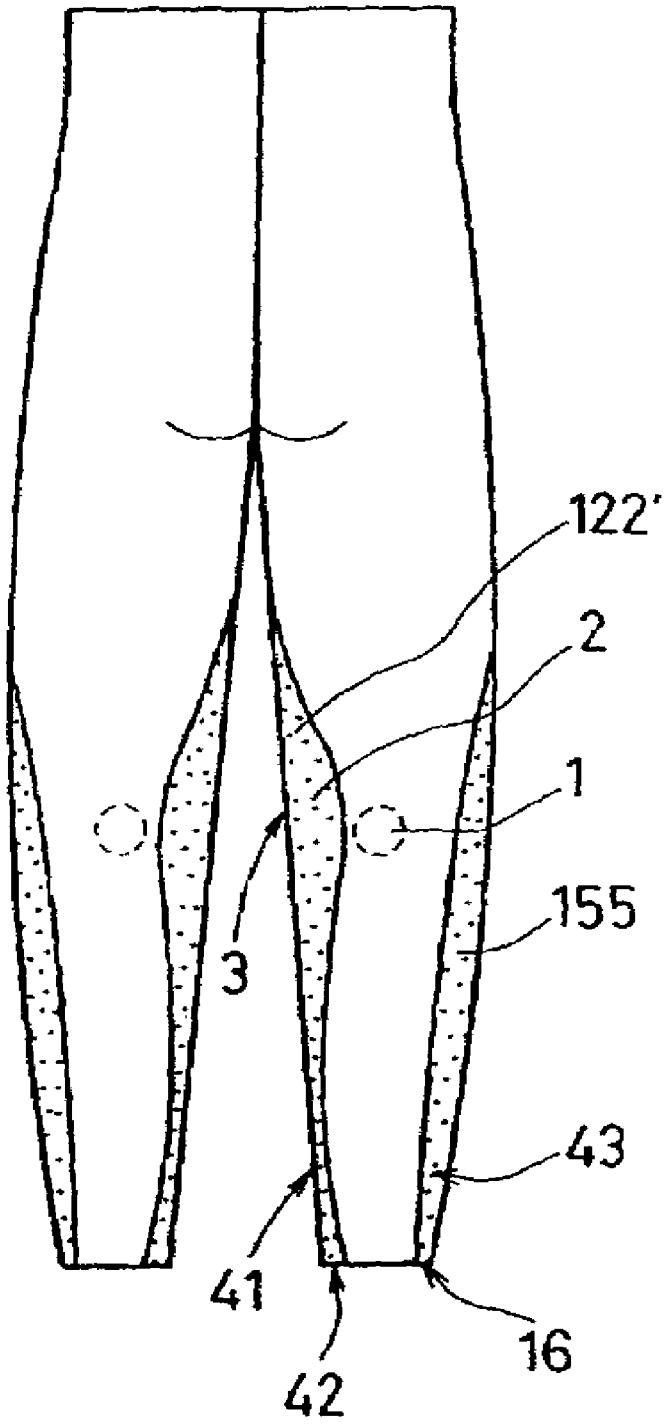
FIG. 73 is a rear view illustrating still another embodiment of a long-tights-type leg support garment of the present invention.
Figure 74:
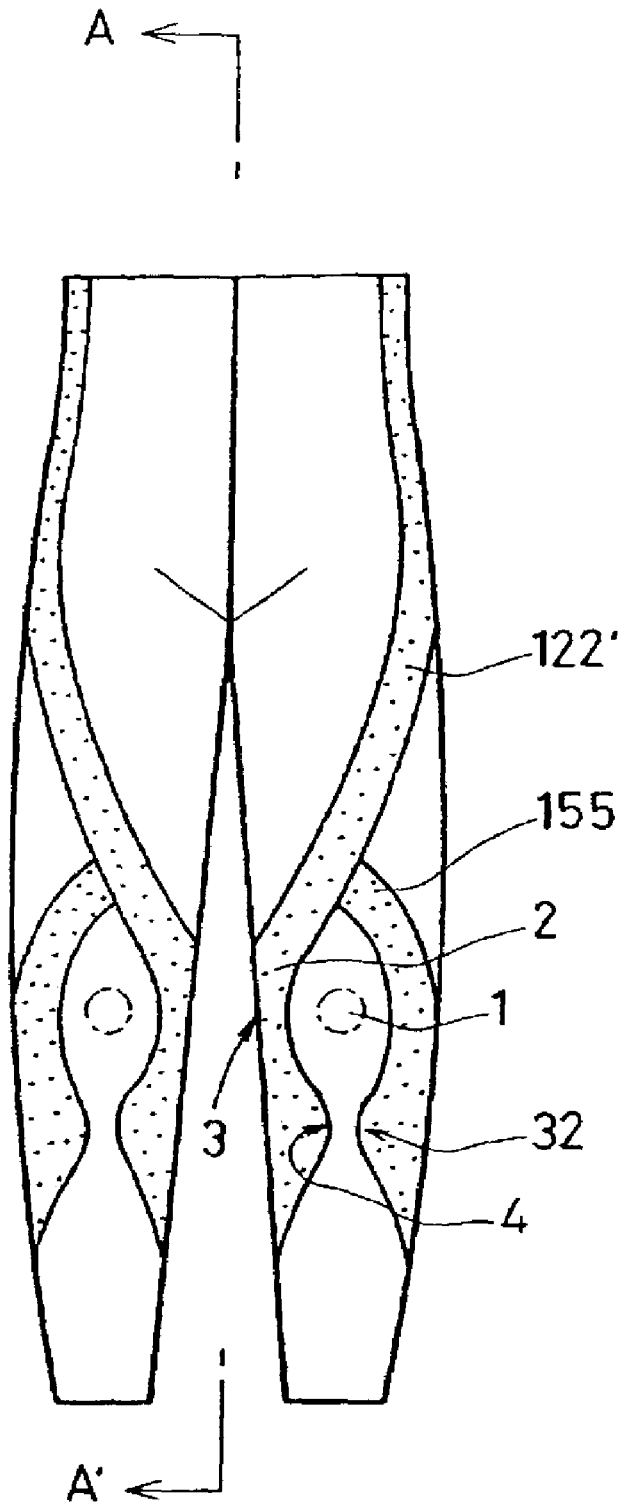
FIG. 74 is a front view of the leg support garment shown in FIG. 73
Figure 75:
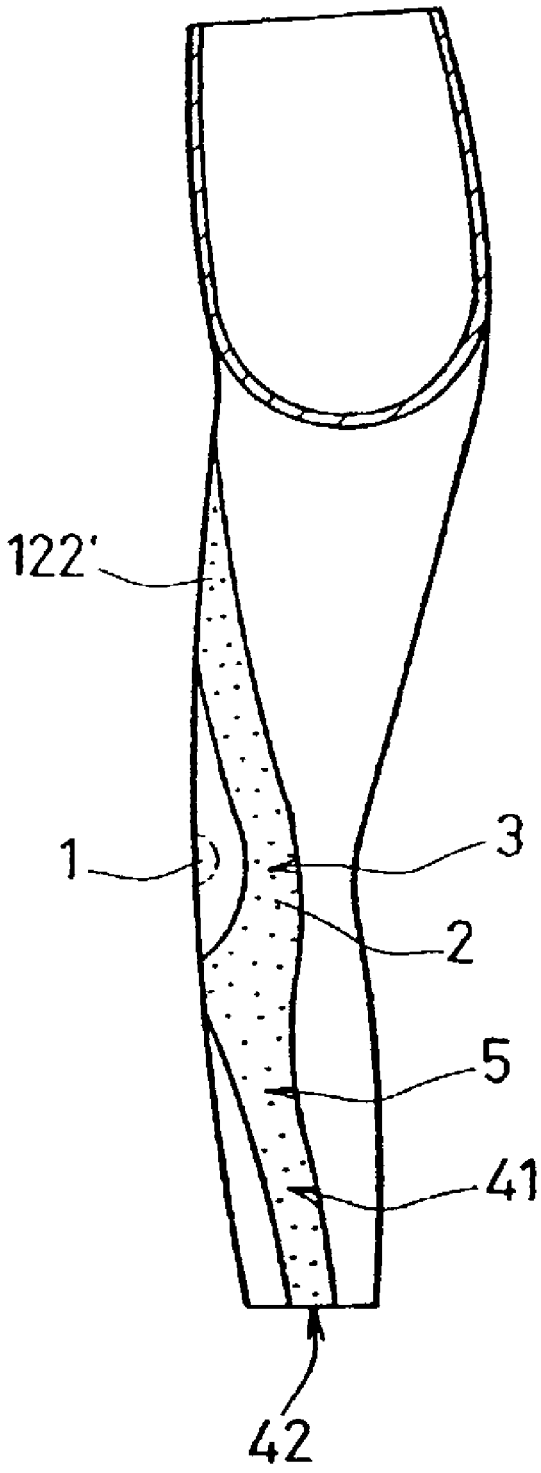
FIG. 75 is a cross-sectional view of the leg support garment taken along an A–A' line in FIG. 74.
Figure 76:
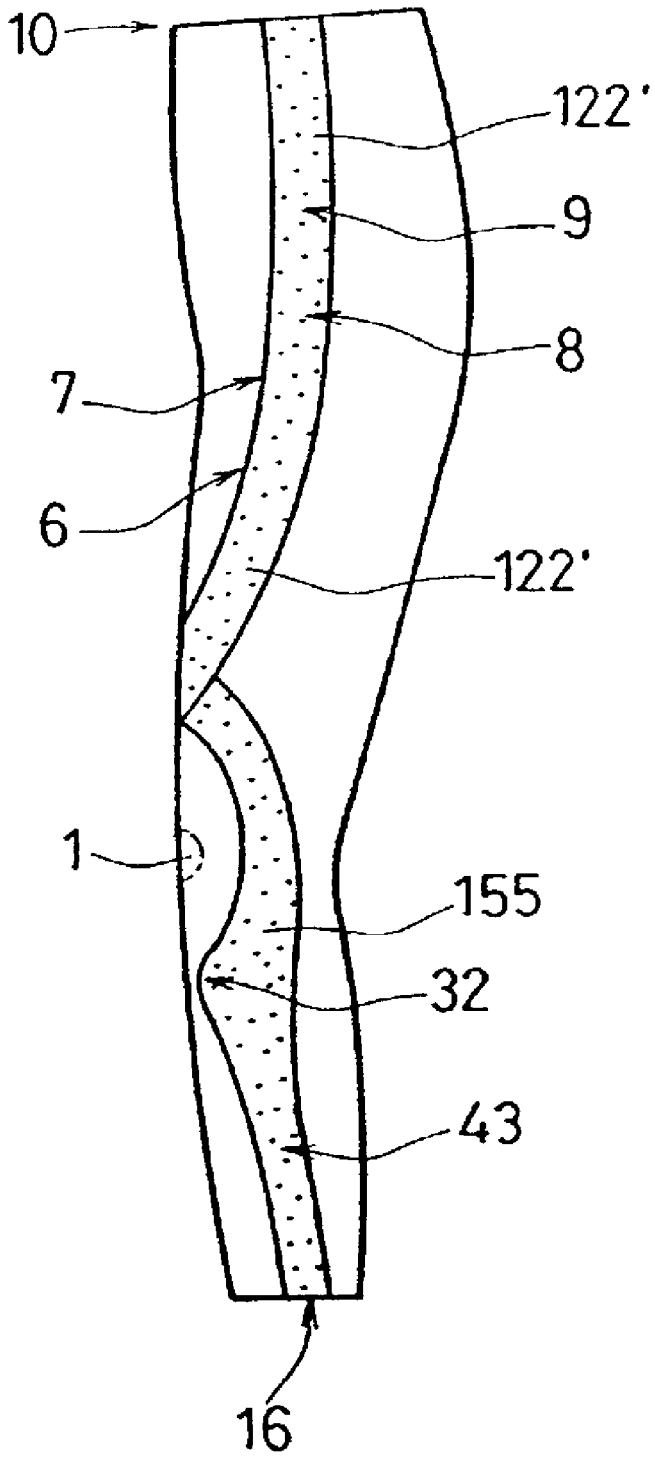
FIG. 76 is a right-side view of the leg support garment shown in FIG. 74.

Next, FIGS. 73 to 76 are views illustrating still another embodiment of a long-tights-type leg support garment of the present invention. FIG. 73 is a rear view of the same, FIG. 74 is a front view of the same, FIG. 75 is a cross-sectional view of the same taken along an A–A' line in FIG. 74, and FIG. 76 is a right-side view of the same.

The garment of the present embodiment is a garment as a modification of the embodiment shown in FIGS. 5 to 8; namely, the portion 2 expressed as the stretchable portion (A) having a relatively great straining force includes a stretchable portion 122' having a relatively great straining force that resembles a combination of the stretchable portions 121 and 122 having relatively great straining forces. The stretchable portion 122' substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7¼) of the periphery of the patella 1 and to cover a part of an inferior region 4 of the patella 1, and reaches a side 5 of the musculus gastrocnemius and the musculus soleus on the medial side. Then, from the side 5 of the musculus gastrocnemius and the musculus soleus on the medial side, the portion 122' passes a side 41 of an inferior part of the musculus gastrocnemius and the musculus soleus on the medial side to a superior side 42 of the malleolus medialis. On the superior side of the knee joint, the portion 122' extends from the medial side to the lateral side of the thigh via the anterior side thereof approximately along the musculus sartorius 6 toward the vicinity of the trochanter major 8, passing a superior part 7 of the musculus rectus femoris. Further, the portion 122' extends therefrom along the tractus iliotibialis 9 to the vicinity of the waist 10. The stretchable portion 122' having the relatively great straining force slightly differs from the combination of the stretchable portions 121 and 122 having relatively great straining forces in the aspect that the former further extends from the side 5 of the musculus gastrocnemius and the musculus soleus via the inferior side 41 of the musculus gastrocnemius and the musculus soleus to the superior side 42 of the malleolus medialis.

In the present embodiment, furthermore, a stretchable portion 155 having a relatively great straining force is provided, which extends from the superior side of the patella 1 via the lateral side thereof, covers an inferior region 32 of the patella, and further, passes a side 43 of the musculus gastrocnemius and the musculus soleus on the lateral side downward to a superior side 16 of the malleolus lateralis.

Therefore, the same function as that of the garment of the embodiment shown in FIGS. 5 to 8 is displayed, and further, since the foregoing garment supports the knee joint from the medial and lateral sides, it provides the more stable support of the knee joint. Moreover, since the stretchable portions having relatively great straining forces passes along both the medial and lateral sides of the musculus gastrocnemius and the musculus soleus, they support these musculus without hindering their actions. Thus, the foregoing embodiment is preferable.

Figure 77:
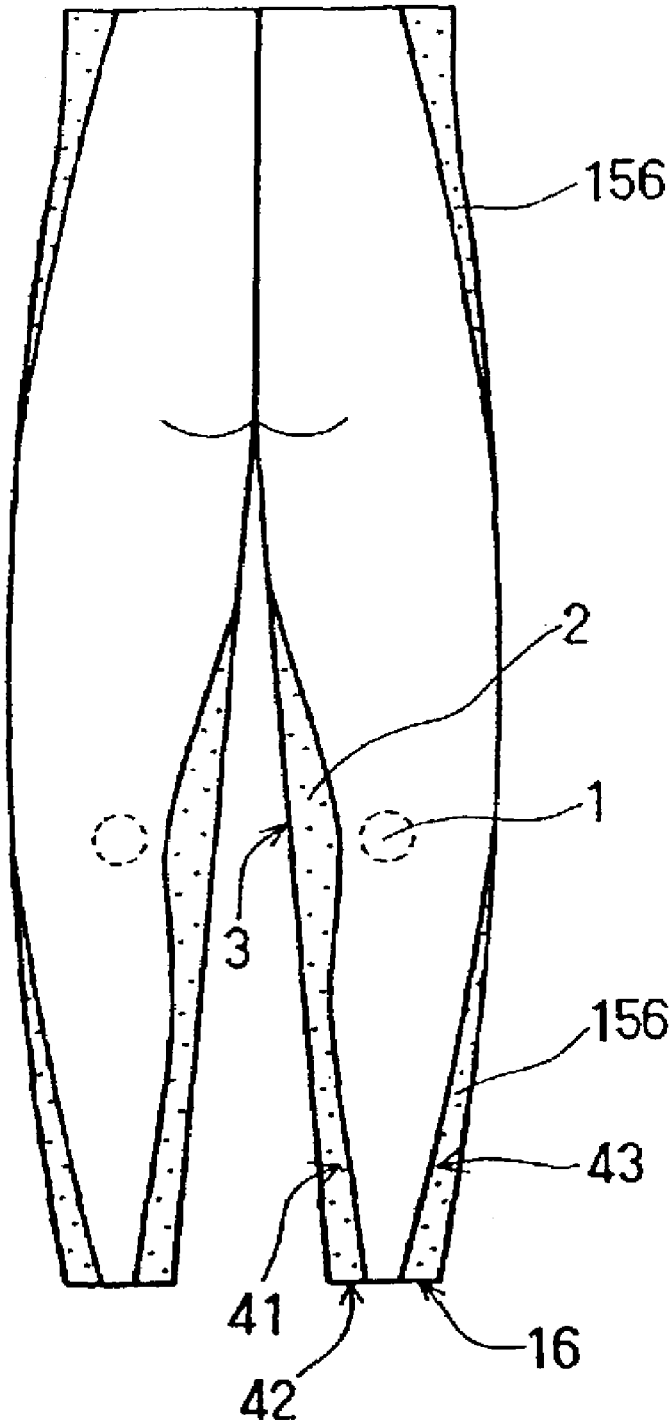
FIG. 77 is a rear view illustrating still another embodiment of a long-tights-type leg support garment of the present invention.
Figure 78:
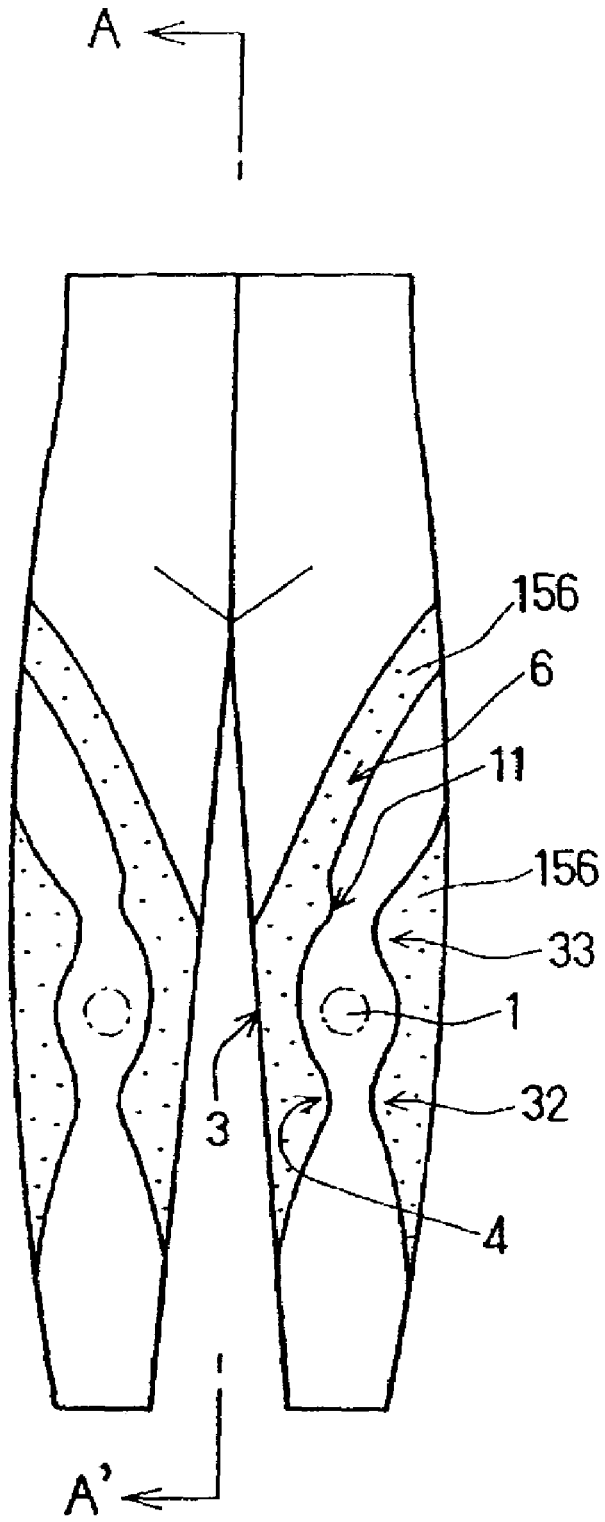
FIG. 78 is a front view of the leg support garment shown in FIG. 77
Figure 79:
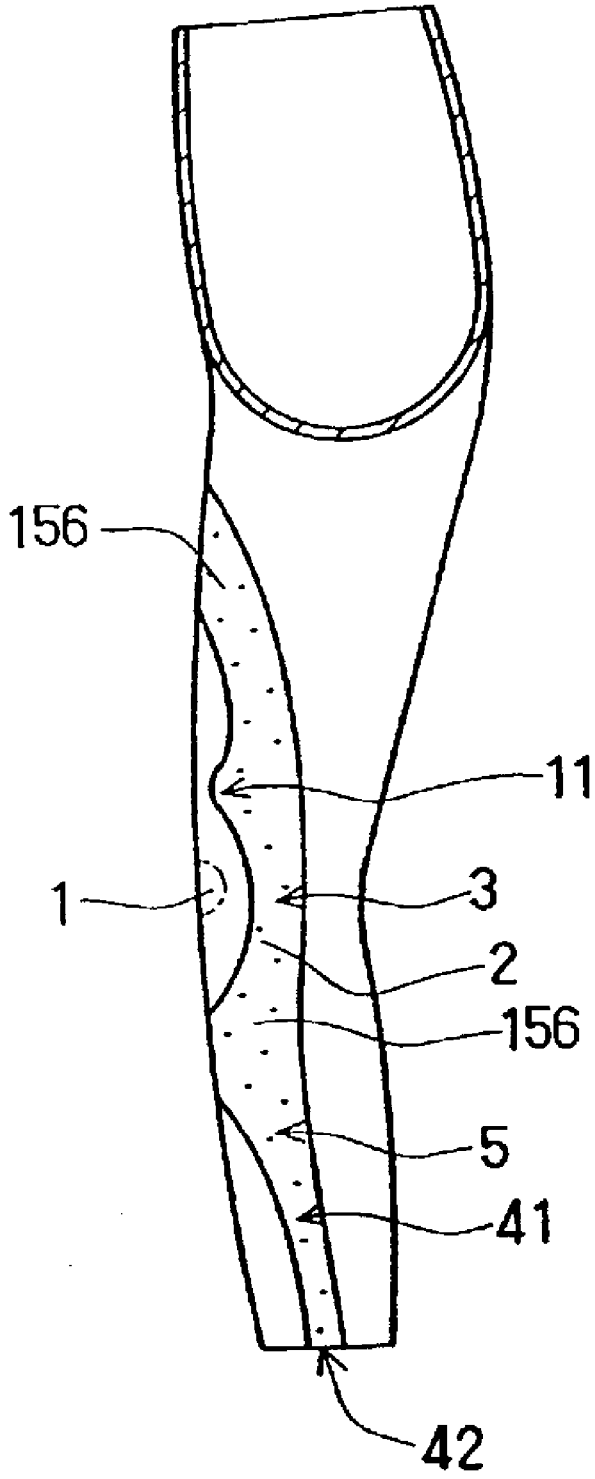
FIG. 79 is a cross-sectional view of the leg support garment taken along an A–A' line in FIG. 78.
Figure 80:
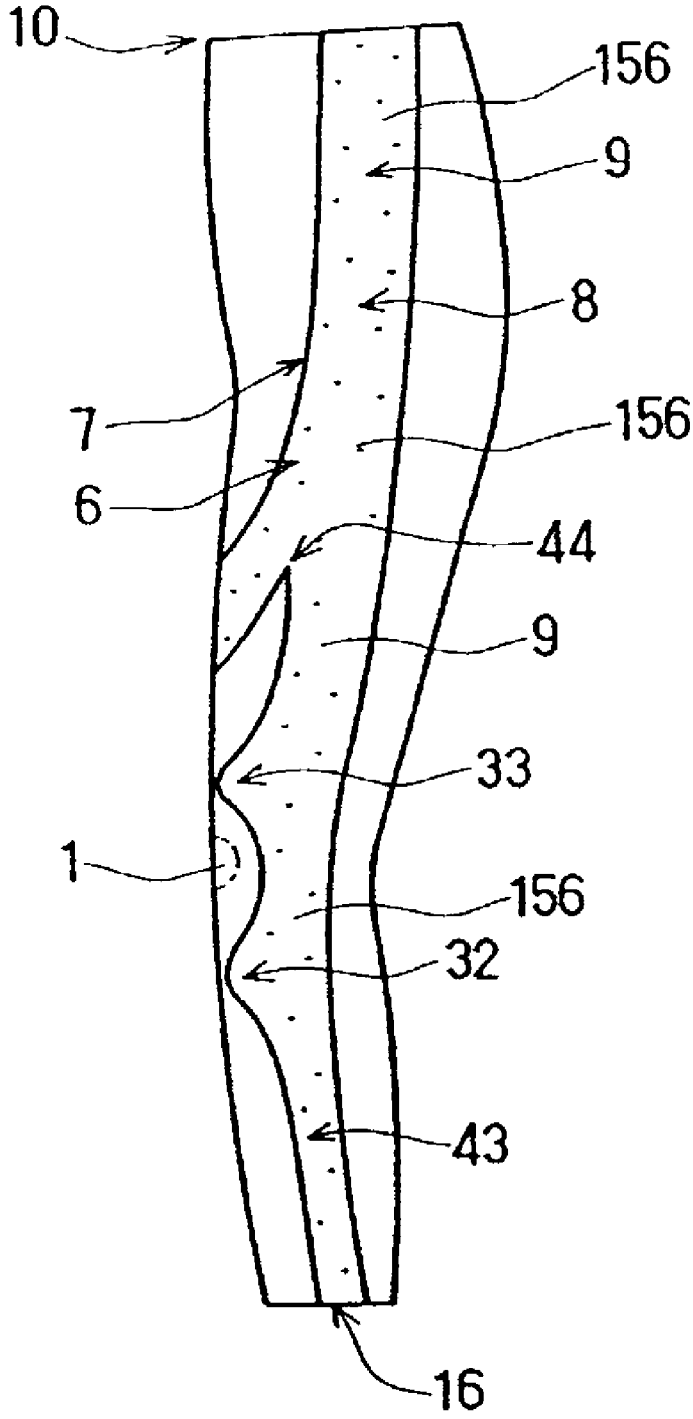
FIG. 80 is a right-side view of the leg support garment shown in FIG. 78.

Next, FIGS. 77 to 80 are views illustrating still another embodiment of a long-tights-type leg support garment of the present invention. FIG. 77 is a rear view of the same, FIG. 78 is a front view of the same, FIG. 79 is a cross-sectional view of the same taken along an A–A' line in FIG. 78, and FIG. 80 is a right-side view of the same.

The garment of the present embodiment is a garment as a modification of the embodiment shown in FIGS. 9 to 12; namely, the portion 2 expressed as the stretchable portion (A) having a relatively great straining force includes a stretchable portion 156 having a relatively great straining force that resembles a combination of the stretchable portions 121 and 122 having relatively great art straining forces. The stretchable portion 156 having a relatively great straining force substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7/4) of the periphery of the patella 1 and to cover a part of an inferior region 4 and a superior region 11 of the patella 1. Then, from a side 5 of the musculus gastrocnemius and the musculus soleus on the medial side, the portion 156 extends via a side 41 of an inferior part of the musculus gastrocnemius and the musculus soleus on the medial side to a superior side 42 of the malleolus medialis. On the superior side of the knee joint, the portion 156 extends from the medial side to the lateral side of the thigh via the anterior side thereof approximately along the musculus sartorius 6 toward the vicinity of the trochanter major 8, passing a superior part 7 of the musculus rectus femoris. Further, the portion 156 extends therefrom along the tractus iliotibialis 9 to the vicinity of the waist 10. The stretchable portion 156 having the relatively great straining force slightly differs from the combination of the stretchable portions 121 and 122 having relatively great straining forces in the aspect that the medial inferior part of the former extends from the side 5 of the musculus gastrocnemius and the musculus soleus via a side 41 of an inferior part of the musculus gastrocnemius and the musculus soleus to a superior side 42 of the malleolus medialis.

Moreover, the garment of the present embodiment greatly differs from the garment shown in FIGS. 9 to 12 in the aspect that the stretchable portion 156 having a relatively great straining force branches out at a divergence point 44 and further covers a region extending therefrom downward along a lateral side of the leg to the malleolus lateralis 16. More specifically, the stretchable portion 156 having a relatively great straining force further extends from the divergence point 44 approximately along the tractus iliotibialis 9 to the lateral side of the patella 1, then, approximately along a vicinity of a periphery of the patella 1 on a lateral side thereof so as to surround the patella through approximately ½ or more of the periphery of the patella and to cover a part of and inferior region 32 and a superior region 33 of the patella 1. Then, it extends downward along a side 43 of the musculus gastrocnemius and the musculus soleus on the lateral side to the superior side 16 of the malleolus lateralis.

The foregoing preferred embodiment of the present invention allows the same function as that of the garment of the embodiment shown in FIGS. 9 to 12 to be displayed. Further, the power for pulling the stretchable portion having a relatively great straining force that supports the ligamentum collateralle medialis 3 is further increased, whereby the power for supporting the ligamentum collateralle medialis 3 is increased. Besides, since the knee joint is supported from both of the medial and lateral sides, this provides the more stable support of the knee joint. Moreover, since the stretchable portion having a relatively great straining force passes both of the medial and lateral sides of the musculus gastrocnemius and the musculus soleus, these muscles are supported without hindering their activities. Thus, the present embodiment is preferable.

Figure 81:
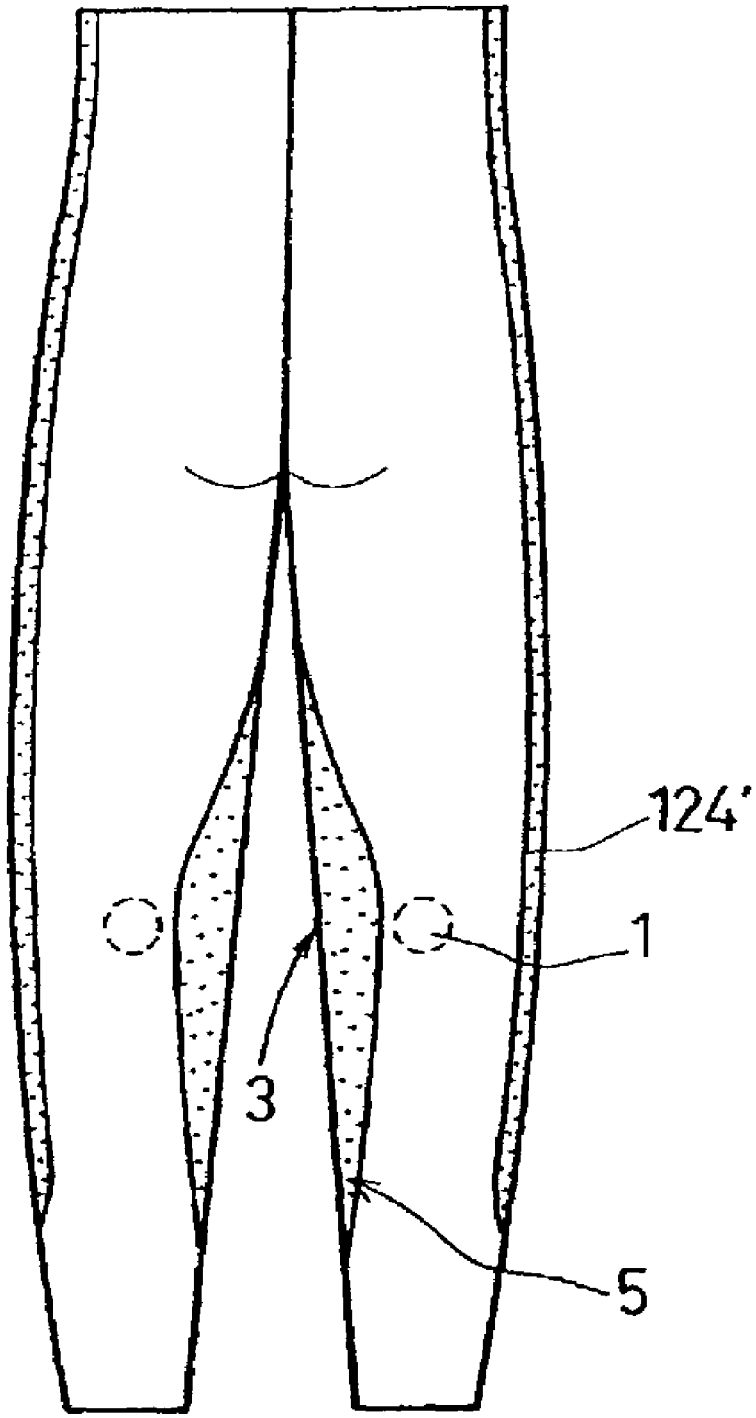
FIG. 81 is a rear view illustrating still another embodiment of a long-tights-type leg support garment of the present invention.
Figure 82:
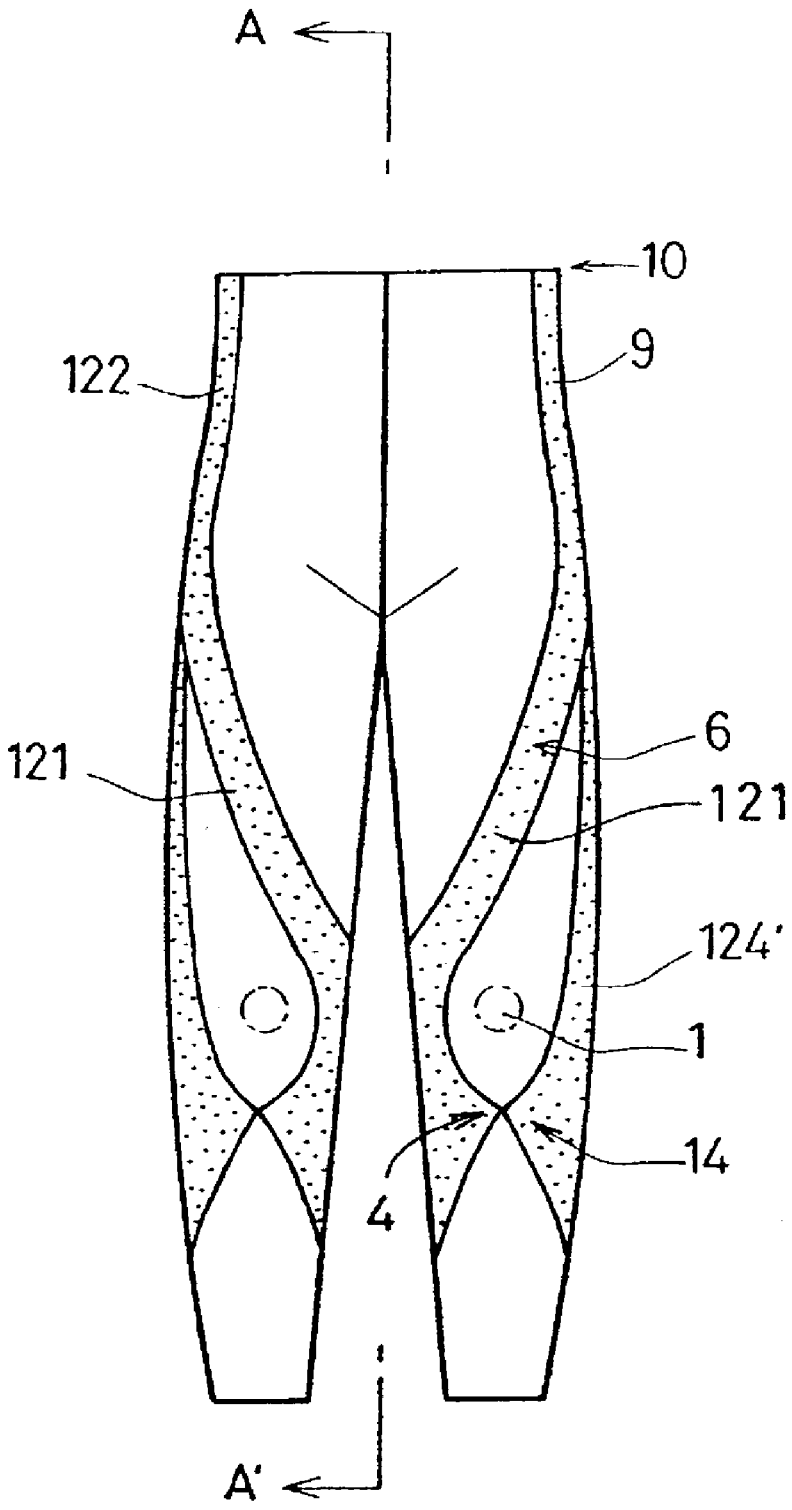
FIG. 82 is a front view of the leg support garment shown in FIG. 81
Figure 83:
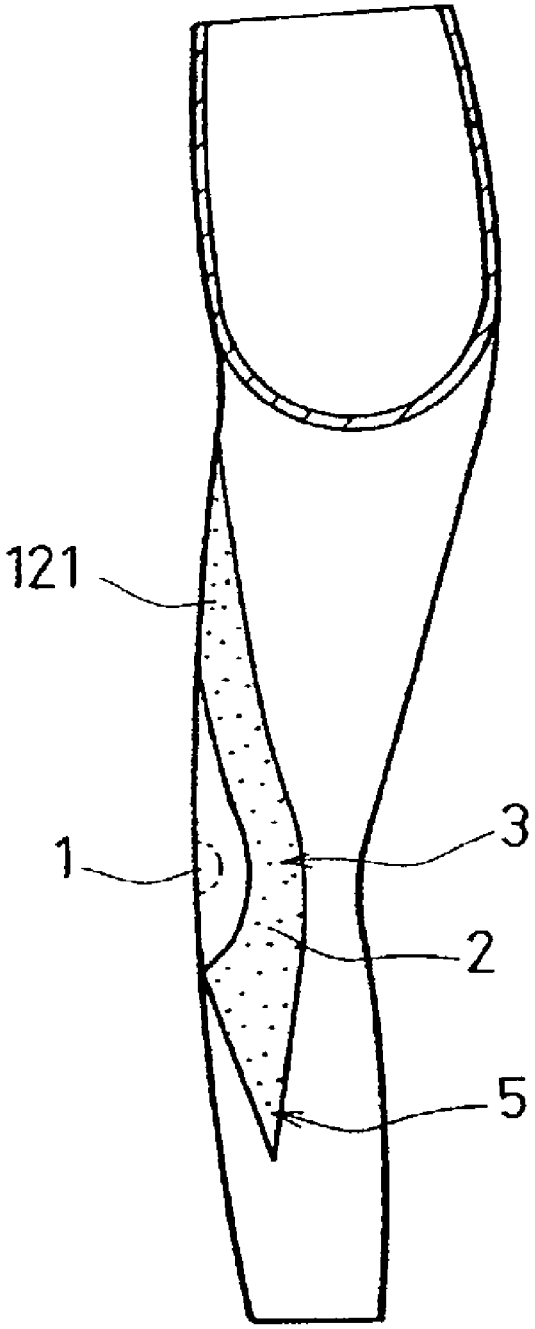
FIG. 83 is a cross-sectional view of the leg support garment taken along an A–A' line in FIG. 82.
Figure 84:
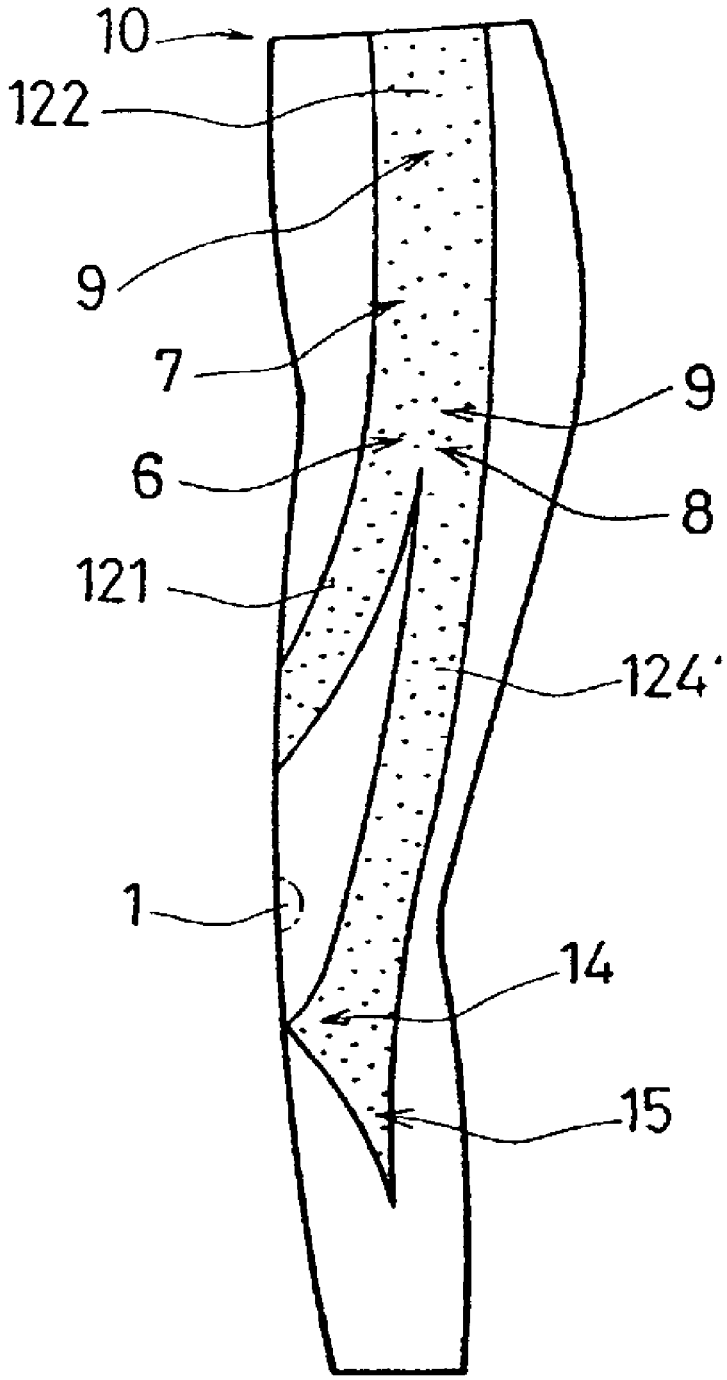
FIG. 84 is a tight-side view of the leg support garment shown in FIG. 82.

Next, FIGS. 81 to 84 are views illustrating still another embodiment of a long-tights-type leg support garment of the present invention. FIG. 81 is a rear view of the same, FIG. 82 is a front view of the same, FIG. 83 is a cross-sectional view of the same taken along an A–A' line in FIG. 82, and FIG. 84 is a right-side view of the same.

The garment of the present embodiment is a garment as a modification of the embodiment shown in FIGS. 17 to 20; namely, in the garment of the embodiment shown in FIGS. 17 to 20, the stretchable portion (A) 121 having a relatively great straining force and the stretchable portion 124' (B) having a relatively great straining force are in contact with each other at a position on the inferior side of the patella. Therefore, the same portions as those shown in FIGS. 17 to 20 are designated with the same reference numerals in the drawings and descriptions of the same are omitted. However, substantially the same portions as those shown in FIGS. 17 to 20 still have slight differences; namely, the stretchable portion (B) 124 having a relatively great straining force reaches to the superior side 16 of the malleolus lateralis, while the stretchable portion (B) 124' having a relatively great straining force of the embodiment shown in FIGS. 81 to 84 stops at a side 15 of the musculus gastrocnemius and the musculus soleus on the lateral side, not reaching the superior side 16 of the malleolus lateralis.

The aspects other than the above are substantially the same as those of the garment of the embodiment shown in FIGS. 17 to 20.

More specifically, a vertex of a projecting portion 4 of the stretchable portion 121 having a relatively great straining force that covers a part of the inferior region of the patella 1 and a vertex of a projecting portion 14 of the stretchable portion 124' having a relatively great straining force that covers a part of the inferior region of the patella 1 are in contact with each other at a position on the inferior side of the patella 1, so as to support the knee from the right, left, and inferior sides of the same. Therefore, the same function as that of the leg support garment shown in FIGS. 17 to 20 is displayed, and the function of supporting the knee from the inferior side is reinforced.

Figure 85:
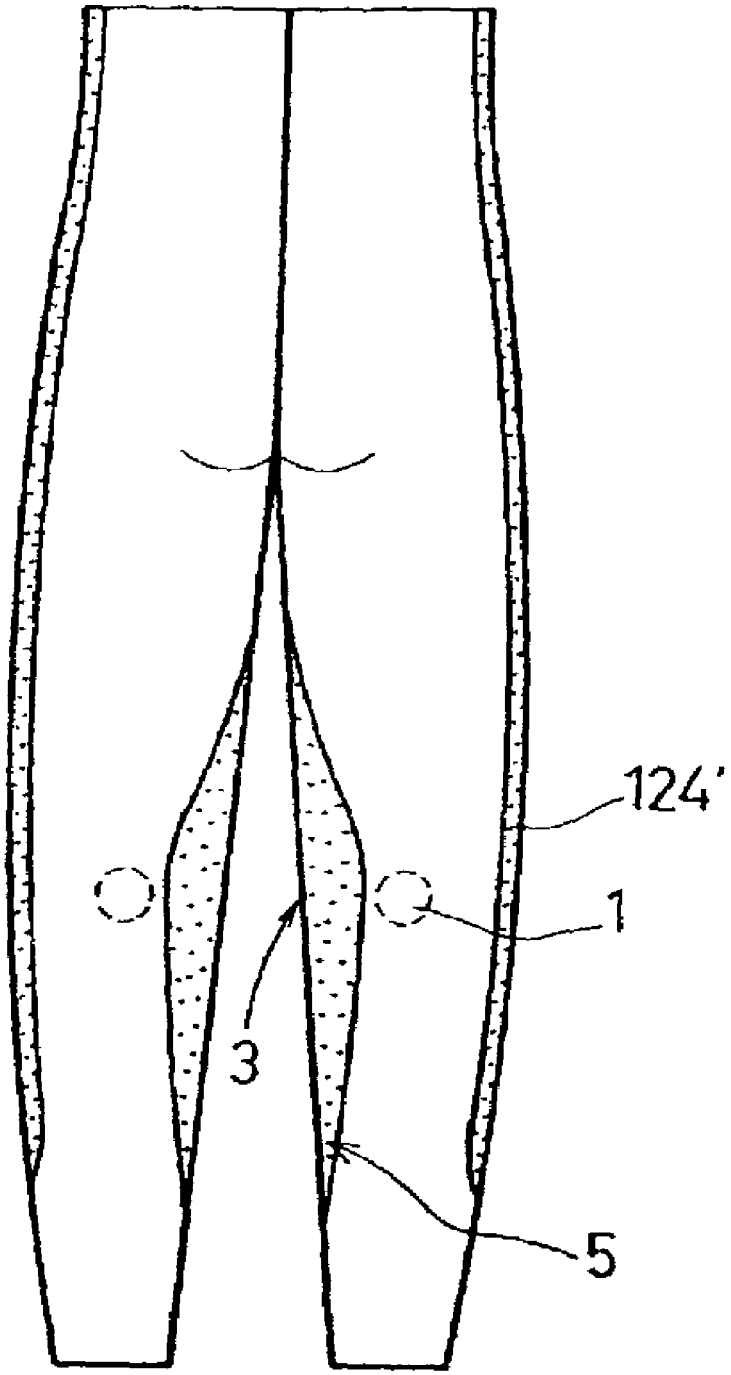
FIG. 85 is a rear view illustrating still another embodiment of a long-tights-type leg support garment of the present invention.
Figure 86:
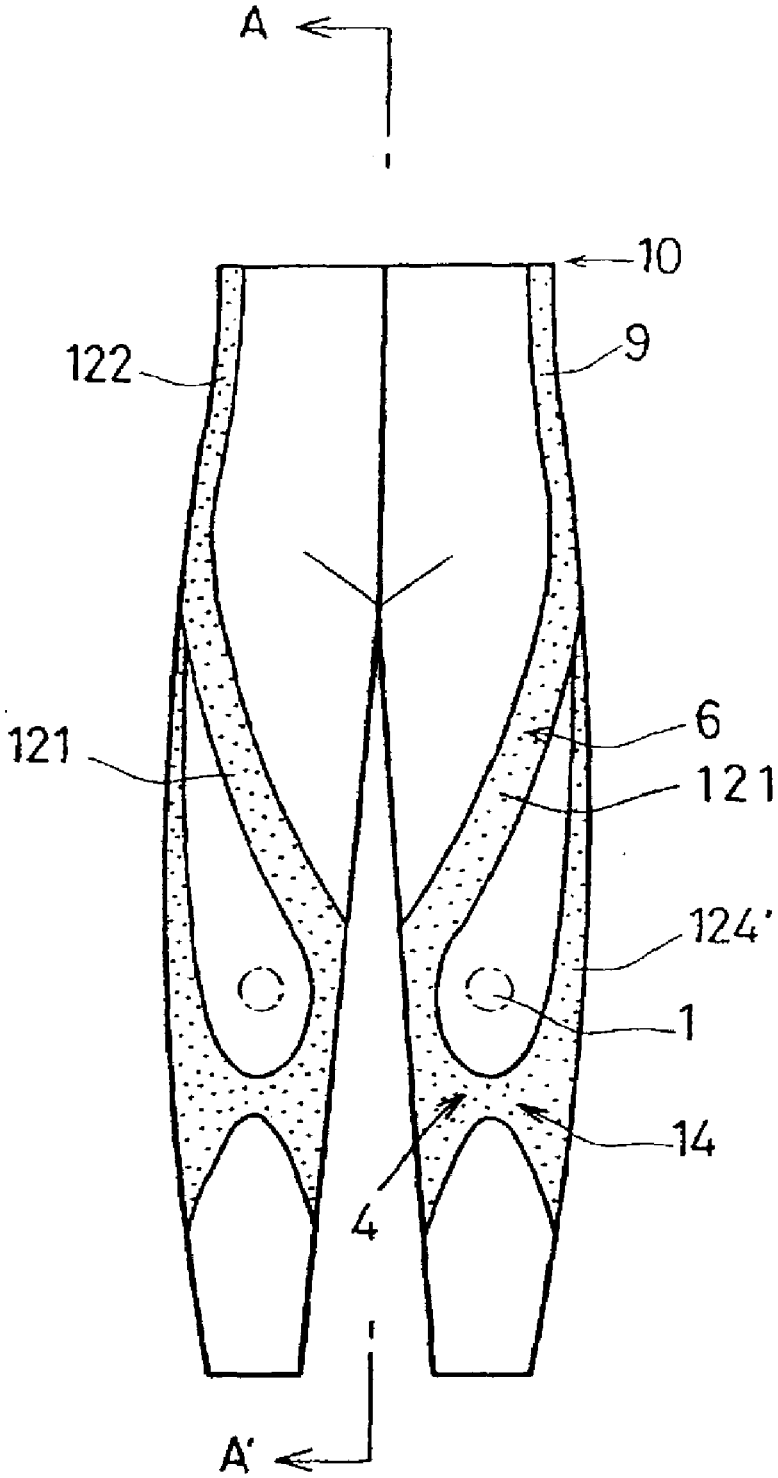
FIG. 86 is a front view of the leg support garment shown in FIG. 85
Figure 87:
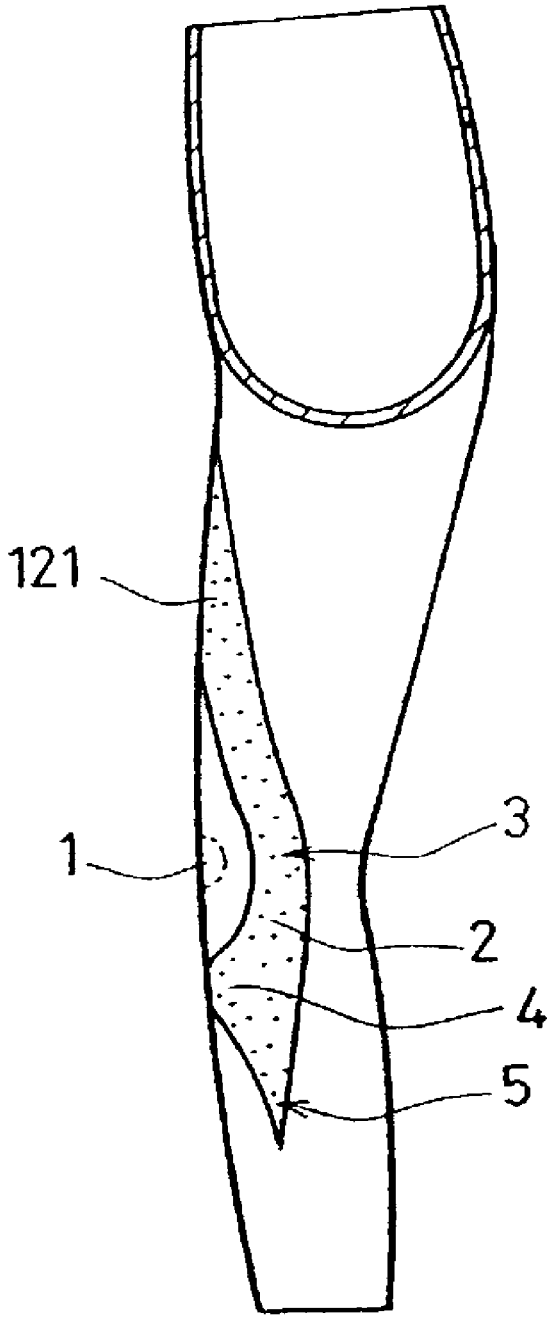
FIG. 87 is a cross-sectional view of the leg support garment taken along an A–A' line in FIG. 86.
Figure 88:
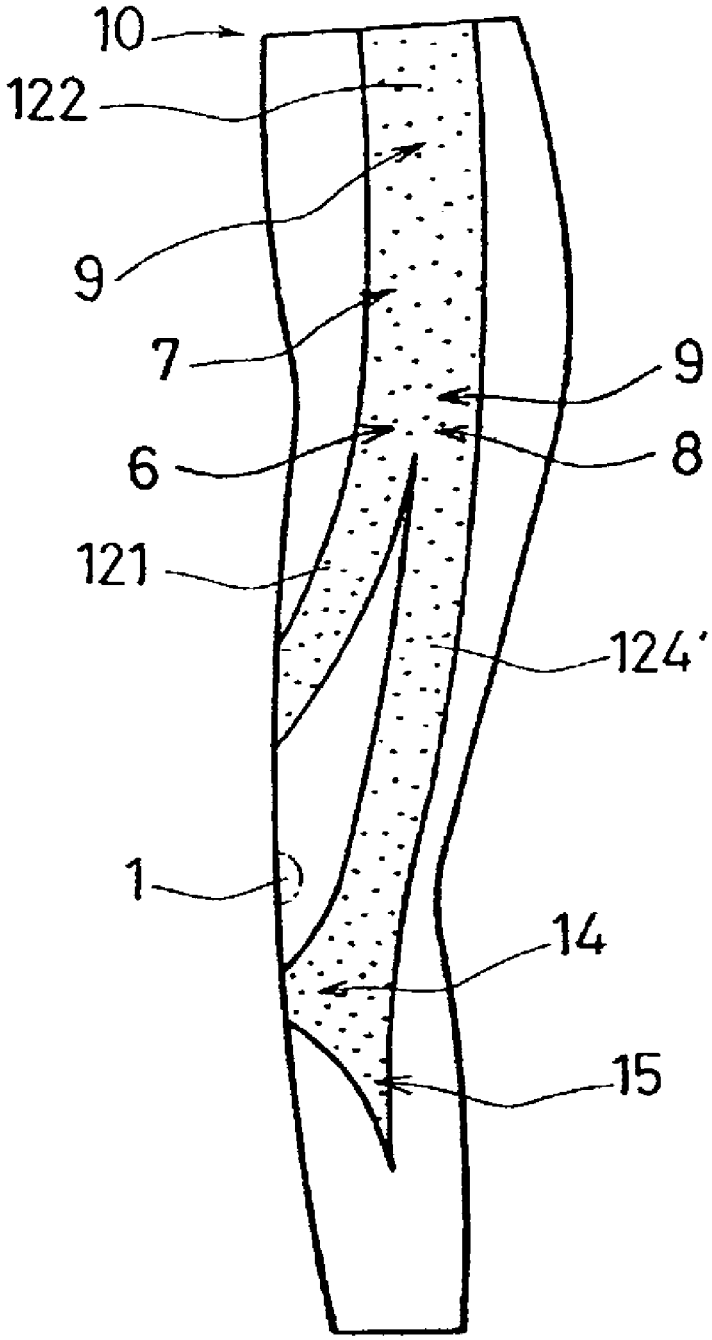
FIG. 88 is a right-side view of the leg support garment shown in FIG. 86.

Next, FIGS. 85 to 88 are views illustrating still another embodiment of a long-tights-type leg support garment of the present invention. FIG. 85 is a rear view of the same, FIG. 86 is a front view of the same, FIG. 87 is a cross-sectional view of the same taken along an A–A' line in FIG. 86, and FIG. 88 is a right-side view of the same.

The garment of the present embodiment is a garment as a modification of the embodiment shown in FIGS. 81 to 84; namely, in the garment of the embodiment shown in FIGS. 81 to 84, the stretchable portion (A) 121 having a relatively great straining force and the stretchable portion (B) 124' having a relatively great straining force are coupled with each other in a slightly wide range on the inferior side of the patella, rather than in point contact with each other. Therefore, the same portions as those of the embodiment shown in FIGS. 81 to 84 are designated with the same reference numerals in the drawings and descriptions of the same are omitted.

More specifically, a portion 4 of the stretchable portion 121 having a relatively great straining force that covers a part of the inferior region of the patella 1 and a portion 14 of the stretchable portion 124' having a relatively great straining force that covers a part of the inferior region of the patella 1 are coupled with each other at a position on the inferior side of the patella 1, so as to support the knee from the right, left, and inferior sides of the same. Therefore, the same function as that of the leg support garment shown in FIGS. 81 to 84 is displayed, and the function of supporting the knee from the inferior side is further reinforced.

It should be noted that in the case of the present embodiment, in the case where the stretchable part having a relatively great straining force is formed by laminating stretchable fabrics in predetermined shapes on a garment main body and sewing them, or the like, the coupling between the portion 4 of the stretchable portion 121 having a relatively great straining force that covers a part of the inferior region of the patella 1 and the portion 14 of the stretchable portion 124' having a relatively great straining force that covers a part of the inferior region of the patella 1 may be achieved by forming the same with one piece of fabric in which the stretchable portions 121 and 124' having relatively great straining forces are continuously provided, so that the coupling therebetween has been achieved beforehand. Alternatively, the stretchable portions 121 and 124' having relatively great straining forces may be made of separate pieces of fabrics, respectively, and portions of the fabrics corresponding to the portions 4 and 14 may be overlapped and sewn so that the coupling therebetween is achieved.

So far the present invention has been described with reference to specific examples of the long-tights-type leg support garment, but any design of a garment in which an upper body part is added to the long-tights-type leg support garment of the present invention as required is not excluded from the present invention at all, as long as the object of the present invention is not inhibited.

The following description will explain embodiments of a tights-type leg support garment having a length capable of covering a range from a waistline to the inferior side of the knee (a garment of this kind is hereinafter referred to as "semi-long-tights-type garment" also) while referring to the drawings. Meanwhile, "having a length capable of covering at least a range to the inferior side of the knee" described above means that the garment reaches at least the inferior end of the patella or a position below the same, and preferably, the garment has a hem line at a position at least 3 cm to 5 cm below the inferior end of the patella. Furthermore, though not particularly limited, the garment preferably has its lowest end at a middle position of the lower leg below the knee or above the same. However, the present invention does not exclude any garment having a hemline at a position below the same.

Figure 89:
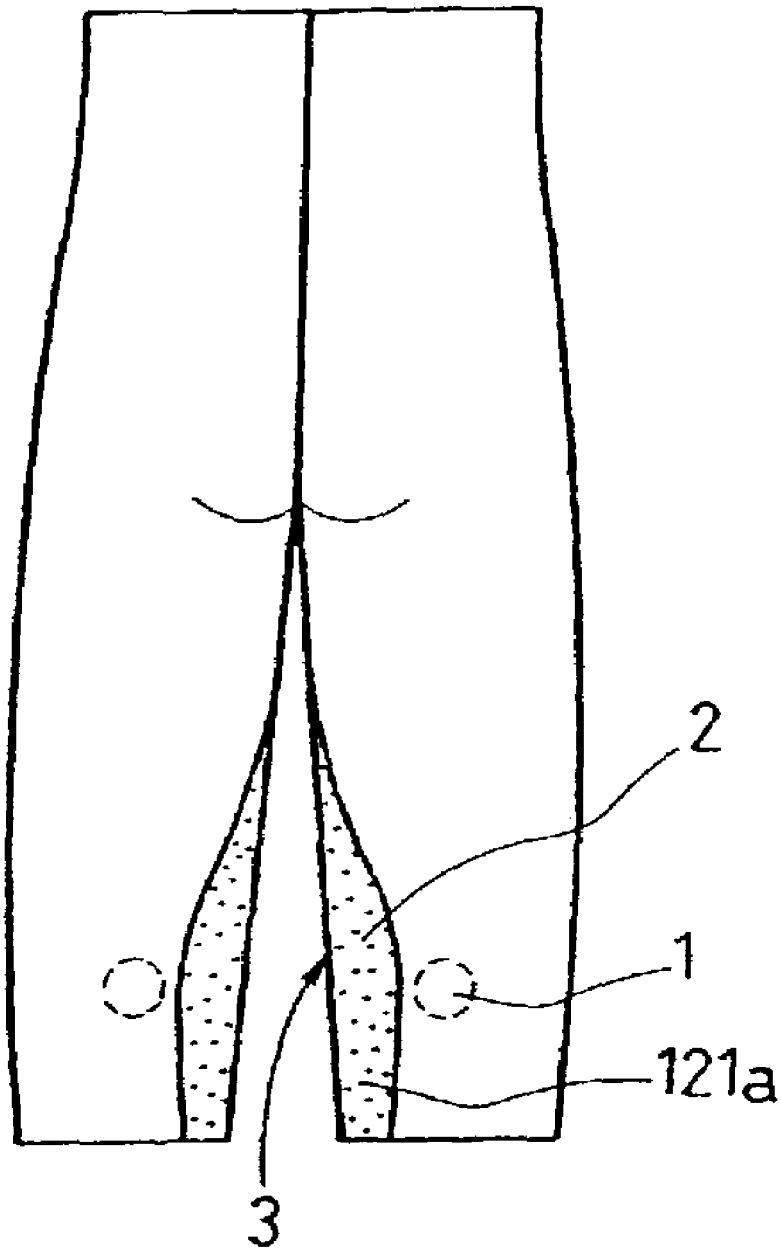
FIG. 89 is a rear view illustrating an embodiment of a semi-long-tights-type leg support garment of the present invention.
Figure 90:
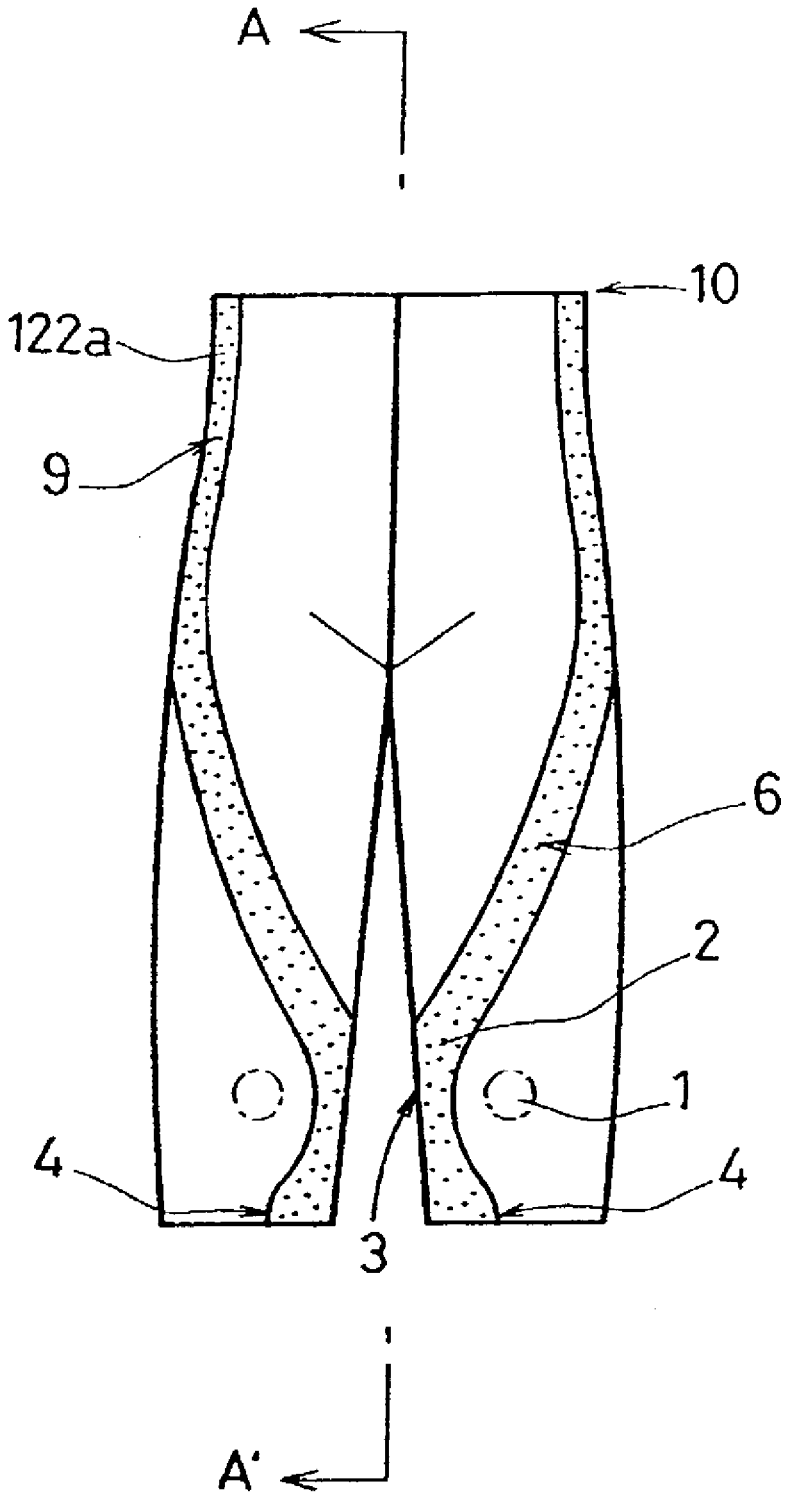
FIG. 90 is a front view of the leg support garment shown in FIG. 89.
Figure 91:
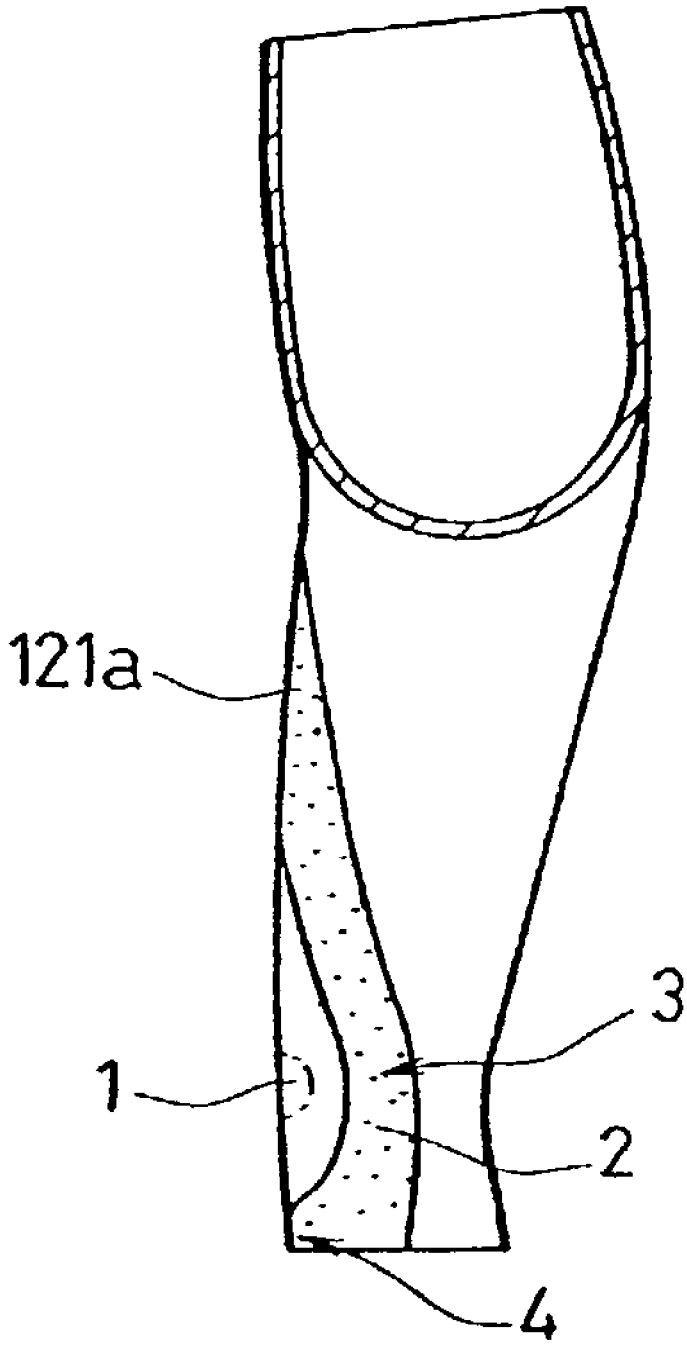
FIG. 91 is a cross-sectional view of the leg support garment taken along an A–A' line in FIG. 90.
Figure 92:
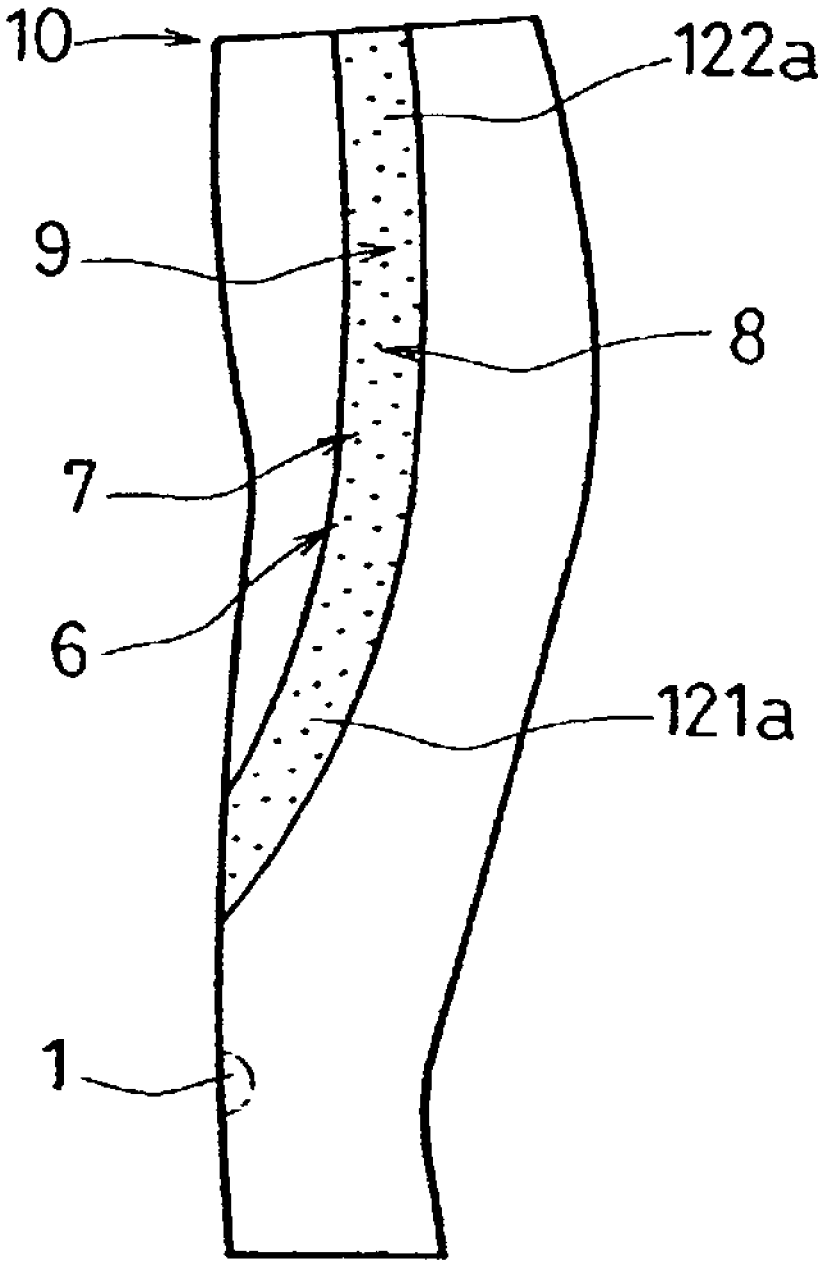
FIG. 92 is a right-side view of the leg support garment shown in FIG. 90.

FIGS. 89 to 92 are views illustrating an embodiment of a semi-long-tights-type leg support garment of the present invention. FIG. 89 is a rear view of the same, FIG. 90 is a front view of the same, FIG. 91 is a cross-sectional view of the same taken along an A–A' line in FIG. 90, and FIG. 92 is a right-side view of the same.

The garment of the present embodiment is equivalent to a semi-long-tights-type leg support garment obtained by, from the long-tights-type leg support garment shown in FIGS. 5 to 8, cutting away a part lower than a position of the portion 4 of the stretchable portion 121 having a relatively great straining force that covers the inferior region of the patella 1.

More specifically, a portion 2 expressed as the stretchable portion (A) having a relatively great straining force includes a stretchable portion ($A^2$1) 121*a* having a relatively great straining force and a stretchable portion ($A^2$1-1) 122*a* having a relatively great straining force. The stretchable portion ($A^2$1) 121*a* having a relatively great straining force substantially covers the ligamentum collateralle 3 on the medial side of the knee joint of the human body, extends approximately along the vicinity of a periphery of the patella 1 on the medial side thereof so as to surround the patella 1 through not less than approximately ¼ (here, approximately 1.7¼) of the periphery of the patella 1 and to cover a part of an inferior region 4 of the patella 1, and on the superior side of the knee joint, extends from the medial side to the lateral side of the thigh via the anterior side thereof approximately along the musculus sartorius 6 toward the vicinity of the trochanter major 8, passing a superior part 7 of the musculus rectus femoris. The stretchable portion ($A^2$1-1) 122*a* having a relatively great straining force extends from the vicinity of the trochanter major 8 to the vicinity of the waist 10 along the tractus iliotibialis 9. The lower end of the hemline in the present embodiment is at a position 5 cm lower than the inferior end of the patella (the semi-long-tights-type garments of the embodiments described below have the same hem line positions, unless otherwise specified).

The semi-long-tights-type leg support garment shown in FIGS. 89 to 92 is, according to the foregoing preferred embodiment of the present invention, arranged so that the stretchable portion ($A^2$1) 121*a* having a relatively great straining force covers a portion 4 of a part of an inferior region of the patella 1 so as to support the patella 1 as if pulling up the same from the inferior side, thereby improving the stability of the knee joint. The portion 121*a* further supports the musculus sartorius 6 and extends from the medial side to the lateral side of the thigh obliquely and spirally toward the vicinity of the trochanter major 8, thereby increasing the power for pulling the stretchable portion having a relatively great straining force that supports the ligamentum collateralle medialis 3. This makes it possible to provide a leg support garment having an increased power for supporting the ligamentum collateralle medialis 3, and hence, this is preferable. Furthermore, this provides the support to the musculus sartorius 6 that complements the function of the ligamentum collateralle medialis 3 as well, which is also preferable. Furthermore, the portion 121*a* includes the stretchable portion ($A^2$1-1) 122 having a relatively great straining force, which extends upward further from the vicinity of the trochanter major 8 to the waist 10 along the tractus iliotibialis 9. Therefore, the function of intensely pressing the trochanter major 8 is enhanced, thereby improving the connection between the caput ossis femoris and the acetabulum. This is preferable since further providing a function of enhancing the stability of the hip joint.

Figure 93:
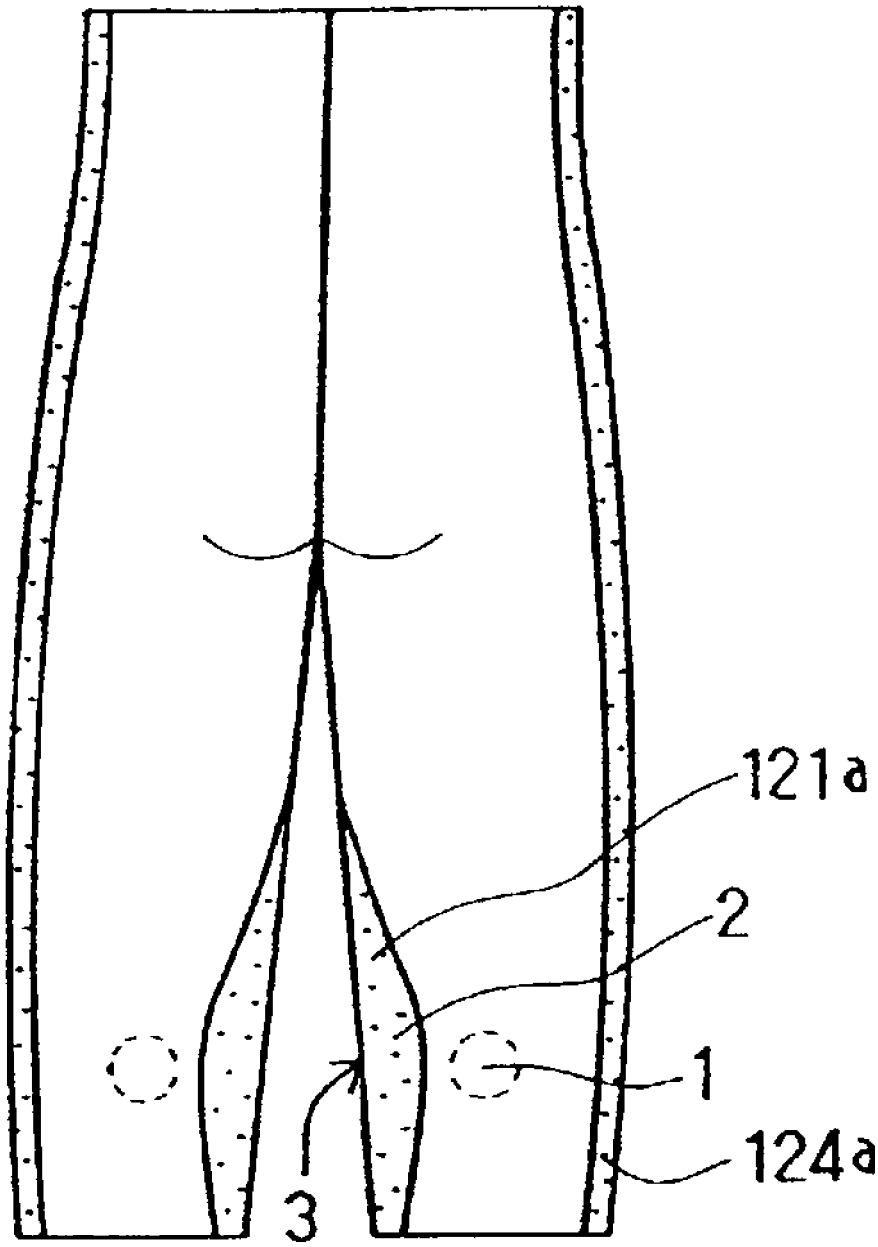
FIG. 93 is a rear view illustrating another embodiment of a semi-long-tights-type leg support garment of the present invention.
Figure 94:
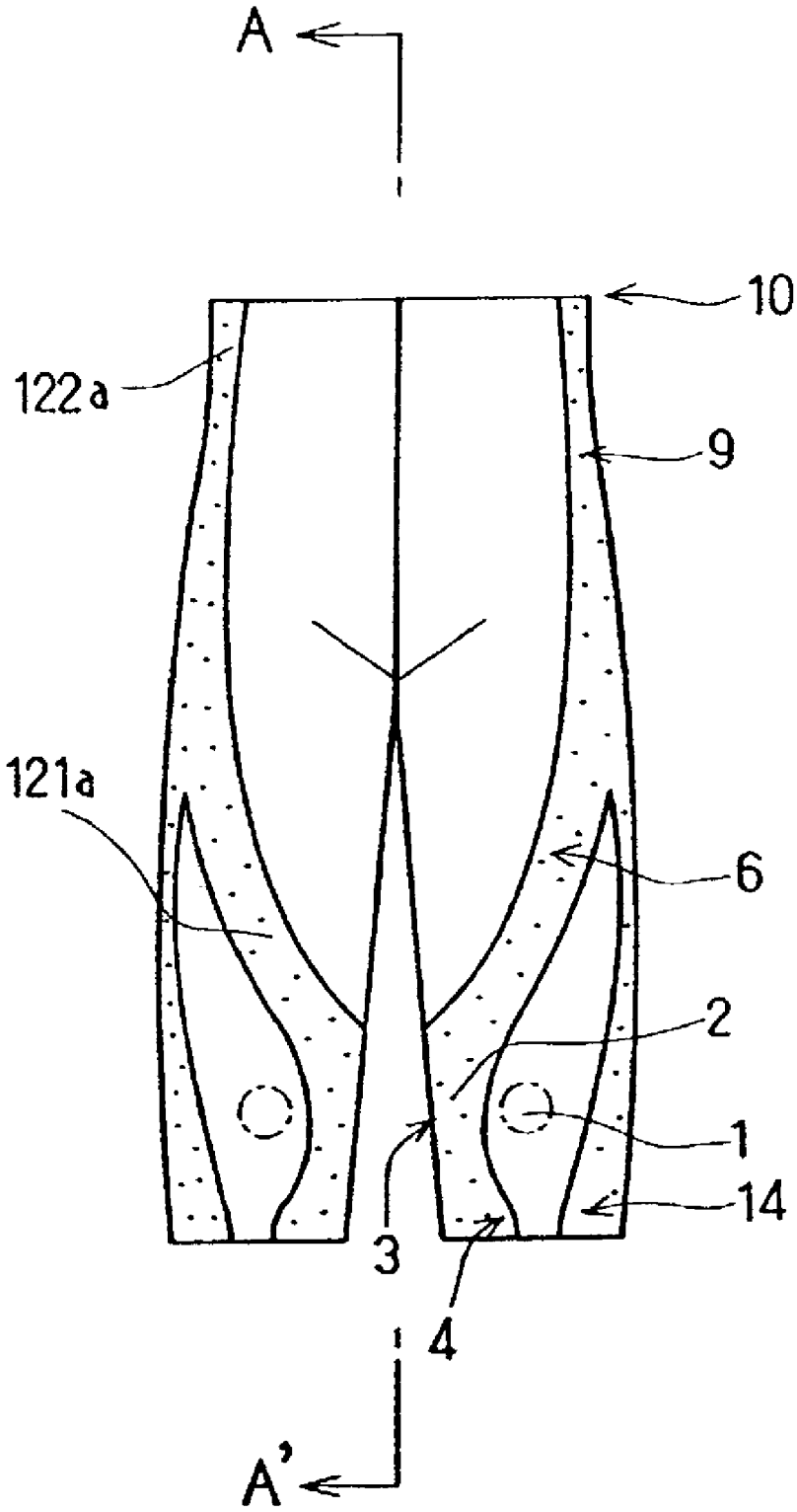
FIG. 94 is a front view of the leg support garment shown in FIG. 93.
Figure 95:
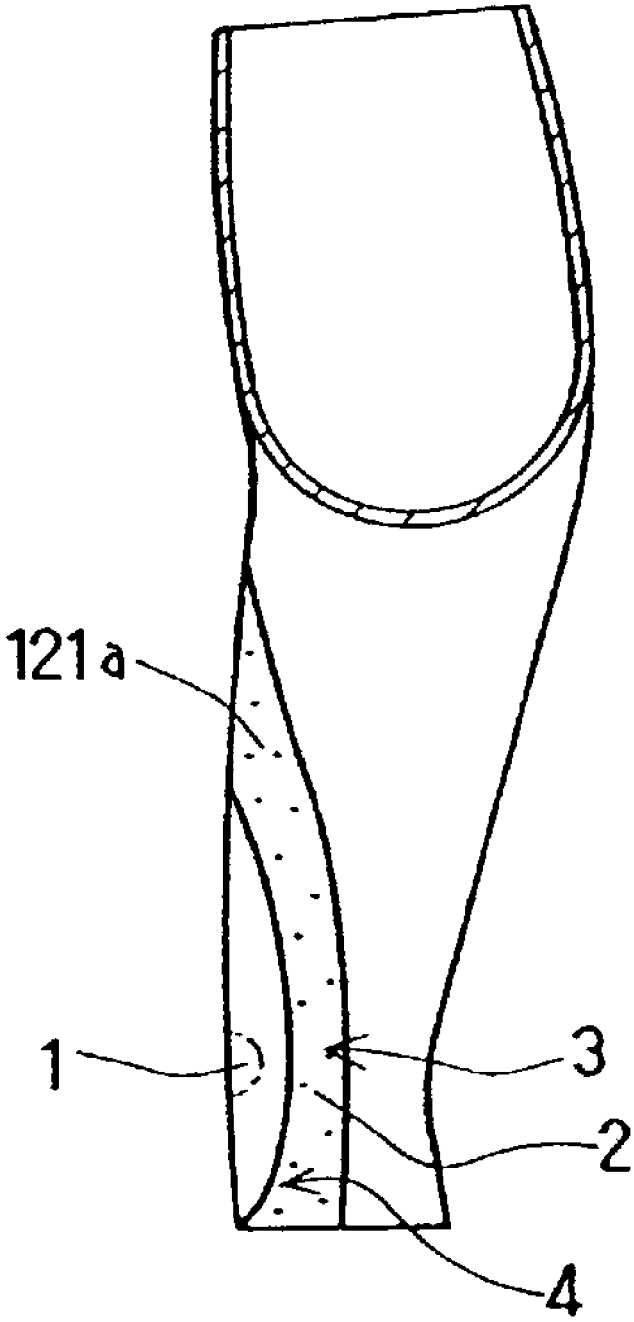
FIG. 95 is a cross-sectional view of the leg support garment taken along an A–A' line in FIG. 94.
Figure 96:
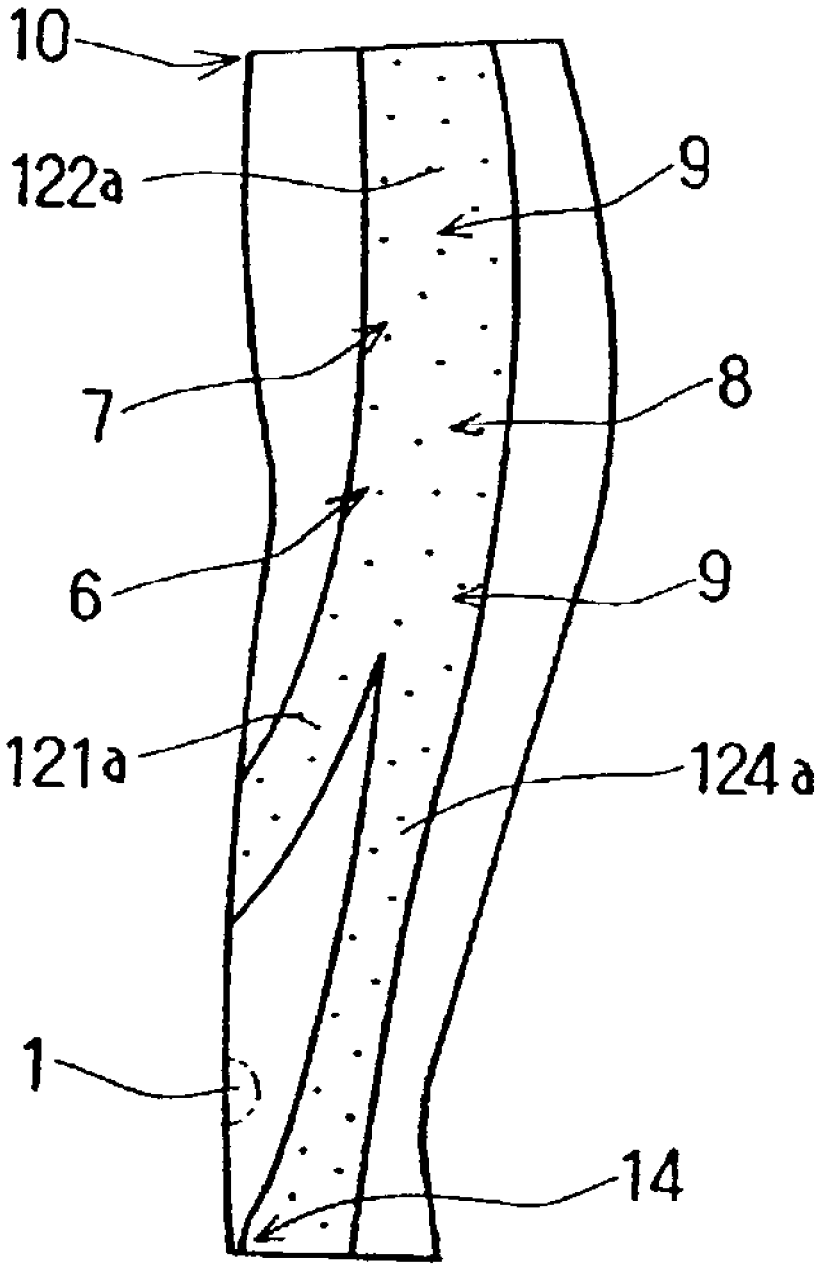
FIG. 96 is a right-side view of the leg support garment shown in FIG. 94.

Next, FIGS. 93 to 96 are views illustrating another embodiment of a semi-long-tights-type leg support garment of the present invention. FIG. 93 is a rear view of the same, FIG. 94 is a front view of the same, FIG. 95 is a cross-sectional view of the same taken along an A–A' line in FIG. 94, and FIG. 96 is a right-side view of the same.

The garment of the present embodiment is a garment as a modification of the embodiment shown in FIGS. 89 to 92; namely, to the garment shown in FIGS. 89 to 92, a stretchable portion ($B^2$) 124*a* having a relatively great straining force as described below is added. Namely, the garment further includes a stretchable portion ($B^2$) 124*a* having a relatively great straining force. The stretchable portion ($B^2$) 124*a* having a relatively great straining force extends from a vicinity of the trochanter major 8 downward approximately along the tractus iliotibialis 9 to the lateral side of the patella 1, covers a part of an inferior region 14 of the patella extending from the lateral side thereof.

The upper portion ($A^2$1-1) 122*a* having a relatively greater straining force has a slightly greater width as compared with that shown in FIGS. 89 to 92, at a position where the stretchable portion ($B^2$) 124*a* having a relatively great straining force and the stretchable portion ($A^2$1) 121*a* having a relatively great straining force are united therewith.

With the foregoing preferred embodiment of the present invention, the same function as that explained with reference to FIGS. 89 to 92 is exhibited. Besides, since the stretchable portion ($B^2$) 124*a* having a relatively great straining force is further provided, the knee is supported from the both sides. Thus, the function of supporting the knee joint is reinforced. Furthermore, the function of pressing the trochanter major 8 is enhanced further, thereby improving the connection between the caput ossis femoris and the acetabulum. Therefore, this reinforces a function of enhancing the stability of the hip joint.

Figure 97:
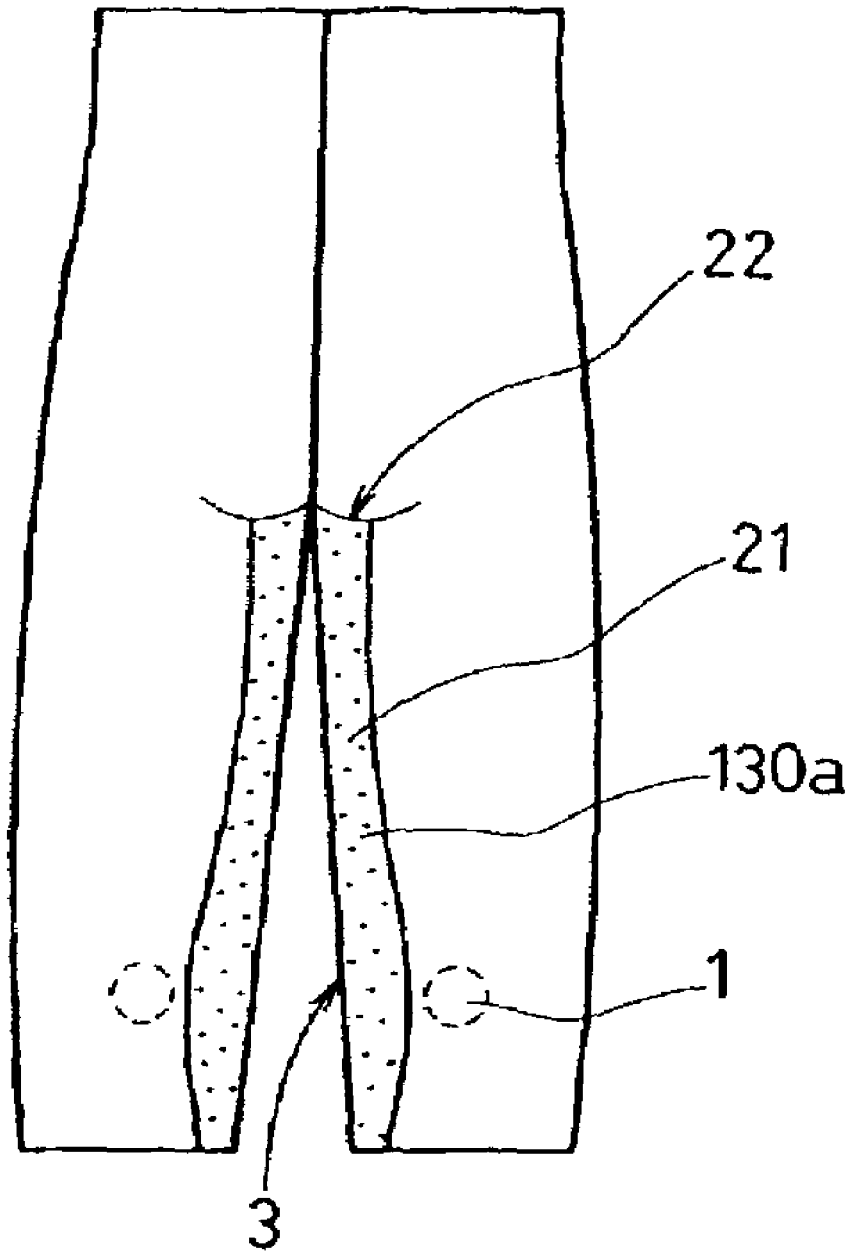
FIG. 97 is a rear view illustrating still another embodiment of a semi-long-tights-type leg support garment of the present invention.
Figure 98:
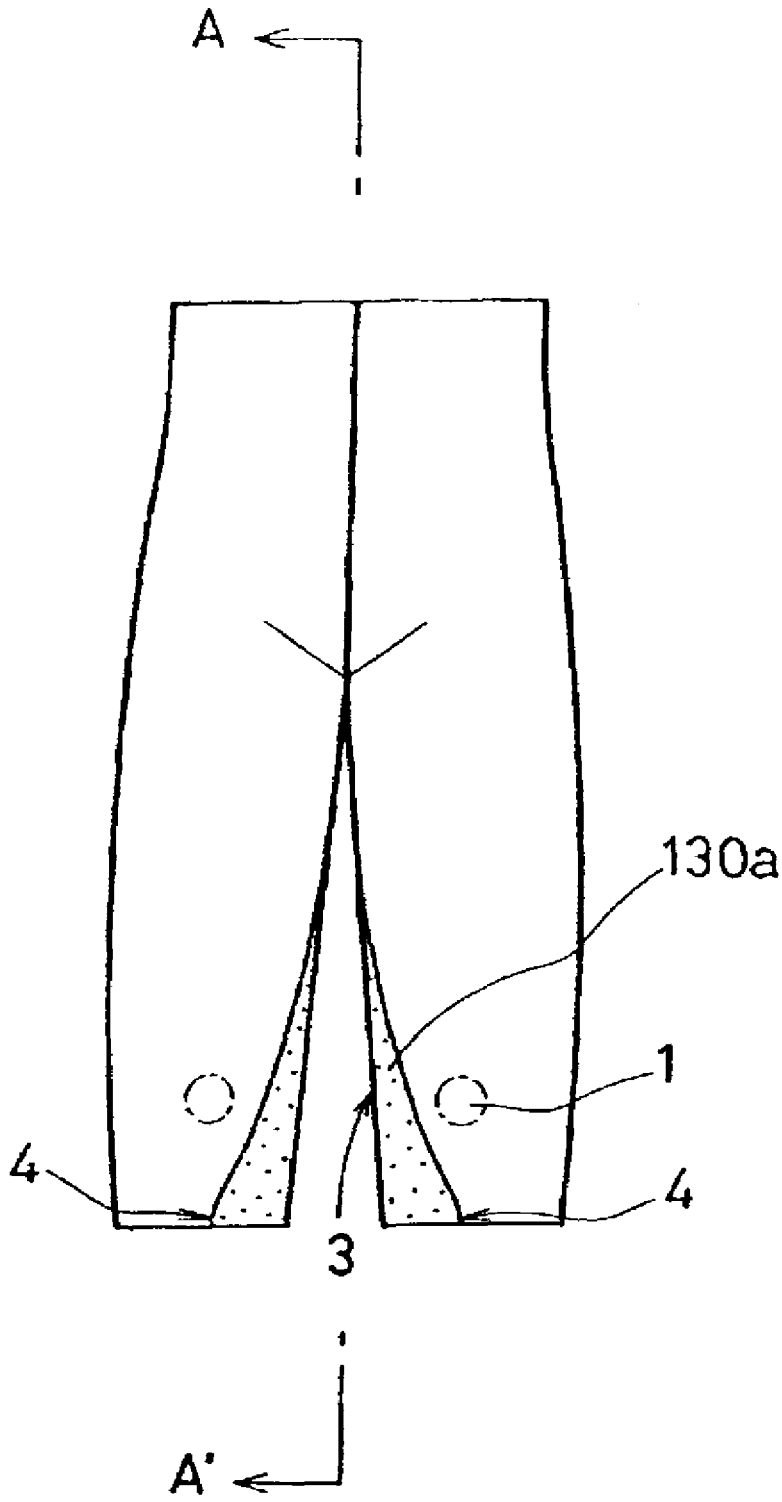
FIG. 98 is a front view of the leg support garment shown in FIG. 97.
Figure 99:
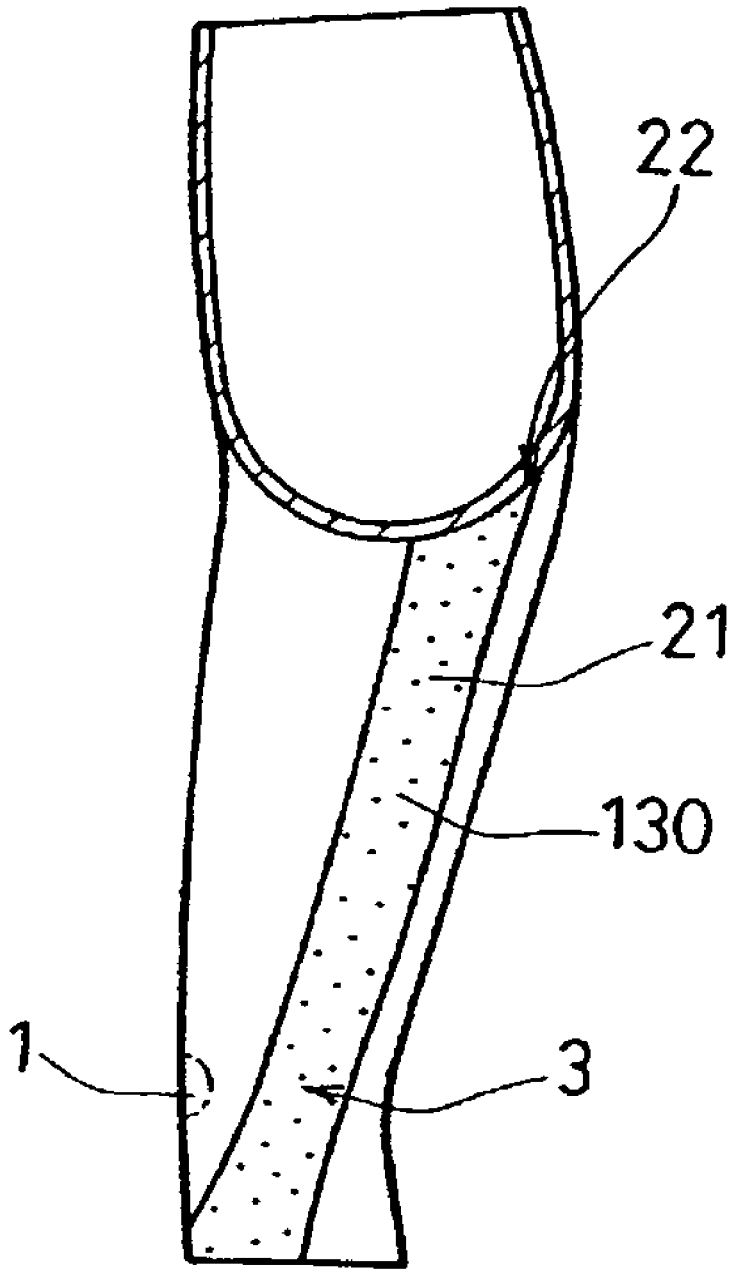
FIG. 99 is a cross-sectional view of the leg support garment taken along an A–A' line in FIG. 98
Figure 100:
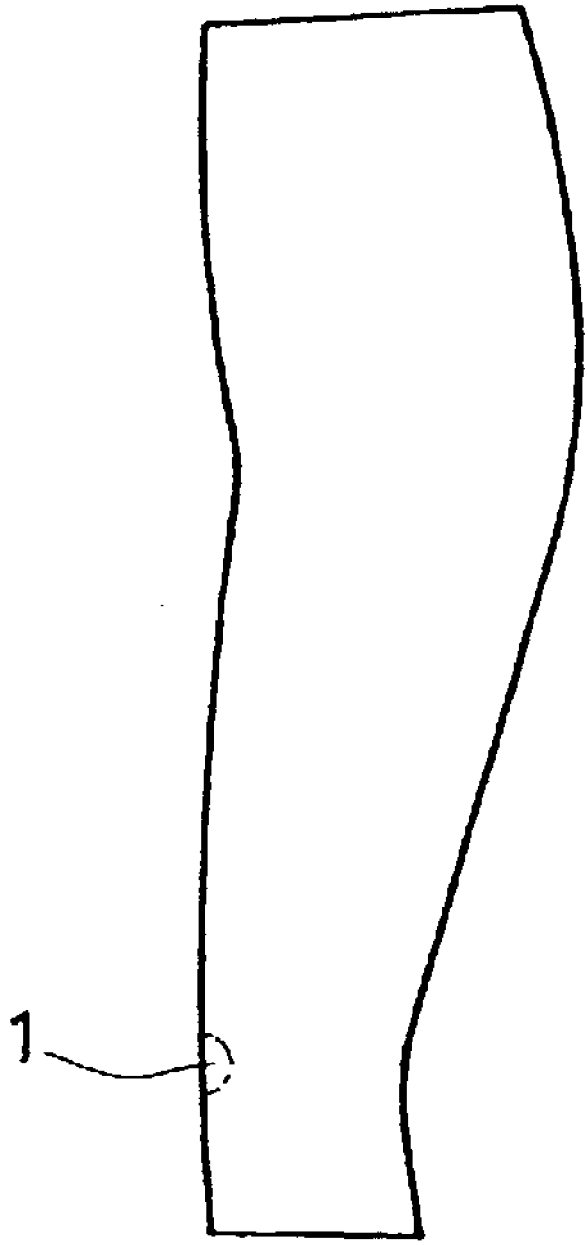
FIG. 100 is a right-side view of the leg support garment shown in FIG. 98.

Next, FIGS. 97 to 100 are views illustrating still another embodiment of a semi-long-tights-type leg support garment of the present invention. FIG. 97 is a rear view of the same, FIG. 98 is a front view of the same, FIG. 99 is a cross-sectional view of the same taken along an A–A' line in FIG. 98, and FIG. 100 is a right-side view of the same.

The garment of the present embodiment is equivalent to a semi-long-tights-type leg support garment obtained by, from the long-tights-type leg support garment shown in FIGS. 21 to 24, cutting away a part lower than a position of the portion 4 of the stretchable portion 121 having a relatively great straining force that covers the inferior region of the patella 1.

The portion expressed as the stretchable portion (A) having a relatively great straining force is composed of a stretchable portion ($A_2$2) 130*a* having a relatively great straining force. The stretchable portion ($A_2$2) 130*a* having a relatively great straining force substantially covers the ligamentum collateralle 3 on the medial side of the knee joint of the human body, and extends approximately along a vicinity of a periphery of the patella 1 on the medial side thereof so as to surround the patella 1 through not less than approximately ¼ of the periphery of the patella 1 and to cover a part of an inferior region 4 of the patella 1, and then, reaches a side of a superior part of the musculus gastrocnemius on the medial side. Furthermore, on the superior side of the knee joint, the stretchable portion ($A^2$2) 130*a* extends through the thigh approximately along the musculus semitendinosus 21 to the vicinity of the sulcus gluteus 22.

The foregoing preferred embodiment allows the stretchable portion 130*a* having a relatively great straining force to cover a part of the inferior region 4 of the patella 1, thereby support the patella 1 as if pulling up the patella 1 from the inferior side thereof. As a result, the stability of the knee joint is improved. Furthermore, the embodiment allows the portion 130*a* to support the musculus semitendinosus 21 that is located on the medial side of the thigh, thereby increasing the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, the musculus semitendinosus that complements the function of the ligamentum collateralle medialis is supported, which is also preferable.

Figure 101:
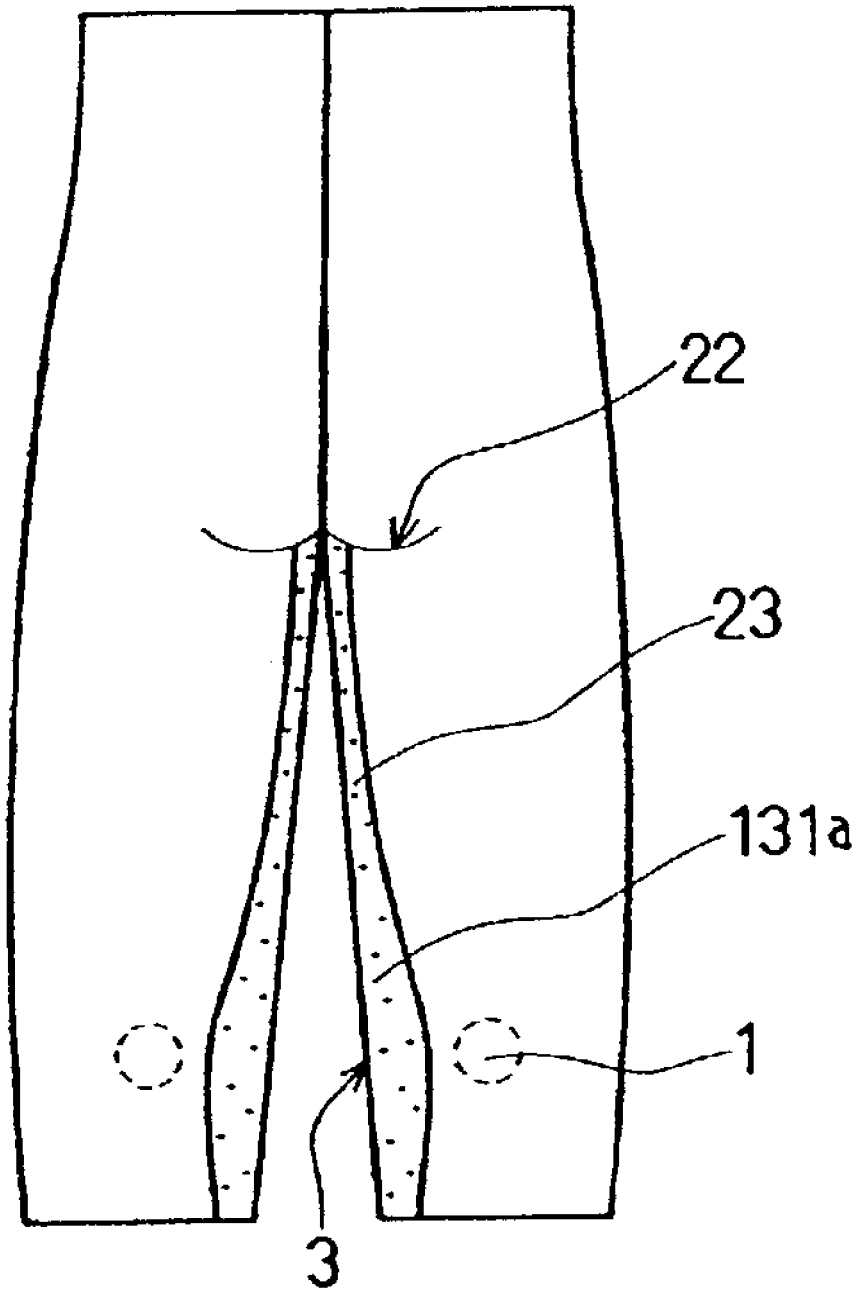
FIG. 101 is a rear view illustrating still another embodiment of a semi-long-tights-type leg support garment of the present invention.
Figure 102:
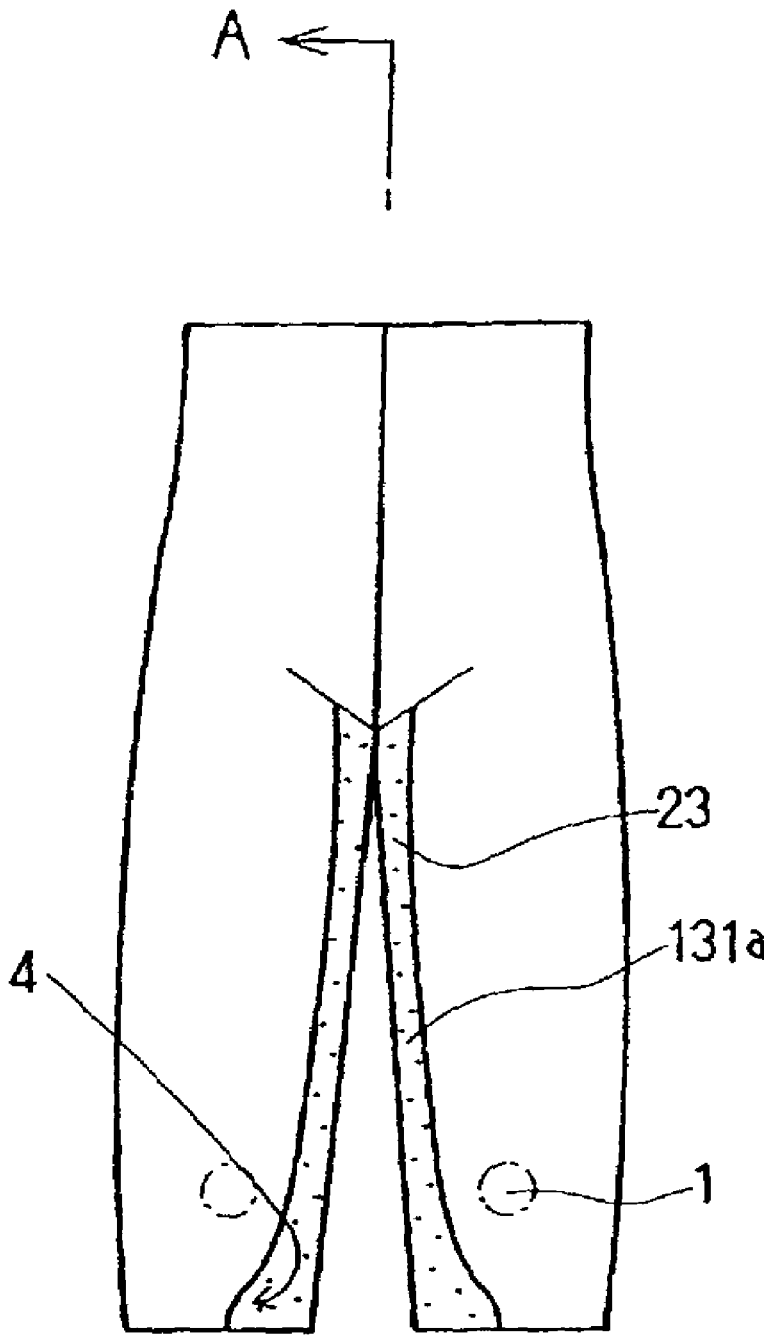
FIG. 102 is a front view of the leg support garment shown in FIG. 101.
Figure 103:
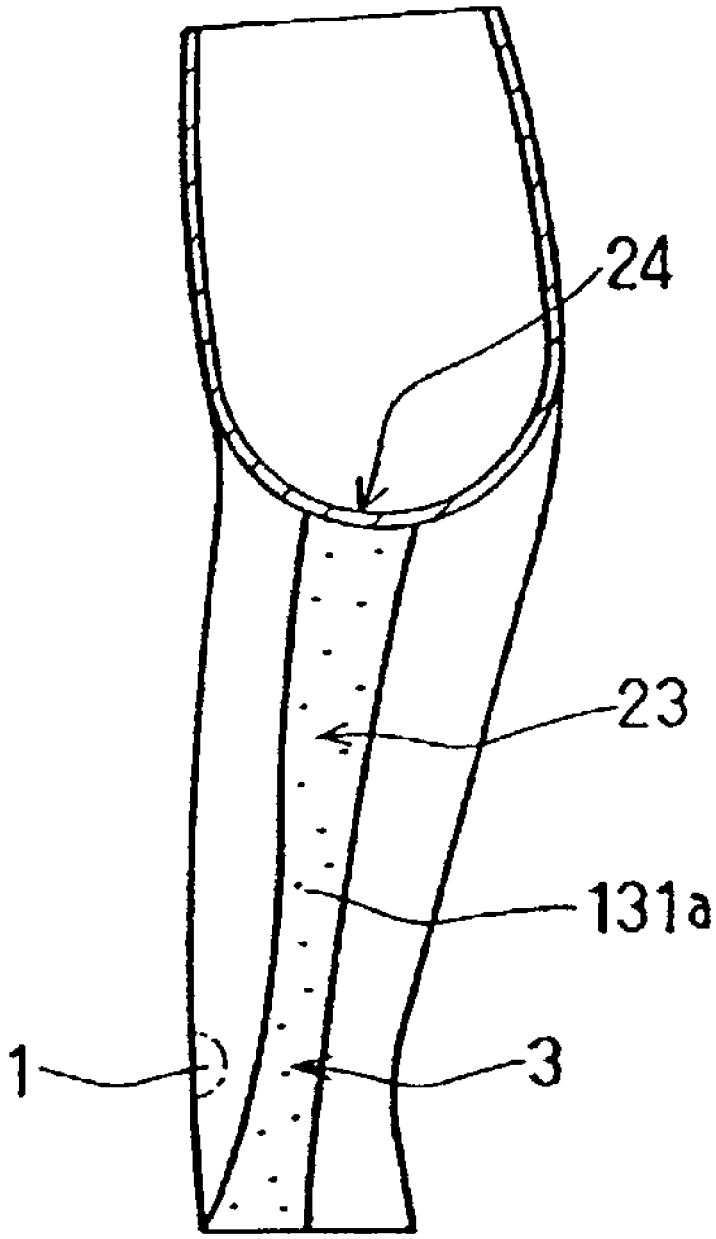
FIG. 103 is a cross-sectional view of the leg support garment taken along an A–A' line in FIG. 102.
Figure 104:
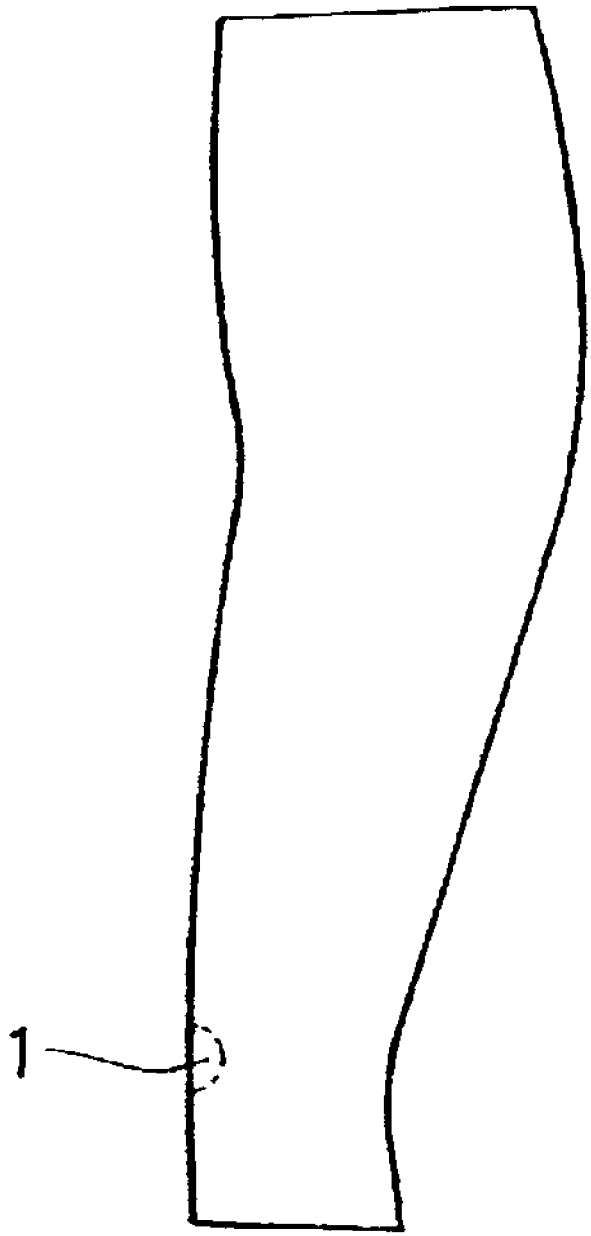
FIG. 104 is a right-side view of the leg support garment shown in FIG. 102.

Next, FIGS. 101 to 104 are views illustrating still another embodiment of a semi-long-tights-type leg support garment of the present invention. FIG. 101 is a rear view of the same, FIG. 102 is a front view of the same, FIG. 103 is a cross-sectional view of the same taken along an A–A' line in FIG. 102, and FIG. 104 is a right-side view of the same.

The garment of the present embodiment is equivalent to a semi-long-tights-type leg support garment obtained by, from the long-tights-type leg support garment shown in FIGS. 25 to 28, cutting away a part lower than a position of the portion 4 of the stretchable portion 131 having a relatively great straining force that covers the inferior region of the patella 1.

The portion expressed as the stretchable portion (A) having a relatively great straining force is composed of a stretchable portion 131*a* having a relatively great straining force. The stretchable portion 131*a* having a relatively great straining force substantially covers the ligamentum collateralle 3 on the medial side of the knee joint of the human body, and extends approximately along a vicinity of a periphery of the patella 1 on the medial side thereof so as to surround the patella 1 through not less than approximately ¼ of the periphery of the patella 1 and to cover a part of an inferior region 4 of the patella 1, and then, reaches a side of a superior part of the musculus gastrocnemius on the medial side. Furthermore, on the superior side of the knee joint, the portion 131*a* passes through the thigh approximately along the musculus gracilis 23, and reaches the vicinity of the crotch 24.

The foregoing preferred embodiment allows the stretchable portion 131*a* having a relatively great straining force to cover a part of the inferior region 4 of the patella 1, thereby support the patella 1 as if pulling up the patella 1 from the inferior side thereof. As a result, the stability of the knee joint is improved. Furthermore, the embodiment allows the portion 131*a* to support the musculus gracilis 23 that is located on the medial side of the thigh, thereby increasing the power of pulling the stretchable portion having a relatively great straining force that supports the ligamentum collateralle medialis 3. Consequently, a leg support garment with an increased power for supporting the ligamentum collateralle medialis 3 is provided, which is preferable. Furthermore, the musculus gracilis that complements the function of the ligamentum collateralle medialis is supported, which is preferable.

Figure 105:
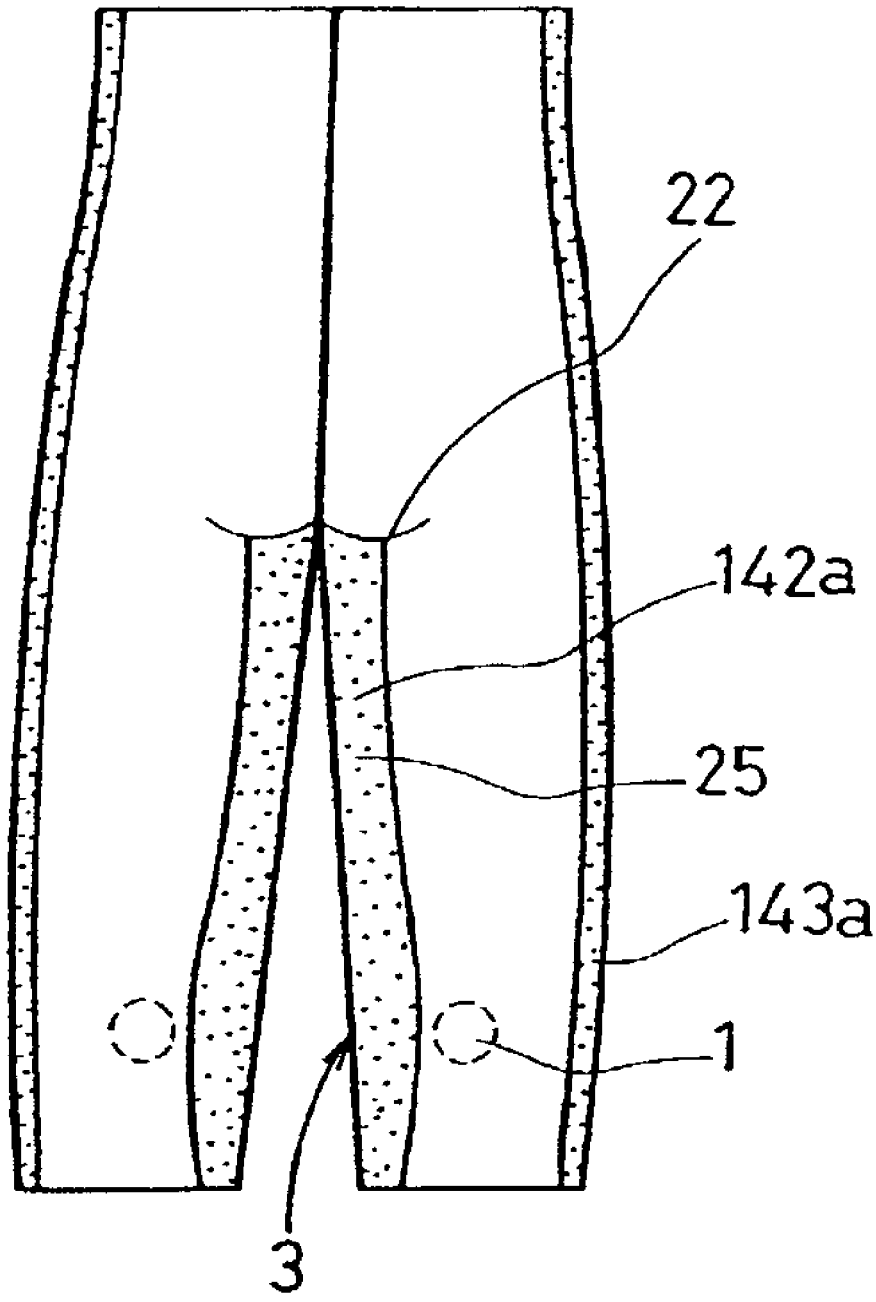
FIG. 105 is a rear view illustrating still another embodiment of a semi-long-tights-type leg support garment of the present invention.
Figure 106:
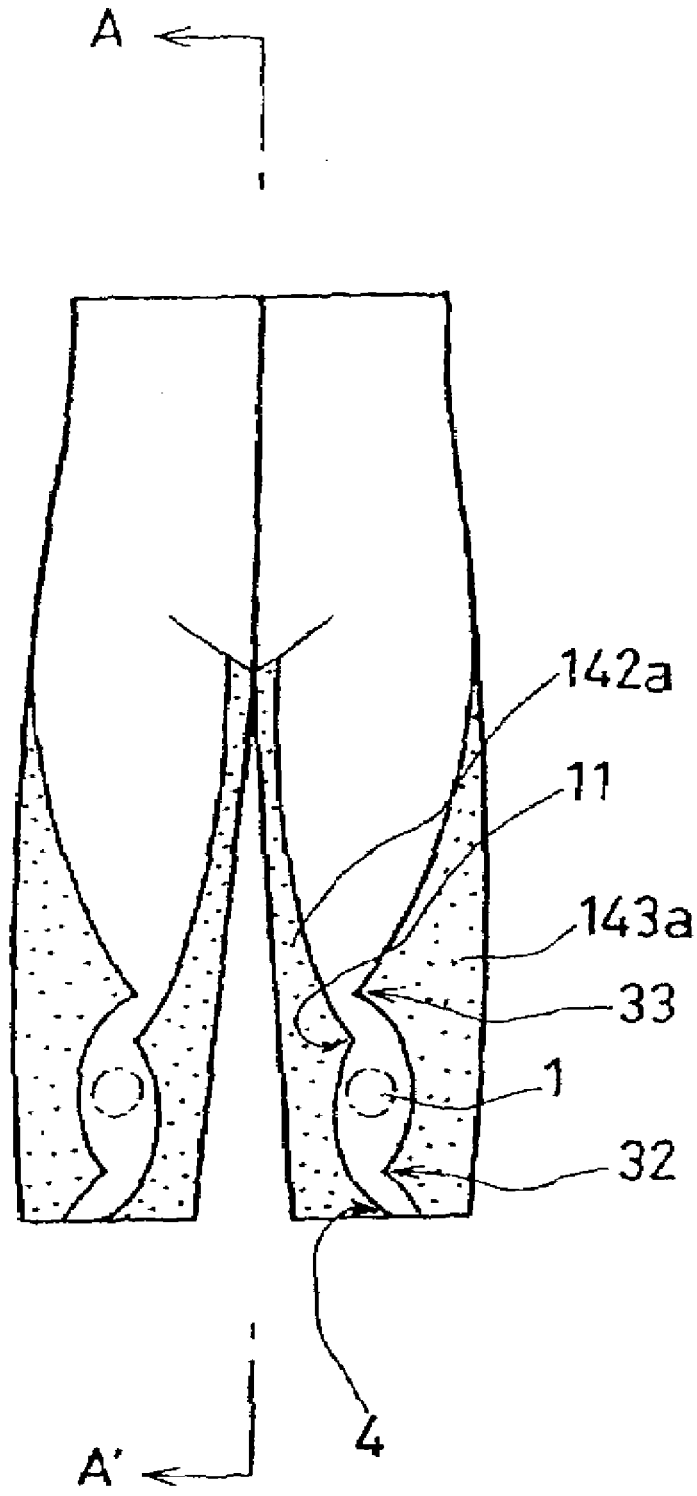
FIG. 106 is a front view of the leg support garment shown in FIG. 105.
Figure 107:
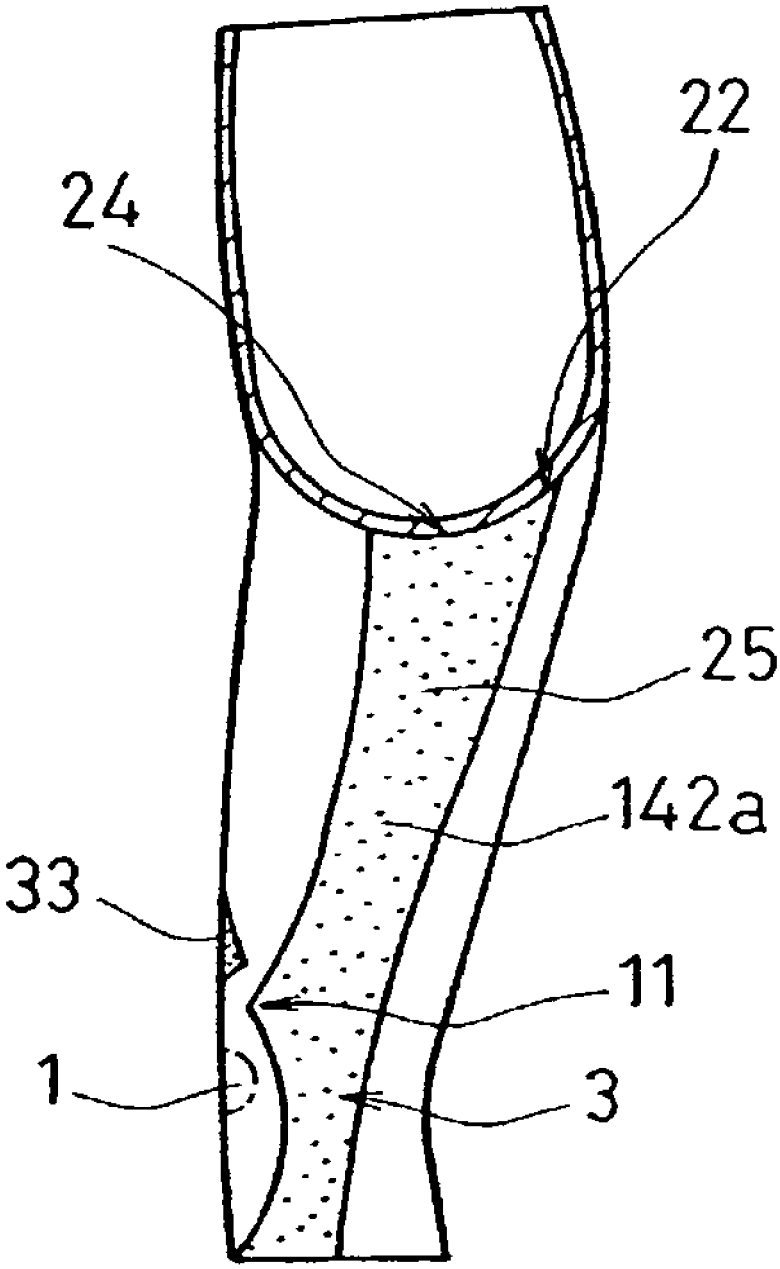
FIG. 107 is a cross-sectional view of the leg support garment taken along an A–A' line in FIG. 106.
Figure 108:
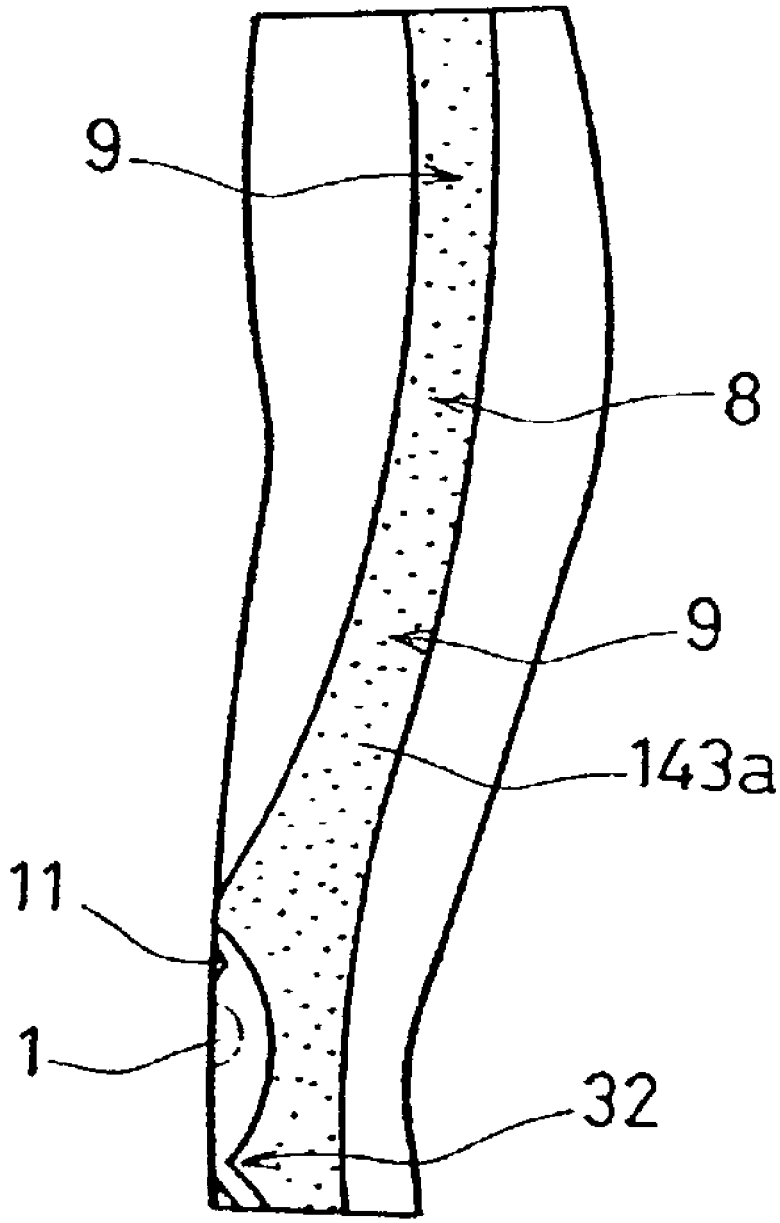
FIG. 108 is a right-side view of the leg support garment shown in FIG. 106.

Next, FIGS. 105 to 108 are views illustrating still another embodiment of a semi-long-tights-type leg support garment of the present invention. FIG. 105 is a rear view of the same, FIG. 106 is a front view of the same, FIG. 107 is a cross-sectional view of the same taken along an A–A' line in FIG. 106, and FIG. 108 is a right-side view of the same.

The garment of the present embodiment is equivalent to a semi-long-tights-type leg support garment obtained by, from the long-tights-type leg support garment shown in FIGS. 45 to 48, cutting away a part lower than a position of the portion 32 that covers a part of the lateral inferior region of the patella 1.

The garment of the present embodiment is a leg support garment in which the portion expressed as the stretchable portion (A) having a relatively great straining force is a stretchable portion ($A^2$2') 142*a* having a relatively great straining force, and the stretchable part having a relatively great straining force further includes a stretchable portion ($B^{2'}$) 143*a* having a relatively great straining force. The stretchable portion ($A^2$2') 142*a* having a relatively great straining force substantially covers the ligamentum collateralle 3 on the medial side of the knee joint of the human body, extends approximately along the vicinity of a periphery of the patella 1 on the medial side thereof so as to surround the patella 1 through at least more than approximately ½ of the periphery of the patella 1 and to cover a part of inferior and superior regions 4 and 11 of the patella 1, and reaches a side of a superior part of the musculus gastrocnemius on the medial side. Further, on the superior side of the knee joint, in the femoral region, the stretchable portion ($A^2$2') 142*a* having a relatively great straining force extends approximately along the musculus semitendinosus and the musculus gracilis, and reaches the vicinity below the crotch 24 and a vicinity of the sulcus gluteus 22. The stretchable portion (132') 143*a* having a relatively great straining force extends from a side part of the waist 10 approximately along the tractus iliotibialis 9 via a vicinity of the trochanter major 8, then, approximately along the tractus iliotibialis 9 to the lateral side of the patella 1, surrounds the patella 1 through approximately ½ or more of the periphery of the patella 1 so as to cover a part of an inferior region 32 and a superior region 33 of the patella 1, and reaches a side of a superior part of the musculus gastrocnemius on the lateral side.

In the foregoing embodiment, two portions 4 and 11 of the stretchable portion ($A^2$2') 142*a* having relatively great straining forces project toward the medial side therefrom and cover a part of the inferior region 4 and a part of the superior region 11 of the patella 1, respectively. Besides, two portions 32 and 33 of the stretchable portion ($B^{2'}$) 143*a* having relatively great straining forces project toward the lateral side therefrom and cover a part of the inferior region 32 and a part of the superior region 33 of the patella 1, respectively. Here, the two portions 4 and 11 of the stretchable portion ($A^2$2') 142*a* having a relatively great straining force are arranged opposite to the two portions 32 and 33 of the stretchable portion ($B^{2'}$) 143*a* having a relatively great straining force, respectively, and at positions slightly shifted to the inferior side from positions of the portions 32 and 33 of the stretchable portion ($B^{2'}$) 143*a* having a relatively great straining force, respectively. Furthermore, when viewed from the front, the portion covering the inferior region 4 of the patella 1, of the stretchable portion ($A^2$2') 142*a* having a relatively great straining force, has a relatively greater area.

The foregoing preferred embodiment allows the stretchable portions having relatively great straining forces to support the knee and leg from both sides in the femoral region and the lower leg region, without hindering the action of the musculus vastus lateralis and the musculus vastus medialis on the anterior side of the thigh, and further, allows the knee joint to be supported as if wrapped from the surrounding, thereby providing further support of the knee joint. Besides, the function of pressing the trochanter major 8 is reinforced, thereby further improving the connection between the caput ossis femoris and the acetabulum. Therefore, the function of enhancing the stability of the hip joint is reinforced, which is preferable.

Furthermore, in the lower leg region, on the medial side, the muscles are fewer and the tibia is in contact with the surface of the body. On the other hand, on the lateral side of the lower leg region, the musculus gastrocnemius is on the lateral side of the fibula. Therefore, the foregoing embodiment provides the support of the knee joint as if pulling the medial side thereof having fewer muscles more intensely from the inferior side, thereby reinforcing the support of the ligamentum collateralle medialis, which is preferable.

As described above, in the foregoing embodiment, as to the two portions 4 and 11 of the stretchable portion ($A^2$2') 142*a* having a relatively great straining force that project to the lateral side and cover a part of the inferior region 4 and a part of the superior region 11 of the patella 1, respectively, and the two portions 32 and 33 of the stretchable portion ($B^{2'}$) 143*a* having a relatively great straining force that project to the medial side and cover a part of the inferior region 32 and a part of the superior region 33 of the patella 1, respectively, the position of the projecting portion 4 is slightly inferior to the position of the projecting portion 32, and the position of the projecting portion 11 is slightly inferior to the position of the projecting portion 32. Therefore, this provides the support of the knee joint as if pulling the medial side thereof having fewer muscles more intensely from the inferior side, thereby reinforcing the support of the ligamentum collateralle medialis, which is preferable. However, the projecting portion 4 may be at a position as high as the position of the projecting portion 32, or the projecting portion 11 may be at a position as high as a position of the projecting portion 33. Besides, the two portions 4 and 11 projecting toward the lateral side may further extend over the central line of the anterior side of the leg toward the lateral side, while the portions 32 and 33 opposite thereto may further extend over the central line of the anterior side of the leg toward the medial side. Alternatively, the projecting portions 4 and 32 may be connected with each other, and likewise, the projecting portions 11 and 33 may be connected with each other. Furthermore, the projecting portion 4 may be located at a position shifted slightly to the superior side of the projecting portion 32, while the projecting portion 11 may be located at a position shifted slightly to the superior side of the projecting portion 33.

Figure 109:
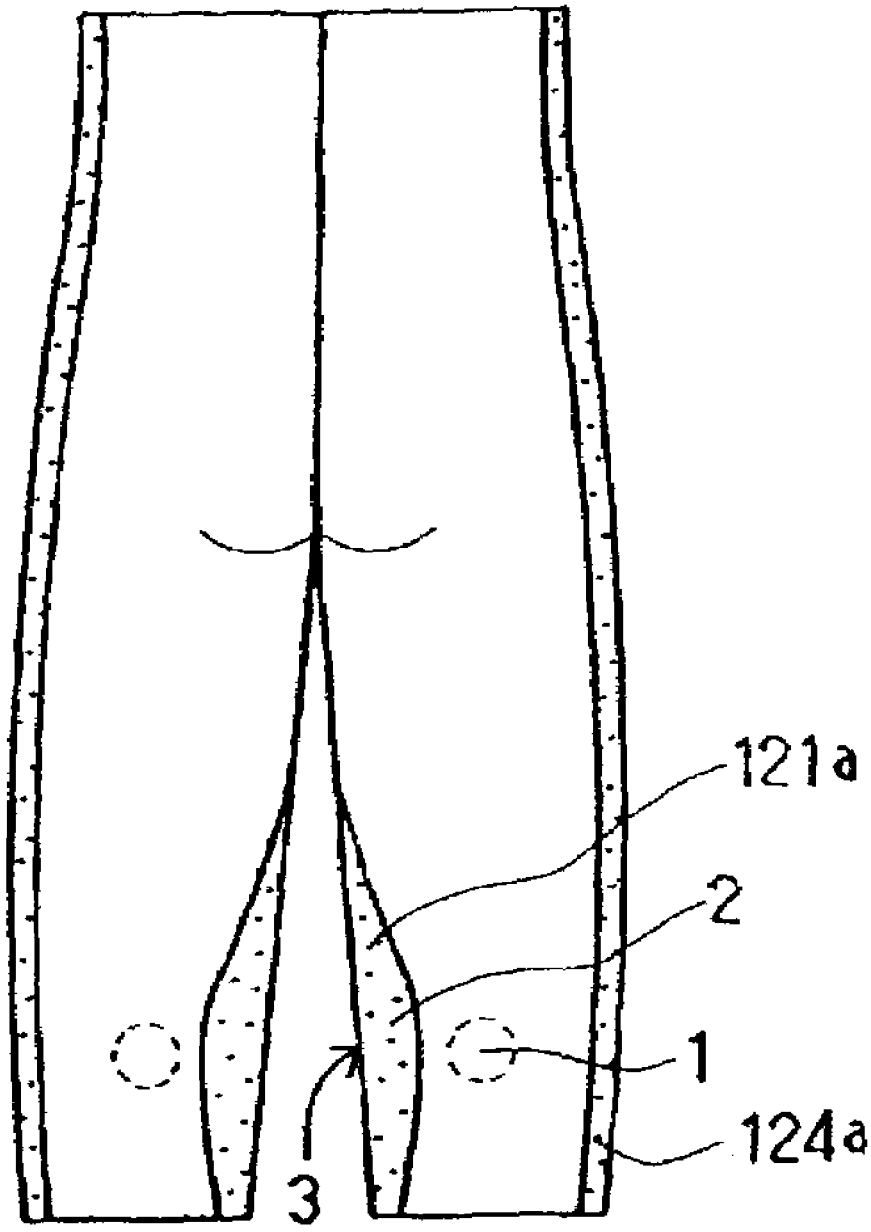
FIG. 109 is a rear view illustrating still another embodiment of a semi-long-tights-type leg support garment of the present invention.
Figure 110:
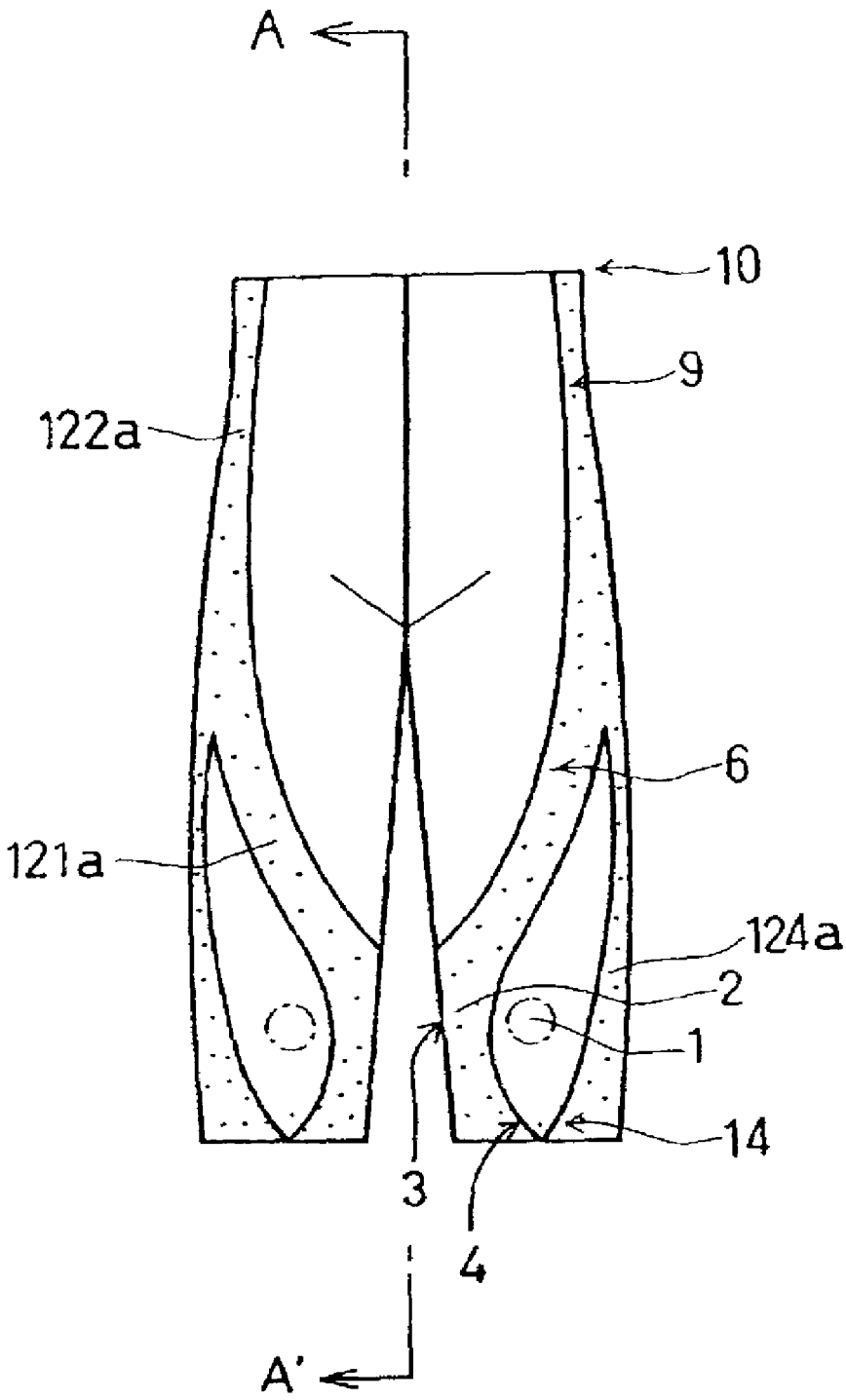
FIG. 110 is a front view of the leg support garment shown in FIG. 109.
Figure 111:
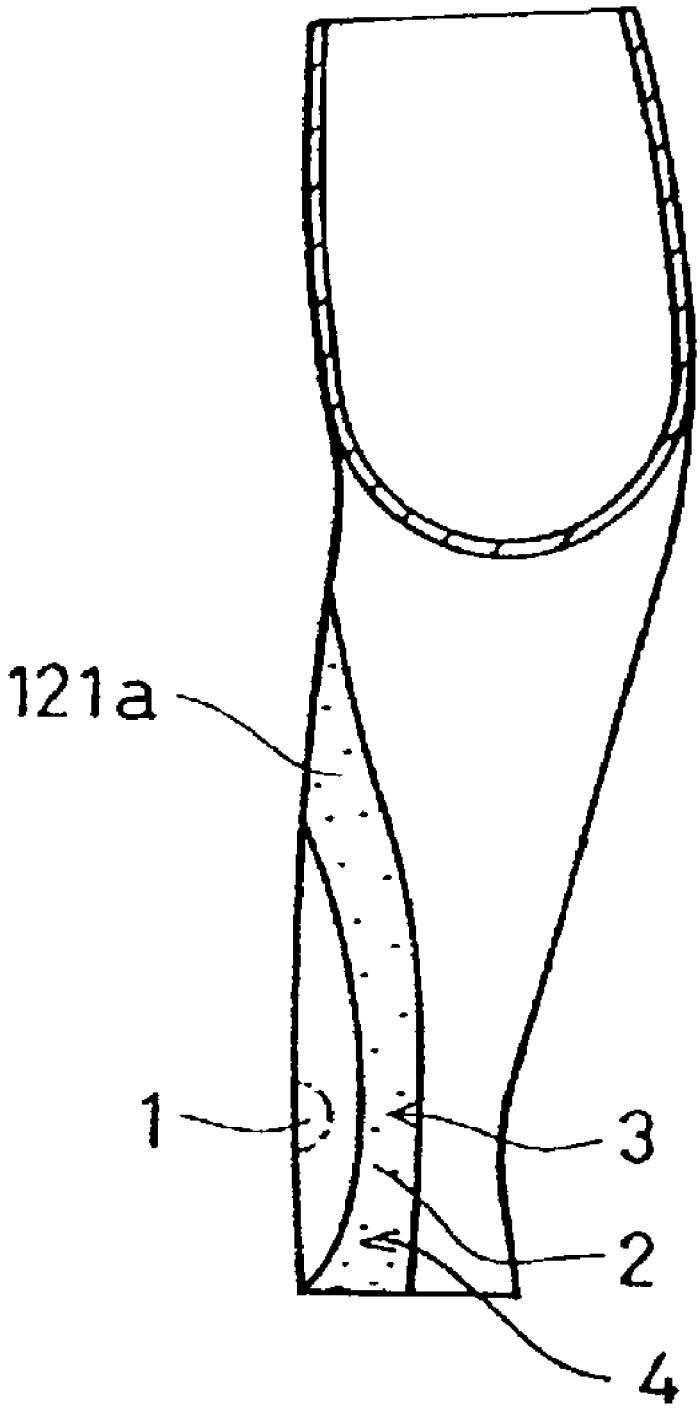
FIG. 111 is a cross-sectional view of the leg support garment taken along an A–A' line in FIG. 110.
Figure 112:
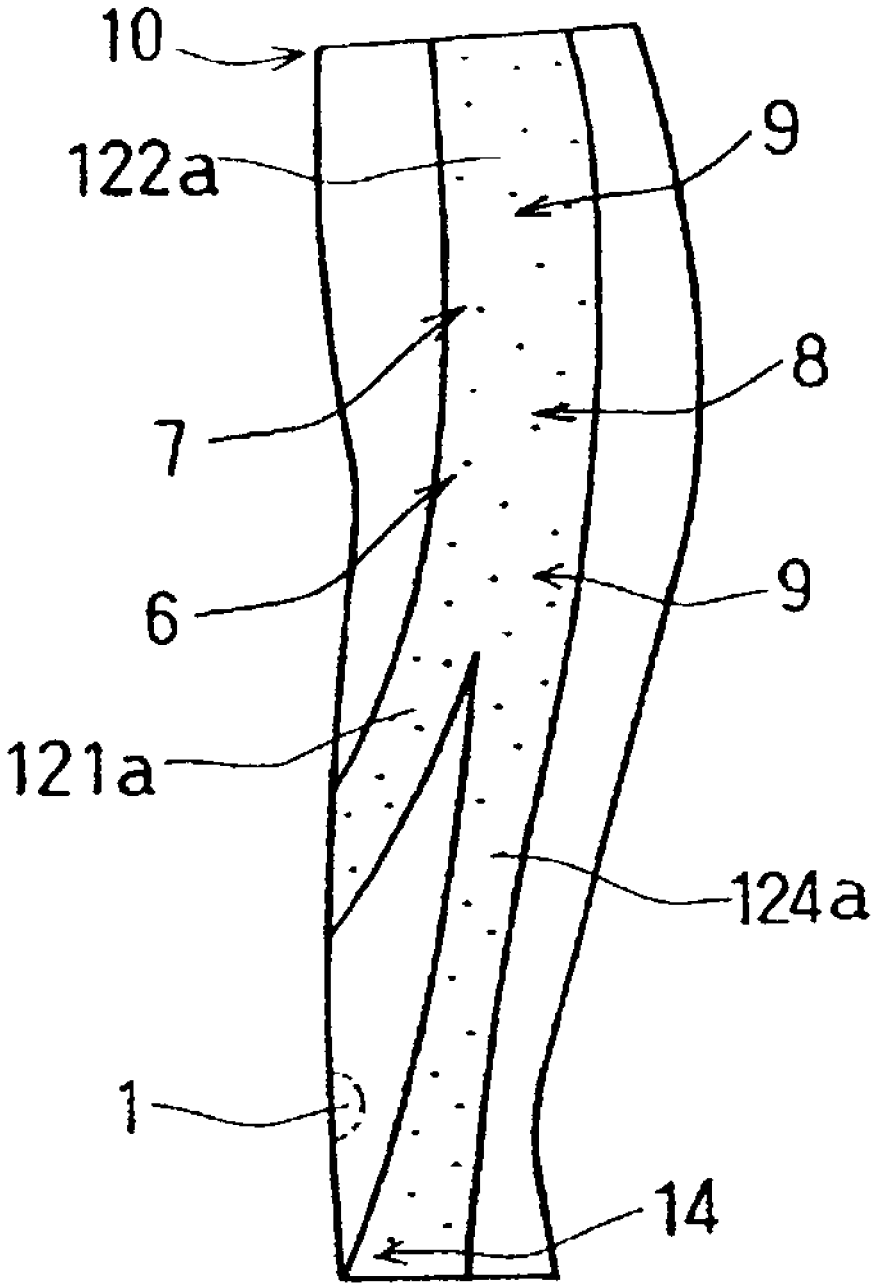
FIG. 112 is a right-side view of the leg support garment shown in FIG. 110.

Next, FIGS. 109 to 112 are views illustrating still another embodiment of a semi-long-tights-type leg support garment of the present invention. FIG. 109 is a rear view of the same, FIG. 110 is a front view of the same, FIG. 111 is a cross-sectional view of the same taken along an A–A' line in FIG. 110, and FIG. 112 is a right-side view of the same.

The garment of the present embodiment is a garment as a modification of the embodiment show in FIGS. 93 to 96; namely, in the garment of the embodiment shown in FIGS. 93 to 96, the stretchable portion ($A^2$1) 121*a* having a relatively great straining force and the stretchable portion ($B^2$) 124*a* having a relatively great straining force are brought in contact with each other at a position on the inferior side of the patella. Therefore, the same portions as those of the embodiment shown in FIGS. 93 to 96 are designated with the same reference numerals in the drawings and descriptions of the same are omitted.

More specifically, a projecting portion 4 of the stretchable portion 121*a* having a relatively great straining force that covers a part of the inferior region of the patella 1 and a projecting portion 14 of the stretchable portion 124*a* having a relatively great straining force that covers a part of the inferior region of the patella 1 are coupled with each other at a position on the inferior side of the patella 1, so as to support the knee from the right, left, and inferior sides of the same. Therefore, the same function as that of the leg support garment shown in FIGS. 85 to 88 is displayed. Besides, since the portions denoted with 4 and 14 are brought into contact with each other, the hems of the garment are stably positioned on the inferior sides of the knees, and the loosening of the garment, such as the sliding up, hardly takes place.

Figure 113:
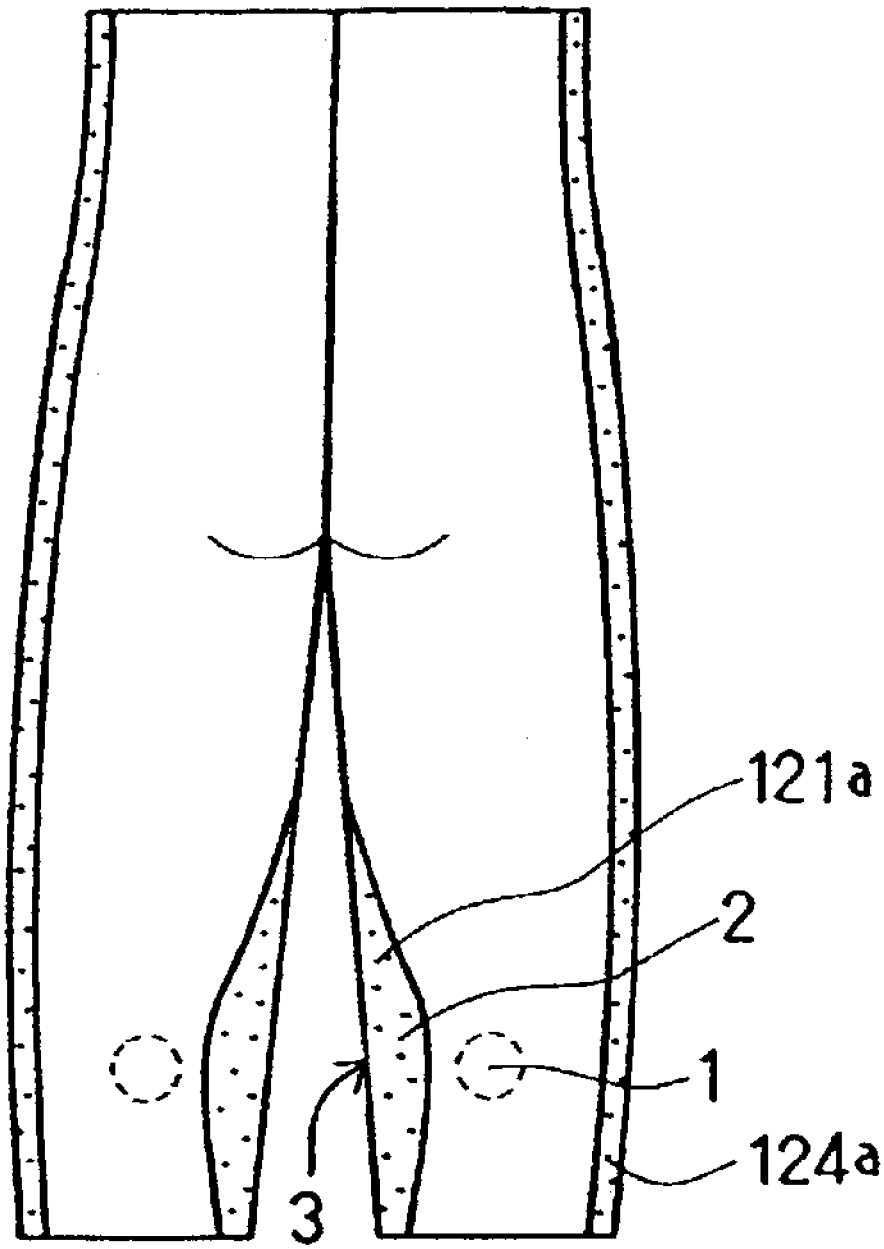
FIG. 113 is a rear view illustrating still another embodiment of a semi-long-tights-type leg support garment of the present invention.
Figure 114:
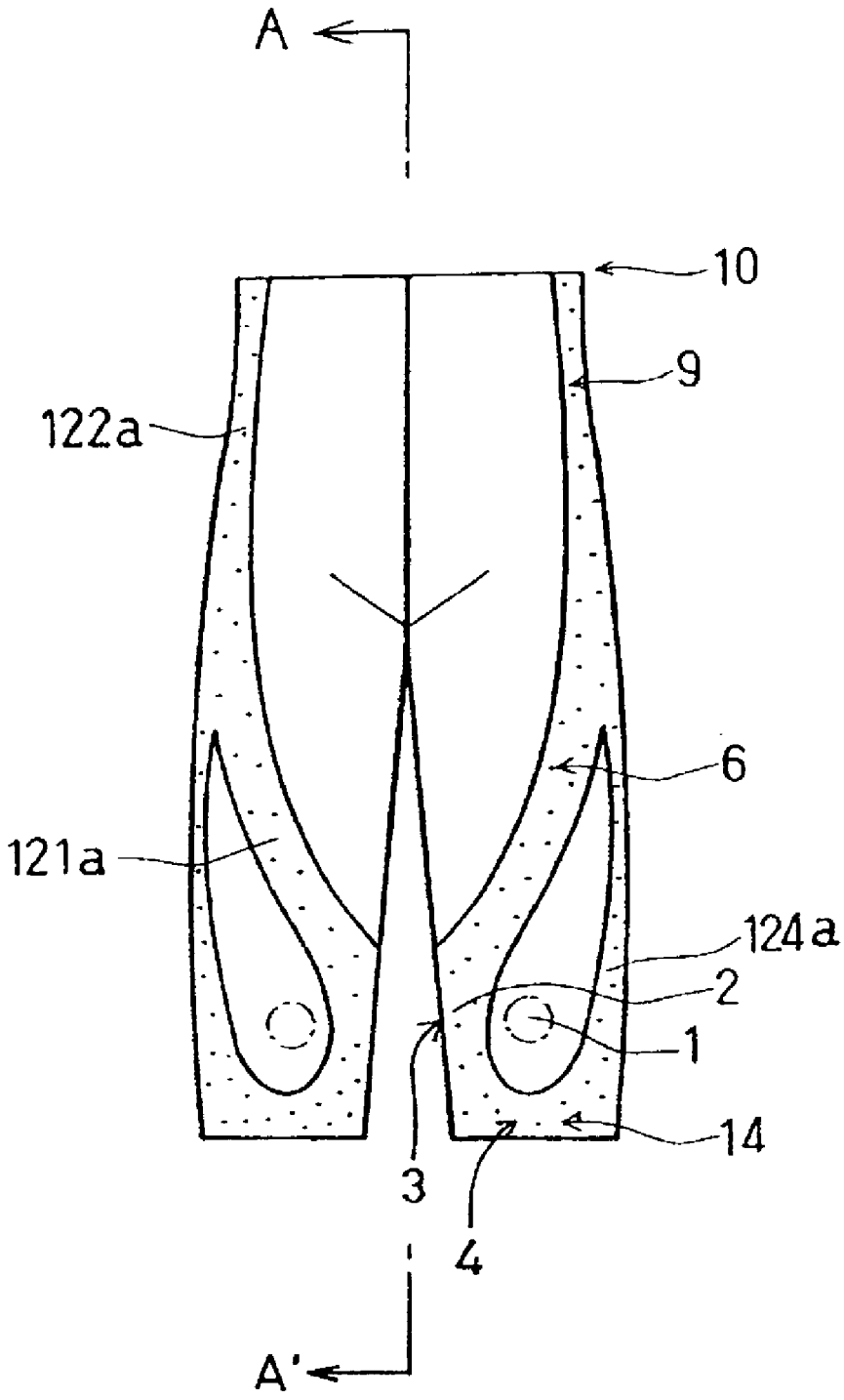
FIG. 114 is a front view of the leg support garment shown in FIG. 113.
Figure 115:
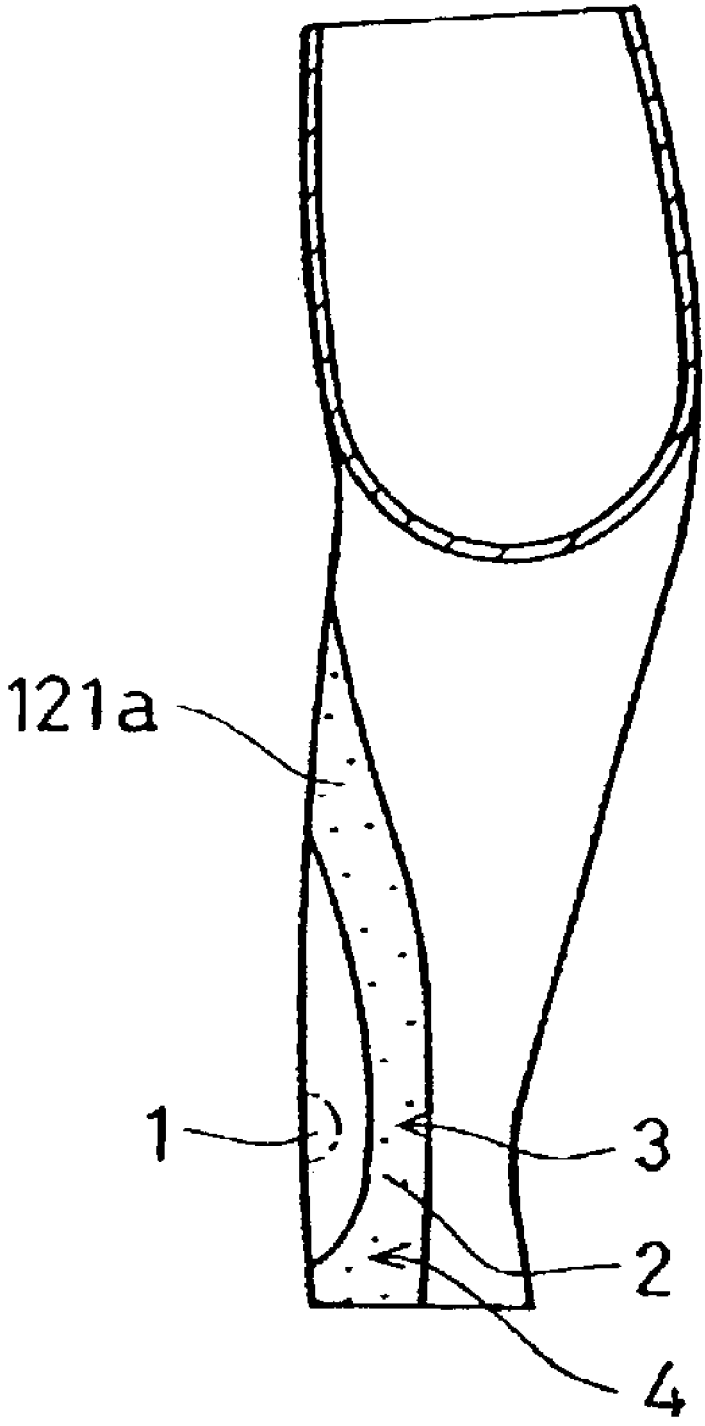
FIG. 115 is a cross-sectional view of the leg support garment taken along an A–A' line in FIG. 114.
Figure 116:
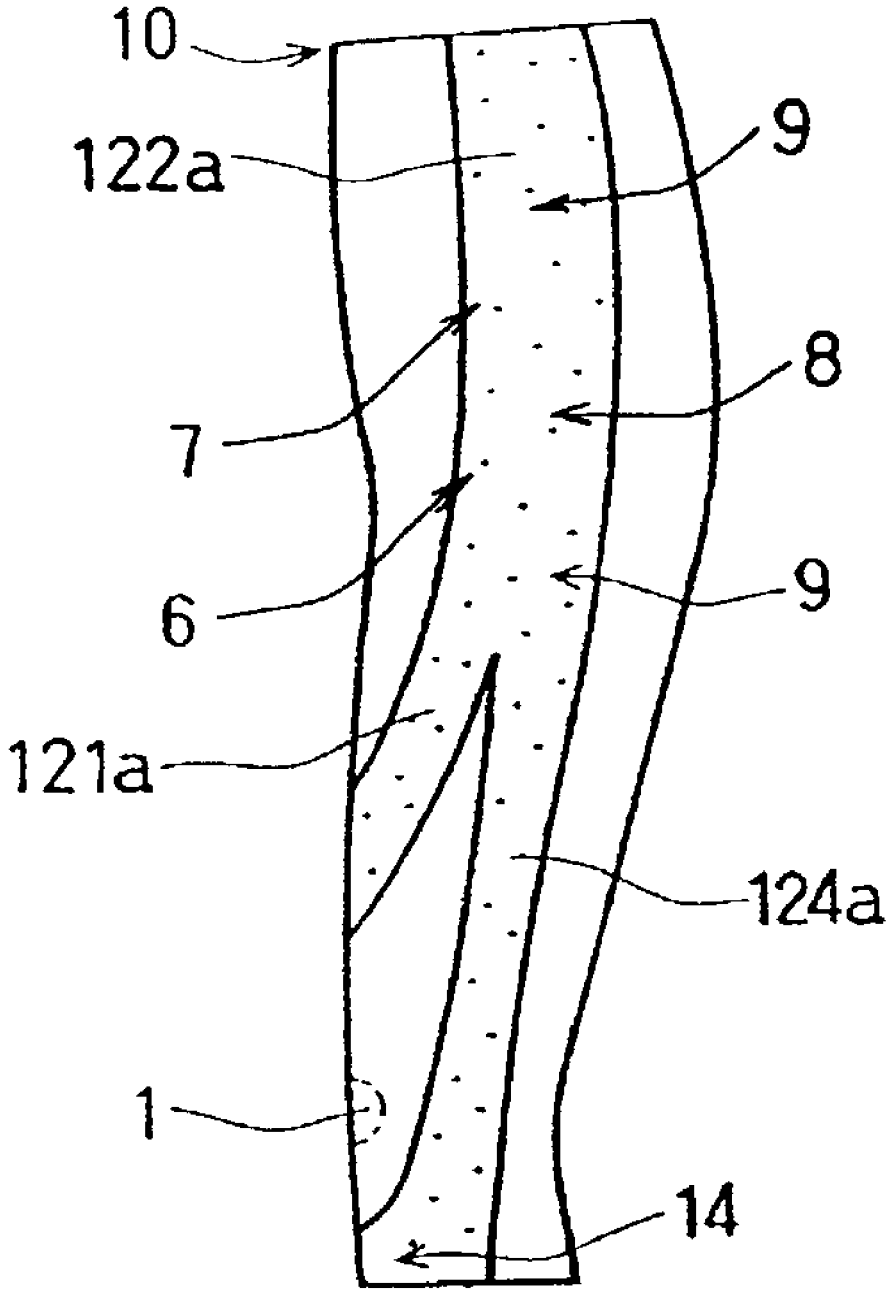
FIG. 116 is a right-side view of the leg support garment shown in FIG. 114.

Next, FIGS. 113 to 116 are views illustrating still another embodiment of a semi-long-tights-type leg support garment of the present invention. FIG. 113 is a rear view of the same, FIG. 114 is a front view of the same, FIG. 115 is a cross-sectional view of the same taken along an A–A' line in FIG. 114, and FIG. 116 is a right-side view of the same.

The garment of the present embodiment is a garment as a modification of the embodiment shown in FIGS. 109 to 112; namely, in the garment of the embodiment shown in FIGS. 109 to 112, the stretchable portion ($A^2$) 121*a* having a relatively great straining force and the stretchable portion ($B^2$) 124*a* having a relatively great straining force are coupled with each other in a slightly wide range on the inferior side of the patella, rather than in point contact with each other. Therefore, the same portions as those of the embodiment shown in FIGS. 109 to 112 are designated with the same reference numerals in the drawings and descriptions of the same are omitted.

More specifically, a projecting portion 4 of the stretchable portion 121*a* having a relatively great straining force that covers a part of the inferior region of the patella 1 and a projecting portion 14 of the stretchable portion 124*a* having a relatively great straining force that covers a part of the inferior region of the patella 1 are coupled with each other at a position on the inferior side of the patella 1, so as to support the knee from the right, left, and inferior sides of the same. Therefore, the same function as that of the leg support garment shown in FIGS. 109 to 112 is displayed, and the function of supporting the knee from the inferior side is further reinforced.

It should be noted that in the case of the present embodiment, in the case where the stretchable part having a relatively great straining force is formed by laminating stretchable fabrics in predetermined shapes on a garment main body and sewing them, or the like, the coupling between the portion 4 of the stretchable portion 121*a* having a relatively great straining force that covers a part of the inferior region of the patella 1 and the portion 14 of the stretchable portion 124*a* having a relatively great straining force that covers a part of the inferior region of the patella 1 may be achieved by forming the same with one piece of fabric in which the stretchable portions 121*a* and 124*a* having relatively great straining forces are continuously provided, so that the coupling therebetween has been achieved beforehand. Alternatively, the stretchable portions 121*a* and 124*a* having relatively great straining forces may be made of separate pieces of fabrics, respectively, and portions of the fabrics corresponding to the portions 4 and 14 may be overlapped and sewn so that the coupling therebetween is achieved.

So far, several embodiments of semi-long-tights-type leg support garments have been described with reference to the drawings. The present invention, however, is not limited to these, and the various kinds of long-tights-type leg support garments described above with reference to the drawings may be applied as semi-long-tights-type garments by cutting away the portions lower than the knee.

Furthermore, any design of a garment in which an upper body part is added to the semi-long-tights-type leg support garment of the present invention as required is not excluded from the present invention at all, as long as the object of the present invention is not inhibited. As to the ankle-length leg support garment of the present invention, any garment of this type to which a piece of fabric traversing the sole is attached so as to connect both sides of the hem of each leg part is not excluded from the present invention at all.

Meanwhile, in the long-tights-type and semi-long-tights-type leg support garments, any seam line of the main body of the garment preferably does not run through at least a region covering the ligamentum collateralle in the stretchable portion having a relatively great straining force located over the ligamentum collateralle on the medial side of the knee joint.

More specifically, as to the leg support garment of the present invention of any type, the long-tights-type or the semi-long-tights-type, it is necessary to form a portion covering the leg part into a cylindrical form, and applicable as a method for forming the leg part into a cylindrical form is, for instance, a method for rolling a flat fabric into a cylindrical form and seaming a hem on one side of the fabric and a hem on the other side of the fabric together. In the case where a fabric is thus shaped in a cylindrical form by seaming the same, conventionally it is usual that the sawing is carried out so that the seam line passes the medial side of the leg part.

In the present invention, it is preferable to design the garment so that the seam line of the main body of the garment does not run through at least a region thereof covering the ligamentum collateralle in the stretchable portion having a relatively great straining force located on the ligamentum collateralle on the medial side of the knee joint. The facilitate the understanding, the seam line of the main body of the garment whose leg part is formed in a cylindrical form is described below, taking concrete examples with reference to a few of the drawings.

Figure 117:
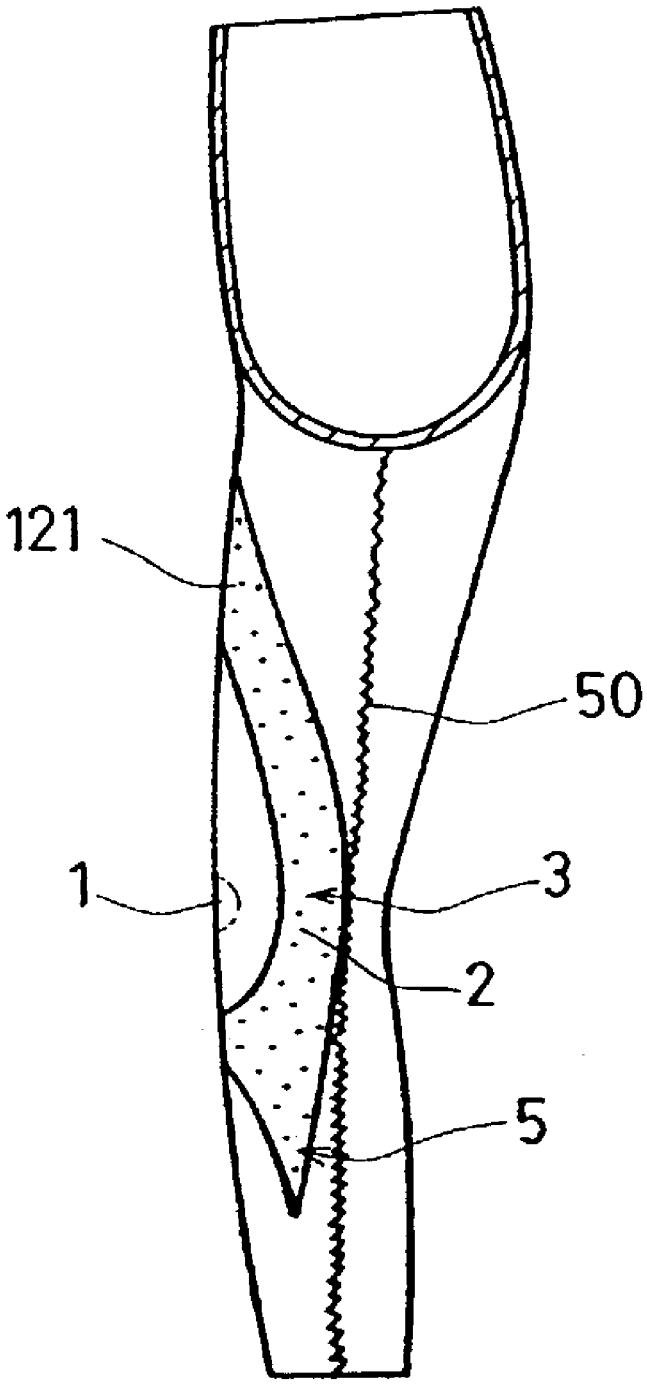
FIG. 117 is a view showing a position of a sewing line for a main body of a garment according to an embodiment; the view is obtained by drawing, on FIG. 7, a sewing line for a main body of a garment whose leg part is formed in a cylindrical form.

FIG. 117 is a drawing in which a seam line of the main body of the garment whose leg part is formed in a cylindrical form is drawn into FIG. 7. More specifically, FIG. 117 illustrates an embodiment in the case where a seam line 50 of the main body of the garment whose leg part is formed in a cylindrical form runs on a medial side of the leg part. The garment is designed so that the seam line 50 of the main body of the garment whose leg part is formed in a cylindrical form passes on a hem of a part of the stretchable portion 121 having a relatively great straining force located over the ligamentum collateralle 3 on the medial side of the knee joint, avoiding at least a region thereof immediately above the ligamentum collateralle 3. Thus, the description "does not run through at least a region covering the ligamentum collateralle in the stretchable portion having a relatively great straining force located on the ligamentum collateralle on the medial side of the knee joint" is used so as to mean that the seam line is allowed to run on the hem of the region covering the ligamentum collateralle of the stretchable portion having a relatively great straining force. Of course, the garment may be designed so that the seam line passes through positions slightly distanced from the region covering the ligamentum collateralle of the stretchable portion having a relatively great straining force, without running on the hem of the region of the ligamentum collateralle at all.

Figure 118:
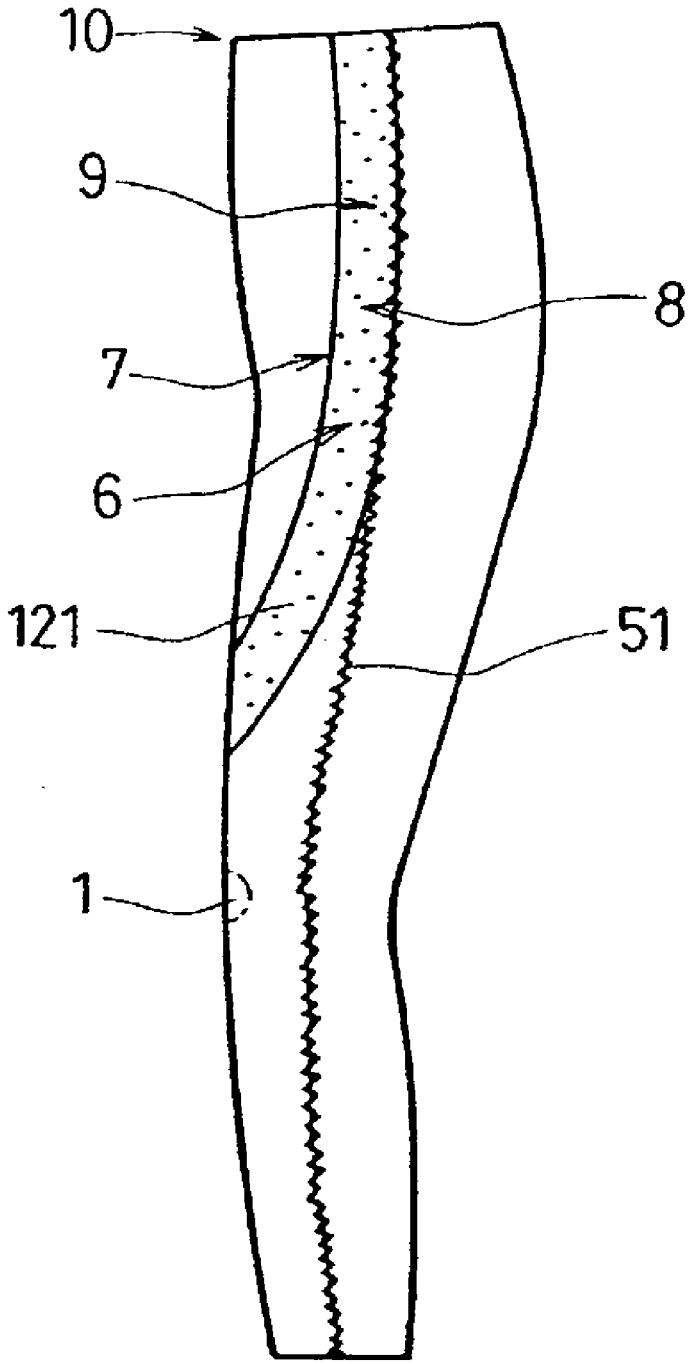
FIG. 118 is a view showing a position of a sewing line for a main body of a garment according to another embodiment; the view is obtained by drawing, on FIG. 8, a sewing line for a main body of a garment whose leg part is formed in a cylindrical form.

Next, FIG. 118 is a view illustrating another embodiment different from that shown in FIG. 117, for explaining a position of the seam line of the main body of the garment. FIG. 118 is a drawing in which the seam line of the main body of the garment whose leg part is formed in a cylindrical form is drawn into FIG. 8. More specifically, FIG. 118 illustrates an embodiment in the case where a seam line 51 of the main body of the garment whose leg part is formed in a cylindrical form runs on a lateral side of the leg part. In the case where the seam line of the main body of the garment whose leg part is formed in a cylindrical form runs on a lateral side of the leg part, the seam line by no means runs through at least a region covering the ligamentum collateralle in the stretchable portion having a relatively great straining force located on the ligamentum collateralle on the medial side of the knee joint. Therefore, such a seam line basically may be allowed to run through any position as long as the position is on the lateral side of the leg part. However, in the case where a certain stretchable portion having a relatively great straining force exists on the lateral side of the leg part, it is preferable to design the garment so that, if possible, the seam line should, for instance, pass along the hem of the same, avoiding the stretchable portion having a relatively great straining force, or that the seam line should be located at a position slightly distanced from the region covering the ligamentum collateralle of the stretchable portion having a relatively great straining force. In the example shown in FIG. 118, the seam line 51 of the main body of the garment whose leg part is formed in a cylindrical form is provided along the hem on one side of the stretchable portion 121 having a relatively great straining force in an upper part of the garment, and then, passes through approximately the center of the side part of the garment, slightly away from the stretchable portion 121 having a relatively great straining force, in a lower part from a position at a distance of if approximately ⅓ of the total length of the garment from the waistline 10.

Figure 119:
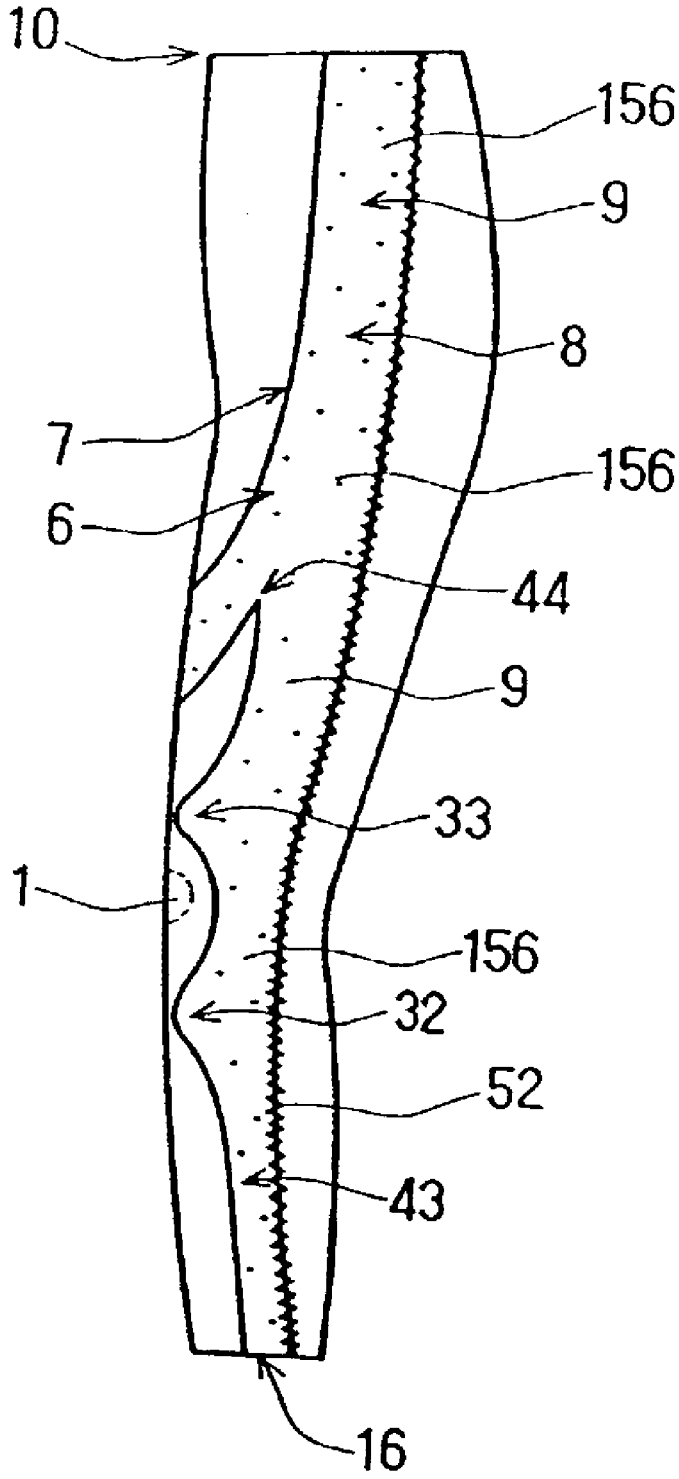
FIG. 119 is a view showing a position of a sewing line for a main body of a garment according to still another embodiment; the view is obtained by drawing, on FIG. 80, a sewing line for a main body of a garment whose leg part is formed in a cylindrical form.

Next, FIG. 119 is a view illustrating still another embodiment different from that shown in FIGS. 117 and 118, for explaining a position of the seam line of the main body of the garment. FIG. 119 is a drawing in which the seam line of the main body of the garment whose leg part is formed in a cylindrical form is drawn in FIG. 80. More specifically, FIG. 118 illustrates another embodiment in the case where a seam line 52 of the main body of the garment whose leg part is formed in a cylindrical form runs on a lateral side of the leg part. In the example shown in FIG. 118, the seam line 52 of the main body of the garment whose leg part is formed in a cylindrical form is provided along a hem on the posterior side of the stretchable portion 156 having a relatively great straining force. By sewing the garment through the foregoing line, the seam line runs on the hem of the stretchable portion 156 having a relatively great straining force. Therefore, the seam line by no means independently appears on the garment, thereby hardly harming the appearance of the garment. Consequently, an advantage in that the design of the garment is not impaired is achieved. Particularly in the case where the stretchable portion having a relatively great straining force is composed of a patch of a fabric, the sewn portions constitute sewn portions where the patch of the fabric and the main body of the garment are sewn together. Therefore, the design of the garment is not impaired. Furthermore, since the sewn portions are such commonly sewn portions, the leg support garment of the present invention can be formed with fewer sewn portions. The foregoing is a mere example, but in the case where the stretchable portion having a relatively great straining force extends on the lateral side of the leg part of the garment, approximately from the upper end to the lower end of the garment, it is preferable that the seam line of the main body of the garment whose leg part is formed in a cylindrical form is provided along the hem of the stretchable portion having a relatively great straining force, since the aforementioned advantages and the like can be achieved.

The foregoing description explains the seam line of the main body of the garment in the case where the leg part thereof is formed in a cylindrical form, while referring to a few concrete examples, but the present invention is not limited to the concrete examples shown in the drawings.

As described above, with the preferred embodiment of the present invention, in which the seam line of the main body of the garment does not run through at least a region covering the ligamentum collateralle in the stretchable portion having a relatively great straining force located over the ligamentum collateralle on the medial side of the knee joint, the insufficiency of the power for supporting the ligamentum collateralle medialis can be avoided; the insufficiency of the power is caused in the case where a seam line runs through at least a region covering the ligamentum collateralle medialis in the stretchable portion having a relatively great straining force located over the ligamentum collateralle medialis, since the stretchability is decreased by the seam line. Therefore, with the preferred embodiment of the present invention, the straining force of the stretchable portion having a great straining force located over the ligamentum collateralle medialis is displayed sufficiently, which is preferable.

In a garment of the present invention, a stretchable portion having a relatively great straining force may be formed by laminating a stretchable fabric having a predetermined shape on the main body of the garment and sewing it, or by laminating a stretchable fabric having a predetermined shape on the main body of the garment and bonding it. Particularly, according to the former method, a garment having durability can be produced easily. Of course, a leg support garment of the present invention may be formed by preparing stretchable portions having relatively great straining forces and other portions as respective parts of predetermined shapes and seaming them together. However, such sewing is complex and takes a lot of labor.

Furthermore, for example, a stretchable portion having a relatively great straining force may be formed by stretching and laminating a stretchable fabric having a predetermined shape on the main body of the garment and sewing or bonding it. These methods are favorable when applying a stronger straining force by the stretchable portion having a relatively great straining force.

Furthermore, a stretchable portion having a relatively great straining force may be formed by impregnating or coating a predetermined part of the main body fabric of the garment with a solution or emulsion of a synthetic resin or rubber having elasticity followed by drying, or by laminating a film of a synthetic resin or rubber having elasticity on a predetermined part of the main body fabric of the garment. According to these methods, a stretchable portion having a relatively great straining force can be obtained with a relatively small thickness. As the synthetic resin having elasticity, suitable elastic resins such as polyurethane resins, polyester elastomer resins, etc. may be used.

Furthermore, a stretchable portion having a relatively great straining force may be formed by changing the knitting stitch of a stretchable fabric that forms the main body of the garment to a stitch with a greater straining force. According to this method, because lamination also is not necessary, a stretchable portion having a relatively great straining force can be formed thinner. The definition of the method in which a stretchable portion having a relatively great straining force is formed by changing the knitting stitch as described also includes a method of forming a stretchable portion having a relatively great straining force by using, among the fiber materials forming the main body of the garment, an elastic fiber thicker than those used in other portions, and a method of forming the same by increasing the density of the elastic fiber as compared with the other portions. According to any one of these methods, because lamination also is not necessary, a stretchable portion having a relatively great straining force can be formed further thinner.

Furthermore, in the case where the circular-knitting fabric is used as the fabric that forms the garment, it is possible to form the stretchable portions having great straining forces by the cut-boss knitting method.

Among the above-described methods for forming a stretchable portion having a relatively great straining force, preferred are the method of laminating a stretchable fabric having a predetermined shape on the main body of the garment and sewing it, and the method of stretching and laminating a stretchable fabric having a predetermined shape on the main body of the garment and sewing it. According to these methods, the straining force of the stretchable fabric sewn to the main body of the garment may be slightly smaller than, the same as, or larger than the straining force of the stretchable fabric of the main body of the garment. This is because lamination of a stretchable fabric on the main body of the garment results in increased straining force in the laminated part. The degree of the straining force of the fabric to be laminated may be chosen as appropriate depending on the type of the garment, intended use, preference of the wearer, etc.

Meanwhile, to facilitate the understanding, the technique for forming the stretchable portion having a relatively great straining force by the aforementioned cut-boss knitting method will be described below, with reference to FIGS. 120 to 122.

Figure 120:
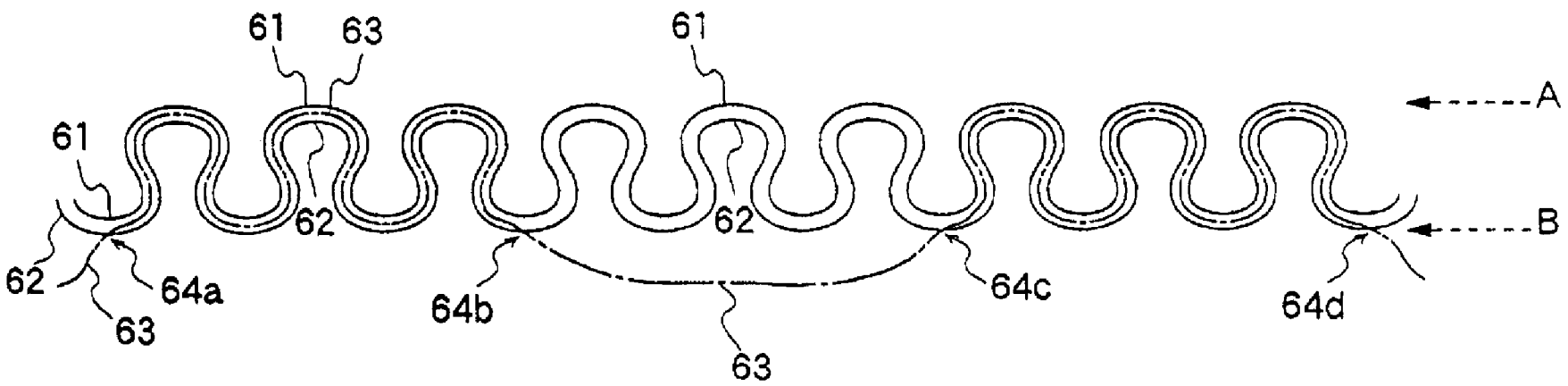
Figure 121:
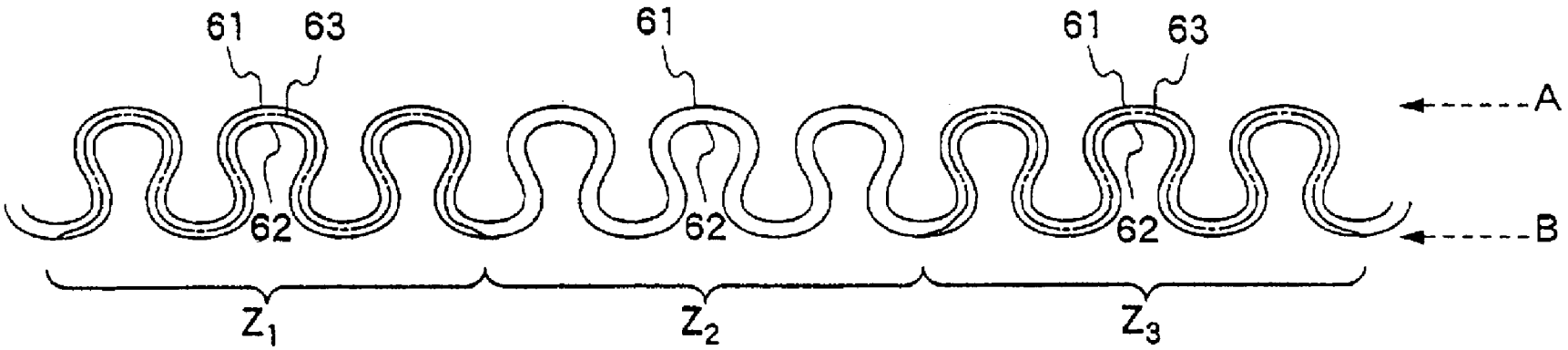
Figure 122:
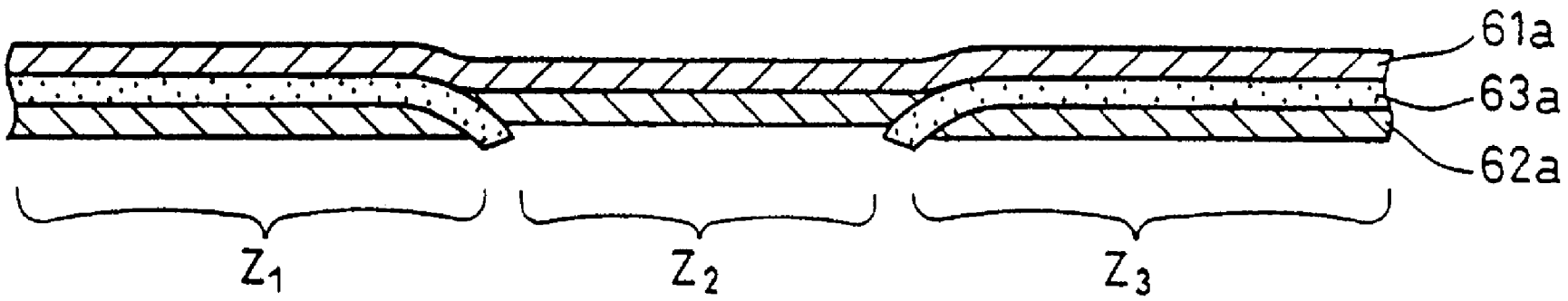

FIGS. 120 to 122 are cross-sectional conceptual process views illustrating the cut-boss knitting technique in the circular knitting. A side indicated by a dotted arrow A is a front side of the circular knitting fabric, and a side indicated by a dotted arrow B is a back side of the circular knitted fabric.

First of all, as shown in FIG. 120, when a front yarn 61 and a back yarn 62 are supplied to a circular knitting machine for knitting, an intermediate yarn 63 is inserted between the front yarn 61 and the back yarn 62 so that the front, intermediate, and back yarns 61, 63, and 62 are supplied together to the circular knitting machine so as to be knitted in a portion that is to have a relatively greater straining force by means of the cut-boss technique. These portions are portions between arrows 64*a* and 64*b* and between arrows 64*c* and 64*d* (it should be noted that the intermediate yarn 63 is indicated with an alternate long and short dash line for conveniences sake.) In a portion to be formed as the portion having a relatively small straining force, like the portion between the arrows 64*b* and 64*c*, the intermediate yarn 63 is not inserted between the front and back yarns 61 and 62 thereby floated on the back side, so that the portion is knitted with only the front and back yarns 61 and 62. Subsequently, the intermediate yarn 63 thus floated is cut at the positions indicated by the arrows 64*a*, 64*b*, 64*c*, and 64*d*. Consequently, as shown in FIG. 121, portions $z_1$ and $z_3$ compose stretchable portions having relatively great straining forces in which the intermediate yarn 63 is inserted, while a portion $z_2$ composes a stretchable portion having a relatively small straining force that is knitted with only the front and back yarns 1 and 2.

FIG. 122 is a cross-sectional conceptual view illustrating a circular knitting fabric obtained by the cut-boss knitting technique. 61*a* is a front surface part of the circular knitting fabric on which the front yarn 61 appears, 62*a* is a back surface part of the circular knitting fabric on which the back yarn 62 appears, 63*a* is a reinforcing layer composed of the intermediate yarn 63, portions $z_1$ and $z_3$ are stretchable portions having relatively great straining forces, and $z_2$ is a stretchable portion having a relatively small straining force.

In the present invention, the stretchable portion having a relatively great straining force and the stretchable portion having a relatively small straining force may be formed by only the cut-boss knitting technique as described above, or alternatively, in addition to the foregoing technique, a technique of varying the straining force by the stitch adjustment in each course of the circular knitting fabric may be used in combination.

Although not particularly limited, it is preferable that a stretchable portion having a relatively great straining force has a straining force of 0.3 N to 4 N approximately in its length direction. Within this range of straining force, the functions of the present invention are exhibited effectively, and moreover compressive feeling is not too strong, and wearing comfort is excellent. Even if the straining force of a stretchable portion having a relatively smaller straining force exceeds 0.3 N. it is justified as long as the straining force is smaller than those of any of the strong straining portions formed in the garment.

In the case where straining forces of fabrics used as a stretchable portion having a relatively great straining force and a stretchable portion having a relatively small straining force are measured, the following tensile test is carried out.

A 2.5 cm×16.0 cm (width×length) sample is formed so that the fabric warp direction (wale direction) is the lengthwise direction of the sample. The sample is placed so that the lengthwise direction is directed in the vertical direction, and both ends of the sample are gripped with clips. The sample is placed to the constant-speed extension-type tensile tester ("AUTOGRPH AG-500D" manufactured by Shimazu Corporation), with an upper grip length and a lower grip length being set to be 2.5 cm and 3.5 cm, respectively, and hence, a space between grips set to be 10.0 cm. The sample is stretched at a rate of 30±2 cm/min, up to a stretching degree of 80%. Here, a stress applied to the sample when the stretching degree is 30% is recorded as a stretching force (unit: N) [1 gf≈0.0098 N]. Then, the stress applied to the sample stretched to the stretching degree of 80% is removed, and the sample contracts toward its original length. Here, a stress applied to the sample when the stretching degree is recovered to approximately 30% is measured as a straining force (unit: N) The foregoing tensile tester is set so that these values are recorded automatically. It should be noted that each of the stretching force and the straining force was determined by measuring two samples and averaging the obtained values.

Here, the stretching degree (%) is a value expressed as $[(d-e)/e]\times 100$ where d represents a length in a stretching direction of a fabric in a stretched state, and e represents an original length of the sample before stretched (i.e., a space between grips).

It should be noted that the sample to be used for the measurement of the stretchability and the straining force preferably has the size as described above, but if a sample of this size cannot be cut out from the garment to be measured, a smaller sample may be used. However, because measurement error increases as the size of the sample decreases, it is preferable that a sample as large as possible is cut out and measured.

The width of a stretchable portion having a relatively great straining force in a garment of the present invention is not particularly limited, and it may be chosen as appropriate depending on the part where the stretchable portion having a relatively great straining force is present, the strength of the straining force of the material used, the means for forming the stretchable portion having a relatively great straining force, the purpose of use of the garment (for instance, the degree of disorder of the knee of the wearer, the part that suffers from the disorder, the aim of preventing disorder, and the type of the sports played), whether the wearer is an adult or a child, etc to the extent so that the object of the present invention is achieved. Besides, the width necessarily varies with the part where it is applied. Therefore, it is difficult to specify the width numerically in general, but if the portion has a very small width, almost in a line form, it is useless, and the portion preferably has an average width of not less than 2 cm, and more preferably not less than 3 cm. Normally, the portion preferably has a width of not more than 15 cm where the portion is widest, and more preferably not more than 13 cm.

Of course, the width of a stretchable portion having a relatively great straining force may be partially smaller or greater depending on the part to the extent so that the object of the present invention is achieved.

In the present invention, the various stretchable portion having relatively great straining forces for supporting the muscles are mainly provided in directions approximately along the directions of fibers of the muscles and ligaments except for specific details. By so doing, the contraction of the muscles and the functions of the ligaments are supported without impairing the function of the muscles and ligaments.

Furthermore, a garment of the present invention may preferably use, as a stretchable fabric, a polyurethane fiber-containing power net that is a polyurethane fiber-containing stretch raschel knitted fabric, a polyurethane fiber-containing two-way stretch tricot knitted fabric that is a polyurethane fiber-containing tricot knitted fabric, a polyurethane fiber-containing circular knitting fabric, etc. Therefore, compared with a conventional supporter using a relatively thick pile fabric or neoprene sheet, etc., a fabric having a thickness in a range as used when making a usual garment, e.g. from about 0.3 mm to about 0.8 mm, may be used. Thus, a garment can be provided that reduces the wearer's appearance little such as the figure when worn, fits well to the body, and has relatively good ventilation. The kind of the power net includes, for example, a plane power net, satin power net, two-way stretch raschel, "TRISKIN" (trademark of Urabe Corporation), etc.

It is not necessary that all stretchable portions having relatively great straining forces have the same straining force, and they may have different straining forces depending on the part.

The kind of fiber yarns forming the fabric of the garment is not particularly limited, and various fiber yarns may be used, such as various synthetic fiber yarns made of polyester, nylon, etc., natural fiber yarns made of cotton, wool, silk, etc., semisynthetic fiber yarns made of rayon, etc., elastic fiber yarns made of polyurethane, etc., mixed fiber yarns made of mixtures of at least two kinds of these, a covering yarn, a water-absorptive quick-dry yarn, and other processed yarns.

In the case where an elastic yarn is used, a yarn made of elastic fibers alone may be used. However, it is more preferable to use an elastic fiber yarn that is covered with another fiber such as the aforementioned water-absorptive quick-dry yarn, a synthetic fiber yarn with an excellent water-repellency, or a natural fiber yarn, etc., depending on the purpose.

INDUSTRIAL APPLICABILITY

As the garment of the present invention, leg support garments that exhibit functions described below are provided.

(1) More specifically, a leg support garment of the present invention is a leg support garment of a tights type that has stretchability and is applied in close contact of the human body so as to support the legs, the leg support garment comprising a stretchable part having a relatively great straining force, wherein the stretchable part having a relatively great straining force includes a stretchable portion (A) having a relatively great straining force that:

substantially covers the ligamentum collateralle on a medial side of the knee joint of the human body; and on a superior side of the knee joint, extends through a length of not less than ¼ of that of the thigh, along at least one selected from the musculus group consisting of the musculus sartorius, the musculus semitendinosus, the musculus semimembranosus, and the musculus gracilis.

Therefore, in the leg support garment of a tights type of the present invention, the stretchable portion (A) having a relatively great straining force supports the ligamentum collateralle medialis, and further, on the superior side of the knee joint, supports at least one selected from the musculus group consisting of the musculus sartorius, the musculus semitendinosus, the musculus semimembranosus, and the musculus gracilis that are located over the ligamentum collateralle medialis and extend upward. Therefore, a power of pulling up the stretchable portion having a relatively great straining force that supports the ligamentum collateralle medialis is produced by the portion extending upward in the stretchable portion (A) having a relatively great straining force, thereby increasing the power of supporting the ligamentum collateralle medialis. Further, at least one of the musculus sartorius, the musculus semitendinosus, the musculus semimembranosus, and the musculus gracilis that support the knee joint in cooperation with the ligamentum collateralle medialis is also supported by the stretchable portion having a relatively great straining force. Therefore, the combined actions of these make it possible to provide a leg support garment that is capable of protecting the knees and stably maintaining the knee joints without decreasing the degree of freedom of the movement of the knee joints, that provides a good feeling when worn, and that is useful for preventing and reducing gonalgia caused by the instability of the knees, and further, for preventing injuries to the ligamentum collateralle medialis caused by sports or the like.

(2.) Furthermore, a leg support garment of a tights type is provided that has stretchability and is applied in close contact with the surface of the human body so as to support the legs, the leg support garment comprising a stretchable part having a relatively great straining force, wherein the stretchable part having a relatively great straining force includes a stretchable portion (A) having a relatively great straining force that:

substantially covers the ligamentum collateralle on a medial side of the knee joint of the human body; and on a superior side of the knee joint, extends through a length of not less than ½ of that of the thigh, along at least one selected from the musculus group consisting of the musculus sartorius, the musculus semitendinosus, the musculus semimembranosus, and the musculus gracilis.

In the foregoing leg support garment of a tights type of the present invention, a length of a portion covering the thigh is set to be not less than ½ of the length of the thigh. Therefore, the power of pulling the stretchable portion having a relatively great straining force that supports the ligamentum collateralle medialis, described in the above item (1), is exerted more intensely where the portion extends upward to the superior part of the thigh. Consequently, this provides a leg support garment in which the power of supporting the ligamentum collateralle medialis is improved, which is preferable.

(3) The leg support garment is a leg support garment described in the above item (1) or (2) arranged according to a preferred embodiment of the present invention in which the leg support garment is a garment of a tights type that has a length capable of covering at least a range from a waistline to a superior side of the ankle. By so doing, the leg support garment has a length capable of covering at least a range from a waistline to a superior side of the ankle. Therefore, the power of pulling the stretchable portion having a relatively great straining force that supports the ligamentum collateralle medialis, described in the above item (1), is exerted further more intensely where the portion extends upward to the superior part of the thigh. Consequently, this provides a leg support garment in which the power of supporting the ligamentum collateralle medialis is improved, which is preferable. Besides, since it is a tights-type garment, it is easy to wear, and suitable as sports wear.

(4) Furthermore, the leg support garment according to the above item (3) is arranged according to a preferred embodiment of the present invention wherein:

the portion expressed as the stretchable portion (A) having a relatively great straining force is a stretchable portion (A1) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of the musculus gastrocnemius and/or the musculus soleus on the medial side; and on a superior side of the knee joint, extends from a medial side to a lateral side of the thigh via an anterior side thereof approximately along the musculus sartorius to a vicinity of the trochanter major, passing a superior part of the musculus rectus femoris.

By so doing, the stretchable portion having a relatively great straining force covers a portion of an inferior region of the patella so as to support the patella as if pulling up the same from the inferior side, thereby improving the stability of the knee joint. The portion further supports the musculus sartorius and extends from the medial side to the lateral side of the thigh obliquely and spirally toward the vicinity of the trochanter major, thereby increasing the power for pulling the stretchable portion having a relatively great straining force that supports the ligamentum collateralle medialis. This makes it possible to provide a leg support garment having an increased power for supporting the ligamentum collateralle medialis, and hence, this is preferable. Furthermore, this provides the support to the musculus sartorius that complements the function of the ligamentum collateralle medialis as well, which is also preferable.

(5) Furthermore, the leg support garment according to the above item (4) is arranged according to a preferred embodiment of the present invention wherein the portion expressed as the stretchable portion (A1) having a relatively great straining force further includes a stretchable portion (A1-1) having a relatively great straining force that extends from a vicinity of the trochanter major to a vicinity of the waist along the tractus iliotibialis. By so doing, the stretchable portion (A1-1) having a relatively great straining force is further provided, which extends from the vicinity of the trochanter major to the waist along the tractus iliotibialis. Therefore, the function of the item (4) is enhanced further, as well as the function of intensely pressing the trochanter major is enhanced also, thereby improving the connection between the caput ossis femoris and the acetabulum. This is preferable since further providing a function of enhancing the stability of the hip joint.

(6) Furthermore, the leg support garment according to the above item (4) or (5) is arranged according to a preferred embodiment of the present invention wherein the portion expressed as the stretchable portion (A1) having a relatively great straining force further covers at least a part of a superior region of the patella by extending thereto approximately from a vicinity of the periphery of the patella on the medial side of the patella. By so doing, the stretchable portion (A1) having a relatively great straining force also covers at least a part of the superior region of the patella. Therefore, the knee joint is supported therefrom as well as from the inferior region of the patella, thereby allowing more stability of the knee joint to be achieved, which is preferable.

(7) Furthermore, the leg support garment according to any one of the above items (4) to (6) is arranged according to a preferred embodiment of the present invention wherein the portion expressed as the stretchable portion (A1) having a relatively great straining force further includes a stretchable portion (A1-2) having a relatively great straining force that extends obliquely upward from a side of the musculus gastrocnemius on the medial side through a vicinity of the periphery of the patella on the inferior side of the patella to a lateral side of the patella. By so doing, the periphery of the patella is covered from a side of the musculus gastrocnemius on the medial side, i.e., from the inferior medial side, and a power of pulling up the same in an obliquely upward direction is exerted thereto. Therefore, this provides more stability of the knee joint, and hence, the present embodiment is preferable.

(8) Furthermore, the leg support garment according to any one of the above items (4) to (7) is arranged according to a preferred embodiment of the present invention wherein the stretchable part having a relatively great straining force further includes a stretchable portion (B) having a relatively great straining force that:

extends from a vicinity of the trochanter major downward approximately along the tractus iliotibialis to a lateral side of the patella;

covers at least a part of the inferior region of the patella extending from the lateral side thereof, and passes a side of the musculus gastrocnemius and/or the musculus soleus on the lateral side.

By so doing, the stretchable portion (B) having a relatively great straining force is further provided. Therefore, the knee and leg are supported from the both sides at the femoral region and the lower leg region, and further, the musculus gastrocnemius and/or the musculus soleus are supported from their sides without hindering their actions. Furthermore, the function of pressing the trochanter major is enhanced further, thereby improving the connection between the caput ossis femoris and the acetabulum. Therefore, this reinforces a function of enhancing the stability of the hip joint.

(9) Furthermore, the leg support garment according to the above item (3) is arranged according to a preferred embodiment of the present invention wherein the portion expressed as the stretchable portion (A) having a relatively great straining force is a stretchable portion (A2) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of the musculus gastrocnemius and/or the musculus soleus on the medial side; and on a superior side of the knee joint, extends approximately along at least one selected from the musculus group consisting of the musculus semitendinosus, the musculus semimembranosus, and the musculus gracilis, and reaches a vicinity below the crotch or of the sulcus gluteus.

By so doing, the stretchable portion having a relatively great straining force covers at least a part of the inferior region of the patella, thereby supporting the patella as if pulling up the patella from the inferior side thereof. As a result, the stability of the knee joint is improved. Furthermore, at least one of the musculus semitendinosus, the musculus semimembranosus, and the musculus gracilis that are located on the medial side of the thigh, thereby increasing the power of pulling the stretchable portion having a relatively great straining force that supports the ligamentum collateralle medialis. Consequently, a leg support garment with an increased power for supporting the ligamentum collateralle medialis is provided, which is preferable. Furthermore, at least one of the musculus semitendinosus, the musculus semimembranosus, and the musculus gracilis that complement the function of the ligamentum collateralle medialis is supported, which is also preferable.

(10) Furthermore, the leg support garment according to the above item (9) is arranged according to a preferred embodiment of the present invention wherein the portion expressed as the stretchable portion (A2) having a relatively great straining force is a stretchable portion (A2-1) having a relatively great straining force that further covers at least a part of a superior region of the patella by extending thereto approximately from a vicinity of the periphery of the patella on the medial side of the patella.

By so doing, the stretchable portion (A2) having a relatively great straining force also covers at least a part of the superior region of the patella. Therefore, the knee joint is supported therefrom as well as from the inferior region of the patella, thereby allowing more stability of the knee joint to be achieved, which is preferable.

(11) Furthermore, the leg support garment according to the above item (3) is arranged according to a preferred embodiment of the present invention wherein the portion expressed as the stretchable portion (A) having a relatively great straining force is a stretchable portion (A3) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of the musculus gastrocnemius and/or the musculus soleus on the medial side; and on a superior side of the knee joint, extends from a medial side to a lateral side of the thigh via a posterior side thereof approximately along the musculus semitendinosus and/or the musculus semimembranosus to a vicinity of the trochanter major, passing over the musculus biceps femoris obliquely.

By so doing, the stretchable portion having a relatively great straining force is provided, which extends from the side of the musculus gastrocnemius and/or the musculus soleus on the medial side upwards, then passes the thigh obliquely in a spiral form from the medial side to the lateral side thereof via the posterior side thereof, and reaches the vicinity of the trochanter major. Therefore, it is possible to support the patella as if pulling up the same from the inferior side thereof, thereby improving the stability of the knee joint. Furthermore, it is also possible to increase the power of pulling the stretchable portion having a relatively great straining force that supports the ligamentum collateralle medialis. Consequently, a leg support garment with an increased power for supporting the ligamentum collateralle medialis is provided, which is preferable. Furthermore, the musculus semitendinosus and/or the musculus semimembranosus that complements the function of the ligamentum collateralle medialis is supported, which is preferable.

(12) Furthermore, the leg support garment according to the above item (11) is arranged according to a preferred embodiment of the present invention wherein the portion expressed as the stretchable portion (A3) having a relatively great straining force is a stretchable portion (A3-1) having a relatively great straining force that further covers at least a part of a superior region of the patella by extending thereto approximately from a vicinity of the periphery of the patella on the medial side of the patella. By so doing, the stretchable portion (A3) having a relatively great straining force also covers at least a part of the superior region of the patella. Therefore, the knee joint is supported therefrom as well as from the inferior region of the patella, thereby allowing more stability of the knee joint to be achieved, which is preferable.

(13) Furthermore, the leg support garment according to any one of the above items (9) to (12) is arranged according to a preferred embodiment of the present invention wherein the stretchable part having a relatively great straining force further includes a stretchable portion (B) having a relatively great straining force that:

extends from a side part of the waist approximately along the tractus iliotibialis via a vicinity of the trochanter major, then, approximately along the tractus iliotibialis to a lateral side of the patella;

covers at least a part of an inferior region of the patella, or at least a part of inferior and superior regions of the patella; and passes a side of the musculus gastrocnemius and/or the musculus soleus on a lateral side of the same.

By so doing, the stretchable portion (B) having a relatively great straining force is further provided. Therefore, the knee and leg are supported from the both sides at the femoral region and the lower leg region, and further, the musculus gastrocnemius and/or the musculus soleus are supported from their sides without hindering their actions. Furthermore, the function of pressing the trochanter major is enhanced further, thereby improving the connection between the caput ossis femoris and the acetabulum. Therefore, this reinforces a function of enhancing the stability of the hip joint.

(14) Furthermore, the leg support garment according to any one of the above items (4) to (8) is arranged according to a preferred embodiment of the present invention wherein the portion expressed as the stretchable portion (A) having a relatively great straining force is the stretchable portion (A1) having a relatively great straining force, and further includes, on a superior side of a knee-joint-part of the stretchable portion (A1) having a relatively great straining force, a stretchable portion (A2') having a relatively great straining force that extends approximately along at least one selected from the musculus group consisting of the musculus semitendinosus, the musculus semimembranosus, and the musculus gracilis to a vicinity of the crotch or a vicinity of the sulcus gluteus. By so doing, the stretchable portion having a relatively great straining force is present in a spiral form, extending obliquely from the medial side to the lateral side of the thigh, and then, to the trochanter major. In addition, the stretchable portion (A2') having a relatively great C straining force that branches therefrom on the superior side of the knee joint is present also, extending through the thigh approximately along at least one selected from the musculus group consisting of the musculus semitendinosus, the musculus semimembranosus, and the musculus gracilis to the vicinity of the crotch or the vicinity of the sulcus gluteus. The actions of these in combination further increase the power of pulling the stretchable portion having a relatively great straining force that supports the ligamentum collateralle medialis. Consequently, a leg support garment with an increased power for supporting the ligamentum collateralle medialis is provided, which is preferable. Furthermore, along with the musculus sartorius that complements the function of the ligamentum collateralle medialis, at least one selected from the musculus group consisting of the musculus semitendinosus, the musculus semimembranosus, and the musculus gracilis is also supported, which is preferable. Furthermore, the stretchable portion having a relatively great straining force that is provided from the vicinity of the trochanter major to the vicinity of the waist along the tractus iliotibialis provides a function of pressing the trochanter major, thereby improving the connection between the caput ossis femoris and the acetabulum. Therefore, this further provides a function of enhancing the stability of the hip joint, which is preferable

(15) Furthermore, the leg support garment according to the above item (3) is arranged according to a preferred embodiment of the present invention wherein:

the portion expressed as the stretchable portion (A) having a relatively great straining force is a stretchable portion (A2') having a relatively great straining force that:

substantially covers the ligamentum collateralle on the medial side of the knee joint of the human body;

extends approximately along a vicinity of a periphery of the patella on a medial side thereof;

surrounds the patella through at least approximately ½ or more of the periphery of the patella so as to cover at least a part of inferior and superior regions of the patella, and reaches a side of the musculus gastrocnemius and/or the musculus soleus on the medial side; and on a superior side of the knee joint, extends approximately along at least one selected from the musculus group consisting of the musculus semitendinosus, the musculus semimembranosus, and the musculus gracilis, and reaches a vicinity below the crotch and a vicinity of the sulcus gluteus;

and, the stretchable part having a relatively great straining force further includes a stretchable portion (B') having a relatively great straining force that:

extends from a side part of the waist approximately along the tractus iliotibialis via a vicinity of the trochanter major, then, approximately along the tractus iliotibialis to a lateral side of the patella;

surrounds the patella through approximately ½ or more of the periphery of the patella so as to cover at least a part of inferior and superior regions of the patella; and passes a side of the musculus gastrocnemius and/or the musculus soleus on the lateral side.

By so doing, the stretchable portions having relatively great straining forces supports the knee and leg from both sides in the femoral region and the lower leg region, without hindering the action of the musculus vastus lateralis and the musculus vastus medialis on the anterior side of the thigh. Further, the foregoing embodiment allows the knee joint to be supported as if wrapped from the surrounding, thereby providing more support to the knee joint. Besides, the function of pressing the trochanter major is reinforced, thereby further improving the connection between the caput ossis femoris and the acetabulum. Therefore, the function of enhancing the stability of the hip joint is reinforced, which is preferable.

(16) Furthermore, the leg support garment according to the above item (15) is arranged according to a preferred embodiment of the present invention wherein:

the stretchable portion (A2') having a relatively great straining force includes two portions projecting toward the lateral side and covering a part of the inferior region and a part of the superior region of the patella, respectively;

the stretchable portion (B') having a relatively great straining force includes two portions projecting toward the medial side and covering a part of the inferior region and a part of the superior region of the patella, respectively;

said two projecting portions of the stretchable portion (A2') having a relatively great straining force are arranged at positions opposite to said two projecting portions of the stretchable portion (3') having a relatively great straining force, respectively, the positions being slightly shifted to the inferior side from positions of said two portions of the stretchable portion (B') having a relatively great straining force, respectively;

and when viewed from the front, the portion of the stretchable portion (A2') having a relatively great straining force that covers the inferior region of the patella has a relatively greater area.

By so doing, the function described in the above item (15) is achieved. Meanwhile, in the lower leg region, on the medial side, the muscles are fewer and the tibia is in contact with the surface of the body, whereas on the lateral side of the lower leg region, the musculus gastrocnemius is on the lateral side of the fibula. Therefore, the foregoing embodiment provides the support of the knee joint as if pulling the medial side thereof having fewer muscles more intensely from the inferior side, thereby reinforcing the support of the ligamentum collateralle medialis, which is preferable.

(17) Furthermore, the leg support garment according to any one of the items (2) to (16) is arranged according to a preferred embodiment of the present invention wherein the stretchable part having a relatively great straining force further includes:

a stretchable portion (C) having a relatively great straining force that, on the posterior side of the human body, covers a region extending from a certain position in a range from the vertebrae lumbales to the os sacrum, through an approximately middle part of the musculus gluteus maximus at right and left, approximately in a direction along muscular fibers of the musculus gluteus maximus via the top of the bulge of the hip or the vicinity of the same to at least the vicinity of trochanter major; and a stretchable portion (D) having a relatively great straining force that, on the anterior side of the human body, covers a region extending from a position on the musculus rectus abdominis in the hypogastric region, obliquely downward approximately in a direction along muscular fibers of the musculus obliquus internus abdominis at right and left to the vicinity of the trochanter major.

By so doing, the stretchable portion (C) having a relatively great straining force is provided, which provides the firm support of the musculus gluteus maximus in the muscular fiber direction thereof. Thus, it can play a large role in supporting the rotating motion of the hips, preventing a decrease in the rotating angle of the hips, and stabilizing the pelvis in anterior-posterior direction. For an elderly person, it is effective in preventing falling down. Furthermore, it can play a large role in extending the hip joint in anterior-posterior direction when running, jumping, and climbing up a slope. Besides, the stretchable portion (D) having a relatively great straining force is provided, which supports a part of the musculus rectus abdominis and the musculus obliquus internus abdominis, thereby providing functions of reducing lumbar lordosis, maintaining good posture, making youthful figure, and preventing generation of pains such as lumbar pains.

(18) Furthermore, the leg support garment according to the above item (1) or (2) is arranged according to a preferred embodiment of the present invention wherein the leg support garment is a garment of a tights type that has a length capable of covering at least a range from a waistline to an inferior side of the knee. By so doing, the leg support garment has a length capable of covering at least a range from the waistline to the inferior side of the knee. Therefore, the power of pulling the stretchable portion having a relatively great straining force that supports the ligamentum collateralle medialis, described in the above item (1), is exerted more intensely where the portion extends upward to the superior part of the thigh. Consequently, this provides a leg support garment in which the power of supporting the ligamentum collateralle medialis is improved, which is preferable. Moreover, since it is a tights-type garment, it is easy to wear, and suitable as sports wear. Particularly, it is suitably worn in high temperature areas or in the hot season.

(19) Furthermore, the leg support garment according to the above item (18) is arranged according to a preferred embodiment of the present invention wherein:

the portion expressed as the stretchable portion (A) having a relatively great straining force is a stretchable portion ($A^2$1) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of a superior part of the musculus gastrocnemius on the medial side; and on a superior side of the knee joint, extends from a medial side to a lateral side of the thigh via an anterior side thereof approximately along the musculus sartorius to a vicinity of the trochanter major, passing a superior part of the musculus rectus femoris.

By so doing, the stretchable portion having a relatively great straining force covers a portion of an inferior region of the patella so as to support the patella as if pulling up the same from the inferior side, thereby improving the stability of the knee joint. The portion further supports the musculus sartorius and extends from the medial side to the lateral side of the thigh obliquely and spirally toward the vicinity of the trochanter major, thereby increasing the power for pulling the stretchable portion having a relatively great straining force that supports the ligamentum collateralle medialis. This makes it possible to provide a leg support garment having an increased power for supporting the ligamentum collateralle medialis, and hence, this is preferable. Furthermore, this provides the support to the musculus sartorius that complements the function of the ligamentum collateralle medialis as well, which is also preferable.

(20) Furthermore, the leg support garment according to the above item (19) is arranged according to a preferred embodiment of the present invention wherein the portion expressed as the stretchable portion ($A^2$1) having a relatively great straining force further includes a stretchable portion ($A^2$1-1) having a relatively great straining force that extends from a vicinity of the trochanter major to a vicinity of the waist along the tractus iliotibialis. By so doing, the stretchable portion ($A^2$1-1) having a relatively great straining force is further provided, which extends from the vicinity of the trochanter major to the waist along the tractus iliotibialis. Therefore, the function of the item (19) is enhanced further, as well as the function of intensely pressing the trochanter major is enhanced also, thereby improving the connection between the caput ossis femoris and the acetabulum. This is preferable since further providing a function of enhancing the stability of the hip joint.

(21) Furthermore, the leg support garment according to the above item (19) or (20) is arranged according to a preferred embodiment of the present invention wherein the portion expressed as the stretchable portion ($A^2$1) having a relatively great straining force further covers at least a part of a superior region of the patella by extending thereto approximately from a vicinity of the periphery of the patella on the medial side of the patella. By so doing, the stretchable portion ($A^2$1) having a relatively great straining force also covers at least a part of the superior region of the patella. Therefore, the knee joint is supported therefrom as well as from the inferior region of the patella, thereby allowing more stability of the knee joint to be achieved, which is preferable.

(22) Furthermore, the leg support garment according to any one of the above items (19) to (20) is arranged according to a preferred embodiment of the present invention wherein the stretchable part having a relatively great straining force further includes a stretchable portion ($B^2$) having a relatively great straining force that:

extends from a vicinity of the trochanter major downward approximately along the tractus iliotibialis to a lateral side of the patella;

covers at least a part of the inferior region of the patella extending from the lateral side thereof, and reaches a side of a superior part of the musculus gastrocnemius on the lateral side.

By so doing, the stretchable portion ($B^2$) having a relatively great straining force is further provided. Therefore, the knee is supported from the both sides, whereby the support of the knee is reinforced. Furthermore, the function of pressing the trochanter major is enhanced further, thereby improving the connection between the caput ossis femoris and the acetabulum. Therefore, this reinforces a function of enhancing the stability of the hip joint.

(23) Furthermore, the leg support garment according to the above item (18) is arranged according to a preferred embodiment of the present invention wherein the portion expressed as the stretchable portion (A) having a relatively great straining force is a stretchable portion ($A^2$2) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of a superior part of the musculus gastrocnemius on the medial side; and on a superior side of the knee joint, extends approximately along at least one selected from the musculus group consisting of the musculus semitendinosus, the musculus semimembranosus, and the musculus gracilis, and reaches a vicinity below the crotch or of the sulcus gluteus.

By so doing, the stretchable portion having a relatively great straining force covers at least a part of the inferior region of the patella, thereby supporting the patella as if pulling up the patella from the inferior side thereof. As a result, the stability of the knee joint is improved. Furthermore, at least one of the musculus semitendinosus, the musculus semimembranosus, and the musculus gracilis that are located on the medial side of the thigh, thereby increasing the power of pulling the stretchable portion having a relatively great straining force that supports the ligamentum collateralle medialis. Consequently, a leg support garment with an increased power for supporting the ligamentum collateralle medialis is provided, which is preferable. Furthermore, at least one of the musculus semitendinosus, the musculus semimembranosus, and the musculus gracilis that complement the function of the ligamentum collateralle medialis is supported, which is preferable.

(24) Furthermore, the leg support garment according to the above item (23) is arrange according to a preferred embodiment of the present invention wherein the portion expressed as the stretchable portion ($A^2$2) having a relatively great straining force is a stretchable portion ($A^2$2-1) having a relatively great straining force that further covers at least a part of a superior region of the patella by extending thereto approximately from a vicinity of the periphery of the patella on the medial side of the patella.

By so doing, the stretchable portion ($A^2$2) having a relatively great straining force also covers at least a part of the superior region of the patella. Therefore, the knee joint is supported therefrom as well as from the inferior region of the patella, thereby allowing more stability of the knee joint to be achieved, which is preferable.

(25) Furthermore, the leg support garment according to the above item (18) is arranged according to a preferred embodiment of the present invention wherein the portion expressed as the stretchable portion (A) having a relatively great straining force is a stretchable portion ($A^2$3) having a relatively great straining force that:

substantially covers the ligamentum collateralle on the medial side of the knee joint of the human body;

extends approximately along a vicinity of a periphery of the patella on a medial side thereof so as to surround the patella through not less than approximately ¼ of the periphery of the patella and to cover at least a part of an inferior region of the patella, and reaches a side of a superior part of the musculus gastrocnemius on the medial side; and on a superior side of the knee joint, extends from a medial side to a lateral side of the thigh via a posterior side thereof approximately along the musculus semitendinosus and/or the musculus semimembranosus to a vicinity of the trochanter major, passing over the musculus biceps femoris obliquely.

By so doing, the stretchable portion having a relatively great straining force is present, extending from the medial side to the lateral side of the thigh via the posterior side thereof obliquely and spirally toward the vicinity of the trochanter major, thereby supporting the patella as if pulling up the same from the inferior side, and improving the stability of the knee joint. Furthermore, the power of pulling the stretchable portion having a relatively great straining force that supports the ligamentum collateralle medialis is increased. This makes it possible to provide a leg support garment having an increased power for supporting the ligamentum collateralle medialis, and hence, this is preferable. Furthermore, this provides the support to the musculus semitendinosus and/or the musculus semimembranosus that complements the function of the ligamentum collateralle medialis as well, which is also preferable.

(26) Furthermore, the leg support garment according to the above item (25) is arranged according to a preferred embodiment of the present invention wherein the portion expressed as the stretchable portion ($A^2$3) having a relatively great straining force is a stretchable portion ($A^2$3-1) having a relatively great straining force that further covers at least a part of a superior region of the patella by extending thereto approximately from a vicinity of the periphery of the patella on the medial side of the patella.

By so doing, the stretchable portion ($A^3$3) having a relatively great straining force also covers at least a part of the superior region of the patella. Therefore, the knee joint is supported therefrom as well as from the inferior region of the patella, thereby allowing more stability of the knee, which is preferable.

(27) Furthermore, the leg support garment according to any one of the above items (23) to (26) is arranged according to a preferred embodiment of the present invention wherein the stretchable part having a relatively great straining force further includes a stretchable portion ($B^2$) having a relatively great straining force that:

extends from a side part of the waist approximately along the tractus iliotibialis via a vicinity of the trochanter major, then, approximately along the tractus iliotibialis to a lateral side of the patella;

covers at least a part of an inferior region of the patella, or at least a part of inferior and superior regions of the patella; and reaches a side of a superior part of the musculus gastrocnemius on the lateral side.

By so doing, the stretchable portions ($B^2$) having relatively great straining forces are further provided. Therefore, the knee is supported from both of the sides, whereby the support of the knee is reinforced. Besides, the function of pressing the trochanter major is reinforced, thereby further improving the connection between the caput ossis femoris and the acetabulum. Therefore, the function of enhancing the stability of the hip joint is reinforced.

(28) Furthermore, the leg support garment according to any one of the above items (19) to (22) is arranged according to a preferred embodiment of the present invention wherein the portion expressed as the stretchable portion (A) having a relatively great straining force is the stretchable portion ($A^2$1) having a relatively great straining force, and further includes, on a superior side of a knee-joint-part of the stretchable portion ($A^2$1) having a relatively great straining force, a stretchable portion ($A^2$2') having a relatively great straining force that extends approximately along at least one selected from the musculus group consisting of the musculus semitendinosus, the musculus semimembranosus, and the musculus gracilis to a vicinity of the crotch or a vicinity of the sulcus gluteus.

By so doing, the stretchable portions having relatively great straining forces are present in a spiral form, extending obliquely from the medial side to the lateral side of the thigh, then, to the trochanter major. In addition, the stretchable portion ($A^2$2') having a relatively great straining force that branches therefrom on the superior side of the knee joint is present, extending through the thigh approximately along at least one selected from the musculus group consisting of the musculus semitendinosus, the musculus semimembranosus, and the musculus gracilis to the vicinity of the crotch or the sulcus gluteus. The actions of these in combination increases the power of pulling the stretchable portion having a relatively great straining force that supports the ligamentum collateralle medialis. Consequently, a leg support garment with an increased power for supporting the ligamentum collateralle medialis is provided, which is preferable. Furthermore, along with the musculus sartorius that complements the function of the ligamentum collateralle medialis, at least one selected from the musculus group consisting of the musculus semitendinosus, the musculus semimembranosus, and the musculus gracilis is also supported, which is preferable. Furthermore, the stretchable portion having a relatively great straining force that is provided from the vicinity of the trochanter major to the vicinity of the waist along the tractus iliotibialis provides a function of pressing the trochanter major, thereby improving the connection between the caput ossis femoris and the acetabulum. Therefore, this further provides a function of enhancing the stability of the hip joint, which is preferable.

(29) Furthermore, the leg support garment according to the above item (18) is arranged according to a preferred embodiment of the present invention wherein:

the portion expressed as the stretchable portion (A) having a relatively great straining force is a stretchable portion ($A^2$2') having a relatively great straining force that:

substantially covers the ligamentum collateralle on the medial side of the knee joint of the human body;

extends approximately along a vicinity of a periphery of the patella on a medial side thereof;

surrounds the patella through at least approximately ½ or more of the periphery of the patella so as to cover at least a part of inferior and superior regions of the patella, and reaches a side of a superior part of the musculus gastrocnemius on the medial side; and on a superior side of the knee joint, extends approximately along at least one selected from the musculus group consisting of the musculus semitendinosus, the musculus semimembranosus, and the musculus gracilis, and reaches a vicinity below the crotch and a vicinity of the sulcus gluteus;

and, the stretchable part having a relatively great straining force further includes a stretchable portion ($B^{2'}$) having a relatively great straining force that:

extends from a side part of the waist approximately along the tractus iliotibialis via a vicinity of the trochanter major, then, approximately along the tractus iliotibialis to a lateral side of the patella;

surrounds the patella through approximately ½ or more of the periphery of the patella so as to cover at least a part of inferior and superior regions of the patella; and reaches a side of a superior part of the musculus gastrocnemius on the lateral side.

By so doing, the stretchable portions having relatively great straining forces support the knee and leg from both sides in the femoral region and the lower leg region, without hindering the action of the musculus vastus lateralis and the musculus vastus medialis on the anterior side of the thigh. Further, the knee joint is supported as if wrapped from the surrounding, whereby further support of the knee joint is provided. Besides, the function of pressing the trochanter major is reinforced, thereby further improving the connection between the caput ossis femoris and the acetabulum. Therefore, the function of enhancing the stability of the hip joint is reinforced, which is preferable.

(30) Furthermore, the leg support garment according to the item (29) is arranged according to a preferred embodiment of the present invention wherein:

the stretchable portion ($A^2$2') having a relatively great straining force includes two portions projecting toward the lateral side and covering a part of the inferior region and a part of the superior region of the patella, respectively;

the stretchable portion ($B^{2'}$) having a relatively great straining force includes two portions projecting toward the medial side and covering a part of the inferior region and a part of the superior region of the patella, respectively;

said two projecting portions of the stretchable portion ($A^2$2') having a relatively great straining force are arranged at positions opposite to said two projecting portions of the stretchable portion ($B^{2'}$) having a relatively great straining force, respectively, the positions being slightly shifted to the inferior side from positions of said two portions of the stretchable portion ($B^{2'}$) having a relatively great straining force, respectively;

and a vertex of the portion of the stretchable portion ($A^2$2') having a relatively great straining force that covers the inferior region of the patella is positioned at center of the patella, or slightly on a lateral side from the center. By so doing, the function described in the above item (29) is achieved. Meanwhile, in the lower leg region, on the medial side, the muscles are fewer and the tibia is in contact with the surface of the body, whereas on the lateral side of the lower leg region, the musculus gastrocnemius is on the lateral side of the fibula. Therefore, the foregoing embodiment provides the support of the knee joint as if pulling the medial side thereof having fewer muscles more intensely from the inferior side, thereby reinforcing the support of the ligamentum collateralle medialis, which is preferable.

(31) Furthermore, the leg support garment according to any one of the above items (18) to (30) is arranged according to a preferred embodiment of the present invention wherein the stretchable part having a relatively great straining force further includes:

a stretchable portion (C) having a relatively great straining force that, on the posterior side of the human body, covers a region extending from a certain position in a range from the vertebrae lumbales to the os sacrum, through an approximately middle part of the musculus gluteus maximus at right and left, approximately in a direction along muscular fibers of the musculus gluteus maximus via the top of the bulge of the hip or the vicinity of the same to at least the vicinity of trochanter major; and a stretchable portion (D) having a relatively great straining force that, on the anterior side of the human body, covers a region extending from a position on the musculus rectus abdominis in the hypogastric region, obliquely downward approximately in a direction along muscular fibers of the musculus obliquus internus abdominis at right and left to the vicinity of the trochanter major.

By so doing, the stretchable portion (C) having a relatively great straining force is provided, which provides the firm support of the musculus gluteus maximus in the muscular fiber direction thereof. Thus, it can play a large role in supporting the rotating motion of the hips, preventing a decrease in the rotating angle of the hips, and stabilizing the pelvis in anterior-posterior direction. For an elderly person, it is effective in preventing falling down. Furthermore, it can play a large role in extending the hip joint in anterior-posterior direction when running, jumping, and climbing up a slope. Besides, the stretchable portion (D) having a relatively great straining force is provided, which supports a part of the musculus rectus abdominis and the musculus obliquus internus abdominis, thereby providing functions of reducing lumbar lordosis, maintaining good posture, making youthful figure, and preventing generation of pains such as lumbar pains.

As described above, the leg support garments of the present invention are advantageously used as leg support garments such as long tights for sports, semi-long tights for sports, etc., that are capable of effectively protecting the knees and stably maintaining the knee joints without decreasing the degree of freedom of the movement of the knee joints, that provides a good feeling when worn, and that is useful for preventing and reducing gonalgia of the knees, and further, for preventing injuries to the ligamentum collateralle medialis caused by sports or the like.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

The invention claimed is:

1. A tights-type leg support garment comprising:

an inner leg surface;

an outer leg surface;

a front surface;

a rear surface;

a first stretchable portion in the shape of a band extending from an upper portion of the outer leg surface obliquely across the front surface of the garment to a middle portion of the inner leg surface and covering a portion of the corresponding middle portion on the rear surface; and a second stretchable portion, wherein said first stretchable portion has a greater straining force than said second stretchable portion, said first stretchable portion is configured to substantially cover the ligamentum collaterallis on a medial side of a knee joint of a wearer and further configured to extend obliquely from a superior side of said knee joint through at least ¼ of the length of the anterior surface of the corresponding thigh of said wearer and along the portion of the corresponding musculus sartorius of said wearer beneath said anterior surface of said thigh, thereby applying greater pressure along said anterior surface of said musculus sartorius than said second portion applies to portions of said thigh that are covered by said second portion, and said garment supports said knee joint and provides full degrees of freedom of movement of said knee joint.

2. A garment as defined in claim 1, wherein said garment has a length configured to cover at least the region from a waistline to the inferior sides of the knees of said wearer.

3. A garment as defined in claim 1, wherein said first stretchable portion is further configured to cover a medial side of the patella and a part of the medial inferior side of the patella, thereby supporting the knee joint without decreasing the freedom of movement of said knee joint.

4. A tights-type leg support garment comprising:

an inner leg surface;

an outer leg surface;

a front surface;

a rear surface;

a first stretchable portion in the shape of a band extending from an upper portion of the outer leg surface obliquely across the front surface of the garment to a middle portion of the inner leg surface and covering a portion of the corresponding middle portion on the rear surface; and a second stretchable portion, wherein said first stretchable portion has a greater straining force than said second stretchable portion, said first stretchable portion is configured to substantially cover the ligamentum collaterallis on a medial side of a knee joint of a wearer and further configured to extend obliquely from a superior side of said knee joint through at least ½ of the length of the anterior surface of the corresponding thigh of said wearer and along the portion of the corresponding musculus sartorius of said wearer beneath said anterior surface of said thigh, thereby applying greater pressure along said anterior surface of said musculus sartorius than said second portion applies to portions of said thigh that are covered by said second portion, supporting said knee joint, and providing full degrees of freedom of movement of said knee joint.

5. A garment as defined in claim 4, further comprising:

a third stretchable portion disposed on the rear surface of the garment and having a pair of bands extending from a center line of the rear surface obliquely across the rear surface to the outer leg surface of the garment; and a fourth stretchable portion disposed on the front surface of the garment and having a pair of bands extending from a center line of the front surface obliquely across the front surface to the outer leg surface of the garment, wherein said third and fourth stretchable portions have a greater straining force than said second stretchable portion, said third stretchable portion is configured to extend, on the posterior side of the wearer, from the vertebrae lumbales to the os sacrum, through an approximately middle parts of the right and left musculus gluteus maximus in a direction approximately along said musculus gluteus maximus via the vicinity of the top bulge of the hip to at least the vicinity of the trochanter major; and said fourth stretchable portion is configured to extend, on the anterior side of the wearer, from a position in the hypergastric region of the musculus rectus abdominis obliquely downward in the direction approximately along the right and left musculus obliquus internis abdominis portion to the vicinity of the trochanter major.

6. A garment as defined in claim 4, wherein said garment is configured to cover from a waistline to a superior side of the ankles of said wearer.

7. A garment as defined in claim 4, wherein said garment has a length configured to cover at least the region from a waistline to the inferior sides of the knees of said wearer.

8. A garment as defined in claim 7, wherein said first stretchable portion is further configured to extend approximately along a periphery on the medial side of the patella to surround not less than approximately ¼ of said periphery and cover at least a part of an inferior region of said patella, further configured to reach a side of a superior part of the musculus gastroenemius on the medial side, and on a superior side of said knee joint, further configured to extend from a medial side to a lateral side of the thigh via an anterior side thereof approximately along the musculus sartorius to a vicinity of the trochanter major passing a superior part of the musculus rectus femoris.

9. A garment as defined in claim 8, wherein said first stretchable portion is further configured to extend from a vicinity of the trochanter major to a vicinity of the waist along the tractus iliotibialis.

10. A garment as defined in claim 8, wherein said first stretchable portion is further configured to cover at least a part of a superior region of the patella by further extending thereto approximately from a vicinity of the periphery of said patella on the medial side of said patella.

11. A garment as defined in claim 8, further comprising:

a third stretchable portion having a greater straining force than said second stretchable portion, said third stretchable portion extending in a band-like fashion from a middle portion of the outer leg surface down though a lower portion of the outer leg surface along the outer leg surface of the garment, wherein said third portion is configured to extend from a vicinity of the trochanter major downward approximately along the tratus iliotibialis to a lateral side of the patella, further configured to cover at least a part of the inferior region of the patella extending from the lateral side thereof, and further configured to reach a side of a superior part of the musculus gastrocnemius on the lateral side.

12. A garment as defined in claim 7, further comprising:

a third stretchable portion disposed on the rear surface of the garment and having a pair of bands extending from a center line of the rear surface obliquely across the rear surface to the outer leg surface of the garment; and a fourth stretchable portion disposed on the front surface of the garment and having a pair of bands extending from a center line of the front surface obliquely across the front surface to the outer leg surface of the garment, wherein said third and fourth stretchable portions have a greater straining force than said second stretchable portion, said third portion is configured to extend, on the posterior side of the human, from the vertebrae lumbales to the os sacrum, through an approximately middle parts of the right and left musculus gluteus maximus in a direction approximately along said musculus gluteus maximus via the vicinity of the top bulge of the hip to at least the vicinity of the trochanter major, and said fourth stretchable portion is configured to extend, on the anterior side of the wearer, from a position in the hypergastric region of the musculus rectus abdominis obliquely downward in the direction approximately along the right and left musculus obliquus internis abdominis portion to the vicinity of the trochanter major.

13. A tights-type leg support garment comprising:

an inner leg surface;

an outer leg surface;

a front surface;

a rear surface;

a first stretchable portion in the shape of a band extending from an upper portion of the outer leg surface obliquely across the front surface of the garment to a middle portion of the inner leg surface and covering a portion of the corresponding middle portion on the inner leg surface and rear surface; and a second stretchable portion, wherein said first stretchable portion has a greater straining force than said second stretchable portion, said first stretchable portion is configured to substantially cover the ligamentum collaterallis on a medial side of a knee joint of a wearer, and further configured to extend approximately along a vicinity of the periphery of the patella of said wearer on a medial side thereof to surround said patella through at least approximately ¼ of the periphery of said patella to cover at least a part of an inferior region of said patella and extends to a side of a muscle selected from the group consisting of (i) the musculus gastrocnemius, (ii) the musculus soleus, or (iii) a combination thereof and on a superior side of said knee-joint extends obliquely from a medial side to a lateral side of the corresponding thigh through the anterior surface of said thigh, along the portion of the corresponding musculus sartorius of said wearer beneath said anterior surface of said thigh, and to a vicinity of the corresponding trochanter major and over a superior part of the musculus rectus femoris, thereby applying greater pressure along said anterior surface of said musculus sartorius than said second portion applies to portions of said thigh that are covered by said second portion, supporting said knee joint, and providing full degrees of freedom of movement of said knee joint.

14. A garment as defined in claim 13, wherein said first stretchable portion is further configured to extend from said vicinity of said trochanter major to a vicinity of the waist of said wearer along the tractus iliotibialis.

15. A garment as defined in claim 13, wherein said first stretchable portion is further configured to cover at least a part of a superior region of the corresponding patella and further configured to extend to said part of said superior patella region from a vicinity of the periphery of said patella on the medial side of said patella.

16. A garment as defined in claim 13, wherein said first stretchable portion further comprises:

a stretchable portion extending from a lower part of the inner leg surface obliquely across the front surface to a middle portion of the outer leg surface of the garment, wherein said stretchable portion of said first stretchable portion is configured to extend obliquely upward from a side of the corresponding musculus gastrocnemius on the medial side through a vicinity of the periphery of said patella on the inferior side of said patella to a lateral side of said patella.

17. A garment as defined in claim 13, further comprising:

a third stretchable portion having a greater straining force than said second stretchable portion, said third stretchable portion extending from an upper portion of the outer leg surface down to a lower portion of the outer leg surface along the outer leg surface of the garment and having a taper at the lower portion extending from the outer leg surface to no more than a center portion of the front surface of the garment, wherein said third stretchable portion is configured to extend from a vicinity of the corresponding trochanter major approximately along the corresponding tractus iliotibialis to a lateral side of said patella, configured to cover at least a part of the inferior region of said patella extending from the lateral side thereof, and further configured to pass a side of the corresponding muscle selected from the group consisting of (i) the musculus gastrocnemius, (ii) the musculus soleus, or (iii) a combination thereof on the lateral side.

18. A garment as defined in claim 13, wherein said first stretchable portion further comprises:

a stretchable portion extending from a lower portion of the inner leg surface obliquely across the front surface to a middle portion of the outer leg surface of the garment, and further extending from a lower portion of the outer leg surface to a middle portion of the outer leg surface along the outer leg surface, wherein said stretchable portion of said first stretchable portion is configured to extend obliquely upward from a side of the musculus gastrocneminius on the medial side through the vicinity of the periphery of the inferior side of the patella and reaches the lateral side of the patella, thereby maintaining the knee joint without decreasing the freedom of movement of said knee joint.

19. A garment as defined in claim 13, wherein said first stretchable portion further comprises:

a stretchable portion extending from an upper portion of the inner leg surface to a middle portion of the inner leg surface along the inner leg surface of the garment and covering a portion of the corresponding upper and middle portion of the rear surface of the garment, wherein said stretchable portion of said first stretchable portion is configured to extend approximately along at least one corresponding muscle selected from the group consisting of (i) the musculus semitendinosus, (ii) the musculus semimembranosus, and (iii) the musculus gracilis to a vicinity selected from the group consisting of(i) the vicinity of the crotch and (ii) the vicinity of the sulcus gluteus.

20. A tights-type leg support garment comprising:

an inner leg surface;

an outer leg surface;

a front surface;

a rear surface;

a first stretchable portion extending from an upper portion of the outer leg surface obliquely across the front surface of the garment to a middle portion of the inner leg surface in a band-like fashion and covering a portion of the corresponding middle portion on the rear surface; and a second stretchable portion, wherein said first stretchable portion has a greater straining force than said second stretchable portion, said first stretchable portion is configured to substantially cover the ligamentum collateralle medialis on a medial side of a knee joint of a wearer; and said first stretchable portion is further configured to, on a superior side of said knee joint, extend obliquely and spirally from the medial side to the lateral side of the thigh along the musculus sartorius, thereby supporting said knee joint and providing full degrees of freedom of movement of said knee joint.

21. A garment as defined in claim 20, wherein said garment has a length configured to cover at least the region from a waistline to the superior sides of the ankles of said wearer.

22. A garment as defined in claim 20, wherein said garment has a length configured to cover at least the region from a waistline to the inferior sides of the knees of said wearer.

23. A tights-type leg support garment comprising:

an inner leg surface;

an outer leg surface;

a front surface;

a rear surface;

a first stretchable portion extending from a middle portion of the inner leg surface obliquely across the front surface of the garment to an upper portion of the outer leg surface in a band-like fashion and covering a portion of the corresponding middle portion on the rear surface; and a second stretchable portion, wherein said first stretchable portion has a greater straining force than said second stretchable portion, said first stretchable portion is configured to substantially cover the ligamentum collateralle medialis on a medial side of a knee joint of a wearer; and said first stretchable portion is further configured to, on a superior side of said knee joint, extend obliquely and spirally from the medial side to the lateral side of the thigh along the musculus sartorius toward the vicinity of the trochanter major, thereby supporting said knee joint and providing full degrees of freedom of said knee joint.

24. A garment as defined in claim 23, wherein said garment has a length configured to cover at least the region from a waistline to the superior sides of the ankles of said wearer.

25. A garment as defined in claim 23, wherein said garment has a length configured to cover at least the region from a waistline to the inferior sides of the knees of said wearer.

26. A tights-type leg support garment comprising:

an inner leg surface;

an outer leg surface;

a front surface;

a rear surface;

a first stretchable portion extending from an upper portion of the outer leg surface obliquely across the front surface of the garment to a middle portion of the inner leg surface in a band-like fashion and covering a portion of the corresponding middle portion on the rear surface, said first stretchable portion comprising:

a projecting part, said projecting part extending from the middle portion of the inner leg surface and tapering to a vertex at a center of the front surface of the garment;

a second stretchable portion, and a third stretchable portion having a triangular shape and extending from a lower portion of the outer leg surface across to a center of the front surface of the garment, wherein said first stretchable portion has a greater straining force than said second stretchable portion, said first stretchable portion is configured to substantially cover the ligamentum collaterallis on a medial side of a knee joint of a wearer, and further configured to extend approximately along a periphery of the vicinity of the medial side of the patella to cover a part of an inferior region of the patella, and further configured to reach a side of the musculus gastrocnemius and the medial side of the musculus soleus, said first stretchable portion is further configured to, on the superior side of the knee joint, extend from the medial side to the lateral side of the thigh via the anterior side thereof approximately along the musculus sartorius toward the vicinity of the trochanter major, wherein said third stretchable portion is configured to be located on the lateral inferior side of the patella, said projecting part of said first stretchable portion is configured to cover a part of the inferior region of the patella to reach a side of the musculus gastrocenemius and the musculus soleus on the medial side, and further configured to contact a vertex of said third stretchable portion at a position on the inferior side of the patella, thereby supporting the knee joint without decreasing the freedom of movement of said knee joint; and said garment has a length configured to cover at least the region from the waistline to the superior sides of the ankles of said wearer.

27. A tights-type leg support garment comprising:

an inner leg surface;

an outer leg surface;

a front surface;

a rear surface;

a first stretchable portion disposed on the front surface of the garment, said first stretchable portion in the shape of a band comprising:

an upper portion extending from an upper portion of the outer leg surface obliquely across the front surface to a middle portion of the inner leg surface, covering a portion of the corresponding middle portion on the rear surface, and a lower portion extending from the middle portion of the inner leg surface obliquely across a lower portion of the front surface to the outer leg portion of the garment; and a second stretchable portion, wherein said first stretchable portion has a greater straining force than said second stretchable portion, said first stretchable portion is configured to substantially cover the ligamentum collaterallis on a medial side of a knee joint of a wearer, configured to extend approximately along a periphery of the vicinity of the patella on the medial side of said wearer around a part of periphery the patella to cover an inferior region of the patella, configured to extend obliquely through the anterior side of the lower leg region to the lateral side of said wearer in the direction of the malleolus lateralis, and further configured to, on the superior side of the knee joint, extend from the medial side to the lateral side of the thigh via the anterior side thereof approximately along the musculus sartorius toward the vicinity of the trochanter major, thereby supporting the knee joint without decreasing the freedom of movement of said knee joint.

28. A garment as defined in claim 1, further comprising:

a third stretchable portion having a greater straining force than said second portion, said third stretchable portion extending from the outer leg surface towards the middle of the front surface, wherein said third stretchable portion is configured to cover a lateral side of the patella and a part of the lateral inferior side of the patella, thereby supporting the knee joint without decreasing the freedom of movement of said knee joint.

29. A garment as defined in claim 18, further comprising:

a third stretchable portion having a greater straining force than said second portion, said third stretchable portion extending from a bottom of the outer leg surface along the outer leg surface to the lower portion of the outer leg surface, wherein said third stretchable portion is configured to cover at least one corresponding muscle selected from the group consisting of (i) the musculus gastrocnemius, (ii) the musculus soleus, or (iii) a combination thereof on a lateral side.

* * * * *